US006689554B2

(12) United States Patent
Yamada et al.

(10) Patent No.: US 6,689,554 B2
(45) Date of Patent: Feb. 10, 2004

(54) SILVER HANDLE EMULSION AND SILVER HALIDE PHOTOGRAPHIC LIGHTSENSITIVE MATERIAL

(75) Inventors: Kohzaburoh Yamada, Minami-Ashigara (JP); Masahiko Taniguchi, Minami-Ashigara (JP); Naoki Asanuma, Minami-Ashigara (JP); Takashi Hoshimiya, Minami-Ashigara (JP); Hirokazu Kyota, Minami-Ashigara (JP); Masafumi Mizuno, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/207,106

(22) Filed: Jul. 30, 2002

(65) Prior Publication Data

US 2003/0207221 A1 Nov. 6, 2003

(30) Foreign Application Priority Data

Aug. 1, 2001 (JP) ..... 2001-234048
Aug. 1, 2001 (JP) ..... 2001-234075
Aug. 21, 2001 (JP) ..... 2001-250679

(51) Int. Cl.[7] ..... G03C 1/12; G03C 1/14; G03C 1/18; G03C 1/10; G03C 1/24

(52) U.S. Cl. ..... 430/600; 430/566; 430/572; 430/576; 430/578; 430/580; 430/581; 430/583; 430/592; 430/595; 430/603; 430/955

(58) Field of Search ..... 430/600, 596, 430/603, 955, 566, 572, 576, 578, 580, 581, 583, 584, 588, 592, 595

(56) References Cited

U.S. PATENT DOCUMENTS 5,747,235 A 5/1998 Farid et al.
5,747,236 A 5/1998 Farid et al.
5,994,051 A 11/1999 Gould et al.
6,010,841 A 1/2000 Farid et al.
6,054,260 A 4/2000 Adin et al.
6,153,371 A 11/2000 Farid et al.
6,514,683 B2 * 2/2003 Muenter et al. ..... 430/603
6,593,075 B1 * 7/2003 Ichikawa et al. ..... 430/603

OTHER PUBLICATIONS

Ian R. Gould et al., "Two–Election Sensitization: A New Concept of Silver Halide Photography", J. Am. Chem. Soc.., 122 pp. 11934–11943 (2000).

* cited by examiner

*Primary Examiner*—Richard L. Schilling
(74) *Attorney, Agent, or Firm*—Sughrue Mion, PLLC

(57) ABSTRACT

A silver halide emulsion comprises an electron-releasing compound of Types 1 to 4:

(Type 1) a compound capable of undergoing a one-electron oxidation (1-EO) to form a one-electron oxidation product (1-EOP), the 1-EOP capable of releasing further two or more electrons accompanying a subsequent bond cleavage reaction, (Type 2) a compound capable of undergoing 1-EO to form 1-EOP, the 1-EOP capable of releasing further one electron accompanying a subsequent bond cleavage reaction, and having, in its molecule, two or more adsorptive groups acting on silver halides, (Type 3) a compound capable of undergoing 1-EO to thereby form 1-EOP, the 1-EOP capable of releasing further one or more electrons after going through a subsequent bond forming process, and (Type 4) a compound capable of undergoing 1-EO to form 1-EOP, the 1-EOP capable of releasing further one or more electrons after going through a subsequent intramolecular ring cleavage reaction.

16 Claims, No Drawings

SILVER HANDLE EMULSION AND SILVER HALIDE PHOTOGRAPHIC LIGHTSENSITIVE MATERIAL

CROSS-REFERENCE TO RELATED APPLICATIONS

This application is based upon and claims the benefit of priority from the prior Japanese Patent Applications No. 2001-234048, filed Aug. 1, 2001; No. 2001-234075, filed Aug. 1, 2001; No. 2001-250679, filed Aug. 21, 2001; and No. 2001-272137, filed Sep. 7, 2001, the entire contents of all of which are incorporated herein by reference.

BACKGROUND OF THE INVENTION

1. Field of the Invention

The present invention relates to a lightsensitive silver halide emulsion of enhanced photographic speed and a photographic element including the same.

2. Description of the Related Art

Various techniques are being employed for the purpose of improving the light sensitivity of silver halide photographic lightsensitive materials. For example, chemical sensitizers such as sulfur, gold and compounds of Group VIII metals are being employed in order to enhance the inherent photographic speed of silver halides. Spectral sensitization with the use of cyanines and other polymethine dyes is also a technology known in the art to which the present invention pertains.

The phenomenon that, when a spectral sensitizing dye is added to an emulsion in an amount exceeding the optimum amount thereof, the photographic speed of the emulsion is extremely reduced is known as a dye desensitization. As means for improving this phenomenon, there is known a technology comprising utilizing the supersensitization effect by the use of a supersensitizer. This supersensitizer is a generally colorless organic compound which itself does not exert any spectral sensitizing effect, but acts on a sensitizing dye (or excited sensitizing dye) to thereby exert an effect of inhibiting the dye desensitization.

Examples of supersensitizer compounds are listed in, for example, patents such as U.S. Pat. Nos. 2,937,089, 3,706,567, 2,875,058, 3,695,888, 3,457,078, 3,458,318, 3,615,632, 5,192,654, 5,306,612, 2,419,975, 5,459,052 and 4,971,890, and E.P. 554856.

Further, various electron-donating compounds are used in combination with the sensitizing dye in order to enhance the spectral sensitivity of silver halide photographic lightsensitive materials. Examples of electron-donating compounds are listed in U.S. Pat. Nos. 3,695,588 and 3,809,561, and GB's 255084 and 1064193.

Still further, use is made of compounds comprising such an electron-donating compound linked by a covalent bond with a sensitizing dye. Examples of these compounds are listed in U.S. Pat. Nos. 5,436,121 and 5,478,719 (compounds having an electron-donating styryl base bonded to a monomethine dye) and U.S. Pat. No. 4,607,006 (compounds having an electron-donating group derived from phenothiazine, phenoxazine, carbazole, dibenzophenothiazine, ferrocene or tris-2,2'-bipyridylruthenium, or having a triarylamine skeleton bonded to a silver halide adsorptive group).

However, an ideally enhanced photographic speed has not yet been realized despite implementation of the above various means proposed. In particular, the current situation is that there are few compounds which can attain an enhancement of photographic speed while coping with a problem of fog occurring in accordance with the enhancement of photographic speed or a problem of storage fogging experienced when silver halide photographic lightsensitive materials are stored under severe conditions, for example, high temperature and high humidity, or exposure to hazardous gas evolved at the time of combustion, such as automobile exhaust gas.

Recently, a technology of sensitizing with the use of a compound capable of being fragmented (bond cleavage) after a one-electron oxidation and further releasing another electron as a "two-electron sensitizer" has been reported in U.S. Pat. Nos. 5,747,235 and 5,747,236, E.P.'s 786692A1, 893731A1 and 893732A1, WO 99/05570, and paper published in Journal of American Chemical Society ("Two-Electron Sensitization: A New Concept for Silver Halide Photography", J. Am. Chem. Soc., 122, 11934–11943 (2000)). This compound is described in patent specifications as being characterized in that it is oxidized by a dye hole (sensitizing dye molecule having lost one electron after injection of an electron into a conductive band of silver halide from an excited sensitizing dye) or a hole generated by excitation of silver halides, undergoes a fragmentation reaction and releases another electron to thereby induce an enhancement of photographic speed.

However, even the use of this compound has been unable to attain an ideal technology of enhancing photographic speed whereby a lightsensitive material of high speed/fog ratio and of excellent storability can be produced.

BRIEF SUMMARY OF THE INVENTION

The object of the present invention is to provide a silver halide photographic lightsensitive material which ensures enhanced photographic speed of a photographic emulsion and suppresses fog that is likely to occur in accordance with the enhancement of photographic speed, and which realizes a reduced fog increase even if stored under severe conditions, for example, high temperature and high humidity, or exposure to hazardous gas evolved at the time of combustion, such as automobile exhaust gas.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

The above object has been attained by the following constructions 1 to 10. Particularly, the use of the following novel type of electron-releasing compound has enabled attaining a silver halide emulsion and a silver halide photographic lightsensitive material which realize a high speed/fog ratio and excellent storability.

Construction 1: A silver halide emulsion comprising at least one compound selected from the following four types of electron-releasing compounds, namely:

(Type 1) an electron-releasing compound capable of undergoing a one-electron oxidation to thereby form a one-electron oxidation product thereof, the one-electron oxidation product capable of releasing further two or more electrons accompanying a subsequent bond cleavage reaction;

(Type 2) an electron-releasing compound capable of undergoing a one-electron oxidation to thereby form a one-electron oxidation product thereof, the one-electron oxidation product capable of releasing further one electron accompanying a subsequent bond cleavage reaction, and the one-electron oxidation product having, in its molecule, two or more adsorptive groups acting on silver halides;

(Type 3) an electron-releasing compound capable of undergoing a one-electron oxidation to thereby form a one-electron oxidation product thereof, the one-electron oxidation product capable of releasing further one or more electrons after going through a subsequent bond forming process; and (Type 4) an electron-releasing compound capable of undergoing a one-electron oxidation to thereby form a one-electron oxidation product thereof, the one-electron oxidation product capable of releasing further one or more electrons after going through a subsequent intramolecular ring cleavage reaction.

Construction 2: The silver halide emulsion according to construction 1, wherein the above at least one compound is a compound which undergoes a one-electron oxidation induced by exposure of the silver halide emulsion to light.

Construction 3: The silver halide emulsion according to construction 1 or 2, wherein the above at least one compound is represented by any of the following general formulae (A), (B), (C), (D), (E), (F), (1), (2) and (3):

(A)

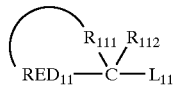

(B)

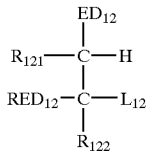

(C)

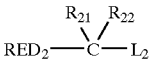

(D)

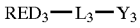

(E)

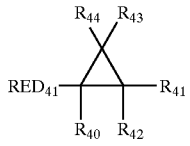

(F)

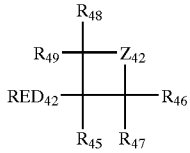

(1)

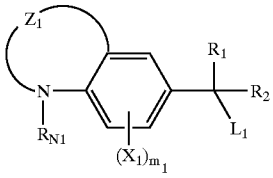

-continued (2)

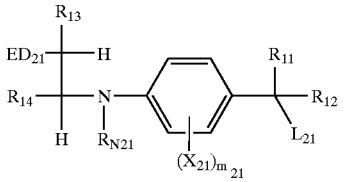

(3)

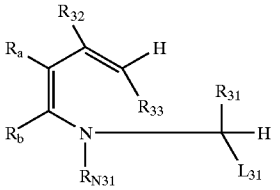

In the general formula (A), $RED_{11}$, represents a one-electron oxidizable reducing group; $L_{11}$ represents a split-off group; $R_{112}$ represents a hydrogen atom or substituent; and $R_{111}$ represents a nonmetallic atomic group capable of forming a cyclic structure corresponding to a tetrahydro form, hexahydro form or octahydro form of a 5-membered or 6-membered aromatic ring (including an aromatic heterocycle) together with carbon atom (C) and $RED_{11}$.

In the general formula (B), $RED_{12}$ and $L_{12}$ have the same meanings as those of $RED_{11}$ and $L_{11}$ of the general formula (A), respectively; each of $R_{121}$ and $R_{122}$ represents a hydrogen atom or substituent; and $ED_{12}$ represents an electron-donating group. In the general formula (B), $R_{121}$ and $RED_{12}$, or $R_{121}$ and $R_{122}$, or $ED_{12}$ and $RED_{12}$ may be bonded with each other to thereby form a cyclic structure.

In the general formula (C), $RED_2$ has the same meaning as that of $RED_{12}$ of the general formula (B); $L_2$ represents a split-off group; each of $R_{21}$ and $R_{22}$ represents a hydrogen atom or substituent; and $RED_2$ and $R_{21}$ may be bonded with each other to thereby form a cyclic structure. The compound represented by the general formula (C) is a compound having, in its molecule, two or more adsorptive groups acting on silver halides.

In the general formula (D), $RED_3$ has the same meaning as that of $RED_{12}$ of the general formula (B); $Y_3$ represents a reactive group capable of reacting with a one-electron oxidation product formed as a result of a one-electron oxidation of $RED_3$ to thereby form a new bond; and $L_3$ represents a linking group which links between $RED_3$ and $Y_3$.

In the general formulae (E) and (F), each of $RED_{41}$ and $RED_{42}$ has the same meaning as that of $RED_{12}$ of the general formula (B); and each of $R_{40}$ to $R_{44}$ and $R_{45}$ to $R_{49}$ represents a hydrogen atom or substituent. In the general formula (F), $Z_{42}$ represents —$CR_{420}R_{421}$—, —$NR_{423}$— or —O—. Herein, each of $R_{420}$ and $R_{421}$ represents a hydrogen atom or substituent; and $R_{423}$ represents a hydrogen atom, alkyl group, aryl group or heterocyclic group.

In the general formula (1), $Z_1$ represents an atomic group capable of forming a 6-membered ring together with the nitrogen atom and the two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group. In the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent; $m_{21}$ is an integer of 0 to 3; and $L_{21}$ represents a split-off group. Any two of $R_{N21}$, $R_{13}$, $R_{14}$, $X_{21}$ and $ED_{21}$ may be bonded with each other to thereby form a cyclic structure. In the general formula (3), each of $R_{31}$, $R_{32}$, $R_{33}$, $R_{N31}$, $R_a$ and $R_b$ represents a hydrogen atom or substituent; and $L_{31}$ represents a split-off group. Provided that, when $R_{N31}$ represents a group other than an aryl group, $R_a$ and $R_b$ are bonded to each other to thereby form an aromatic ring.

Construction 4: The silver halide emulsion according to any of constructions 1 to 3, wherein the electron-releasing compounds of types 1, 3 and 4 are compounds each having in its molecule at least one adsorptive group acting on silver halides or at least one partial structure of a spectral sensitizing dye.

Construction 5: The silver halide emulsion according to any of constructions 1 to 4, wherein each of the above compounds is a compound having in its molecule two or more mercapto groups as a partial structure thereof.

Construction 6: The silver halide emulsion according to any one of constructions 1 to 5, wherein the above compounds have a nitrogen-containing heterocyclic group that is substituted with two or more mercapto groups, as the adsorptive group.

Construction 7: The silver halide emulsion according to any one of constructions 3 to 6, wherein the split-off group of each of the general formulas (A) to (F) and (1) to (3) is a carboxyl group or salt thereof, or hydrogen atom.

Construction 8: The silver halide emulsion according to any of constructions 3 to 7, wherein the compound of general formula (D) is represented by any of the following general formulae (D-1) to (D-4):

(D-1)

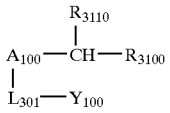

(D-2)

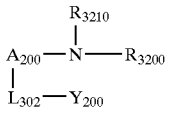

(D-3)

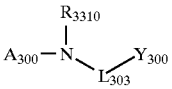

(D-4)

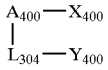

In the general formulae (D-1) to (D-4), each of $A_{100}$, $A_{200}$, $A_{300}$ and $A_{400}$ represents an aryl group or a heterocyclic group, provided that each of $A_{100}$, $A_{200}$ and $A_{400}$ represents a divalent group resulting from removal of one hydrogen atom from an aryl group or a heterocyclic group. Each of $L_{301}$, $L_{302}$, $L_{303}$ and $L_{304}$ represents a linking group; and each of $Y_{100}$, $Y_{200}$, $Y_{300}$ and $Y_{400}$ represents a reactive group. Each of $R_{3100}$, $R_{3110}$, $R_{3200}$, $R_{3210}$ and $R_{3310}$ represents a hydrogen atom or substituent. $R_{3110}$ and $A_{100}$, or $R_{3210}$ and $A_{200}$, or $R_{3310}$ and $A_{300}$ may be bonded with each other to thereby form a cyclic structure. $X_{400}$ represents a hydroxyl group, mercapto group or alkylthio group.

Construction 9: The silver halide emulsion according to any one of constructions 1 to 8, wherein an oxidation potential with respect to the first electron is 0 V or more and 1.4 V or less.

Construction 10: The silver halide emulsion according to any one of constructions 1 to 9, wherein the one-electron oxidation product that is produced after the one-electron oxidation of the compounds of Types 1 to 4 has an oxidation potential of −0.7 V or less.

Construction 11: The silver halide emulsion according to any one of constructions 1 to 10, wherein silver halide grains contained in the silver halide emulsion comprise tabular grains having an aspect ratio of 5 or more.

Construction 12: A silver halide emulsion having been chemically sensitized by at least one compound selected from the following four types of electron-releasing compounds, namely:

(Type 1) an electron-releasing compound capable of undergoing a one-electron oxidation to thereby form a one-electron oxidation product thereof, the one-electron oxidation product capable of releasing further two or more electrons accompanying a subsequent bond cleavage reaction;

(Type 2) an electron-releasing compound capable of undergoing a one-electron oxidation to thereby form a one-electron oxidation product thereof, the one-electron oxidation product capable of releasing further one electron accompanying a subsequent bond cleavage reaction, and the one-electron oxidation product having, in its molecule, two or more adsorptive groups acting on silver halides;

(Type 3) an electron-releasing compound capable of undergoing a one-electron oxidation to thereby form a one-electron oxidation product thereof, the one-electron oxidation product capable of releasing further one or more electrons after going through a subsequent bond forming process; and (Type 4) an electron-releasing compound capable of undergoing a one-electron oxidation to thereby form a one-electron oxidation product thereof, the one-electron oxidation product capable of releasing further one or more electrons after going through a subsequent intramolecular ring cleavage reaction.

Construction 13: A silver halide photographic lightsensitive material comprising the silver halide emulsion according to any of constructions 1 to 12.

Construction 14: A silver halide photographic lightsensitive material comprising the silver halide emulsion according to construction 12.

Construction 15: The silver halide photographic lightsensitive material according to construction 13 further comprising at least one reducing compound.

Construction 16: The silver halide photographic lightsensitive material according to construction 14 further comprising at least one reducing compound.

DETAILED DESCRIPTION OF THE INVENTION

The electron-releasing compound, which is a compound having chemical sensitization capability, for use in the present invention is selected from the following four types of electron-releasing compounds, namely:

(Type 1) an electron-releasing compound capable of undergoing a one-electron oxidation to thereby form a one-electron oxidation product thereof, the one-electron oxidation product capable of releasing further two or more electrons accompanying a subsequent bond cleavage reaction;

(Type 2) an electron-releasing compound capable of undergoing a one-electron oxidation to thereby form a one-electron oxidation product thereof, the one-electron oxidation product capable of releasing further one electron accompanying a subsequent bond cleavage reaction, and the one-electron oxidation product having, in its molecule, two or more adsorptive groups acting on silver halides;

(Type 3) an electron-releasing compound capable of undergoing a one-electron oxidation to thereby form a one-electron oxidation product thereof, the one-electron oxidation product capable of releasing further one or more electrons after going through a subsequent bond forming process; and (Type 4) an electron-releasing compound capable of undergoing a one-electron oxidation to thereby form a one-electron oxidation product thereof, the one-electron oxidation product capable of releasing further one or more electrons after going through a subsequent intramolecular ring cleavage reaction.

"Compounds having adsorptive groups acting on silver halides in molecules thereof" and "compounds having partial structures of spectral sensitizing dye in molecules thereof" are preferred among the above electron-releasing compounds of types 1 to 4. "Compounds having adsorptive groups acting on silver halides in molecules thereof" are more preferred.

The electron-releasing compound of Type 1 will be described in detail below.

With respect to the electron-releasing compound of Type 1, the expression "bond cleavage reaction" refers to the cleavage of bond between elements, in particular, carbon-carbon bond, carbon-silicon bond, carbon-hydrogen bond, carbon-boron bond, carbon-tin bond or carbon-germanium bond. Further, the cleavage of carbon-hydrogen bond may accompany the above bond cleavage. The electron-releasing compound of Type 1 is a compound capable of undergoing a one-electron oxidation to thereby form a one-electron oxidation product. The one-electron oxidation product only thereafter capable of undergoing a bond cleavage reaction to thereby further release two or more electrons (preferably three or more electrons). In another expression, the electron-releasing compound of Type 1 is a further two or more electrons (preferably three or more electrons) oxidizable compound.

As mentioned in the above description of the related art, compounds each capable of being fragmented (bond cleavage) after a one-electron oxidation and further releasing another electron as a "two-electron sensitizer" have been described in U.S. Pat. Nos. 5,747,235 and 5,747,236, E.P.'s 786692A1, 893731A1 and 893732A1, WO 99/05570, and paper published in Journal of American Chemical Society ("Two-Electron Sensitization: A New Concept for Silver Halide Photography", J. Am. Chem. Soc., 122, 11934–11943 (2000)). Although these compounds are relatively similar to the compound of the present invention in the structure and function, the electron-releasing compound of Type 1 according to the present invention is clearly different from the "two-electron sensitizer" of the prior art in the number of electrons released after the one-electron oxidation. The most conspicuous characteristic of the compound of the present invention resides in this very respect. That is, the inventors have independently accomplished a novel finding that the compound of the present invention can exert a peculiar unexpected striking sensitizing effect because the number of electrons released after the one-electron oxidation is not one but two or more (preferably three or more).

Compounds preferred among the electron-releasing compounds of Type 1 are represented by the general formula (A), general formula (B), general formula (1), general formula (2) or general formula (3).

General formula (A):

(A)

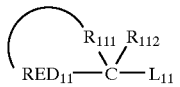

General formula (B):

(B)

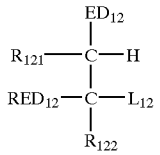

In the general formula (A), $RED_{11}$ represents a one-electron oxidizable reducing group, and $L_{11}$ represents a split-off group. $R_{112}$ represents a hydrogen atom or substituent. $R_{111}$ represents a nonmetallic atomic group capable of forming a specific 5-membered or 6-membered cyclic structure together with the carbon atom (C) and $RED_{11}$. Herein, the expression "specific 5-membered or 6-membered cyclic structure" means a cyclic structure corresponding to a tetrahydro form, hexahydro form or octahydro form of 5-membered or 6-membered aromatic ring (including an aromatic heterocycle).

In the general formula (B), $RED_{12}$ represents a one-electron oxidizable reducing group, and $L_{12}$ represents a split-off group. Each of $R_{121}$ and $R_{122}$ represents a hydrogen atom or substituent. $ED_{12}$ represents an electron-donating group. In the general formula (B), $R_{121}$ and $RED_{12}$; $R_{121}$ and $R_{122}$; $ED_{12}$ and $RED_{12}$ may be bonded with each other to thereby form a cyclic structure.

These compounds are compounds which, after a one-electron oxidation of the reducing group represented by $RED_{11}$ or $RED_{12}$ of the general formula (A) or general formula (B), can spontaneously split $L_{11}$ or $L_{12}$ through a bond cleavage reaction, namely, cleave the C (carbon atom)—$L_{11}$ bond or the C (carbon atom)—$L_{12}$ bond to thereby further release two or more, preferably three or more, electrons.

General formula (1)

(1)

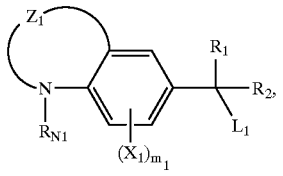

general formula (2)

(2)

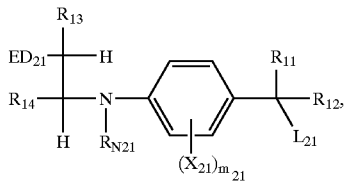

-continued general formula (3):

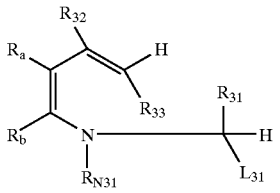

(3)

In the general formula (1), $Z_1$ represents an atomic group capable of forming a 6-membered ring together with the nitrogen atom and two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group. In the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent; $m_{21}$ is an integer of 0 to 3; and $L_{21}$ represents a split-off group. Any two of $R_{N21}$, $R_{13}$, $R_{14}$, $X_{21}$ and $ED_{21}$ may be bonded with each other to thereby form a cyclic structure. In the general formula (3), each of $R_{31}$, $R_{32}$, $R_{33}$, $R_{N31}$, $R_a$ and $R_b$ represents a hydrogen atom or substituent; and $L_{31}$ represents a split-off group. Provided that, when $R_{N31}$ represents a group other than an aryl group, $R_a$ and $R_b$ are bonded to each other to thereby form an aromatic ring.

These compounds are compounds which, after a one-electron oxidation, can spontaneously split $L_1$, $L_{21}$ or $L_{31}$ through a bond cleavage reaction, namely, cleave the C (carbon atom)—$L_1$ bond, the C (carbon atom)—$L_{21}$ bond or the C (carbon atom)—$L_{31}$ bond to thereby further release two or more, preferably three or more, electrons.

The compounds of the general formula (A) will first be described in detail below.

In the general formula (A), the one-electron oxidizable reducing group represented by $RED_{11}$ is a group capable of bonding with $R_{111}$ described later to thereby effect a specific cyclization. The one-electron oxidizable reducing group can be, for example, a divalent group corresponding to a monovalent group, as mentioned below, having one hydrogen atom removed therefrom at a position which is appropriate for cyclization. The monovalent group can be, for example, any of an alkylamino group, arylamino group (e.g., anilino, naphthylamino), heterocyclic amino group (e.g., benzothiazolylamino, pyrrolylamino), alkylthio group, arylthio group (e.g., phenylthio), heterocyclic thio group, alkoxy group, aryloxy group (e.g., phenoxy), heterocyclic oxy group, aryl group (e.g., phenyl, naphthyl, anthranyl) and aromatic or nonaromatic heterocyclic group (5 to 7-membered monocyclic or condensed-ring heterocycle containing at least one heteroatom selected from a nitrogen atom, a sulfur atom, an oxygen atom and a selenium atom, which heterocycle can be, for example, a tetrahydroquinoline ring, tetrahydroisoquinoline ring, tetrahydroquinoxaline ring, tetrahydroquinazoline ring, indoline ring, indole ring, indazole ring, carbazole ring, phenoxazine ring, phenothiazine ring, benzothiazoline ring, pyrrole ring, imidazole ring, thiazoline ring, piperidine ring, pyrrolidine ring, morpholine ring, benzimidazole ring, benzimidazoline ring, benzoxazoline ring or methylenedioxyphenyl ring) (hereinafter, for simplicity, $RED_{11}$ is referred to as denoting a monovalent group). These groups may each have a substituent.

The substituent can be, for example, any of a halogen atom, alkyl groups (including, e.g., an aralkyl group, cycloalkyl group, active methine group), an alkenyl group, alkynyl group, aryl group, heterocyclic group (preferably, 5- to 7-membered ring having at least one hetero atom selected from N, O and s, with its substitution position is not questioned), heterocyclic group containing a quaternated nitrogen atom (e.g., pyridinio, imidazolio, quinolinio or isoquinolinio), acyl group, alkoxycarbonyl group, aryloxycarbonyl group, carbamoyl group, carboxyl group or salt thereof, sulfonylcarbamoyl group, acylcarbamoyl group, sulfamoylcarbamoyl group, carbazoyl group, oxalyl group, oxamoyl group, cyano group, carbonimidoyl group, thiocarbamoyl group, hydroxyl group, alkoxy groups (including a group containing ethyleneoxy or propyleneoxy repeating units), aryloxy group, heterocyclic oxy group, acyloxy group, alkoxy- or aryloxy-carbonyloxy group, carbamoyloxy group, sulfonyloxy group, amino group, alkyl-, aryl- or heterocyclic-amino group, acylamino group, sulfonamido group, ureido group, thioureido group, imido group, alkoxy- or aryloxy-carbonylamino group, sulfamoylamino group, semicarbazido group, thiosemicarbazido group, hydrazino group, ammonio group, oxamoylamino group, alkyl- or aryl-sulfonylureido group, acylureido group, acylsulfamoylamino group, nitro group, mercapto group, alkyl-, aryl- or heterocyclic-thio group, alkyl- or aryl-sulfonyl group, alkyl- or aryl-sulfinyl group, sulfo group or salt thereof, sulfamoyl group, acylsulfamoyl group, sulfonylsulfamoyl group or salt thereof, and group containing a phosphoramide or phosphoric ester structure. These substituents may be further substituted with these substituents.

In the general formula (A), $L_{11}$ represents a split-off group which can be split off through a bond cleavage only after a one-electron oxidation of the reducing group represented by $RED_{11}$. $L_{11}$ represents, for example, a carboxyl group or salt thereof, silyl group, hydrogen atom, triarylboron anion, trialkylstannyl group, trialkylgermyl group, or a group of the formula $—CR_{C1}R_{C2}R_{C3}$.

When $L_{11}$ represents a salt of carboxyl group, as a counter ion for forming a salt, there can be mentioned, for example, an alkali metal ion (e.g., $Li^+$, $Na^+$, $K^+$ or $Cs^+$), an alkaline earth metal ion (e.g., $Mg^{2+}$, $Ca^{2+}$ or $Ba^{2+}$), a heavy metal ion (e.g., $Ag^+$ or $Fe^{2+/3+}$), an ammonium ion or a phosphonium ion. When $L_{11}$ represents a silyl group, the silyl group is, for example, a trialkylsilyl group, an aryldialkylsilyl group or a triarylsilyl group. The alkyl of these groups can be, for example, methyl, ethyl, benzyl or t-butyl. The aryl of these groups can be, for example, phenyl.

When $L_{11}$ represents a triarylboron anion, the aryl thereof is preferably a substituted or unsubstituted phenyl, wherein the substituent can be any of those which may be had by $RED_{11}$.

When $L_{11}$ represents a trialkylstannyl group or a trialkylgermyl group, the alkyl thereof is a substituted or unsubstituted linear, branched or cyclic alkyl having 1 to 24 carbon atoms, wherein the substituent can be any of those which may be had by $RED_{11}$.

When $L_{11}$ represents a group of the formula $—CR_{C1}R_{C2}R_{C3}$, each of $R_{C1}$, $R_{C2}$ and $R_{C3}$ independently represents any of a hydrogen atom, alkyl group, aryl group, heterocyclic group, alkylthio group, arylthio group, alkylamino group, arylamino group, heterocyclic amino group, alkoxy group, aryloxy group and hydroxyl group. These may be bonded with each other to thereby form a cyclic structure. Each of these may further have a substituent. The substituent can be any of those which may be had by $RED_{11}$. Provided however that, when one of $R_{C1}$, $R_{C2}$ and $R_{C3}$ represents a hydrogen atom or alkyl group, the remaining two do not represent a hydrogen atom or alkyl group. It is preferred that each of $R_{C1}$, $R_{C2}$ and $R_{C3}$ independently represent an alkyl group, aryl group (especially, phenyl), alkylthio group, arylthio group, alkylamino group, arylamino group, heterocyclic group, alkoxy group or hydroxyl group. Specific examples thereof include phenyl, p-dimethylaminophenyl, p-methoxyphenyl, 2,4-dimethoxyphenyl, p-hydroxyphenyl, methylthio, phenylthio, phenoxy, methoxy, ethoxy, dimethylamino, N-methylanilino, diphenylamino, morpholino, thiomorpholino and hydroxyl. Examples of groups having a cyclic structure formed by mutual bonding of these include 1,3-dithiolan-2-yl, 1,3-dithian-2-yl, N-methyl-1,3-thiazolidin-2-yl and N-benzylbenzothiazolidin-2-yl.

Preferred groups of the formula —$CR_{C1}R_{C2}R_{C3}$ can be, for example, trityl, tri(p-hydroxyphenyl)methyl, 1,1-diphenyl-1-(p-dimethylaminophenyl)methyl, 1,1-diphenyl-1-(methylthio)methyl, 1-phenyl-1,1-(dimethylthio)methyl, 1,3-dithiolan-2-yl, 2-phenyl-1,3-dithiolan-2-yl, 1,3-dithian-2-yl, 2-phenyl-1,3-dithian-2-yl, 2-methyl-1,3-dithian-2-yl, N-methyl-1,3-thiazolidin-2-yl, 2-methyl-3-methyl-1,3-thiazolidin-2-yl, N-benzylbenzothiazolidin-2-yl, 1,1-diphenyl-1-dimethylaminomethyl and 1,1-diphenyl-1-morpholinomethyl group. It is also preferred that the group of the formula —$CR_{C1}R_{C2}R_{C3}$ be the same group as the residue resulting from removal of $L_{11}$ from the general formula (A) as a consequence of selection within the above scopes with respect of the $R_{C1}$, $R_{C2}$ and $R_{C3}$.

In the general formula (A), $R_{112}$ represents a hydrogen atom or substituent capable of substituting on the carbon atom. When $R_{112}$ represents a substituent capable of substituting on the carbon atom, the substituent can be, for example, any of those mentioned as substituent examples with respect to the $RED_{11}$ having a substituent. Provided however that $R_{112}$ and $L_{11}$ do not represent the same group.

In the general formula (A), $R_{111}$ represents a nonmetallic atomic group capable of forming a specific 5-membered or 6-membered cyclic structure together with the carbon atom (C) and $RED_{11}$. Herein, the expression "specific 5-membered or 6-membered cyclic structure" formed by $R_{111}$ means a cyclic structure corresponding to a tetrahydro form, hexahydro form or octahydro form of 5-membered or 6-membered aromatic ring, including an aromatic heterocycle. Herein, the terminology "hydro form" means a cyclic structure resulting from partial hydrogenation of internal carbon to carbon double bonds or carbon to nitrogen double bonds of an aromatic ring, including an aromatic heterocycle. The tetrahydro form refers to a structure resulting from hydrogenation of two carbon to carbon double bonds or carbon to nitrogen double bonds. The hexahydro form refers to a structure resulting from hydrogenation of three carbon to carbon double bonds or carbon to nitrogen double bonds. The octahydro form refers to a structure resulting from hydrogenation of four carbon to carbon double bonds or carbon to nitrogen double bonds. As a result of hydrogenation, the aromatic ring becomes a partially hydrogenated nonaromatic cyclic structure.

Specifically, as examples of 5-membered monocycles, there can be mentioned a pyrrolidine ring, imidazolidine ring, thiazolidine ring, pyrazolidine ring and oxazolidine ring which correspond to tetrahydro forms of aromatic rings including a pyrrole ring, imidazole ring, thiazole ring, pyrazole ring and oxazole ring, respectively. As examples of 6-membered monocycles, there can be mentioned tetrahydro or hexahydro forms of aromatic rings such as a pyridine ring, pyridazine ring, pyrimidine ring and pyrazine ring. Particular examples thereof include a piperidine ring, tetrahydropyridine ring, tetrahydropyrimidine ring and piperazine ring. As examples of 6-membered condensed rings, there can be mentioned a tetralin ring, tetrahydroquinoline ring, tetrahydroisoquinoline ring, tetrahydroquinazoline ring and tetrahydroquinoxaline ring which correspond to tetrahydro forms of aromatic rings including a naphthalene ring, quinoline ring, isoquinoline ring, quinazoline ring and quinoxaline ring, respectively. As examples of tricyclic compounds, there can be mentioned a tetrahydrocarbazole ring, which is a tetrahydro form of a carbazole ring, and an octahydrophenanthridine ring, which is an octahydro form of a phenanthridine ring.

These cyclic structures may further be substituted. As examples of suitable substituents, there can be mentioned those described above with respect to substituents which may be had by the $RED_{11}$. Substituents of these cyclic structures may be further bonded with each other to thereby form a ring. The thus newly formed ring is a nonaromatic carbon ring or heterocycle.

Preferred range of compounds represented by the general formula (A) of the present invention will be described below.

In the general formula (A), $L_{11}$ preferably represents a carboxyl group or salt thereof, or hydrogen atom. More preferably, $L_{11}$ is a carboxyl group or salt thereof. As a counter ion of the salt, there can preferably be mentioned an alkali metal ion or an ammonium ion. An alkali metal ion (especially $Li^+$, $Na^+$ or $K^+$ ion) is most preferred.

When $L_{11}$ represents a hydrogen atom, it is preferred that the compound represented by the general formula (A) have an intramolecular base moiety. By virtue of the action of the base moiety, the compound represented by the general formula (A) is oxidized, and thereafter the hydrogen atom represented by $L_{11}$ is deprotonized to thereby enable further release of an electron therefrom.

Herein, the base refers to, for example, a conjugated base of acid exhibiting a pKa value of about 1 to about 10. As the base, there can be mentioned, for example, any of nitrogen-containing heterocycles (pyridines, imidazoles, benzimidazoles, thiazoles, etc.), anilines, trialkylamines, an amino group, carbon acids (active methylene anion, etc.), a thioacetate anion, carboxylate (—$COO^-$), sulfate (—$SO_3^-$) and an amine oxide (>$N^+(O^-)$—). Preferred base is a conjugated base of acid exhibiting a pKa value of about 1 to about 8. Carboxylate, sulfate and an amine oxide are more preferred. Carboxylate is most preferred. When these bases have an anion, a counter cation may be had thereby. The counter cation can be, for example, an alkali metal ion, an alkaline earth metal ion, a heavy metal ion, an ammonium ion or a phosphonium ion.

These bases are linked at an arbitrary position thereof to the compound represented by the general formula (A). The position at which the base moiety is bonded may be any of $RED_{11}$, $R_{111}$ and $R_{112}$ of the general formula (A). Also, the bases may be linked at substituents of these groups.

When $L_{11}$ represents a hydrogen atom, it is preferred that the hydrogen atom and the base moiety be linked to each other through an atomic group consisting of 8 or less atoms. More preferably, the linkage is made by an atomic group consisting of 5 to 8 atoms. Herein, what is counted as a linking atomic group refers to an atomic group which links the hydrogen atom to the central atom of base moiety (namely, an atom having an anion, or an atom having a lone electron pair) by a covalent bond. For example, with respect to carboxylate, two atoms of —C—$O^-$ are counted. With respect to sulfate, two atoms of S—$O^-$ are counted. Also, the carbon atom represented by C in the general formula (A) is included in the count.

In the general formula (A), when $L_{11}$ represents a hydrogen atom and when $RED_{11}$ represents an aniline whose nitrogen atom forms a 6-membered monocyclic saturated ring structure (for example, a piperidine ring, piperazine ring, morpholine ring, thiomorpholine ring or selenomorpholine ring) together with $R_{111}$, it is preferred that the compound have an adsorptive group acting on silver halides in its molecule. It is more preferred that the compound simultaneously have an intramolecular base moiety, the base moiety and the hydrogen atom linked to each other through an atomic group consisting of 8 or less atoms.

In the general formula (A), it is preferred that $RED_{11}$ represents an alkylamino group, arylamino group, heterocyclic amino group, aryl group, or aromatic or nonaromatic heterocyclic group. As the heterocyclic group, preferred use is made of, for example, tetrahydroquinolinyl, tetrahydroquinoxalinyl, tetrahydroquinazolinyl, indolyl, indolenyl, carbazolyl, phenoxazinyl, phenothiazinyl, benzothiazolinyl, pyrrolyl, imidazolyl, thiazolidinyl, benzimidazolyl, benzimidazolinyl or 3,4-methylenedioxyphenyl-1-yl. More preferred use is made of an aryl group (especially a phenyl group) or arylamino group (especially an anilino group) having 18 or less carbon atoms. When $RED_{11}$ represents an aryl group, it is preferred that the aryl group has at least one electron-donating group (the number of electron-donating groups is preferably 4 or less, more preferably 1 to 3). Herein, the electron-donating group specifically refers to a hydroxyl group, alkoxy group, mercapto group, sulfonamido group, acylamino group, alkylamino group, arylamino group, heterocyclic amino group, active methine group, electron-excess aromatic heterocyclic group (e.g., indolyl, pyrrolyl, imidazolyl, benzimidazolyl, thiazolyl, benzthiazolyl or indazolyl), or a nonaromatic nitrogen-containing heterocyclic group that is bonded to the carbon atom of the general formula (A) via its nitrogen atom (e.g., pyrrolidinyl, indolinyl, piperidinyl, piperazinyl or morpholino). Herein, the active methine group refers to a methine group substituted with two electron-withdrawing groups. Herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. These two electron-withdrawing groups may be bonded with each other to thereby form a circular structure. When $RED_{11}$ represents an aryl group, the substituent of the aryl group is preferably an alkylamino group, hydroxyl group, alkoxy group, mercapto group, sulfonamido group, active methine group, or nonaromatic nitrogen-containing heterocyclic group that is bonded to the carbon atom of the general formula (A) via its nitrogen atom. More preferably, the substituent is an alkylamino group, hydroxyl group, active methine group, or nonaromatic nitrogen-containing heterocyclic group that is bonded to the carbon atom of the general formula (A) via its nitrogen atom. Most preferably, the substituent is an alkylamino group, or nonaromatic nitrogen-containing heterocyclic group that is bonded to the carbon atom of the general formula (A) via its nitrogen atom.

In the general formula (A), $R_{112}$ preferably represents any of a hydrogen atom, alkyl group, aryl group (e.g., phenyl), alkoxy group (e.g., methoxy, ethoxy or benzyloxy), hydroxyl group, alkylthio group (e.g., methylthio or butylthio), amino group, alkylamino group, arylamino group and heterocyclic amino group, each preferably having 18 or less carbon atoms. More preferably, $R_{112}$ represents any of a hydrogen atom, alkyl group, alkoxy group, phenyl group, alkylamino group or hydroxyl group, each preferably having 10 or less carbon atoms.

In the general formula (A), $R_{111}$ preferably represents a nonmetallic atomic group capable of forming the following specific 5-membered or 6-membered cyclic structure together with the carbon atom (C) and $RED_{11}$. Specifically, the cyclic structure formed by $R_{111}$ may be, for example, either of a pyrrolidine ring and an imidazolidine ring which correspond to tetrahydro forms of monocyclic 5-membered aromatic rings including a pyrrole ring and imidazole ring, respectively. Also, the cyclic structure may be a tetrahydro or hexahydro form of monocyclic 6-membered aromatic ring such as a pyridine ring, pyridazine ring, pyrimidine ring or pyrazine ring. For example, the cyclic structure may be a piperidine ring, tetrahydropyridine ring, tetrahydropyrimidine ring or piperazine ring. Further, the cyclic structure may be any of a tetralin ring, tetrahydroquinoline ring, tetrahydroisoquinoline ring, tetrahydroquinazoline ring and tetrahydroquinoxaline ring which correspond to tetrahydro forms of condensed-ring of 6-membered aromatic rings including a naphthalene ring, a quinoline ring, isoquinoline ring, quinazoline ring and quinoxaline ring, respectively. Still further, the cyclic structure may be a tetrahydrocarbazole ring which is a tetrahydro form of a tricyclic aromatic carbazole ring, or octahydrophenanthridine ring which is an octahydro form of a phenanthridine ring. The cyclic structure formed by $R_{111}$ is more preferably selected from a pyrrolidine ring, imidazolidine ring, piperidine ring, tetrahydropyridine ring, tetrahydropyrimidine ring, piperazine ring, tetrahydroquinoline ring, tetrahydroquinazoline ring, tetrahydroquinoxaline ring and tetrahydrocarbazole ring. Most preferably, the cyclic structure formed by $R_{111}$ is selected from a pyrrolidine ring, piperidine ring, piperazine ring, tetrahydroquinoline ring, tetrahydroquinazoline ring, tetrahydroquinoxaline ring and tetrahydrocarbazole ring. Optimally, the cyclic structure formed by $R_{111}$ is selected from a pyrrolidine ring, piperidine ring and tetrahydroquinoline ring.

Now, the general formula (B) will be described in detail.

With respect to the $RED_{12}$ and $L_{12}$ of the general formula (B), not only the meanings but also the preferred ranges thereof are the same as those of the $RED_{11}$ and $L_{11}$ of the general formula (A), respectively. Provided however that $RED_{12}$ represents a monovalent group unless the following cyclic structure is formed thereby. For example, the monovalent group can be any of those mentioned with respect to $RED_{11}$. With respect to $R_{121}$ and $R_{122}$, not only the meanings but also the preferred ranges thereof are the same as those of the $R_{112}$ of the general formula (A). $ED_{12}$ represents an electron-donating group. $R_{121}$ and $RED_{12}$; $R_{121}$ and $R_{122}$; or $ED_{12}$ and $RED_{12}$ may be bonded with each other to thereby form a cyclic structure.

In the general formula (B), the electron-donating group represented by $ED_{12}$ refers to a hydroxyl group, alkoxy group, mercapto group, alkylthio group, arylthio group, heterocyclic thio group, sulfonamido group, acylamino group, alkylamino group, arylamino group, heterocyclic amino group, active methine group, electron-excess aromatic heterocyclic group (e.g., indolyl, pyrrolyl or indazolyl), a nonaromatic nitrogen-containing heterocyclic group that is bonded to the carbon atom of the general formula (B) via its nitrogen atom (e.g., pyrrolidinyl, piperidinyl, indolinyl, piperazinyl or morpholino), or an aryl group substituted with any of these electron-donating groups (e.g., p-hydroxyphenyl, p-dialkylaminophenyl, an o,p-dialkoxyphenyl or 4-hydroxynaphthyl). Herein, the active methine group is the same as described above as a substituent when $RED_{11}$ represents an aryl group. $ED_{12}$ preferably represents a hydroxyl group, alkoxy group, mercapto group, sulfonamido group, alkylamino group, arylamino group, active methine group, electron-excess aromatic heterocyclic group, nonaromatic nitrogen-containing heterocyclic group that is bonded to the carbon atom of the general formula (B) via its nitrogen atom, or phenyl group substituted with any of these electron-donating groups. More preferably, $ED_{12}$ represents a hydroxyl group, mercapto group, sulfonamido group, alkylamino group, arylamino group, active methine group, nonaromatic nitrogen-containing heterocyclic group that is bonded to the carbon atom of the general formula (B) via its nitrogen atom, or phenyl group substituted with any of these electron-donating groups (e.g., p-hydroxyphenyl, p-dialkylaminophenyl or o,p-dialkoxyphenyl).

In the general formula (B), $R_{121}$ and $RED_{12}$; $R_{122}$ and $R_{121}$; or $ED_{12}$ and $RED_{12}$ may be bonded with each other to thereby form a cyclic structure. The thus formed cyclic structure is a substituted or unsubstituted cyclic structure consisting of a 5 to 7-membered monocyclic or condensed-ring nonaromatic carbon ring or heterocycle. When $R_{121}$ and $RED_{12}$ form a cyclic structure, the thus formed cyclic structure can be, for example, a pyrrolidine ring, pyrroline ring, imidazolidine ring, imidazoline ring, thiazolidine ring, thiazoline ring, pyrazolidine ring, pyrazoline ring, oxazolidine ring, oxazoline ring, indane ring, piperidine ring, piperazine ring, morpholine ring, tetrahydropyridine ring, tetrahydropyrimidine ring, indoline ring, tetralin ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring or 2,3-dihydrobenzothiophene ring. When $ED_{12}$ and $RED_{12}$ form a cyclic structure, $ED_{12}$ preferably represents an amino group, alkylamino group or arylamino group. The cyclic structure formed thereby can be, for example, a tetrahydropyrazine ring, piperazine ring, tetrahydroquinoxaline ring or tetrahydroisoquinoline ring. When $R_{122}$ and $R_{121}$ form a cyclic structure, the thus formed cyclic structure can be, for example, a cyclohexane ring or cyclopentane ring.

Those which are more preferred among the compounds of the general formula (A) of the present invention are represented by the following general formulae (10) to (12). Those which are more preferred among the compounds of the general formula (B) are represented by the following general formulae (13) and (14).

(10)

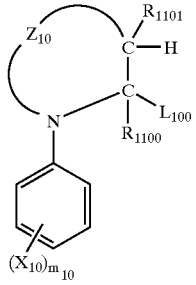

(11)

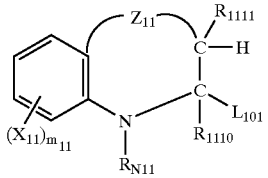

-continued (12)

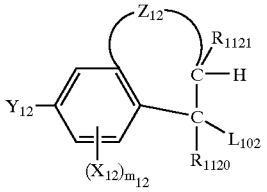

(13)

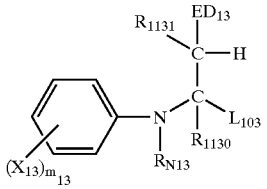

(14)

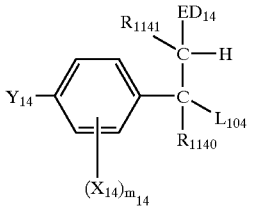

With respect to the $L_{100}$, $L_{101}$, $L_{102}$, $L_{103}$ and $L_{104}$ of the general formulae (10) to (14), not only the meanings but also the preferred ranges thereof are the same as those of the $L_{11}$ of the general formula (A). With respect to $R_{1100}$ and $R_{1101}$; $R_{1110}$ and $R_{1111}$; $R_{1120}$ and $R_{1121}$; $R_{1130}$ and $R_{1131}$; and $R_{1140}$ and $R_{1141}$; not only the meanings but also the preferred ranges thereof are the same as those of the $R_{122}$ and $R_{121}$, respectively of the general formula (B). With respect to the $ED_{13}$ and $ED_{14}$, not only the meanings but also the preferred ranges thereof are the same as those of the $ED_{12}$ of the general formula (B). Each of $X_{10}$, $X_{11}$, $X_{12}$, $X_{13}$ and $X_{14}$ represents a substituent capable of substituting on the benzene ring. Each of $m_{10}$, $m_{11}$, $m_{12}$, $m_{13}$ and $m_{14}$ is an integer of 0 to 3. When it is 2 or more, a plurality of $X_{10}$, $X_{11}$, $X_{12}$, $X_{13}$ or $X_{14}$ groups may be the same or different. Each of $Y_{12}$ and $Y_{14}$ represents an amino group, alkylamino group, arylamino group, nonaromatic nitrogen-containing heterocyclic group that is bonded to the benzene ring of the general formula (12) or (14) via its nitrogen atom (e.g., pyrrolyl, piperidinyl, indolinyl, piperazino or morpholino), hydroxyl group or alkoxy group.

Each of $Z_{10}$, $Z_{11}$ and $Z_{12}$ represents a nonmetallic atomic group capable of forming a specific cyclic structure. The specific cyclic structure formed by $Z_{10}$ means a cyclic structure corresponding to a tetrahydro form or hexahydro form of 5- or 6-membered, monocyclic or condensed-ring, nitrogen-containing aromatic heterocycle. As such a cyclic structure, there can be mentioned, for example, a pyrrolidine ring, imidazolidine ring, thiazolidine ring, pyrazolidine ring, piperidine ring, tetrahydropyridine ring, tetrahydropyrimidine ring, piperazine ring, tetrahydroquinoline ring, tetrahydroisoquinoline ring, tetrahydroquinazoline ring or tetrahydroquinoxaline ring. The specific cyclic structure formed by $Z_{11}$ refers to a tetrahydroquinoline ring or tetrahydroquinoxaline ring. The specific cyclic structure formed by $Z_{12}$ refers to a tetralin ring, tetrahydroquinoline ring or tetrahydroisoquinoline ring.

Each of $R_{N11}$ and $R_{N13}$ represents a hydrogen atom or substituent capable of substituting on the nitrogen atom. The substituent can be, for example, any of an alkyl group, alkenyl group, alkynyl group, aryl group, heterocyclic group and acyl group, preferably an alkyl group or aryl group, each of which preferably have 18 or less carbon atoms, more preferably 10 or less carbon atoms.

The substituents capable of substituting on the benzene ring, represented by $X_{10}$, $X_{11}$, $X_{12}$, $X_{13}$ or $X_{14}$, can be, for example, those which may be had by the $RED_{11}$ of the general formula (A). Preferably, the substituents can be a halogen atom, alkyl group, aryl group, heterocyclic group, acyl group, alkoxycarbonyl group, aryloxycarbonyl group, carbamoyl group, cyano group, alkoxy group (including a group containing ethyleneoxy or propyleneoxy repeating units), alkyl-, aryl- or heterocyclic-amino group, an acylamino group, sulfonamido group, ureido group, thioureido group, imido group, alkoxy- or aryloxy-carbonylamino group, nitro group, alkyl-, aryl- or heterocyclic-thio group, alkyl- or aryl-sulfonyl group, a sulfamoyl group, etc. Each of $m_{10}$, $m_{11}$, $m_{12}$, $m_{13}$ and $m_{14}$ is preferably an integer of 0 to 2, more preferably 0 or 1.

Each of $Y_{12}$ and $Y_{14}$ preferably represents an alkylamino group, arylamino group, nonaromatic nitrogen-containing heterocyclic group that is bonded to the benzene ring of the general formula (12) or (14) via its nitrogen atom, hydroxyl group or alkoxy group. More preferably, each of $Y_{12}$ and $Y_{14}$ represents an alkylamino group, 5- or 6-membered nonaromatic nitrogen-containing heterocyclic group that is bonded to the benzene ring of the general formula (12) or (14) via its nitrogen atom, or hydroxyl group. Most preferably, each of $Y_{12}$ and $Y_{14}$ represents an alkylamino group (especially, a dialkylamino group) or a 5- or 6-membered nonaromatic nitrogen-containing heterocyclic group that is bonded to the benzene ring of the general formula (12) or (14) via its nitrogen atom.

In the general formula (13), $R_{1131}$ and $X_{13}$; $R_{1131}$ and $R_{N13}$; $R_{1130}$ and $X_{13}$; or $R_{1130}$ and $R_{N13}$ may be bonded with each other to thereby form a cyclic structure. In the general formula (14), $R_{1141}$ and $X_{14}$; or $R_{1141}$ and $R_{1140}$; $ED_{14}$ and $X_{14}$; or $R_{1140}$ and $X_{14}$ may be bonded with each other to thereby form a cyclic structure. The thus formed cyclic structure is a substituted or unsubstituted cyclic structure consisting of a 5- to 7-membered monocyclic or condensed-ring nonaromatic carbon ring or heterocycle. When, in the general formula (13), $R_{1131}$ and $X_{13}$ are bonded with each other to thereby form a cyclic structure, or $R_{1131}$ and $R_{N13}$ are bonded with each other to thereby form a cyclic structure, the resultant compound, like that wherein no cyclic structure is formed, is a preferred example of the compounds of the general formula (13). As the cyclic structure formed by $R_{1131}$ and $X_{13}$ in the general formula (13), there can be mentioned, for example, any of an indoline ring, in which case, $R_{1131}$ represents a single bond, tetrahydroquinoline ring, tetrahydroquinoxaline ring, 2,3-dihydrobenzo-1,4-oxazine ring and 2,3-dihydrobenzo-1,4-thiazine ring. Of these, an indoline ring, tetrahydroquinoline ring and tetrahydroquinoxaline ring are especially preferred. As the cyclic structure formed by $R_{1131}$ and $R_{N13}$ in the general formula (13), there can be mentioned, for example, any of a pyrrolidine ring, pyrroline ring, imidazolidine ring, imidazoline ring, thiazolidine ring, thiazoline ring, pyrazolidine ring, pyrazoline ring, oxazolidine ring, oxazoline ring, piperidine ring, piperazine ring, morpholine ring, tetrahydropyridine ring, tetrahydropyrimidine ring, indoline ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring and 2,3-dihydrobenzothiophene ring. Of these, a pyrrolidine ring, piperidine ring, tetrahydroquinoline ring and tetrahydroquinoxaline ring are especially preferred.

When, in the general formula (14), $R_{1141}$ and $X_{14}$ are bonded with each other to thereby form a cyclic structure, or $ED_{14}$ and $X_{14}$ are bonded with each other to thereby form a cyclic structure, the resultant compound, like that wherein no cyclic structure is formed, is a preferred example of the compounds of the general formula (14). As the cyclic structure formed by the bonding of $R_{1141}$ and $X_{14}$ in the general formula (14), there can be mentioned, for example, an indane ring, tetralin ring, tetrahydroquinoline ring, tetrahydroisoquinoline ring or indoline ring. As the cyclic structure formed by the bonding of $ED_{14}$ and $X_{14}$, there can be mentioned, for example, a tetrahydroisoquinoline ring or tetrahydrocinnoline ring.

Now, the general formulae (1) to (3) will be described.

In the general formulae (1) to (3), each of $R_1$, $R_2$, $R_{11}$, $R_{12}$ and $R_{31}$ independently represents a hydrogen atom or substituent. With respect to these, not only the meanings but also the preferred ranges thereof are the same as those of the $R_{112}$ of the general formula (A). Each of $L_1$, $L_{21}$ and $L_{31}$ independently represents a split-off group, which can be any of those mentioned as examples in the above description of the $L_{11}$ of the general formula (A). The preferred ranges thereof are also the same as mentioned there. $X_1$ and $X_{21}$ represent substituents capable of substituting on the benzene ring. Each thereof independently represents any of those mentioned as substituent examples with respect to substituted $RED_{11}$ of the general formula (A). Each of $m_1$ and $m_{21}$ is an integer of 0 to 3, preferably 0 to 2, and more preferably 0 or 1.

Each of $R_{N1}$, $R_{N21}$ and $R_{N31}$ represents a hydrogen atom or substituent capable of substituting on the nitrogen atom. The substituent can preferably be any of an alkyl group, aryl group and heterocyclic group. These groups may further have a substituent. This substituent can be any of those which may be had by the $RED_{11}$ of the general formula (A). Each of $R_{N1}$, $R_{N21}$ and $R_{N31}$ preferably represents a hydrogen atom, alkyl group or aryl group, more preferably a hydrogen atom or alkyl group.

Each of $R_{13}$, $R_{14}$, $R_{32}$, $R_{33}$, $R_a$ and $R_b$ independently represents a hydrogen atom or substituent capable of substituting on the carbon atom. The substituent can be any of those which may be had by the $RED_{11}$ of the general formula (A). The substituent can preferably be, for example, an alkyl group, aryl group, acyl group, alkoxycarbonyl group, carbamoyl group, cyano group, alkoxy group, acylamino group, sulfonamido group, ureido group, thioureido group, alkylthio group, arylthio group, alkylsulfonyl group, arylsulfonyl group or sulfamoyl group.

In the general formula (1), $Z_1$ represents an atomic group capable of forming a 6-membered ring together with two carbon atoms of the benzene ring and the nitrogen atom. The 6-membered ring formed with $Z_1$ is a nonaromatic carbon ring or heterocycle fused with the benzene ring of the general formula (1). For example, it can be any of a tetrahydroquinoline ring, tetrahydroquinoxaline ring and tetrahydroquinazoline ring. These may have a substituent. The substituent can be any of those mentioned as examples when the $R_{112}$ of the general formula (A) represents a substituent, and the preferred range thereof is also the same as mentioned there.

In the general formula (1), $Z_1$ preferably represents an atomic group capable of forming a tetrahydroquinoline ring or tetrahydroquinoxaline ring together with the two carbon atoms of the benzene ring and the nitrogen atom.

In the general formula (2), $ED_{21}$ represents an electron-donating group. With respect to the $ED_{21}$, not only the meaning but also the preferred range thereof is the same as those of the $ED_{12}$ of the general formula (B).

In the general formula (2), any two of $R_{N21}$, $R_{13}$, $R_{14}$, $X_{21}$ and $ED_{21}$ may be bonded with each other to thereby form a cyclic structure. The cyclic structure formed by $R_{N21}$ and $X_{21}$ is preferably a 5 to 7-membered nonaromatic carbon ring or heterocycle fused with the benzene ring of the general formula (2). For example, it can be a tetrahydroquinoline ring, tetrahydroquinoxaline ring, indoline ring or 2,3-dihydro-5,6-benzo-1,4-thiazine ring. Preferably, it is a tetrahydroquinoline ring, tetrahydroquinoxaline ring or indoline ring.

In the general formula (3), when $R_{N31}$ represents a group other than aryl, $R_a$ and $R_b$ are bonded with each other to thereby form an aromatic ring. This aromatic ring is an aryl group (e.g., a phenyl group or naphthyl group) or an aromatic heterocyclic group (e.g., a pyridine ring group, pyrrole ring group, quinoline ring group or indole ring group). An aryl group is preferred. The aromatic ring group may have a substituent. The substituent can be any of those mentioned when $X_1$ of the general formula (1) represents a substituent, and the preferred range thereof is also the same as mentioned there.

In the general formula (3), it is preferred that $R_a$ and $R_b$ be bonded with each other to thereby form an aromatic ring (especially a phenyl group).

In the general formula (3), $R_{32}$ preferably represents, for example, a hydrogen atom, alkyl group, aryl group, hydroxyl group, alkoxy group, mercapto group or amino group. When $R_{32}$ represents a hydroxyl group, it is a preferred mode that simultaneously $R_{33}$ represent an electron-withdrawing group. This electron-withdrawing group refers to any of an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. Of these, an acyl group, alkoxycarbonyl group, carbamoyl group and cyano group are preferred.

The electron-releasing compound of Type 2 will be described below.

The electron-releasing compound of Type 2 is a compound capable of undergoing a one-electron oxidation to thereby form a one-electron oxidation product and capable of, only thereafter, undergoing a bond cleavage reaction to thereby further release another electron. That is, the electron-releasing compound of Type 2 is a compound capable of undergoing a further one-electron oxidation. The above bond cleavage reaction refers to the cleavage of bond between elements, in particular, carbon-carbon bond, carbon-silicon bond, carbon-hydrogen bond, carbon-boron bond, carbon-tin bond or carbon-germanium bond. Further, the cleavage of carbon-hydrogen bond may accompany the above bond cleavage.

Among the electron-releasing compounds of Type 2, those preferred are represented by the general formula (C).

General formula (C):

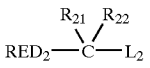

(C)

The compound of the general formula (C) is a compound wherein, after the one-electron oxidation of the reducing group represented by $RED_2$, $L_2$ is spontaneously split off through a bond cleavage reaction, namely, the C (carbon atom)—$L_2$ bond is cleaved, so that further another electron can be released.

The compound of the general formula (C) is a compound having, in its molecule, two or more (preferably 2 to 6, more preferably 2 to 4) adsorptive groups acting on silver halides. More preferably, the compound of the general formula (C) is a compound having a nitrogen-containing heterocyclic group substituted with two or more mercapto groups as the adsorptive group. The number of adsorptive groups is preferably in the range of 2 to 6, more preferably 2 to 4. The adsorptive groups will be described later.

With respect to $RED_2$ of the general formula (C), not only the meaning but also the preferred range thereof is the same as those of the $RED_{12}$ of the general formula (B). With respect to $L_2$, not only the meaning but also the preferred range thereof is the same as those of the $L_{11}$ of the general formula (A). When $L_2$ represents a silyl group, the compound is one having, in its molecule, a nitrogen-containing heterocyclic group substituted with two or more mercapto groups as adsorptive groups. Each of $R_{21}$ and $R_{22}$ represents a hydrogen atom or substituent. With respect to these, not only the meanings but also the preferred ranges thereof are the same as those of the $R_{112}$ of the general formula (A). $RED_2$ and $R_{21}$ may be bonded with each other to thereby form a cyclic structure.

The thus formed cyclic structure is preferably a 5- to 7-membered monocyclic or condensed-ring nonaromatic carbon ring or heterocycle, which may have a substituent. Provided however that the cyclic structure is not one corresponding to a tetrahydro form, hexahydro form or octahydro form of an aromatic ring or aromatic heterocycle. The substituent can be any of those mentioned as substituent examples with respect to substituted $RED_{11}$ of the general formula (A). The cyclic structure is preferably one corresponding to a dihydro form of an aromatic ring or aromatic heterocycle, which can be, for example, any of a 2-pyrroline ring, 2-imidazoline ring, 2-thiazoline ring, 1,2-dihydropyridine ring, 1,4-dihydropyridine ring, indoline ring, benzimidazoline ring, benzothiazoline ring, benzoxazoline ring, 2,3-dihydrobenzothiophene ring, 2,3-dihydrobenzofuran ring, benzo-α-pyran ring, 1,2-dihydroquinoline ring, 1,2-dihydroquinazoline ring and 1,2-dihydroquinoxaline ring.

Of these, a 2-imidazoline ring, 2-thiazoline ring, indoline ring, benzimidazoline ring, benzothiazoline ring, benzoxazoline ring, 1,2-dihydropyridine ring, 1,2-dihydroquinoline ring, 1,2-dihydroquinazoline ring and 1,2-dihydroquinoxaline ring are preferred. An indoline ring, benzimidazoline ring, benzothiazoline ring and 1,2-dihydroquinoline ring are more preferred. An indoline ring is most preferred.

The electron-releasing compound of Type 3 will be described below.

The electron-releasing compound of Type 3 is a compound characterized in that it can undergo a one-electron oxidation to thereby form a one-electron oxidation product, the one-electron oxidation product undergoing a subsequent bond forming step to thereby further release one or more electrons. The bond forming step refers to the formation of bond between atoms, in particular, carbon-carbon bond, carbon-nitrogen bond, carbon-sulfur bond or carbon-oxygen bond.

The compound of Type 3 is preferably a compound characterized in that it can undergo a one-electron oxidation to thereby form a one-electron oxidation product, the one-electron oxidation product subsequently reacting with a reactive group moiety (a carbon to carbon double bond moiety, a carbon to carbon triple bond moiety, an aromatic group moiety or a nonaromatic heterocyclic group moiety of benzo condensed rings) which is copresent in the molecule to thereby form a bond, followed by further release of one or more electrons.

The one-electron oxidation product formed by the one-electron oxidation of the electron-releasing compound of Type 3 refers to a cation radical species, which may undergo splitting of a proton to thereby form a neutral radical species. This one-electron oxidation product (cation radical species or neutral radical species) reacts with a carbon to carbon double bond moiety, a carbon to carbon triple bond moiety, an aromatic group moiety and a nonaromatic heterocyclic group moiety of benzo condensed rings which are copresent in the molecule, thereby forming interatomic bonds such as carbon-carbon bond, carbon-nitrogen bond, carbon-sulfur bond and carbon-oxygen bond. Thus, a new intramolecular cyclic structure is formed. Simultaneously or thereafter, further one or more electrons are released. The characteristic of the electron-releasing compound of Type 3 resides in this respect.

More specifically, the compound of Type 3 is characterized in that the bond forming reaction after the one-electron oxidation leads to formation of a new radical species of cyclic structure, from which the second electron is further released directly or through splitting of a proton to thereby cause an oxidation thereof.

Furthermore, the electron-releasing compounds of Type 3 include one exhibiting such a capability that the thus formed two-electron oxidation product subsequently undergoes a tautomeric reaction accompanying a transfer of proton either by way of a hydrolytic reaction or directly to thereby further release one or more, generally two or more, electrons, resulting in an oxidation thereof. Still further, the compounds of Type 3 include one exhibiting such a capability that, without undergoing such a tautomeric reaction, further one or more, generally two or more, electrons are directly released from the two-electron oxidation product, resulting in oxidation thereof.

The compound of Type 3 is preferably represented the general formula (D).

General formula (D):

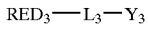

$$RED_3—L_3—Y_3 \quad (D)$$

In the general formula (D), $RED_3$ represents the same meanings as defined for $RED_{12}$ of the general formula (B).

In the general formula (D), $RED_3$ preferably represents an arylamino group, heterocyclic amino group, aryloxy group, arylthio group, aryl group, or aromatic or nonaromatic heterocyclic group (especially preferably a nitrogen-containing heterocyclic group). More preferably, $RED_3$ represents an arylamino group, heterocyclic amino group, aryl group, or aromatic or nonaromatic heterocyclic group. With respect to the heterocyclic group, it is preferred to use, for example, a tetrahydroquinoline ring group, tetrahydroquinoxaline ring group, tetrahydroquinazoline ring group, indoline ring group, indole ring group, carbazole ring group, phenoxazine ring group, phenothiazine ring group, benzothiazoline ring group, pyrrole ring group, imidazole ring group, thiazole ring group, benzimidazole ring group, benzimidazoline ring group, benzothiazoline ring group or 3,4-methylenedioxyphenyl-1-yl ring group.

An arylamino group (especially anilino), an aryl group (especially phenyl) or an aromatic or nonaromatic heterocyclic group is most preferred as $RED_3$, wherein the number of carbon atoms of the aryl group or heterocyclic group moiety is preferably 18 or less.

When $RED_3$ represents an aryl group, it is preferred that the aryl group has at least one electron-donating group. Herein, the electron-donating group specifically refers to a hydroxyl group, alkoxy group, mercapto group, alkylthio group, sulfonamido group, acylamino group, alkylamino group, arylamino group, heterocyclic amino group, active methine group, electron-excess aromatic heterocyclic group (e.g., indolyl, pyrrolyl or indazolyl), or a nonaromatic nitrogen-containing heterocyclic group that is bonded to $L_3$ via its nitrogen atom (e.g., pyrrolidinyl, indolinyl, piperidinyl, piperazinyl, morpholino or thiomorpholino). Herein, the active methine group refers to a methine group substituted with two electron-withdrawing groups. Herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. These two electron-withdrawing groups may be bonded with each other to thereby form a cyclic structure.

When $RED_3$ represents a substituted aryl group, the substituent of the substituted aryl group is preferably an alkylamino group, hydroxyl group, alkoxy group, mercapto group, sulfonamido group, active methine group, or nonaromatic nitrogen-containing heterocyclic group that is bonded to $L_3$ via its nitrogen atom. More preferably, the substituent is an alkylamino group, hydroxyl group, active methine group, or nonaromatic nitrogen-containing heterocyclic group that is bonded to $L_3$ via its nitrogen atom. Most preferably, the substituent is an alkylamino group, or nonaromatic nitrogen-containing heterocyclic group that is bonded to $L_3$ via its nitrogen atom.

In the general formula (D), $Y_3$ represents a reactive group capable of reacting with a one-electron oxidation product formed as a result of a one-electron oxidation of $RED_3$ to thereby form a new bond. Specifically, $Y_3$ represents an organic group having a carbon to carbon double bond moiety, carbon to carbon triple bond moiety, aromatic group moiety, or benzo-condensed nonaromatic heterocyclic group moiety. When the reactive group represented by $Y_3$ is an organic group having a carbon to carbon double bond or carbon to carbon triple bond moiety, the moiety may have a substituent. Two of such substituents may be bonded with each other thereby to form a ring. As an organic group comprising a carbon to carbon double bond moiety and carbon to carbon triple bond moiety, a substituted or unsubstituted vinyl group and a substituted or unsubstituted ethynyl group can be mentioned, respectively. The substituent of the substituted organic group can preferably be any of, for example, an alkyl group (preferably having 1 to 8 carbon atoms), aryl group (preferably having 6 to 12 carbon atoms), cyano group, alkoxycarbonyl group (preferably having 2 to 8 carbon atoms), carbamoyl group, acyl group and electron-donating group. Herein, the electron-donating group refers to any of an alkoxy group (preferably having 1 to 8 carbon atoms), hydroxyl group, amino group, alkylamino group (preferably having 1 to 8 carbon atoms), arylamino group (preferably having 6 to 12 carbon atoms), heterocyclic amino group (preferably having 2 to 6 carbon atoms), sulfonamido group, acylamino group, active methine group, mercapto group, an alkylthio group (preferably having 1 to 8 carbon atoms), arylthio group (preferably having 6 to 12 carbon atoms) and aryl group having any of these groups as a substituent (the number of carbon atoms of the aryl moiety is preferably in the range of 6 to 12). The hydroxyl group may be protected with a silyl group. For example, a trimethylsilyloxy group, t-butyldimethylsilyloxy group, triphenylsilyloxy group, triethylsilyloxy group or phenyldimethylsilyloxy group can be mentioned as the electron-donating group.

When $Y_3$ represents an organic group comprising a carbon to carbon double bond moiety that has a substituent, the substituent thereof is more preferably, for example, an alkyl group, phenyl group, acyl group, cyano group, alkoxycarbonyl group, carbamoyl group or electron-donating group. Herein, the electron-donating group preferably refers to any of an alkoxy group, hydroxyl group, which may be protected with a silyl group, amino group, alkylamino group, arylamino group, sulfonamido group, active methine group, mercapto group, alkylthio group and phenyl group having any of these electron-donating groups as a substituent, among the substituents mentioned above.

When the carbon to carbon double bond moiety has a hydroxyl group as a substituent, $Y_3$ contains a partial structure of the formula $>C_1{=}{=}C_2(-OH)-$. This may be tautomerized into a partial structure of the formula $>C_1H-C_2(=O)-$. Further, in this structure, it is preferred that the substituent on $C_1$ carbon be an electron-withdrawing group. In this instance, $Y_3$ has a partial structure of "active methylene group" or "active methine group". The electron-withdrawing groups capable of providing this partial structure of active methylene group or active methine group are the same as mentioned in the above description of "active methine groups".

When $Y_3$ represents an organic group having a carbon to carbon triple bond moiety that has a substituent, the substituent is preferably, for example, an alkyl group, phenyl group, alkoxycarbonyl group, carbamoyl group or electron-donating group. Herein, the electron-donating group preferably refers to any of an alkoxy group, amino group, alkylamino group, arylamino group, heterocyclic amino group, sulfonamido group, acylamino group, active methine group, mercapto group, alkylthio group and phenyl group having any of these electron-donating groups as a substituent.

When $Y_3$ represents an organic group having an aromatic group moiety, the aromatic group is preferably an indole ring group or an aryl group (especially preferably a phenyl group) having an electron-donating group as a substituent. Herein, the electron-donating group preferably refers to a hydroxyl group, which may be protected with a silyl group, alkoxy group, amino group, alkylamino group, active methine group, sulfonamido group or mercapto group.

When $Y_3$ represents an organic group having a nonaromatic heterocyclic group of benzo condensed rings, the nonaromatic heterocyclic group of benzo condensed rings is preferably one having an aniline structure as an internal partial structure, which can be, for example, an indoline ring group, 1,2,3,4-tetrahydroquinoline ring group, 1,2,3,4-tetrahydroquinoxaline ring group or 4-quinolone ring group.

In the general formula (D), the reactive group represented by $Y_3$ is more preferably an organic group containing a carbon to carbon double bond moiety, aromatic group moiety or nonaromatic heterocyclic group of benzo condensed rings. Still more preferably, the reactive group is an organic group having a carbon to carbon double bond moiety, phenyl group having an electron-donating group as a substituent, indole ring group, or nonaromatic heterocyclic group of benzo condensed rings having an aniline structure as an internal partial structure. Herein, it is more preferred that the carbon to carbon double bond moiety have at least one electron-donating group as a substituent.

When the reactive group represented by $Y_3$ of the general formula (D) has the same partial structure as that of the reducing group represented by $RED_3$ of the general formula (D) as a result of selection within the range described hereinbefore, also, preferred examples of the compounds of the general formula (D) are provided thereby.

In the general formula (D), $L_3$ represents a linking group which links between $RED_3$ and $Y_3$. For example, $L_3$ represents a group consisting of each of, or each of combinations of, a single bond, alkylene group, arylene group, heterocyclic group, —O—, —S—, $-NR_N-$, —C(=O)—, $-SO_2-$, —SO— and —P(=O)—. Herein, $R_N$ represents a hydrogen atom, alkyl group, aryl group or heterocyclic group. The linking group represented by $L_3$ may have a substituent. The substituent can be any of those mentioned hereinbefore as substituents which may be had by $RED_{11}$ of the general formula (A). The linking group represented by $L_3$ can engage in linkage by replacing one arbitrary hydrogen atom of each of the groups represented by $RED_3$ and $L_3$ at an arbitrary position thereof.

The linking group represented by $L_3$ of the general formula (D) is preferably such that, when the cationic radical species ($X^{+}$.) formed as a result of oxidation of $RED_3$ of the general formula (D) or radical species (X.) formed through splitting of proton therefrom reacts with the reactive group represented by $Y_3$ of the general formula (D) to thereby form a bond, the relevant atomic groups engaging therein can form a 3- to 7-membered cyclic structure including $L_3$. From this viewpoint, it is preferred that the radical species ($X^{+}$. or X.), the reactive group represented by $Y_3$ and the group $L_3$ be linked to each other by a group of 3 to 7 atoms.

As a preferred example of $L_3$, there can be mentioned a divalent linking group selected from a single bond, alkylene group (especially methylene, ethylene or propylene), an arylene group (especially phenylene), —C(=O)— group, —O— group, —NH— group, —N(alkyl group)— group and combinations thereof.

Among the compounds of the general formula (D), preferred compounds are represented by the following general formulae (D-1) to (D-4):

(D-1)

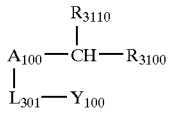

(D-2)

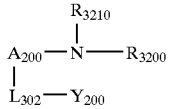

(D-3)

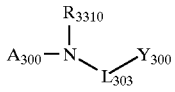

(D-4)

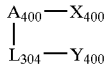

In the general formulae (D-1) to (D-4), each of $A_{100}$, $A_{200}$ and $A_{400}$ represents an arylene group or divalent heterocyclic group, and $A_{300}$ represents an aryl group or a heterocyclic group. The preferred range thereof is the same as that of $RED_3$ of the general formula (D). Each of $L_{301}$, $L_{302}$, $L_{303}$ and $L_{304}$ represents a linking group. With respect to these, not only the meanings but also the preferred ranges thereof are the same as those of $L_3$ of the general formula (D). Each of $Y_{100}$, $Y_{200}$, $Y_{300}$ and $Y_{400}$ represents a reactive group. With respect to these, not only the meanings but also the preferred ranges thereof are the same as those of $Y_3$ of the general formula (D). Each of $R_{3100}$, $R_{3110}$, $R_{3200}$, $R_{3210}$ and $R_{3310}$ represents a hydrogen atom or substituent. Each of $R_{3100}$ and $R_{3110}$ preferably represents a hydrogen atom, alkyl group or aryl group. Each of $R_{3200}$ and $R_{3310}$ preferably represents a hydrogen atom. $R_{3210}$ preferably represents a substituent. This substituent is preferably an alkyl group or aryl group. $R_{3110}$ and $A_{100}$; $R_{3210}$ and $A_{200}$; $R_{3310}$ and $A_{300}$ may be bonded with each other to thereby form a cyclic structure. The thus formed cyclic structure is preferably, for example, a tetralin ring, indane ring, tetrahydroquinoline ring or indoline ring. $X_{400}$ represents a hydroxyl group, mercapto group or alkylthio group, preferably represents a hydroxyl group or mercapto group, and more preferably represents a mercapto group.

Among the compounds of the general formulae (D-1) to (D-4), the compounds of the general formulae (D-2), (D-3) and (D-4) are preferred. The compounds of the general formulae (D-2) and (D-3) are more preferred.

The electron-releasing compound of Type 4 will be described below.

The electron-releasing compound of Type 4 is a compound having a circular structure substituted with a reducing group, which compound can undergo a one-electron oxidation of the reducing group and thereafter a cleavage reaction of the circular structure to thereby further release one or more electrons.

In the compound of Type 4, the cyclic structure is cleaved after a one-electron oxidation. Herein, the cyclic cleavage reaction refers to the following scheme of reaction:

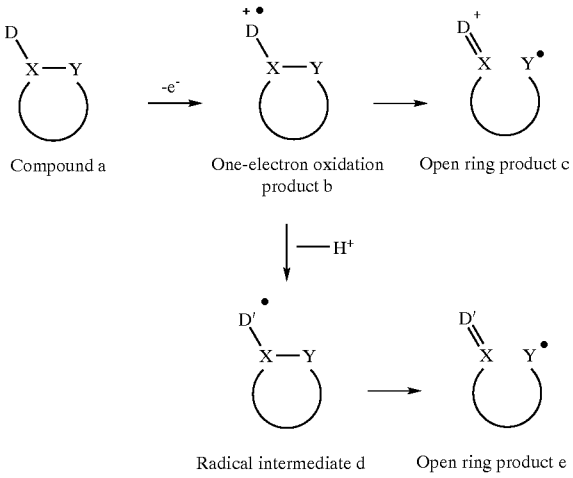

In the formulae, the compound (a) represents a compound of Type 4. In the compound (a), D represents a reducing group, and X and Y represent atoms forming a bond of the circular structure which is cleaved after a one-electron oxidation. First, the compound (a) undergoes a one-electron oxidation to thereby form a one-electron oxidation product (b). Then, the D—X single bond is converted to a double bond, and simultaneously the X—Y bond is cleaved to thereby form an open-ring product (c). An alternative route wherein a proton is split from the one-electron oxidation product (b) to thereby form a radical intermediate (d), from which an open-ring product (e) is similarly formed, may be taken. One or more electrons are further released from the thus formed open-ring product (c) or (e). The characteristic of this compound of the present invention resides in this respect.

The cyclic structure of the compound of Type 4 refers to a nonaromatic, saturated or unsaturated, monocyclic or condensed-ring, 3- to 7-membered carbon ring or heterocycle. A saturated cyclic structure is preferred, and a 3- or 4-membered ring is more preferred. As preferred cyclic structures, there can be mentioned a cyclopropane ring, cyclobutane ring, oxirane ring, oxetane ring, aziridine ring, azetidine ring, episulfide ring and thietane ring. Of these, a cyclopropane ring, cyclobutane ring, oxirane ring, oxetane ring and azetidine ring are preferred. A cyclopropane ring, cyclobutane ring and azetidine ring are more preferred. The cyclic structure may have a substituent.

Now, the reducing group will be described. Herein, the reducing group refers to an organic group. As representative reducing groups, there can be mentioned an amino group, alkylamino group (e.g., methylamino or diethylamino), arylamino group (e.g., phenylamino or diphenylamino), heterocyclic amino group (e.g., benzothiazolylamino or pyrrolylamino), alkylthio group (e.g., methylthio), arylthio group (e.g., 1-naphthylthio), heterocyclic thio group (e.g., 2-pyridylthio), aryloxy group (e.g., phenoxy), aryl group (e.g., phenyl, naphthyl or anthracenyl), aromatic or nonaromatic heterocyclic group (as the heterocycle, there can be mentioned, for example, a tetrahydroquinoline ring, tetrahydroisoquinoline ring, tetrahydroquinoxaline ring, tetrahydroquinazoline ring, indoline ring, indole ring, indazole ring, carbazole ring, phenoxazine ring, phenothiazine ring, benzothiazoline ring, pyrrole ring, imidazole ring, thiazoline ring, piperidine ring, pyrrolidine ring, morpholine ring, benzimidazole ring, benzimidazoline ring, benzoxazoline ring or 3,4-methylenedioxyphenyl ring), active methine group (which refers to a methine group substituted with two electron-withdrawing groups; herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and imino group; and these two electron-withdrawing groups may be bonded with each other to thereby form a circular structure) and a group containing a trivalent phosphorus atom (e.g., $Ph_2P$— or $(EtO)_2P$—). These reducing groups may each have a substituent. It is preferred that the sum of nitrogen and carbon atoms thereof including those of the substituent be in the range of 1 to 50.

The compound of Type 4 is preferably represented by the general formula (E) or (F).

General formula (E):

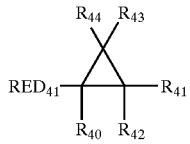

(E)

General formula (F):

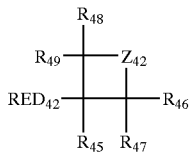

(F)

With respect to $RED_{41}$ and $RED_{42}$ of the general formulae (E) and (F), not only the meanings but also the preferred ranges thereof are the same as those of $RED_{12}$ of the general formula (B). Each of $R_{40}$ to $R_{44}$ and $R_{45}$ to $R_{49}$ represents a hydrogen atom or substituent. The substituent can be any of those which may be had by $RED_{12}$. In the general formula (F), $Z_{42}$ represents —$CR_{420}R_{421}$—, —$NR_{423}$— or —O—. Each of $R_{420}$ and $R_{421}$ represents a hydrogen atom or substituent, and $R_{423}$ represents a hydrogen atom, alkyl group, aryl group or heterocyclic group.

In the general formula (E), $R_{40}$ preferably represents any of a hydrogen atom, alkyl group, alkenyl group, alkynyl group, aryl group, heterocyclic group, alkoxy group, amino group, alkylamino group, arylamino group, heterocyclic amino group, alkoxycarbonyl group, acyl group, carbamoyl group, cyano group and sulfamoyl group. Of these, a hydrogen atom, alkyl group, aryl group, heterocyclic group, alkoxy group, alkoxycarbonyl group, acyl group and carbamoyl group are more preferred. A hydrogen atom, alkyl group, aryl group, heterocyclic group, alkoxycarbonyl group and carbamoyl group are most preferred.

With respect to $R_{41}$ to $R_{44}$, it is preferred that at least one thereof be a donating group. It is also preferred that $R_{41}$ and $R_{42}$; or $R_{43}$ and $R_{44}$ be simultaneously electron-withdrawing groups. More preferably, at least one of $R_{41}$ to $R_{44}$ is a donating group. Most preferably, at least one of $R_{41}$ to $R_{44}$ is a donating group while, among $R_{41}$ to $R_{44}$, nondonating group or groups are a hydrogen atom or alkyl group.

Herein, the donating group refers to a hydroxyl group, alkoxy group, aryloxy group, mercapto group, acylamino group, sulfonylamino group, active methine group, or group selected from preferred examples of the $RED_{41}$ and $RED_{42}$ groups. As the donating group, there can preferably be used any of an alkylamino group, arylamino group, heterocyclic amino group, 5-membered aromatic heterocyclic group having one nitrogen atom in its ring, which may be monocyclic or in the form of condensed rings, a nonaromatic nitrogen-containing heterocyclic group that is bonded to the carbon atom of the general formula (E) via its nitrogen atom and phenyl group substituted with at least one electron-donating group, wherein the donating group refers to a hydroxyl group, alkoxy group, aryloxy group, amino group, alkylamino group, arylamino group, heterocyclic amino group or nonaromatic nitrogen-containing heterocyclic group that is bonded to the carbon atom of the general formula (E) via its nitrogen atom). Of these, an alkylamino group, arylamino group, 5-membered aromatic heterocyclic group having one nitrogen atom in its ring, wherein the aromatic heterocycle refers to an indole ring, pyrrole ring or carbazole ring, and a phenyl group substituted with at least one electron-donating group, in particular, a phenyl group substituted with 3 or more alkoxy groups or a phenyl group substituted with a hydroxyl group, alkylamino group or arylamino group, are more preferred. An arylamino group, 5-membered aromatic heterocyclic group having one nitrogen atom in its ring, wherein the 5-membered aromatic heterocyclic group represents a 3-indolyl group, and a phenyl group substituted with at least one electron-donating group, in particular, a trialkoxyphenyl group or a phenyl group substituted with an alkylamino group or arylamino group, are most preferred. The electron-withdrawing groups are the same as those mentioned in the above description of active methine group.

In the general formula (F), the preferred range of $R_{45}$ is the same as described above with respect to $R_{40}$ of the general formula (E). Each of $R_{46}$ to $R_{49}$ preferably represents any of a hydrogen atom, alkyl group, alkenyl group, alkynyl group, aryl group, heterocyclic group, hydroxyl group, alkoxy group, amino group, alkylamino group, arylamino group, heterocyclic amino group, mercapto group, arylthio group, alkylthio group, acylamino group and sulfonamino group. Of these, a hydrogen atom, alkyl group, aryl group, heterocyclic group, alkoxy group, alkylamino group, arylamino group and heterocyclic amino group are more preferred. Most preferably, each of $R_{46}$ to $R_{49}$ represents a hydrogen atom, alkyl group, aryl group, heterocyclic group, alkylamino group or arylamino group when $Z_{42}$ represents a group of the formula —$CR_{420}R_{421}$—; represents a hydrogen atom, alkyl group, aryl group or heterocyclic group when $Z_{42}$ represents a —$NR_{423}$—; and represents a hydrogen atom, alkyl group, aryl group or heterocyclic group when $Z_{42}$ represents —O—.

$Z_{42}$ preferably represents —$CR_{420}R_{421}$— or —$NR_{423}$—, and more preferably represents —$NR_{423}$—. Each of $R_{420}$ and $R_{421}$ preferably represents any of a hydrogen atom, alkyl group, alkenyl group, alkynyl group, aryl group, heterocyclic group, hydroxyl group, alkoxy group, amino group, mercapto group, acylamino group and sulfonamino group. Of these, a hydrogen atom, alkyl group, aryl group, heterocyclic group, alkoxy group and amino group are more preferred. $R_{423}$ preferably represents a hydrogen atom, alkyl group, aryl group or aromatic heterocyclic group, and more preferably represents methyl, ethyl, isopropyl, t-butyl, t-amyl, benzyl, diphenylmethyl, allyl, phenyl, naphthyl, 2-pyridyl, 4-pyridyl or 2-thiazolyl.

When each of $R_{40}$ to $R_{49}$, $R_{420}$, $R_{421}$ and $R_{423}$ represents a substituent, the total number of carbon atoms of each thereof is preferably 40 or less, more preferably 30 or less, and most preferably 15 or less. These substituents may be bonded with each other or bonded with other moieties (e.g., $RED_{41}$, $RED_{42}$ or $Z_{42}$) of the molecule to thereby form rings.

It is preferred that the compounds of types 1, 3 and 4 according to the present invention be "compounds each having in its molecule an adsorptive group acting on silver halides" or "compounds each having in its molecule a partial structure of spectral sensitizing dye. More preferably, the compounds of types 1, 3 and 4 according to the present invention are "compounds each having in its molecule an adsorptive group acting on silver halides". The compound of Type 2 is a "compound having in its molecule two or more adsorptive groups acting on silver halides". The compounds of types 1 to 4 are more preferably "compounds having each a nitrogen-containing heterocyclic group substituted with two or more mercapto groups as an adsorptive group".

With respect to the compounds of types 1 to 4 according to the present invention, the adsorptive group acting on silver halides refers to a group directly adsorbed onto silver halides or a group capable of promoting the adsorption onto silver halides. For example, the adsorptive group is a mercapto group (or a salt thereof), thione group (—C(=S)—), heterocyclic group containing at least one atom selected from a nitrogen atom, sulfur atom, selenium atom and tellurium atom, sulfido group, cationic group or ethynyl group. Provided however that, with respect to the compound of Type 2 according to the present invention, a sulfido group is not included in the adsorptive groups thereof.

The terminology "mercapto group (or a salt thereof)" as the adsorptive group means not only a mercapto group (or a salt thereof) per se but also, preferably, a heterocyclic, aryl or alkyl group substituted with at least one mercapto group (or salt thereof). Herein, the heterocyclic group refers to a 5- to 7-membered, monocyclic or condensed-ring, aromatic or nonaromatic heterocycle. As the heterocyclic group, there can be mentioned, for example, an imidazole ring group, thiazole ring group, oxazole ring group, benzimidazole ring group, benzothiazole ring group, benzoxazole ring group, triazole ring group, thiadiazole ring group, oxadiazole ring group, tetrazole ring group, purine ring group, pyridine ring group, quinoline ring group, isoquinoline ring group, pyrimidine ring group or triazine ring group. The heterocyclic group may be one containing a quaternary nitrogen atom, which may become a mesoion as a result of dissociation of a substituted mercapto group. This heterocyclic group can be, for example, any of an imidazolium ring group, pyrazolium ring group, thiazolium ring group, triazolium ring group, tetrazolium ring group, thiadiazolium ring group, pyridinium ring group, pyrimidinium ring group and triazinium ring group. Of these groups, a triazolium ring group (e.g., 1,2,4-triazolium-3-thiolate ring group) is preferred. The aryl group can be, for example, a phenyl group or naphthyl group. The alkyl group can be a linear, or branched, or cyclic alkyl group having 1 to 30 carbon atoms. When the mercapto group forms a salt, as the counter ion, there can be mentioned, for example, a cation of alkali metal, alkaline earth metal or heavy metal (e.g., $Li^+$, $Na^+$, $K^+$, $Mg^{2+}$, $Ag^+$ or $Zn^{2+}$), an ammonium ion, a heterocyclic group containing a quaternary nitrogen atom, or a phosphonium ion.

The mercapto group as the adsorptive group may further be tautomerized into a thione group. As such, there can be mentioned, for example, a thioamido group (herein a —C(═S)—NH— group) or a group containing a partial structure of the thioamido group, namely, a linear or cyclic thioamido group, thioureido group, thiourethane group or dithiocarbamic acid ester group. As examples of suitable cyclic groups, there can be mentioned, for example, a thiazolidine-2-thione group, oxazolidine-2-thione group, 2-thiohydantoin group, rhodanine group, isorhodanine group, thiobarbituric acid group and 2-thioxo-oxazolidin-4-one group.

The thione groups as the adsorptive group include not only the above thione groups resulting from tautomerization of mercapto groups but also a linear or cyclic thioamido group, thioureido group, thiourethane group and dithiocarbamic acid ester group which cannot be tautomerized into mercapto groups, i.e., not having any hydrogen atom at the α-position of thione group.

The heterocyclic group containing at least one atom selected from a nitrogen atom, sulfur atom, selenium atom and tellurium atom as the adsorptive group is a nitrogen-containing heterocyclic group having an —NH— group capable of forming an iminosilver (>NAg) as a partial structure of the heterocycle, or a heterocyclic group having an "—S—" group or "—Se—" group or "—Te—" group or "═N—" group capable of coordinating to silver ion by coordinate bond as a partial structure of the heterocycle. The former heterocyclic group can be, for example, a benzotriazole group, triazole group, indazole group, pyrazole group, tetrazole group, benzimidazole group, imidazole group or purine group. The latter heterocyclic group can be, for example, a thiophene group, thiazole group, oxazole group, benzothiazole group, benzoxazole group, thiadiazole group, oxadiazole group, triazine group, selenoazole group, benzoselenoazole group, tellurazole group or benzotellurazole group. The former heterocyclic group is preferred.

As the sulfido group as the adsorptive group, there can be mentioned all the groups having a partial structure of "—S—". Preferably, the sulfido group is a group having a partial structure of alkyl (or alkylene) —S-alkyl (or alkylene), aryl (or arylene)—S-alkyl (or alkylene), or aryl (or arylene)—S-aryl(or arylene). This sulfido group may be in the form of a cyclic structure or —S—S— group. As examples of sulfido groups forming a cyclic structure, there can be mentioned groups containing a thiolane ring, 1,3-dithiolane ring, 1,2-dithiolane ring, thiane ring, dithiane ring, tetrahydro-1,4-thiazine ring (thiomorpholine ring) or the like. Among the sulfido groups, groups having a partial structure of alkyl (or alkylene)—S-alkyl (or alkylene) are especially preferred.

The cationic group as the adsorptive group refers to a group containing a quaternary nitrogen atom. For example, it is a group containing an ammonio group or a nitrogen-containing heterocyclic group containing a quaternary nitrogen atom. However, the cationic group does not become part of an atomic group forming a dye structure (for example, cyanine chromophore). Herein, the ammonio group is, for example, a trialkylammonio group, dialkylarylammonio group or alkyldiarylammonio group. For example, as such, there can be mentioned benzyldimethylammonio group, trihexylammonio group or phenyldiethylammonio group. The nitrogen-containing heterocyclic group containing a quaternary nitrogen atom can be, for example, any of pyridinio group, quinolinio group, isoquinolinio group and imidazolio group. Of these, pyridinio group and imidazolio group are preferred. A pyridinio group is most preferred. The nitrogen-containing heterocyclic group containing a quaternary nitrogen atom may have an arbitrary substituent. However, when the nitrogen-containing heterocyclic group is a pyridinio group or imidazolio group, the substituent is preferably selected from, for example, an alkyl group, aryl group, acylamino group, chlorine atom, alkoxycarbonyl group and carbamoyl group. When the nitrogen-containing heterocyclic group is a pyridinio group, the substituent is most preferably a phenyl group.

The ethynyl group as the adsorptive group refers to a —C≡CH group, whose hydrogen atom may be replaced by a substituent.

The above adsorptive groups may have an arbitrary substituent.

Furthermore, examples of suitable adsorptive groups include those listed on pages 4 to 7 of Jpn. Pat. Appln. KOKAI Publication No. (hereinafter referred to as JP-A-) 11-95355, (U.S. Pat. No. 6,054,260.

In the present invention, it is preferred that the adsorptive group be a nitrogen-containing heterocyclic group substituted with mercapto (e.g., a 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazolium-3-thiolate group), or a nitrogen-containing heterocyclic group having an —NH— group capable of forming an iminosilver (>NAg) as a partial structure of the heterocycle (e.g., a benzotriazole group, benzimidazole group or indazole group). More preferably, the adsorptive group is a 5-mercaptotetrazole group, 3-mercapto-1,2,4-triazole group or benzotriazole group. Most preferably, the adsorptive group is a 3-mercapto-1,2,4-triazole group or 5-mercaptotetrazole group.

Among the compounds of the present invention, those having, in the molecule thereof, two or more mercapto groups as a partial structure are also especially preferred. Herein, the mercapto group (—SH) may become a thione group when it can be tautomerized. Examples of such compounds may include a compound possessing in its molecule two or more adsorptive groups having the above mercapto group or thione group as a partial structure (e.g., a ring forming thioamido group, alkylmercapto group, arylmercapto group or heterocyclic mercapto group), and a compound possessing at least one adsorptive group having, in the adsorptive group per se, two or more mercapto groups or thione groups as a partial structure (e.g., a dimercapto-substituted nitrogen-containing heterocyclic group).

As examples of adsorptive groups having two or more mercapto groups as a partial structure (e.g., dimercapto-substituted nitrogen-containing heterocyclic groups), there can be mentioned a 2,4-dimercaptopyrimidine group, 2,4-dimercaptotriazine group, 3,5-dimercapto-1,2,4-triazole group, 2,5-dimercapto-1,3-thiazole group, 2,5-dimercapto-1,3-oxazole group, 2,7-dimercapto-5-methyl-s-triazolo(1,5-a)pyrimidine group, 2,6,8-trimercaptopurine group, 6,8-dimercaptopurine group, 3,5,7-trimercapto-s-triazolotriazine group, 4,6-dimercaptopyrazolopyrimidine group and 2,5-dimercaptoimidazole group. Of these, a 2,4-dimercaptopyrimidine group, 2,4-dimercaptotriazine group and 3,5-dimercapto-1,2,4-triazole group are especially preferred.

Although substitution with the adsorptive group may be effected at any position of the general formulae (A) to (F) and general formulae (1) to (3), it is preferred that the substitution be effected at $RED_{11}$, $RED_{12}$, $RED_2$ and $RED_3$ in the general formulae (A) to (D); at $RED_{41}$, $R_{41}$, $RED_{42}$ and $R_{46}$ to $R_{48}$ in the general formulae (E) and (F); and at any arbitrary position except $R_1$, $R_2$, $R_{11}$, $R_{12}$, $R_{31}$, $L_1$, $L_{21}$ and $L_{31}$ in the general formulae (1) to (3). It is more preferred that, in all the general formulae (A) to (F), the substitution be effected at $RED_{11}$ to $RED_{42}$.

The partial structure of spectral sensitizing dye refers to a group containing a chromophore of spectral sensitizing dye, and refers to a residue resulting from removal of an arbitrary hydrogen atom or substituent from a spectral sensitizing dye compound. Although substitution with the partial structure of spectral sensitizing dye may be effected at any position of the general formulae (A) to (F) and general formulae (1) to (3), it is preferred that the substitution be effected at $RED_{11}$, $RED_{12}$, $RED_2$ and $RED_3$ in the general formulae (A) to (D); at $RED_{41}$, $R_{41}$, $RED_{42}$ and $R_{46}$ to $R_{48}$ in the general formulae (E) and (F); and at any arbitrary position except $R_1$, $R_2$, $R_{11}$, $R_{12}$, $R_{31}$, $L_1$, $L_{21}$ and $L_{31}$ in the general formulae (1) to (3). It is more preferred that, in all the general formulae (A) to (F), the substitution be effected at $RED_{11}$ to $RED_{42}$. Preferred spectral sensitizing dyes are those typically employed in color sensitization techniques, which include, for example, cyanine dyes, composite cyanine dyes, merocyanine dyes, composite merocyanine dyes, homopolar cyanine dyes, styryl dyes and hemicyanine dyes. Representative spectral sensitizing dyes are disclosed in Research Disclosure, item 36544, September 1994. These spectral sensitizing dyes can be synthesized by persons skilled in the art to which the invention pertains in accordance with the procedure described in the above Research Disclosure or F. M. Hamer "The Cyanine Dyes and Related Compounds", Interscience Publishers, New York, 1964. Further, all the dyes described on pages 7 to 14 of JP-A-11-95355 (U.S. Pat. No. 6,054,260) per se are applicable.

With respect to the compounds of types 1 to 4 according to the present invention, the total number of carbon atoms is preferably in the range of 10 to 60, more preferably 10 to 50, most preferably 11 to 40, and optimally 12 to 30.

With respect to the compounds of types 1 to 4 according to the present invention, a one-electron oxidation thereof is induced upon exposure of the silver halide photographic lightsensitive material wherein use is made of the compounds, followed by reaction. Thereafter, another electron, or two or more electrons depending on the type of compound are released to thereby cause further oxidation. The oxidation potential with respect to the first electron is preferably about 1.4 V or below, more preferably 1.0 V or below. This oxidation potential is preferably higher than 0 V, more preferably higher than 0.3 V. Thus, the oxidation potential is preferably in the range of about 0 to about 1.4 V, more preferably about 0.3 to about 1.0 V.

Herein, the oxidation potential can be measured in accordance with the cyclic voltametry technique. For example, a sample compound is dissolved in a solution consisting of a 80%:20% (vol. %) mixture of acetonitrile and water (containing 0.1 M lithium perchlorate), and nitrogen gas is passed through the solution for 10 min. Thereafter, the oxidation potential is measured at 25° C. and at a potential scanning rate of 0.1 V/sec with the use of a glassy carbon disk as a working electrode, a platinum wire as a counter electrode and a calomel electrode (SCE) as a reference electrode. The oxidation potential vs. SCE is determined at the peak potential of cyclic voltametry wave.

With respect to, among the compounds of types 1 to 4 according to the present invention, those which undergo a one-electron oxidation and, after a subsequent reaction, further release another electron, the oxidation potential at the latter stage is preferably in the range of −0.5 to −2 V, more preferably −0.7 to −2 V, and most preferably −0.9 to −1.6 V.

On the other hand, with respect to, among the compounds of types 1 to 4 according to the present invention, those which undergo a one-electron oxidation and, after a subsequent reaction, further release two or more electrons to thereby effect oxidation, the oxidation potential at the latter stage is not particularly limited. The reason is that the oxidation potential with respect to the second electron cannot be clearly distinguished from the oxidation potential with respect to the third electron et seqq., so that it is often difficult to practically accomplish accurate measuring and distinguishing thereof.

Specific examples of the compounds of types 1 to 4 according to the present invention will be listed below, which however in no way limit the scope of the present invention.

1-1

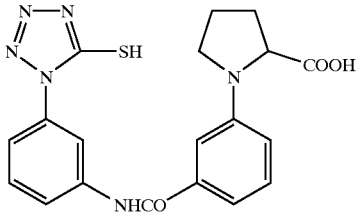

1-2

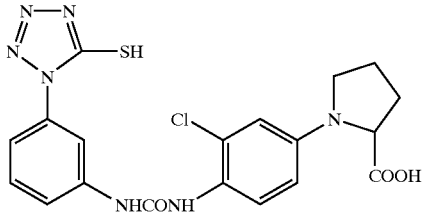

-continued
1-3
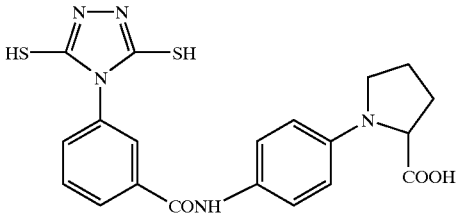
1-4
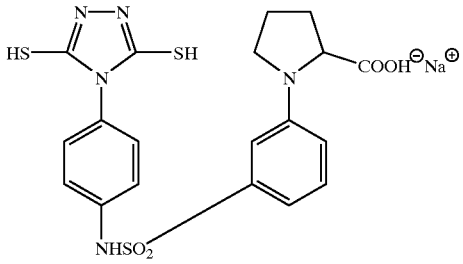
1-5
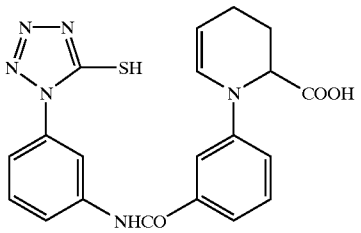
1-6
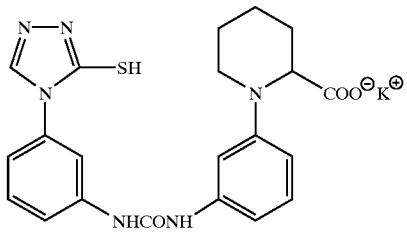
1-7
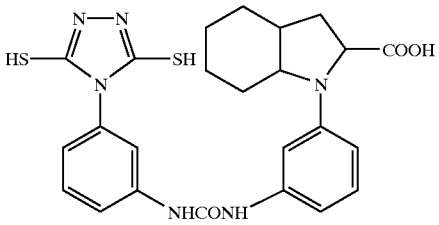
1-8
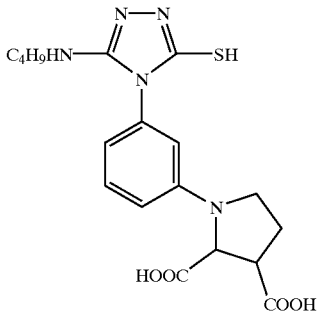
1-9
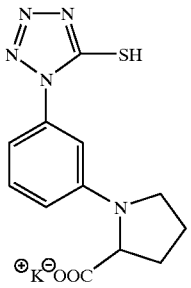
1-10
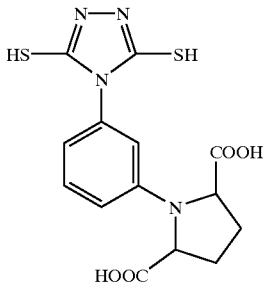
1-11
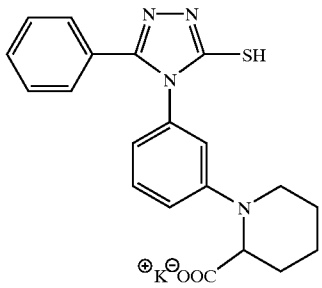
1-12
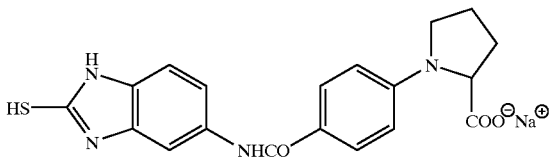

-continued
1-13
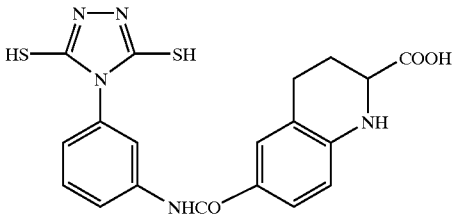
1-14
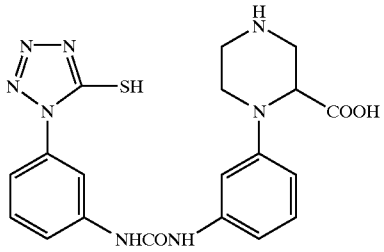
1-15
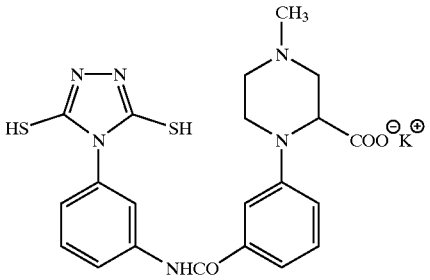
1-16
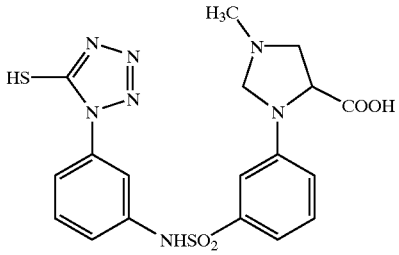
1-17
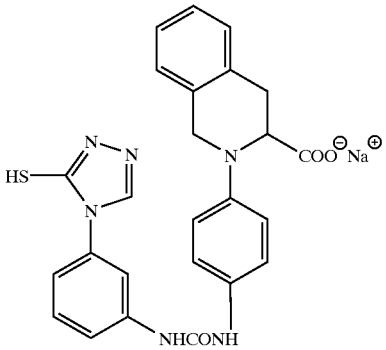
1-18
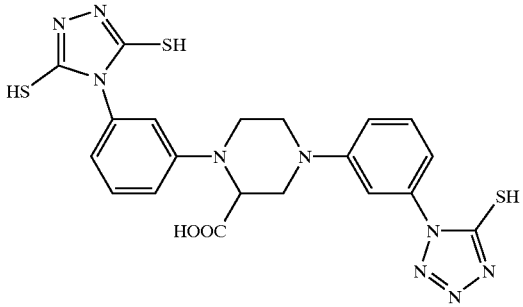
1-19
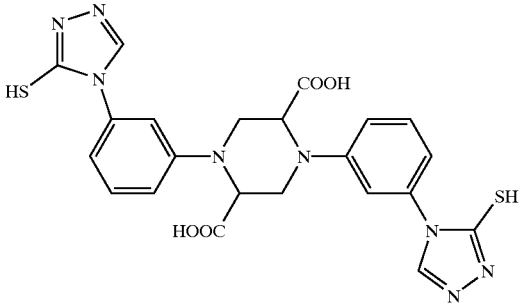
1-20
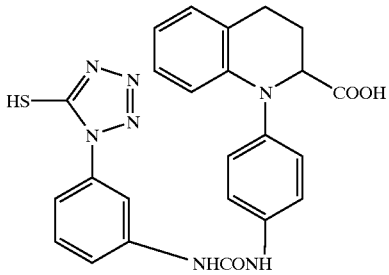
1-21
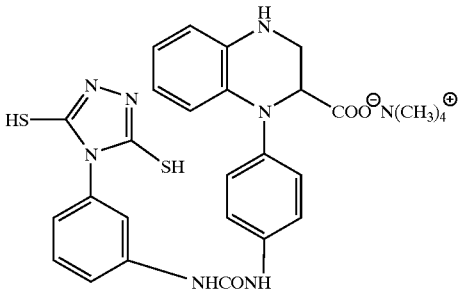
1-22
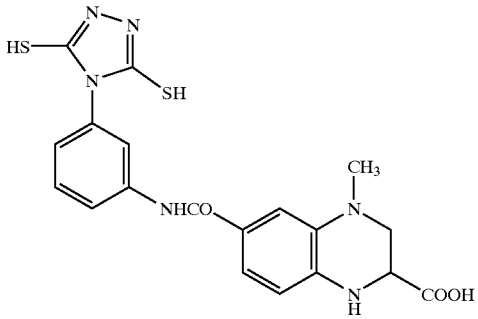

-continued
1-23
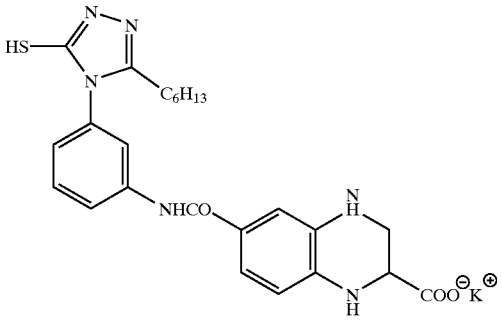
1-24
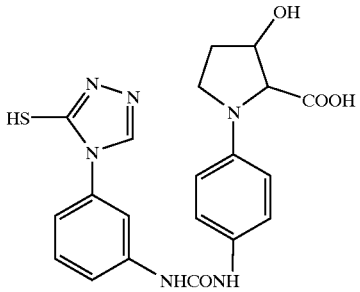
1-25
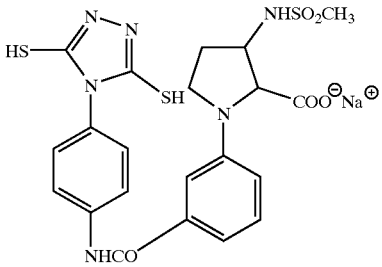
1-26
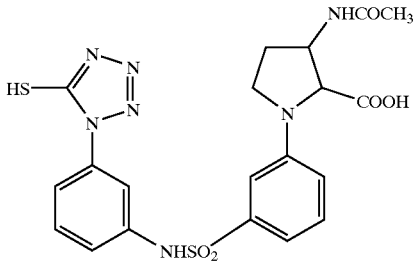
1-27
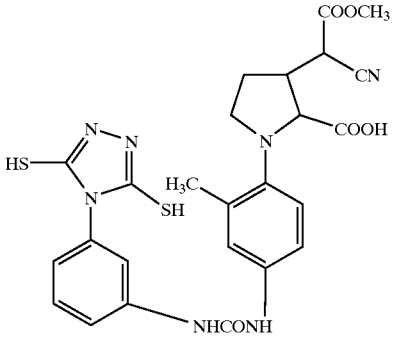
1-28
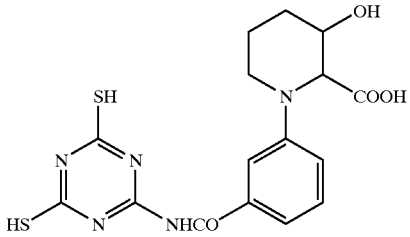
1-29
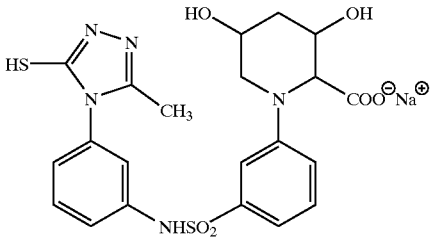
1-30
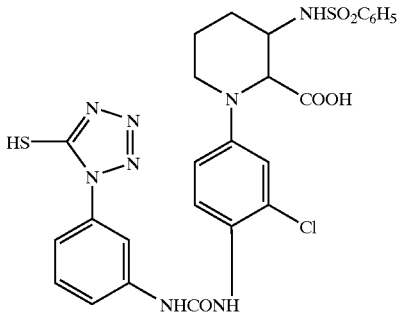
1-31
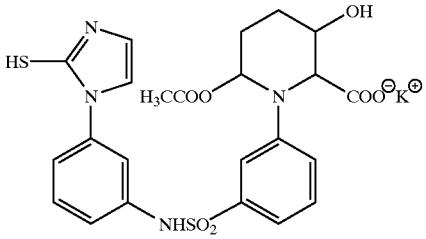
1-32
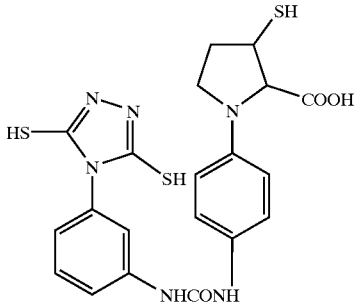

-continued
1-33
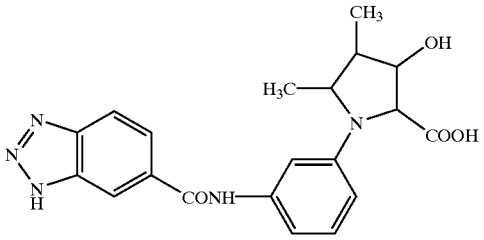
1-34
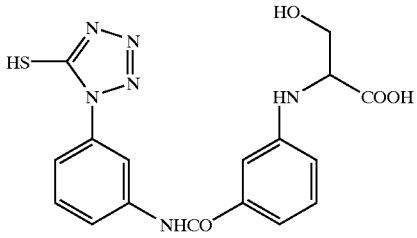
1-35
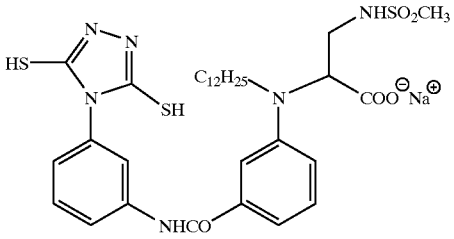
1-36
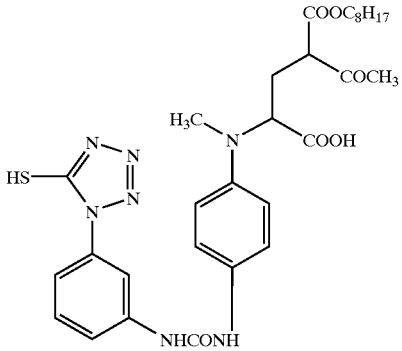
1-37
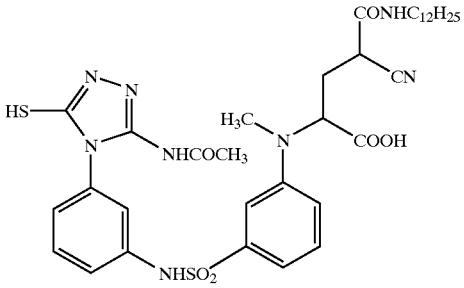
1-38
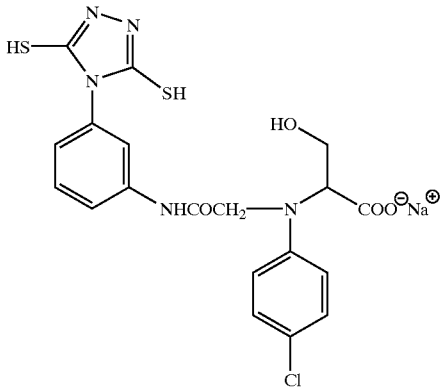
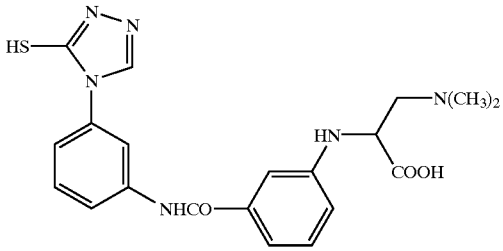
1-40
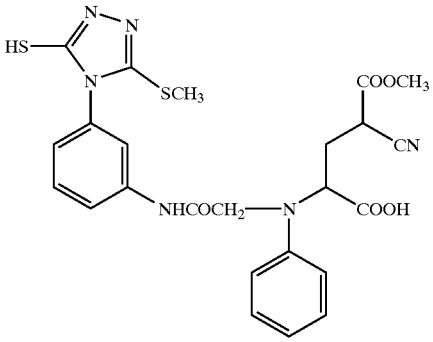

-continued
1-41
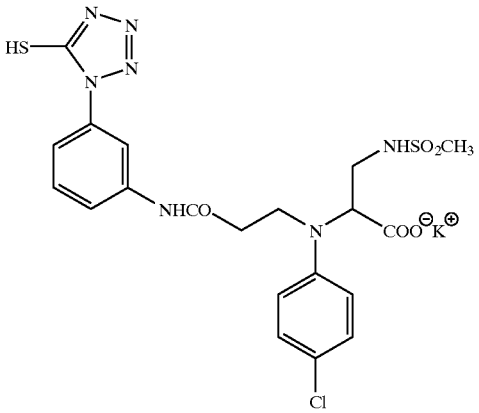
1-42
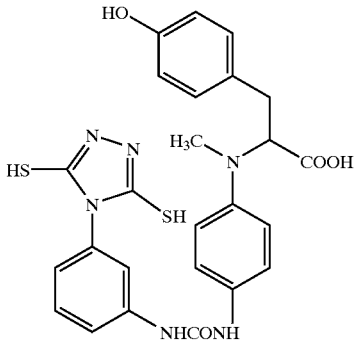
1-43
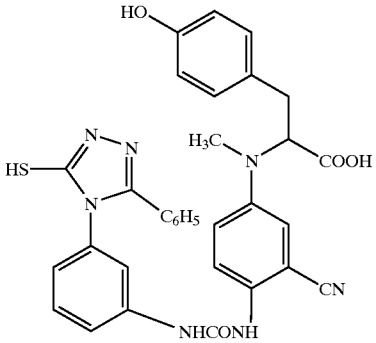
1-44
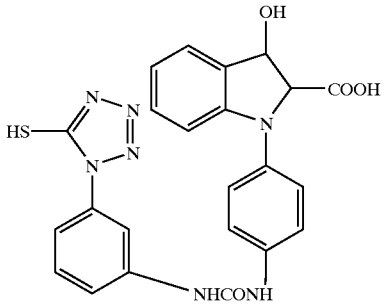
1-45
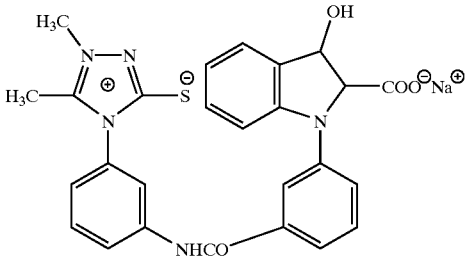
1-46
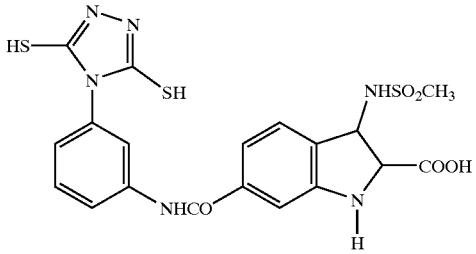
1-47
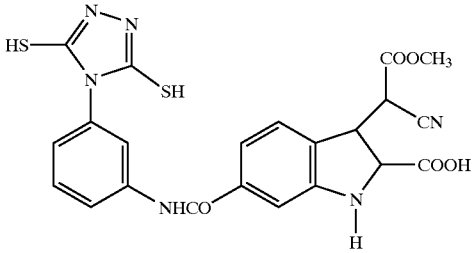
1-48
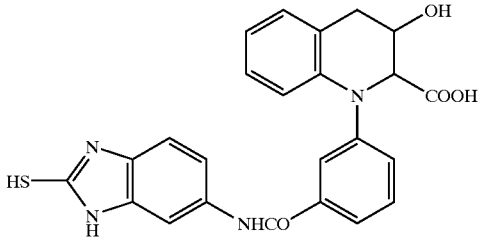
1-49
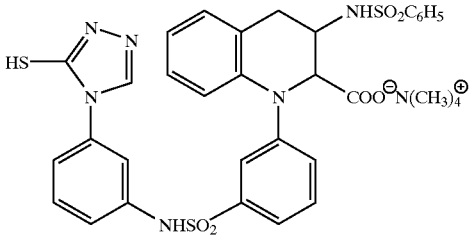
1-50
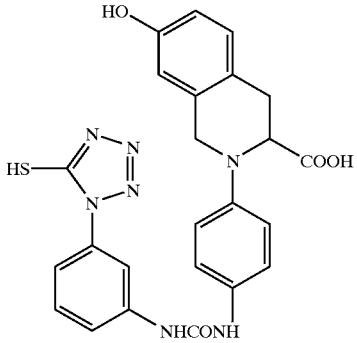

-continued
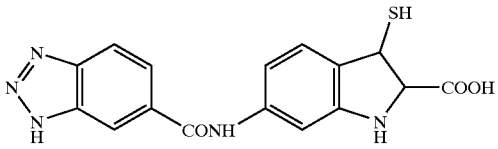
1-51
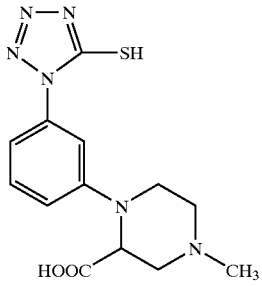
1-52
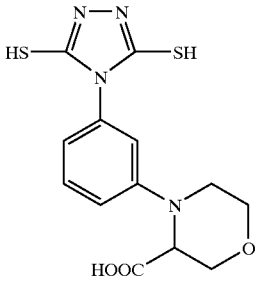
1-53
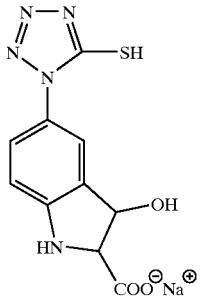
1-54
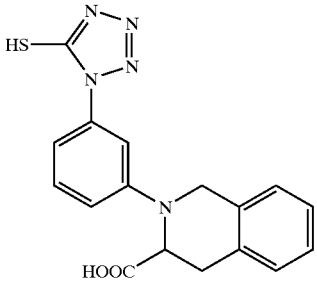
1-55
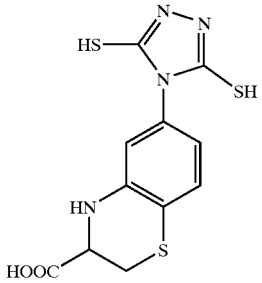
1-56
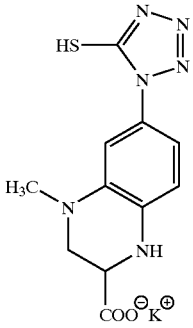
1-57
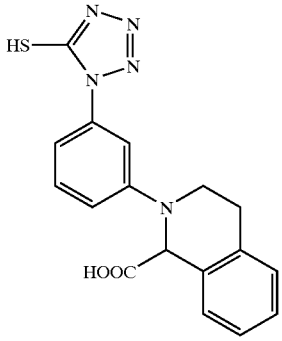
1-58
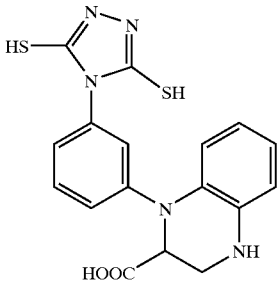
1-59
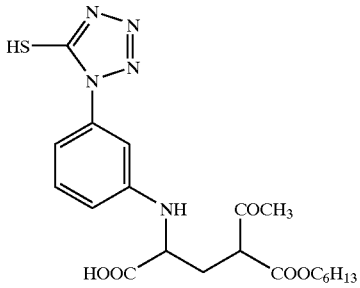
1-60

-continued
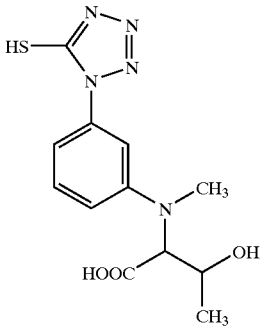
1-61
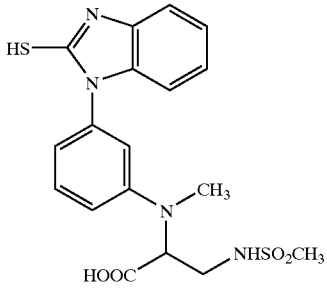
1-62
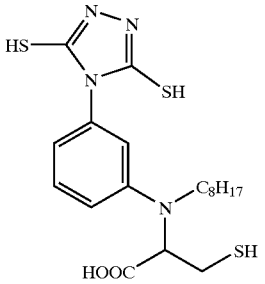
1-63
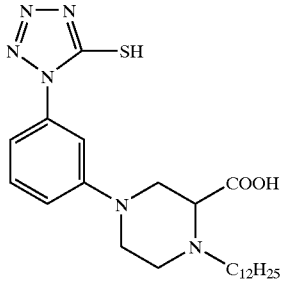
1-64
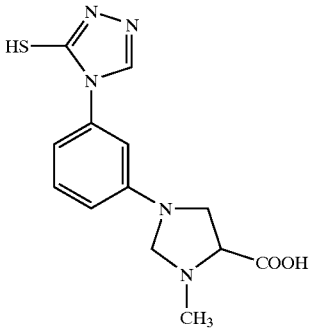
1-65
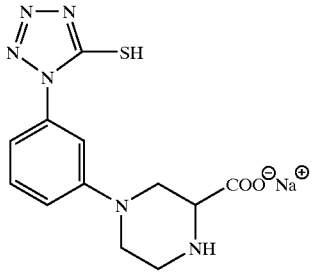
1-66
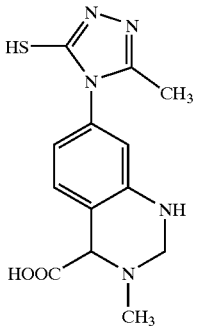
1-67
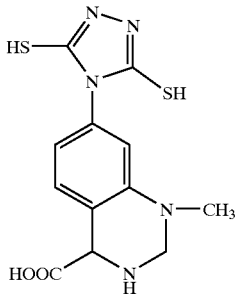
1-68

-continued
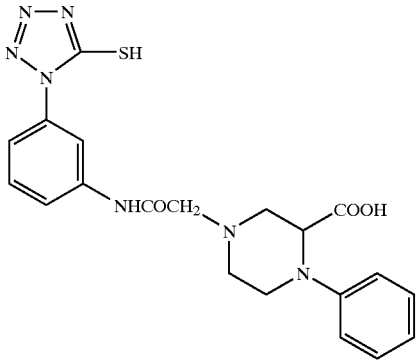
1-69
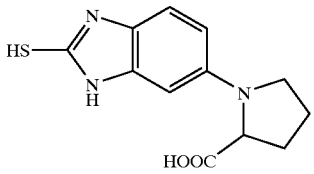
1-70
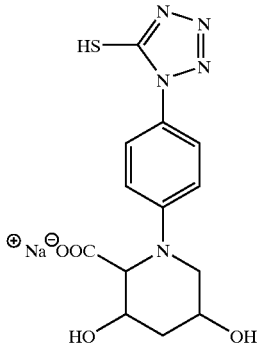
1-71
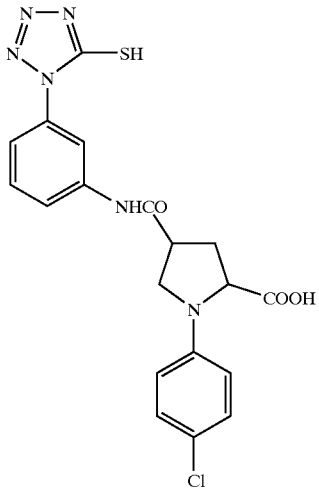
1-72
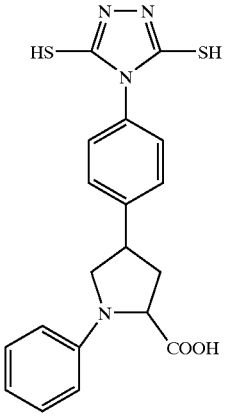
1-73
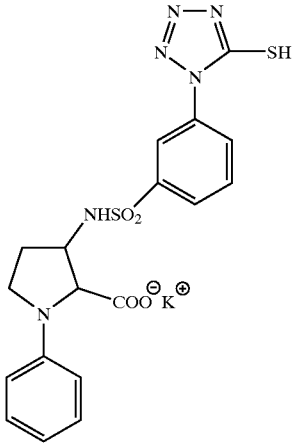
1-74
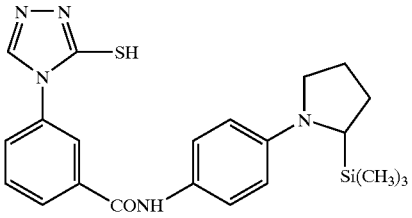
1-75
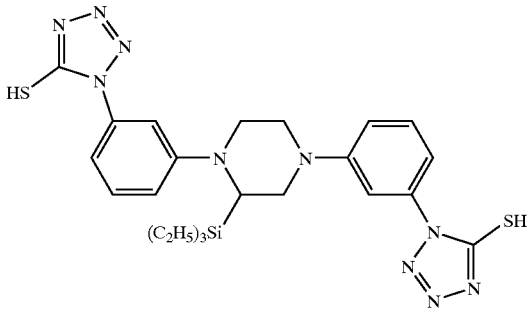
1-76

-continued
1-77
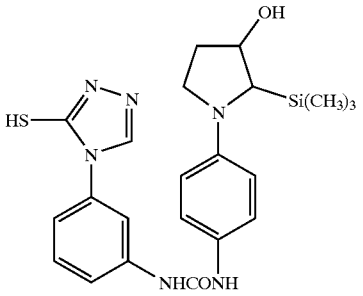
1-78
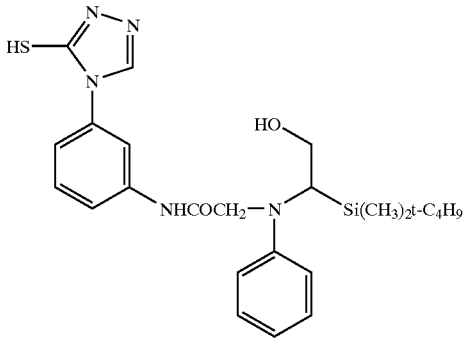
1-79
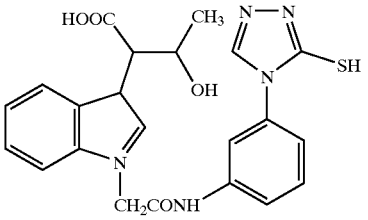
1-80
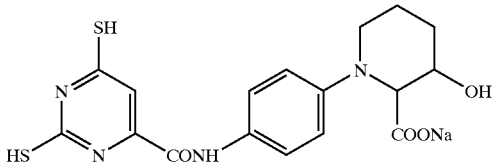
1-81
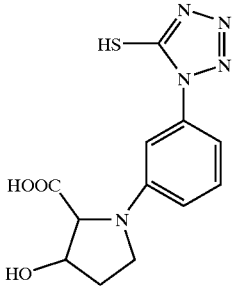
1-82
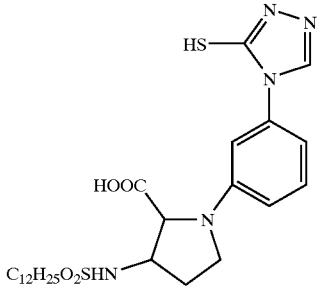
1-83
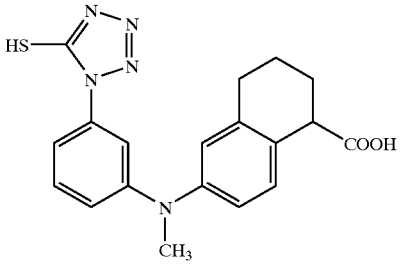
1-84
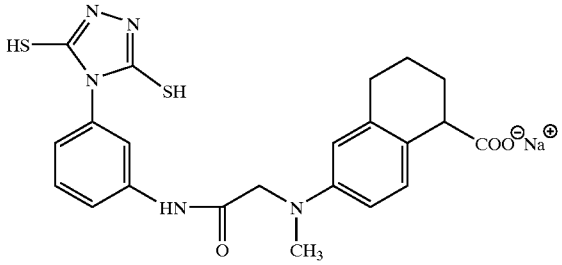
1-85
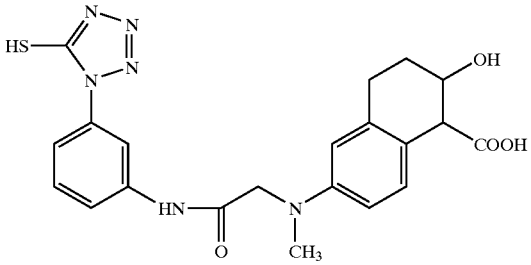
1-86
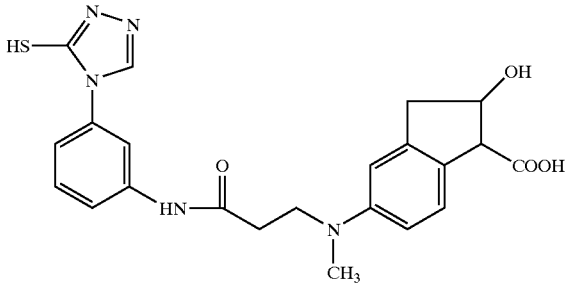

-continued
1-87
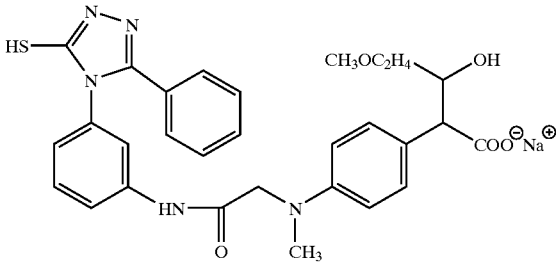
1-88
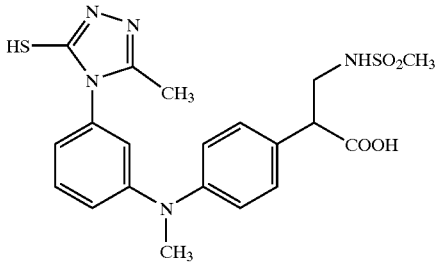
1-89
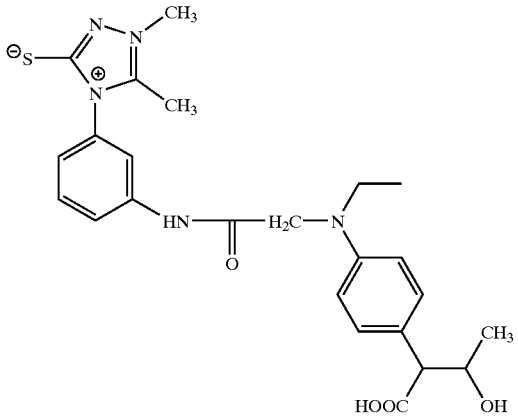
1-90
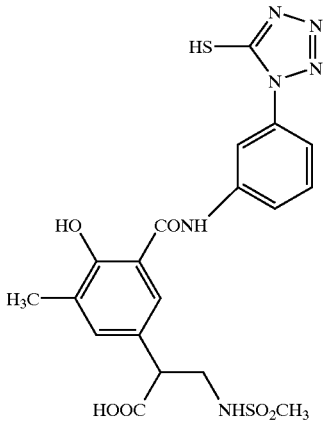
1-91
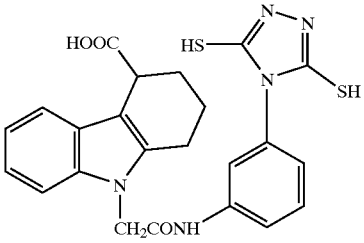
1-92
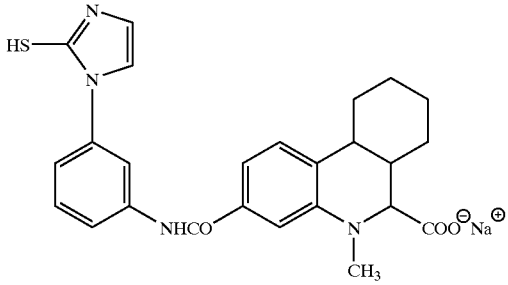
1-93
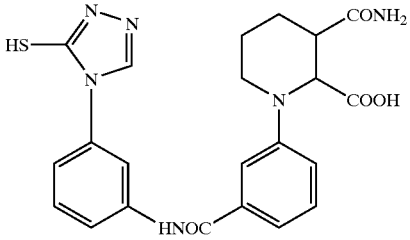
1-94
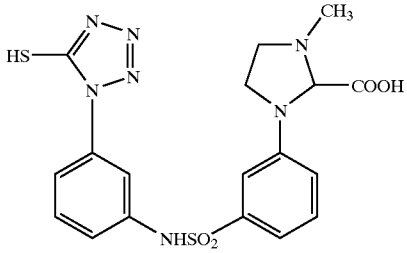
1-95
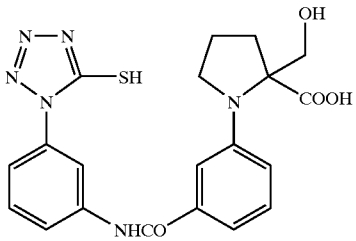
1-96
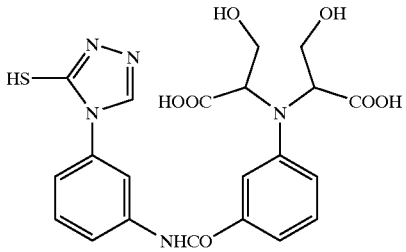

-continued
1-97
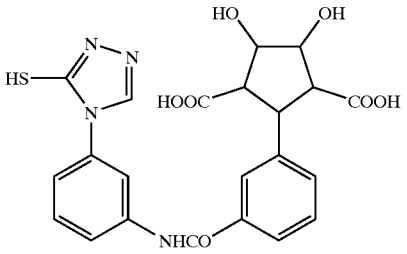
1-98
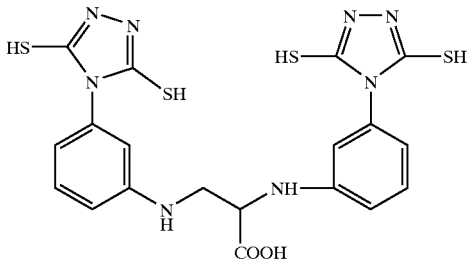
1-99
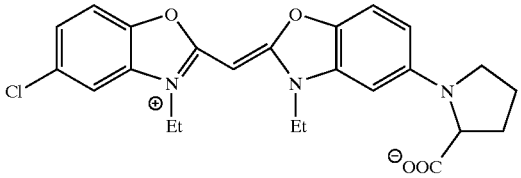
1-100
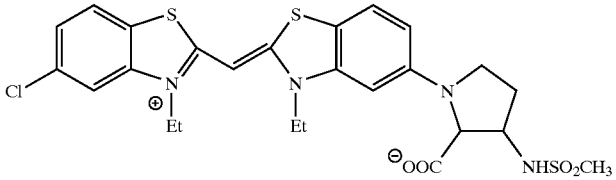
1-101
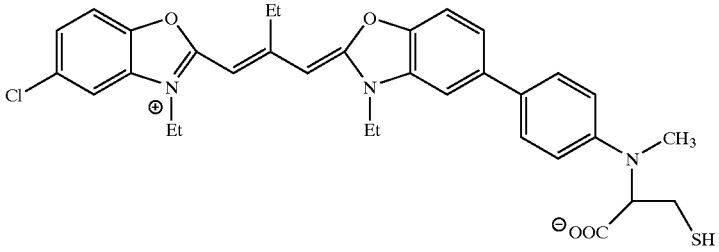
1-102
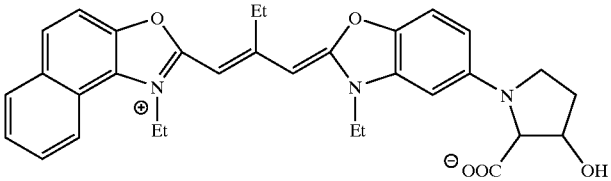
1-103
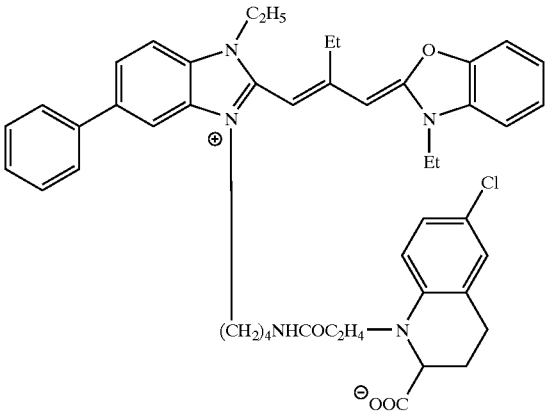
1-104
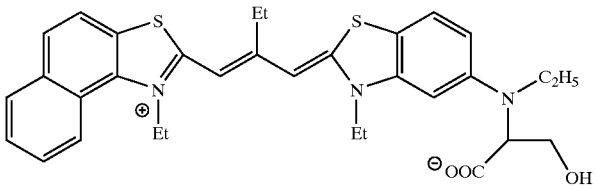

-continued
1-105
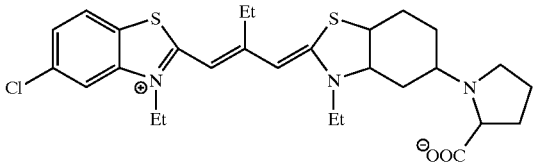
1-106
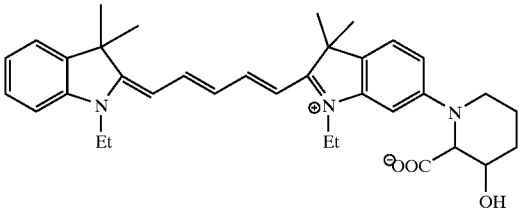
1-107
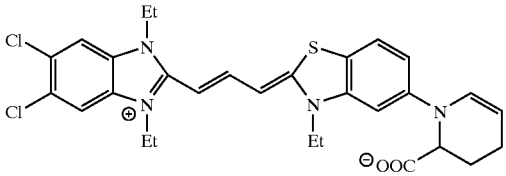
1-108
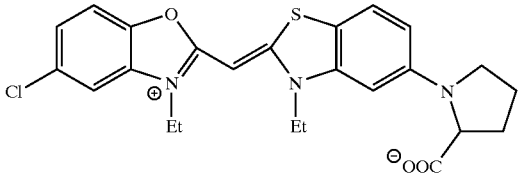
1-109
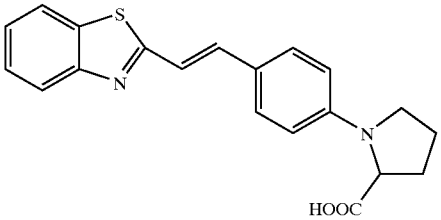
1-110
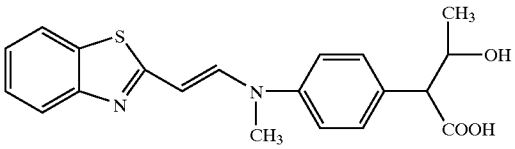
1-111
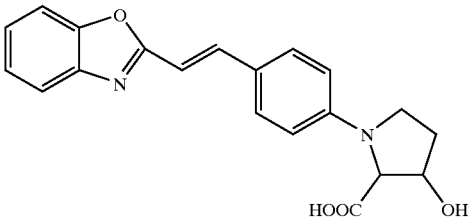
1-112
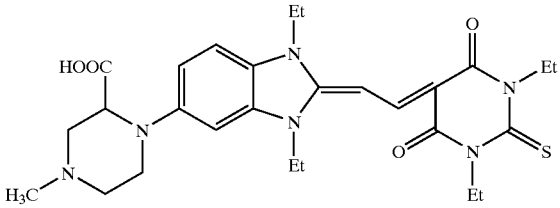

-continued
1-113
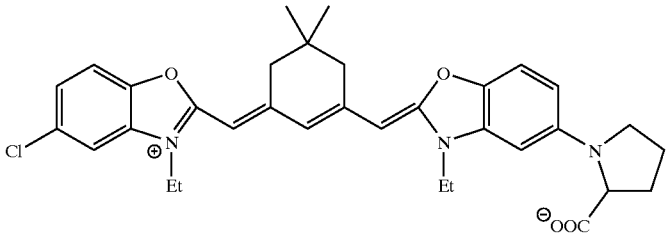
1-114
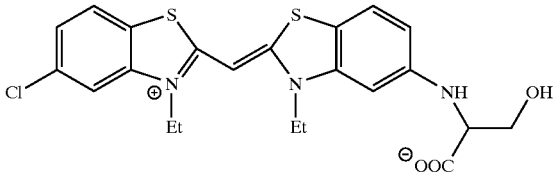
1-115
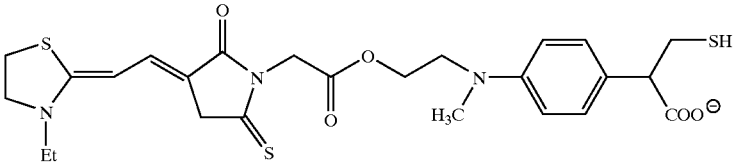
1-116
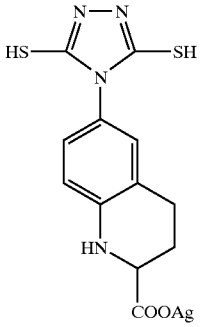
1-117
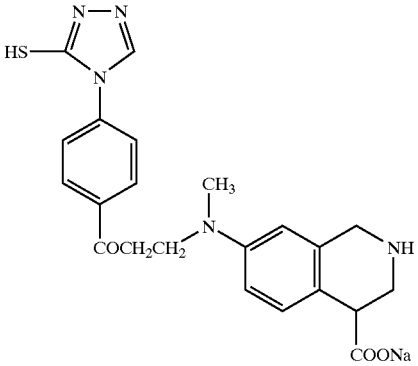
1-118
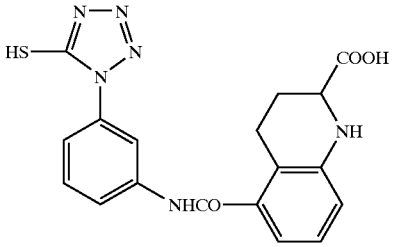
1-119
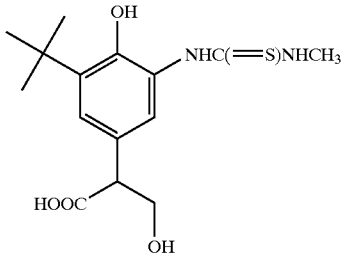
1-120
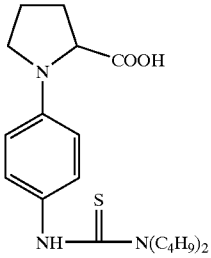
1-121
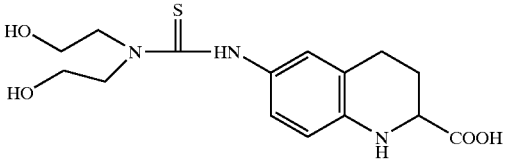

-continued
1-122
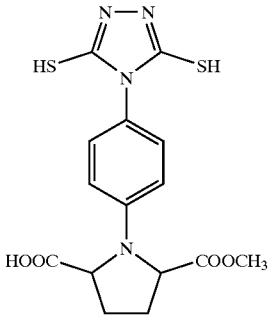
1-123
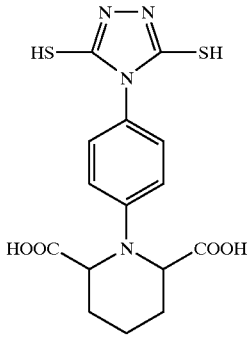
1-124
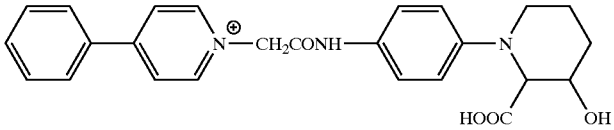
1-125
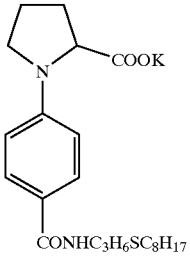
1-126
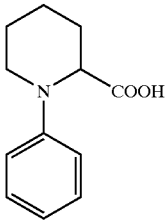
1-127
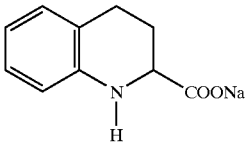
1-128
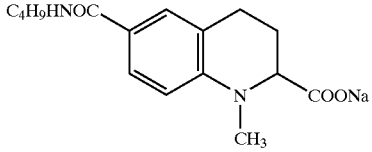
1-129
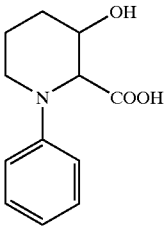
1-130
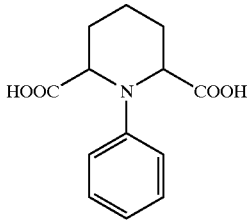
1-131
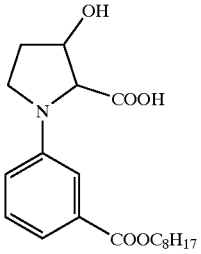
1-132
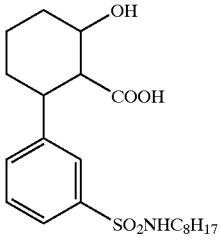

-continued
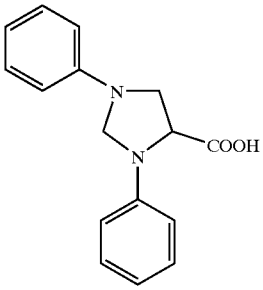
1-133
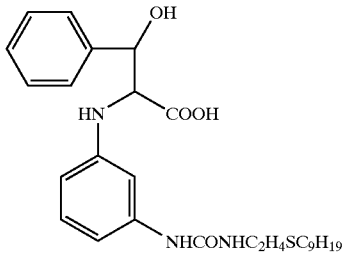
1-134
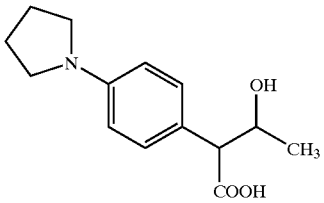
1-135
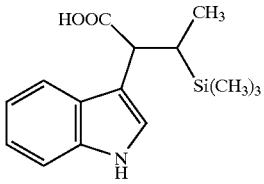
1-136
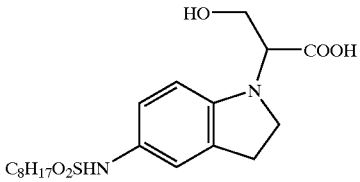
1-137
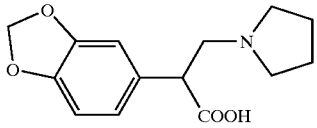
1-138
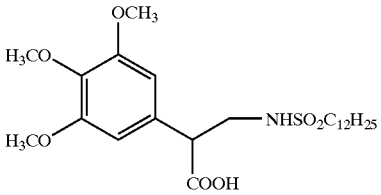
1-139
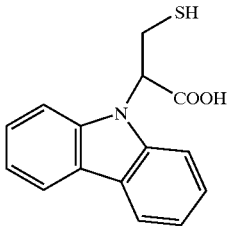
1-140
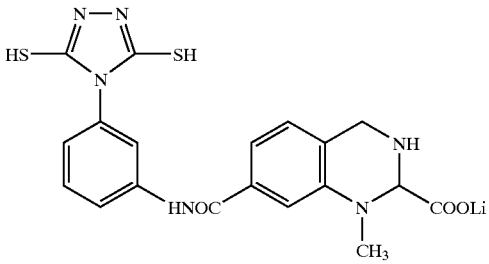
1-141
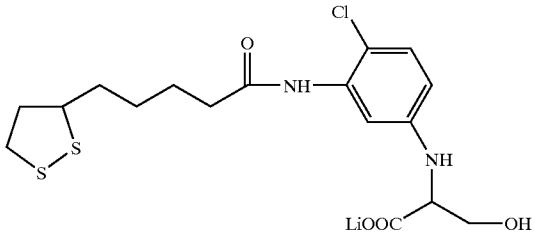
1-142
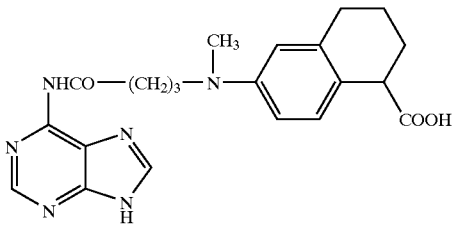
1-143
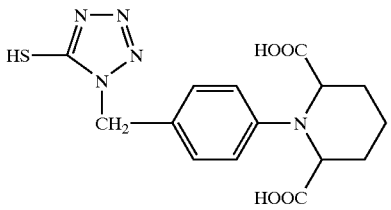
1-144

-continued
1-145
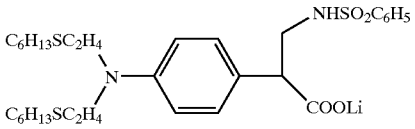
1-146
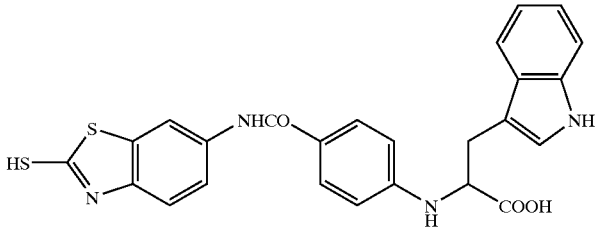
1-147
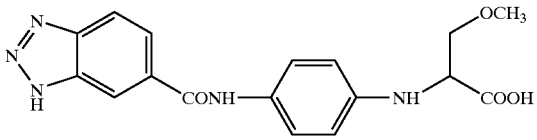
1-148
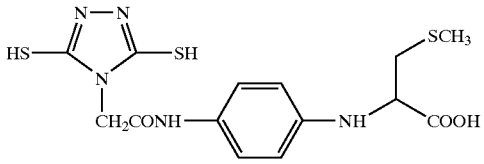
1-149
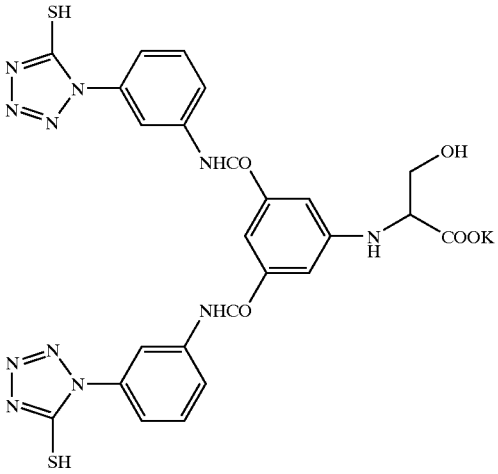
1-150
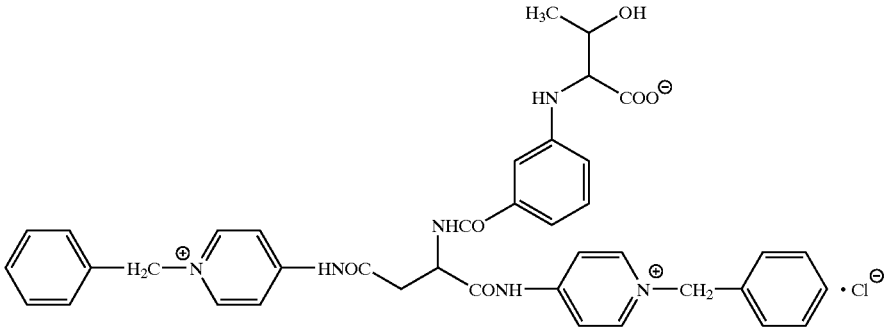
1-151
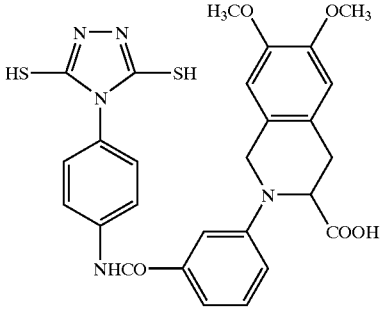
1-152
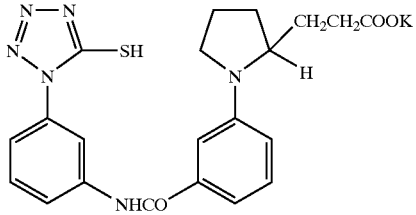

-continued
1-153
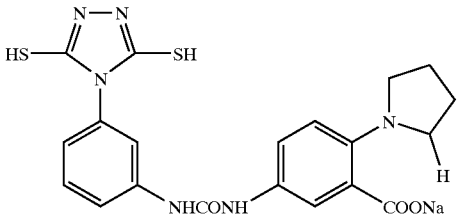
1-154
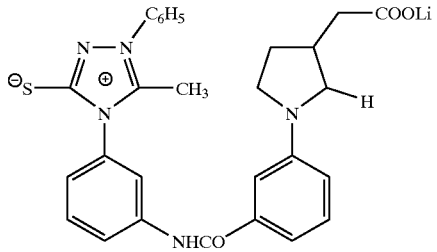
1-155
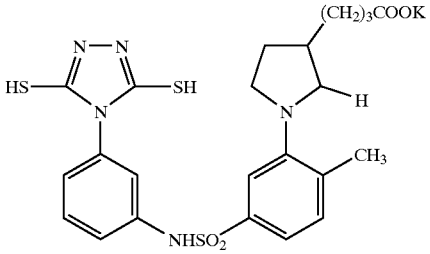
1-156
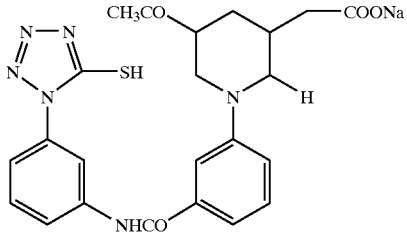
1-157
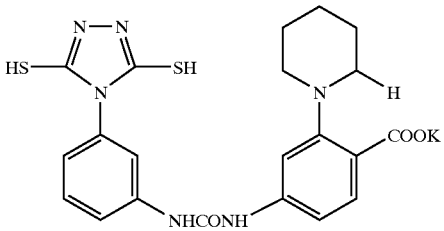
1-158
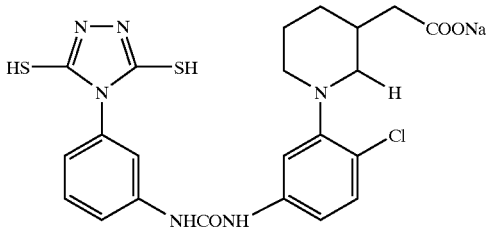
1-159
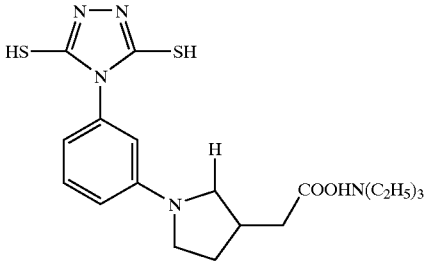
1-160
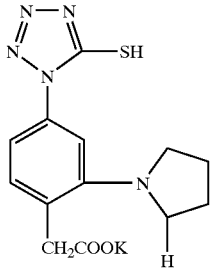
1-161
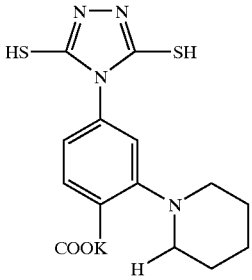
1-162
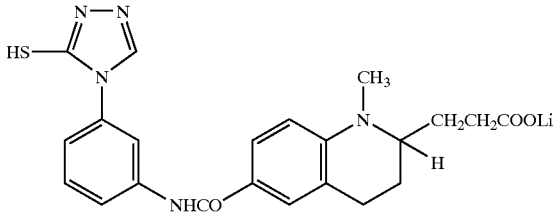
1-163
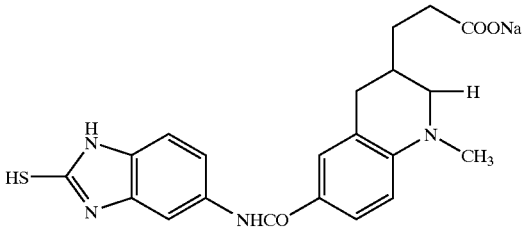
1-164
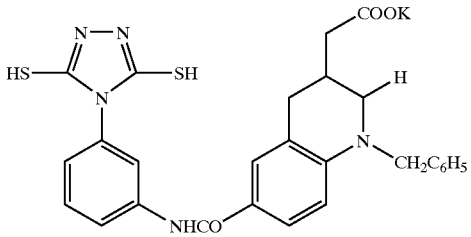

-continued
1-165
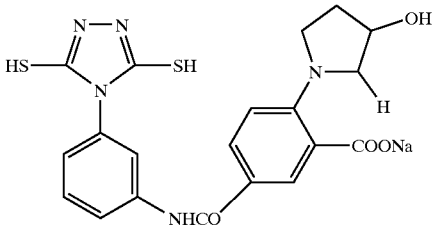
1-166
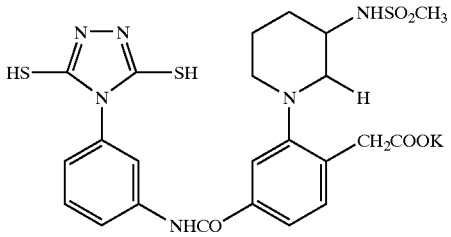
1-167
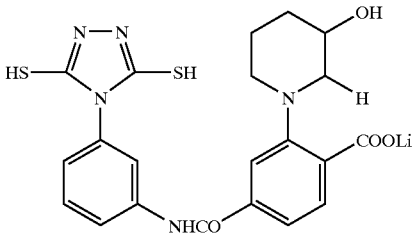
1-168
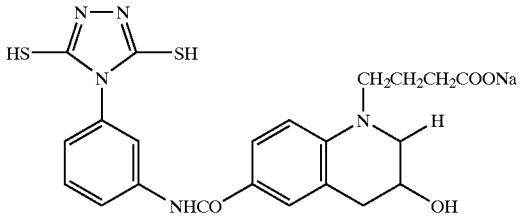
1-169
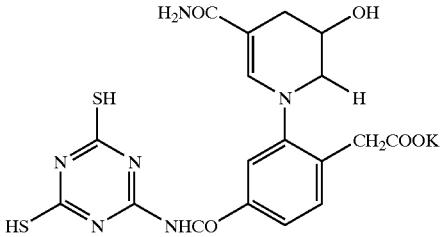
1-170
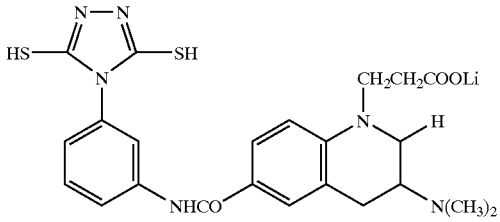
1-171
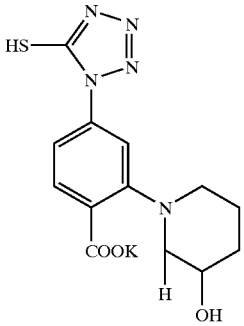
1-172
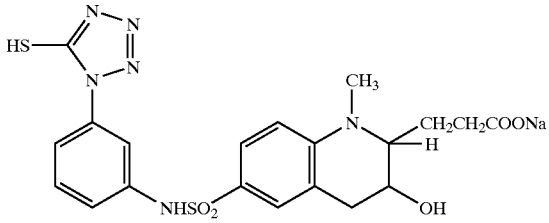
1-173
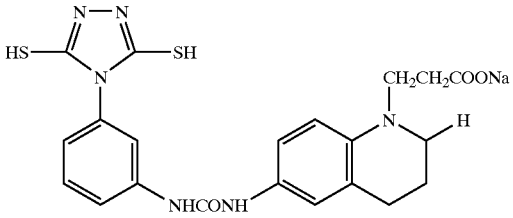
1-174
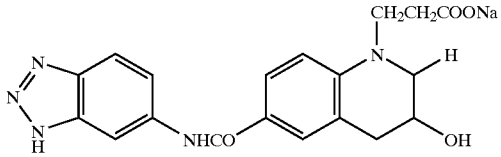
1-175
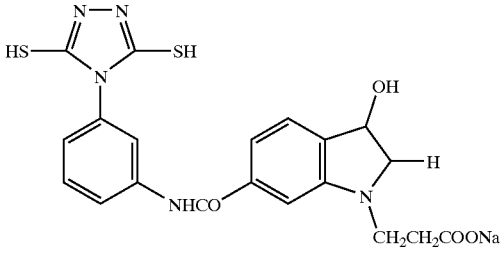
1-176
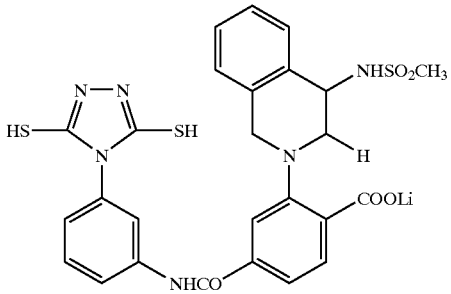

-continued
1-177
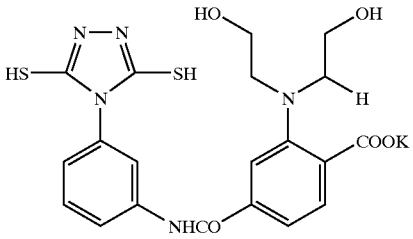
1-178
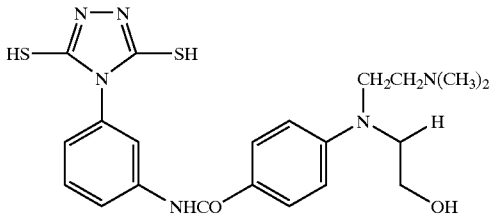
1-179
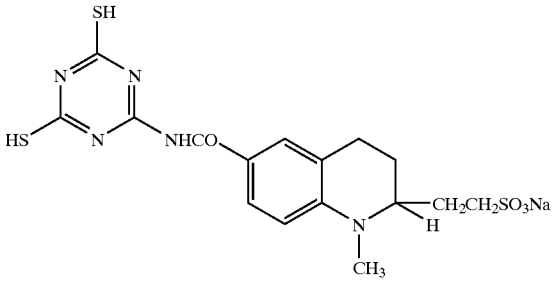
1-180
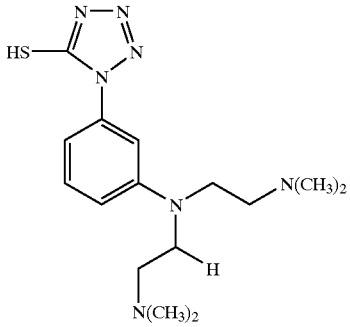
1-180
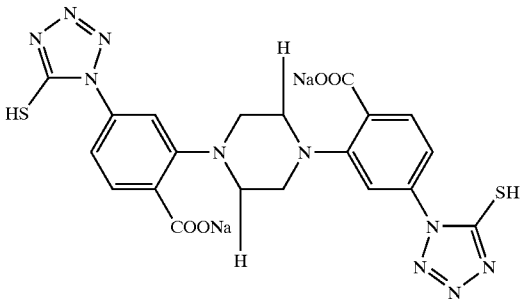
1-181
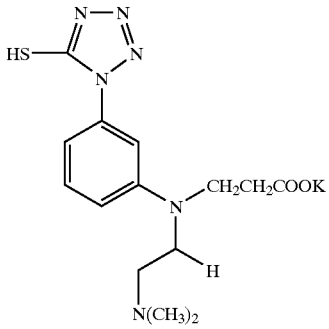
1-183
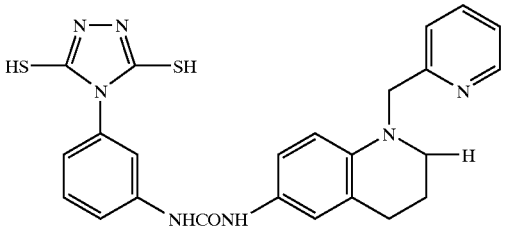
1-184
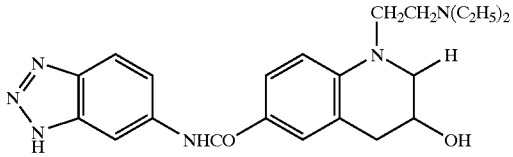
1-185
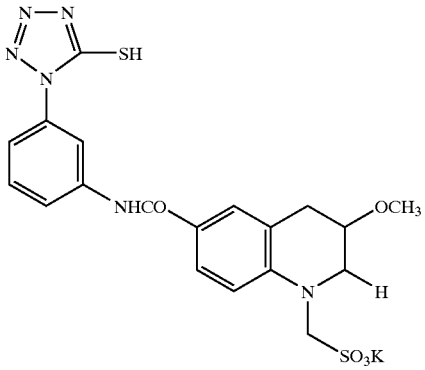
1-186
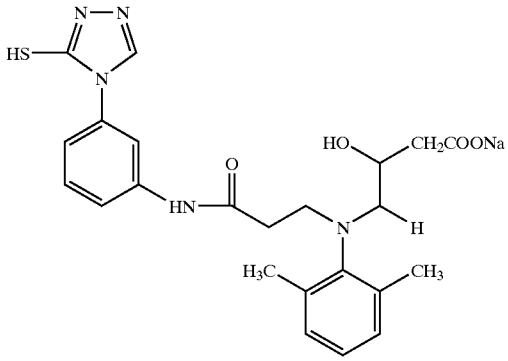

-continued
1-187
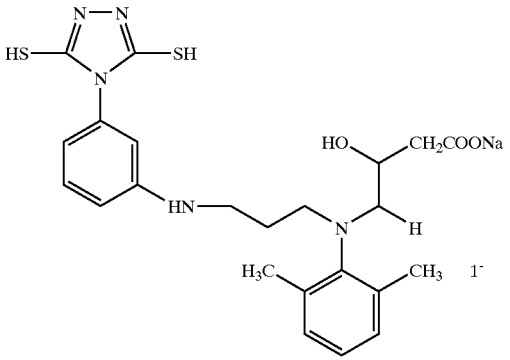
1-188
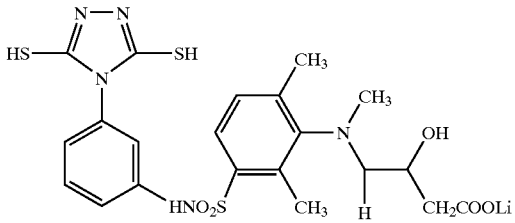
1-189
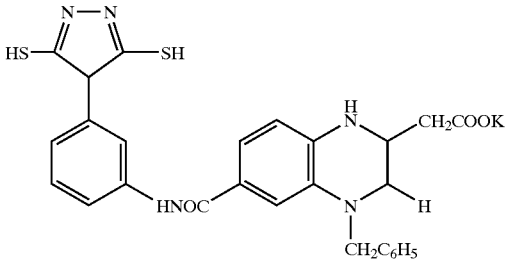
1-190
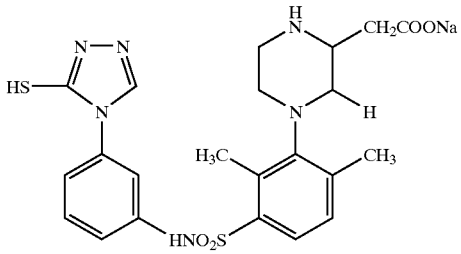
1-191
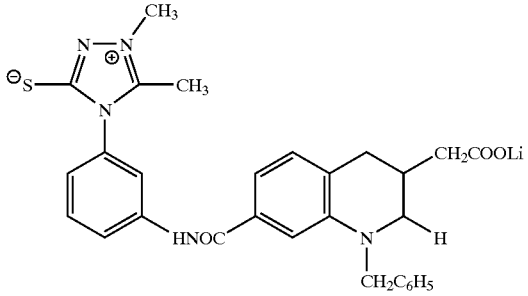
1-192
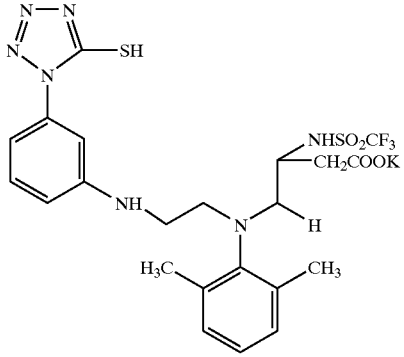
1-193
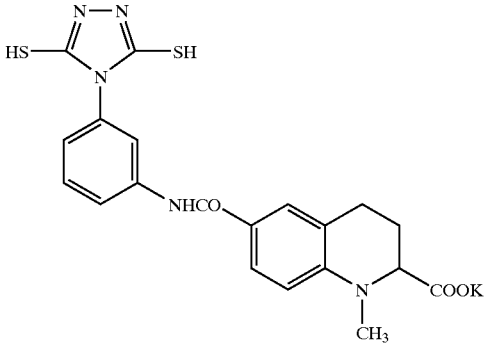
1-194
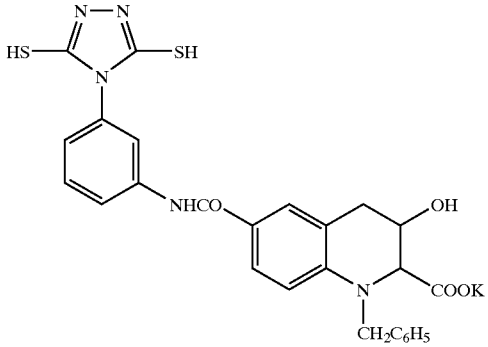

-continued
1-195
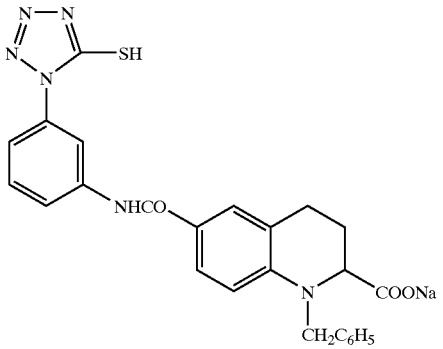
1-196
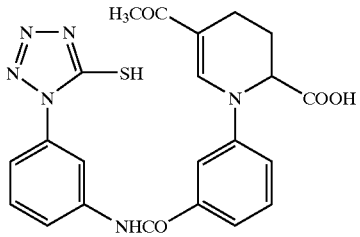
1-197
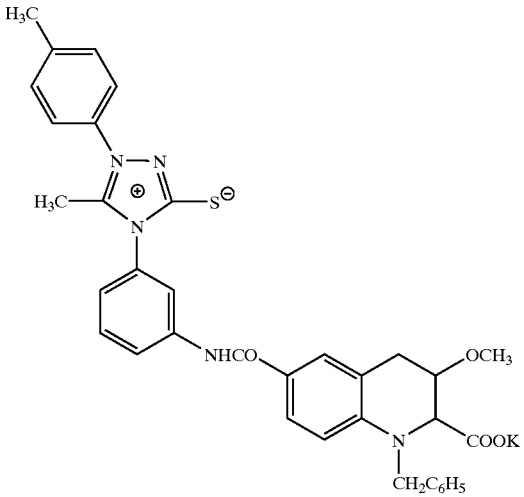
1-198
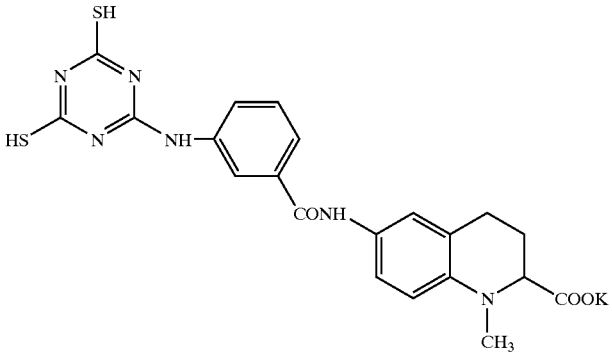
1-199
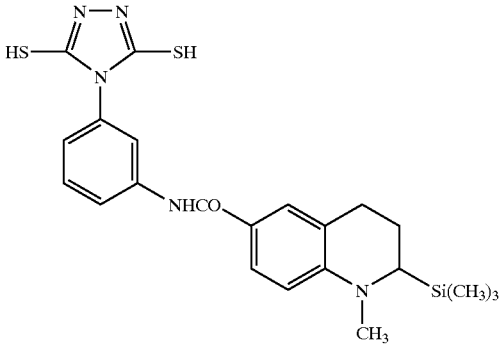

-continued
1-200
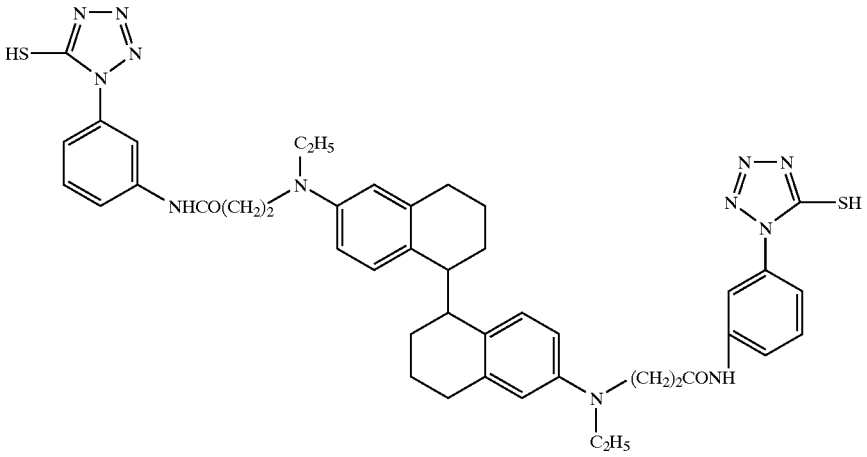
1-201
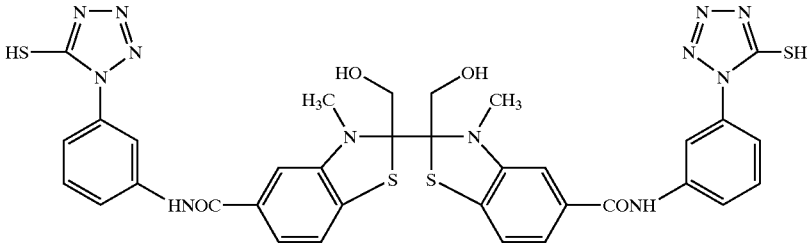
1-202
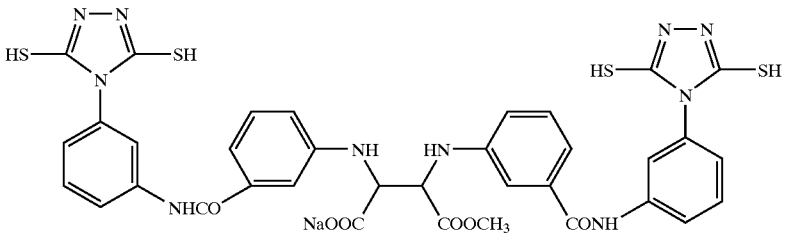
1-203
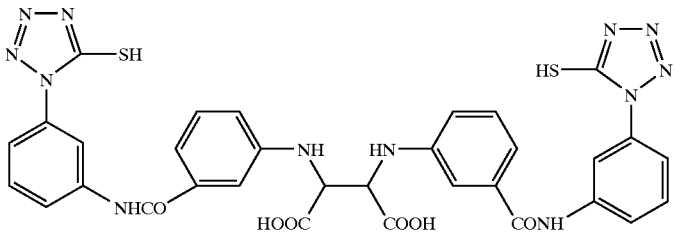
1-204
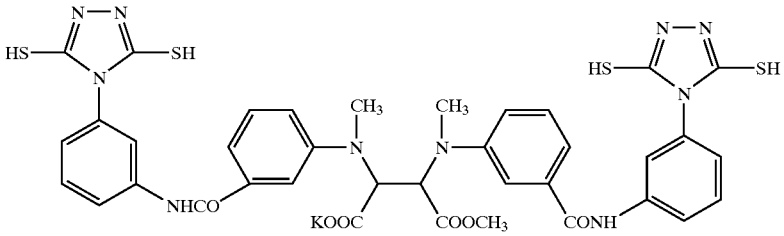

-continued
1-205
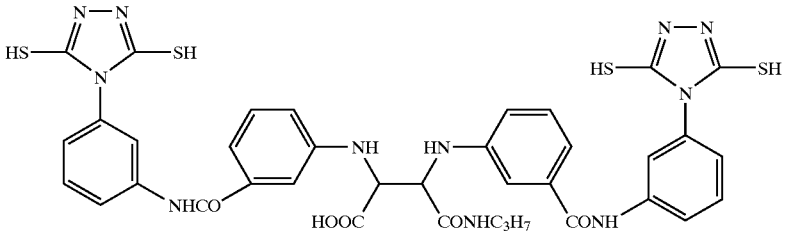
1-206
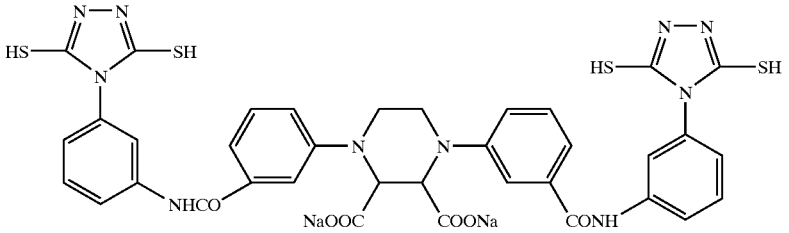
1-207
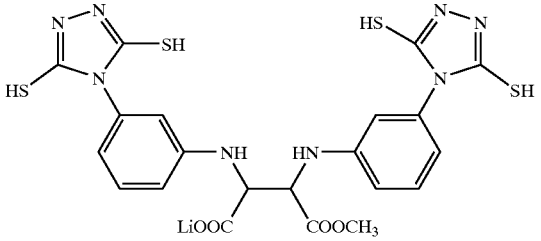
1-208
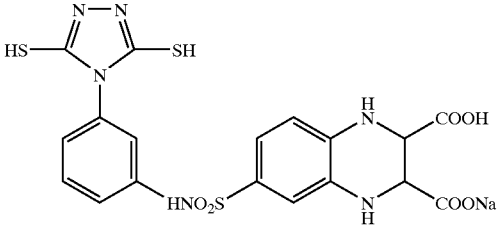
1-209
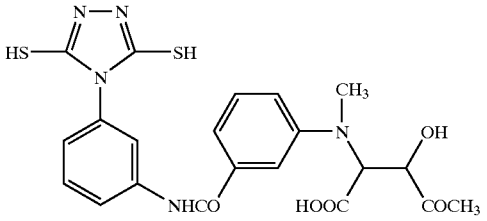
1-210
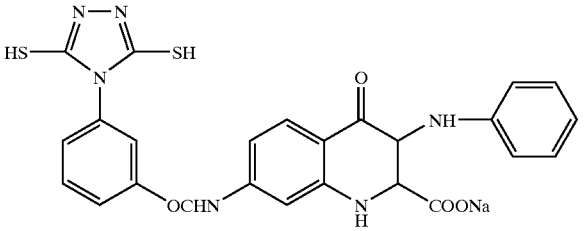
1-301
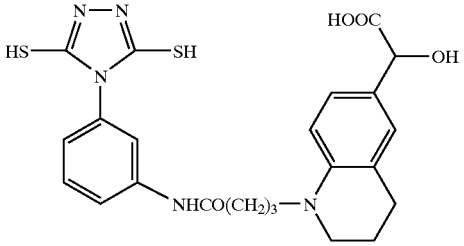
1-302
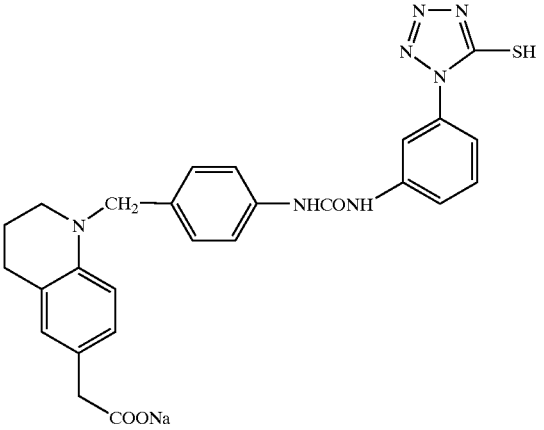

-continued
1-303
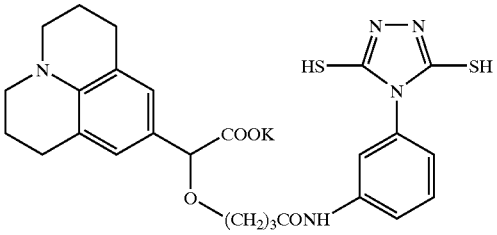
1-304
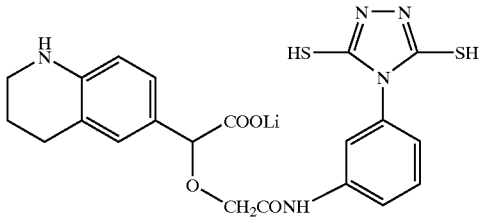
1-305
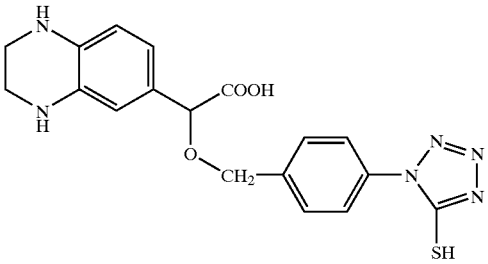
1-306
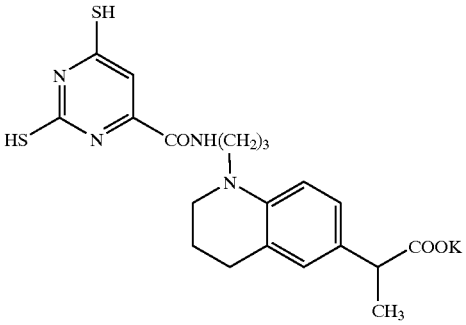
1-307
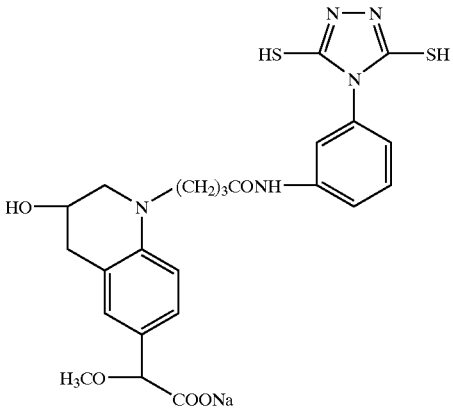
1-308
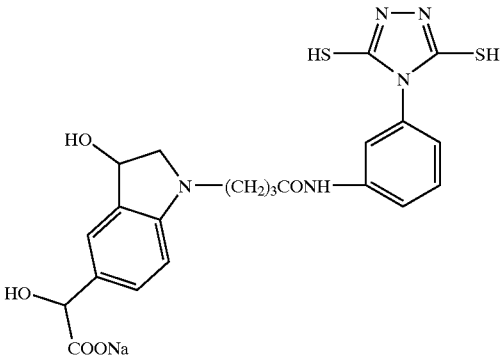
1-309
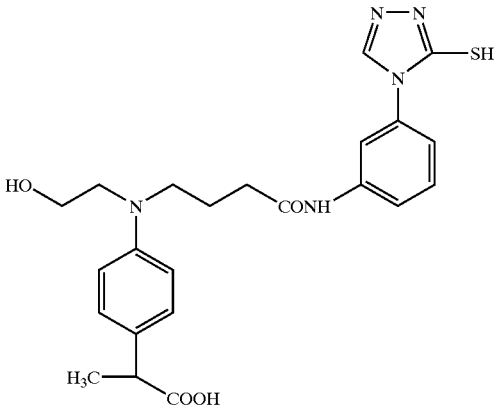
1-310
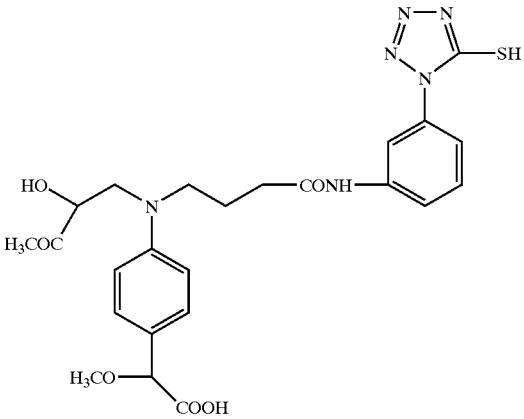

-continued
1-311
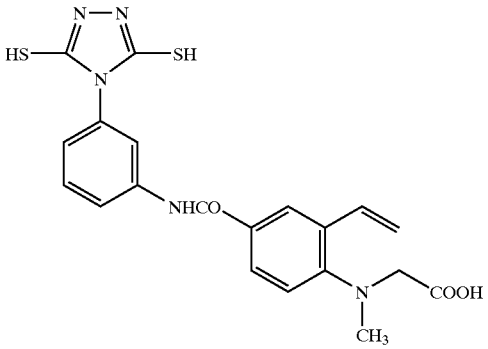
1-312
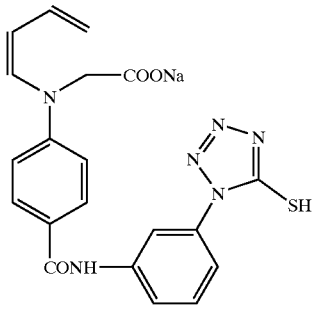
1-313
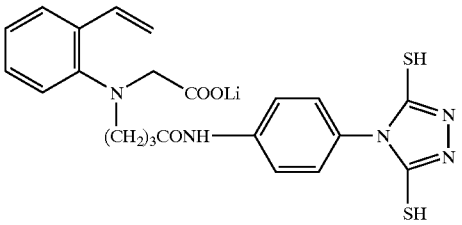
1-314
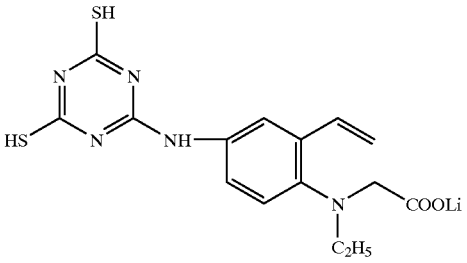
1-315
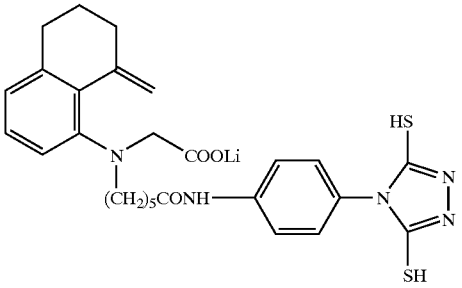
1-316
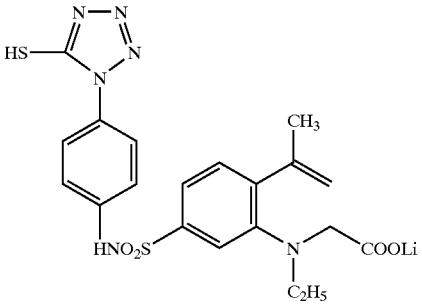
1-317
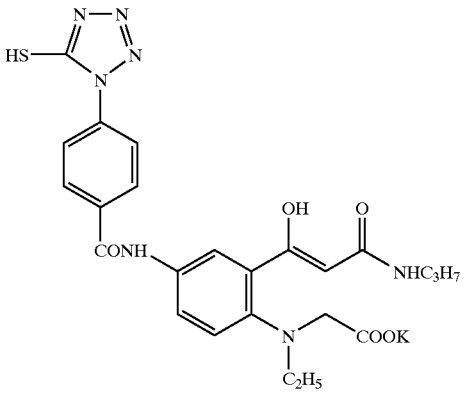
1-318
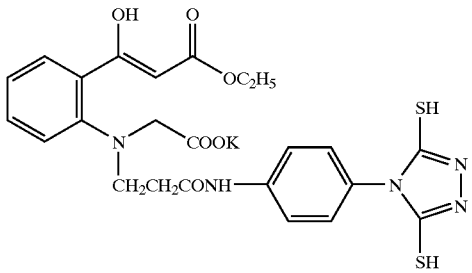
1-319
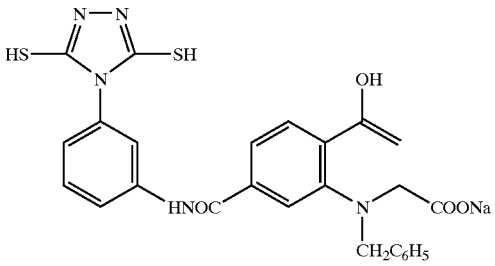
1-320
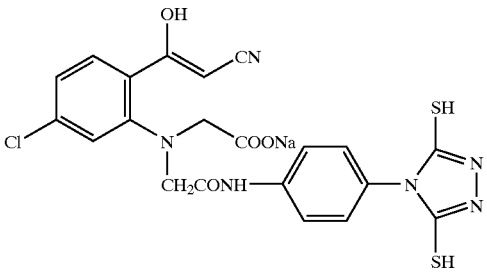

-continued
1-321
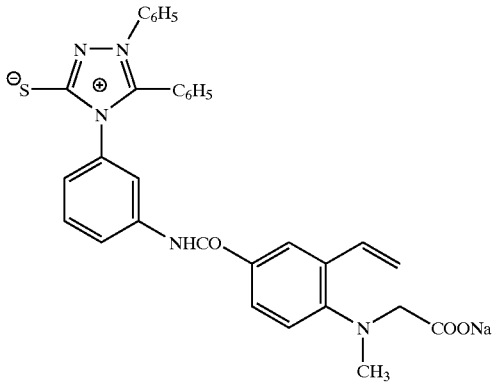
1-322
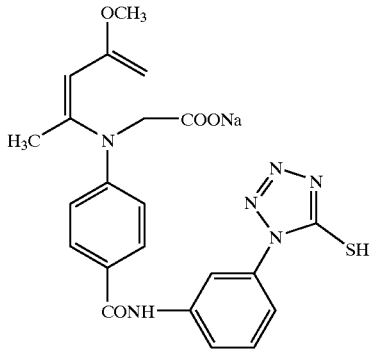
1-323
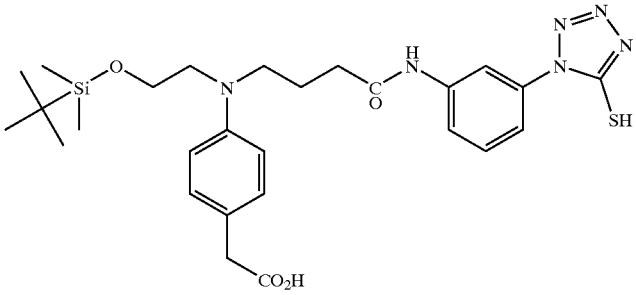
1-324
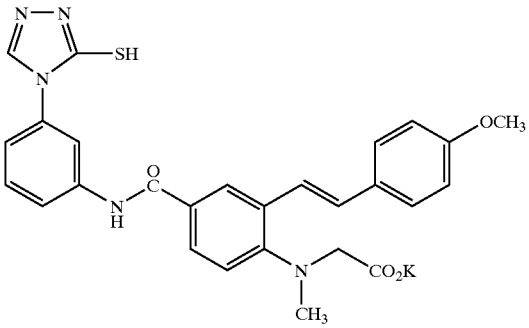
1-325
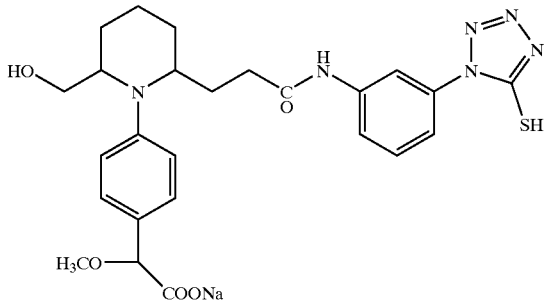
1-326
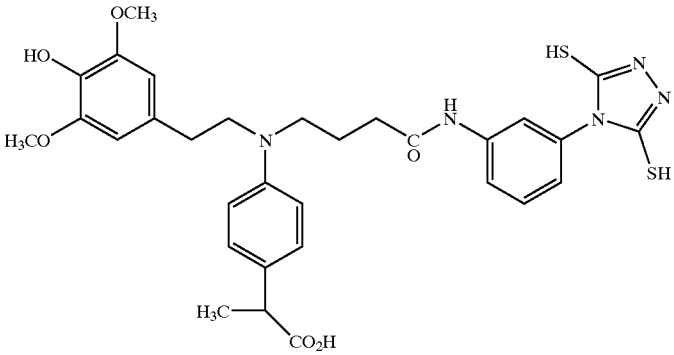

-continued
1-327
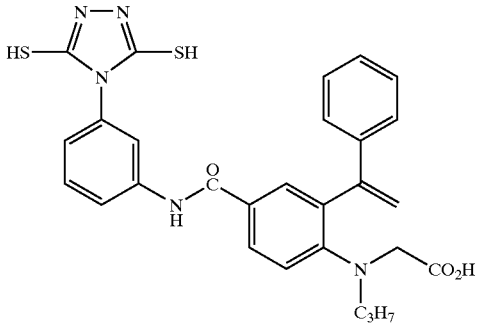
1-328
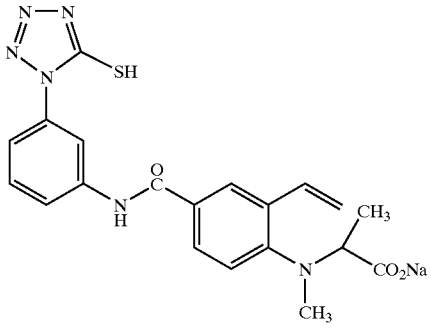
1-329
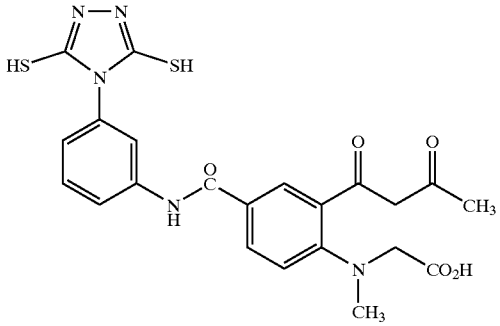
1-330
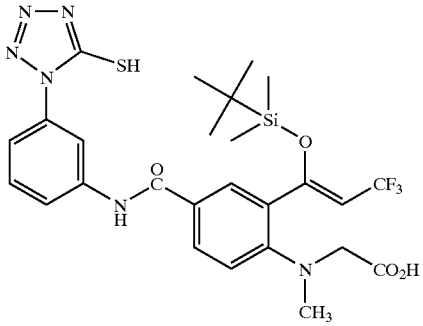
1-331
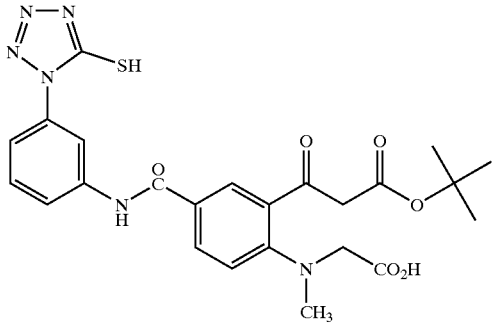
1-332
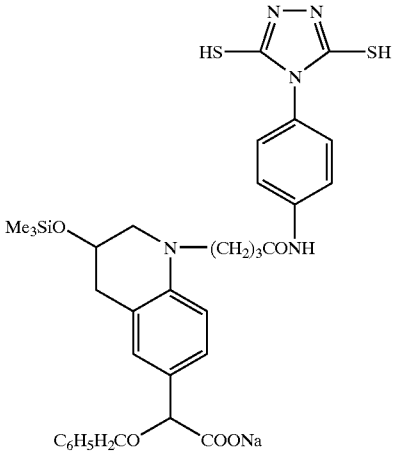
1-333
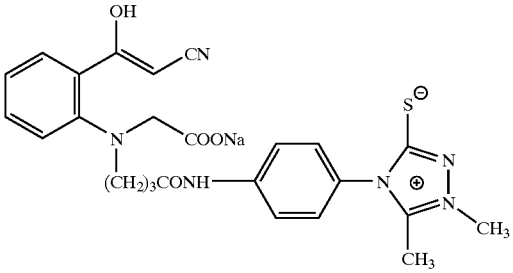
1-334
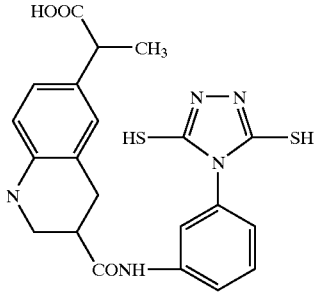

-continued 1-335

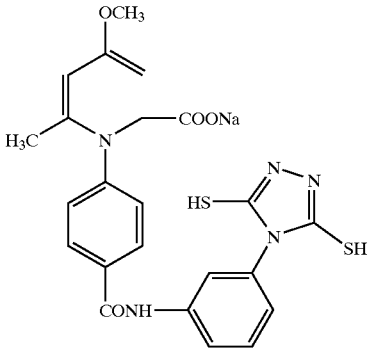

1-336

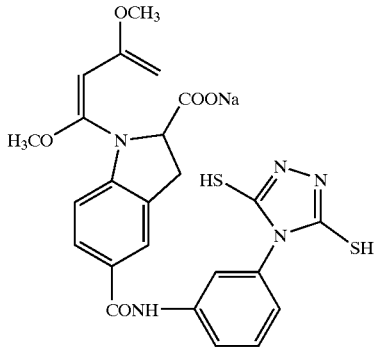

Synthetic Example

Compounds of Type 1 according to the present invention can be easily synthesized by known processes. Particular examples thereof will be described below.

Synthesis of Compound Example 1-1

Compound example 1-1 was synthesized in accordance with the following synthetic scheme 1-1.

Synthetic scheme 1-1

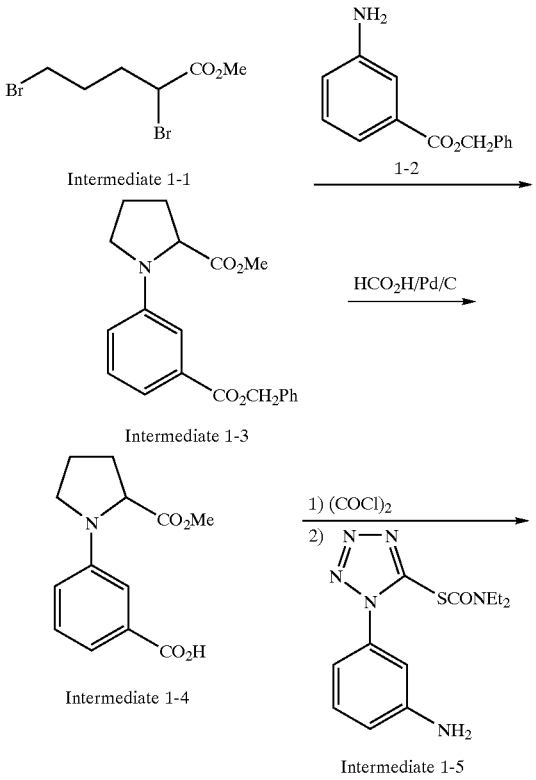

-continued

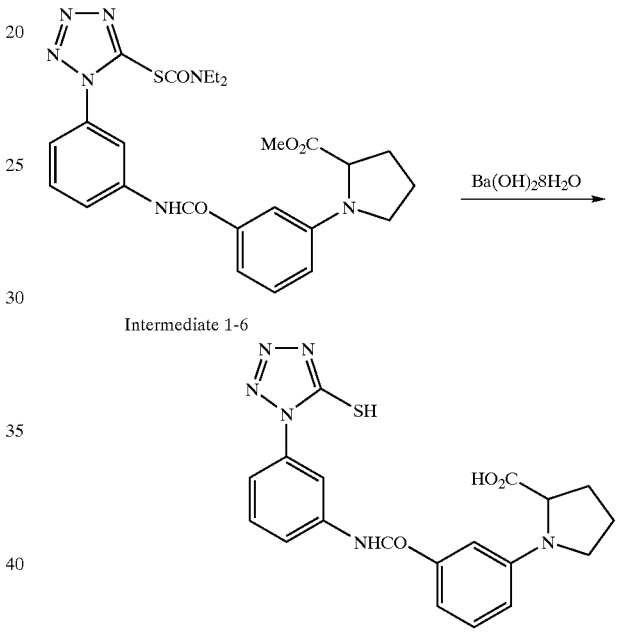

Synthesis of Synthetic Intermediate 1-3

Synthetic intermediate 1-1 (10.2 g, 36.5 mmol) and synthetic intermediate 1-2 (9.1 g, 40 mmol) indicated in the synthetic scheme 1-1, acetonitrile (100 milliliters (hereinafter also referred to as "mL")), $K_2CO_3$ (10 g, 72 mmol) and $Bu_4NI$ (1 g, 2.7 mmol) were mixed together and refluxed by heating for 8 hr. The reaction mixture was treated with dilute hydrochloric acid, and extracted with ethyl acetate. The thus obtained oil layer was dried and concentrated, thereby obtaining a crude product. The crude product was purified by silica gel column chromatography, thereby obtaining synthetic intermediate 1-3 (6.2 g, 50%).

Synthesis of Synthetic Intermediate 1-4

While heating a mixture of synthetic intermediate 1-3 (5.1 g, 15 mmol), palladium black (50% hydrate, 10%, 5 g) and methanol (50 mL) at 40° C., formic acid (10 mL), in divisions, was added thereto. Disappearance of synthetic intermediate 1-3 was confirmed by thin-layer chromatography, and the catalyst was filtered off. The thus obtained filtrate was concentrated, thereby obtaining a crude product. The crude product was purified by silica gel column chromatography, thereby obtaining synthetic intermediate 1-4 (3.6 g, 90%).

Synthesis of Synthetic Intermediate 1-6

Oxalyl chloride (5 mL) and dimethylformamide (2 drops) were added to a mixture of synthetic intermediate 1-4 (2.68 g, 10 mmol) and chloroform (30 mL), and refluxed by heating for 1 hr. The resultant mixture was concentrated in vacuum, thereby obtaining an acid chloride. The acid chloride was dissolved in chloroform (30 mL), and synthetic intermediate 1-5 (3.0 g, 10 mmol) and triethylamine (1.4 mL, 10 mmol) were added to the solution. The mixture was agitated at room temperature for 5 hr. The thus obtained reaction mixture was treated with dilute hydrochloric acid, and extracted with ethyl acetate. The thus obtained oil layer was dried and concentrated, thereby obtaining a crude product. The crude product was purified by silica gel column chromatography, thereby obtaining synthetic intermediate 1-6 (4.4 g, 81%).

Synthesis of Compound Example 1-1

Barium hydroxide octahydrate (3.2 g, 10 mmol) was added to a solution of synthetic intermediate 1-6 (2.7 g, 5 mmol) in methanol (10 mL), and agitated at room temperature for 8 hr. The thus obtained white solid was harvested by filtration, washed with methanol, and added to dilute hydrochloric acid. The resultant mixture was extracted with ethyl acetate. The thus obtained oil layer was dried and concentrated, and washed with chloroform. Consequently, compound example 1-1 (0.4 g, 20%) as a white solid was obtained.

$^1$H NMR (DMSO d6); δ=2.0–2.2 (m, 2H), 2.22.4 (m, 1H), 3.4 (m, 1H), 4.25 (m, 1H), 6.7 (m, 1H), 7.03 (s, 1H), 7.1–7.4 (m, 2H), 7.5–7.7 (m, 2H), 7.91 (d, J=8.4 Hz), 8.35 (s, 1H), 10.46 (s, 1H)

Synthesis of Compound Example 1-12

Compound example 1-12 was synthesized in the same manner as in the synthesis of the compound example 1-1, except that 4-benzyloxycarbonylaniline was used in place of the synthetic intermediate 1-2 and that 2-mercapto-5-aminobenzimidazole was used in place of the synthetic intermediate 1-5.

Synthesis of Compound Example 1-118

Compound example 1-118 was synthesized in accordance with the following synthetic scheme 1-2.

Synthetic scheme 1-2

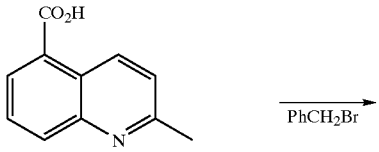

Intermediate 1-7

-continued

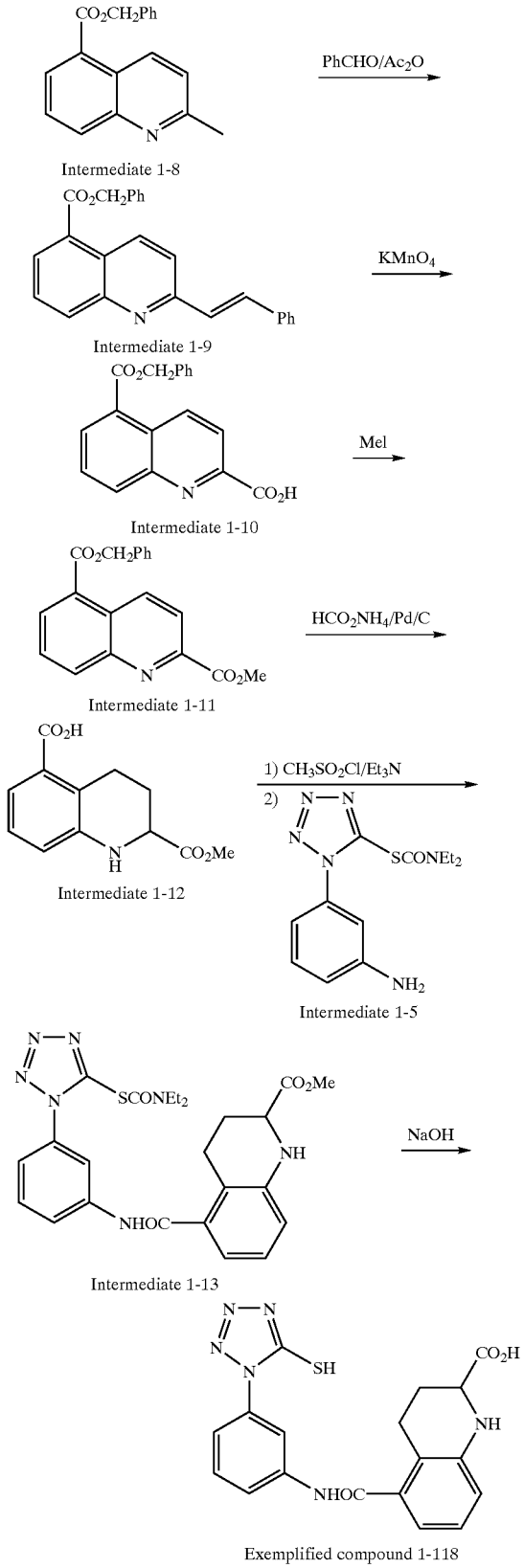

Synthesis of Synthetic Intermediate 1-8

Starting material 1-7 (18.7 g, 0.1 mol) indicated in the synthetic scheme 1-2, $K_2CO_3$ (15.2 g, 0.11 mol) and dimethylacetamide (100 mL) were mixed together. Benzyl bromide (18.7 g, 0.11 mol) was added to the mixture, and refluxed by heating for 3 hr. The reaction mixture was poured into water, and extracted with ethyl acetate. The thus obtained oil layer was treated with concentrated hydrochloric acid, so that the product was extracted into a water layer. The water layer was neutralized with sodium bicarbonate to result in crystallization. The obtained crude crystal was harvested by filtration, and recrystallized from hexane. As a result, synthetic intermediate 1-8 (20 g, yield 72%) was obtained.

Synthesis of Synthetic Intermediate 1-9

Synthetic intermediate 1-8 (20 g, 72 mmol), benzaldehyde (23.6 g, 223 mmol) and acetic anhydride (17 g, 167 mmol) were mixed together, and heated at 170° C. under agitation for 4 hr. The reaction mixture was cooled and added to ethanol. A small amount of water was added to the mixture to result in crystallization. The crude crystal was harvested by filtration, and recrystallized from ethanol. As a result, synthetic intermediate 1-9 (21 g, 80%) was obtained.

Synthesis of Synthetic Intermediate 1-10

Synthetic intermediate 1-9 (21 g, 57.5 mmol), pyridine (114 mL) and water (26 mL) were mixed together. Potassium permanganate (24.6 g, 156 mmol) was added little by little to the mixture under agitation while cooling with ice. Agitation became impossible in the course of addition, so that water (74 mL) was added to the mixture to thereby enable continuing the addition of potassium permanganate. After the completion of addition thereof, further agitation was made for 1 hr. The thus obtained reaction mixture was diluted with a large amount of water, and the pH value of the dilution was adjusted to 4 with the use of sulfuric acid, resulting in crystallization of a blackish-brown solid. $NaS_2O_5$ was added thereto to thereby effect decoloring. Filtration and washing with water were conducted, thereby obtaining synthetic intermediate 1-10 (19 g, hydrate) as a light-yellow powder. The synthetic intermediate 1-10 was used in the subsequent step without drying.

Synthesis of Synthetic Intermediate 1-11

Methyl iodide (30 mL) in three divisions was added to a mixture of synthetic intermediate 1-10 (19 g, hydrate), dimethylacetamide (50 mL) and potassium carbonate (8 g, 58 mmol) placed in an oil bath of 80° C. The reaction mixture was poured into water, extracted with ethyl acetate, and concentrated and dried. Recrystallization from methanol was performed, thereby obtaining synthetic intermediate 1-11 (10 g, yield based on synthetic intermediate 1-9: 54%).

Synthesis of Synthetic Intermediate 1-12

Ammonium formate (30 g, 0.48 mol) in 5 or 6 divisions was added to a mixture of synthetic intermediate 1-11 (10 g, 31.1 mmol), palladium black (50% hydrate, 10%, 10 g) and methanol (50 mL). The reaction mixture was filtered, and the filtrate was concentrated. Water was added to the concentrate, and the pH value thereof was adjusted to 3 with the use of hydrochloric acid, resulting in crystallization of a white solid. The white solid was harvested by filtration, washed with water, and dried. As a result, synthetic intermediate 1-12 (5 g, 68%) was obtained.

Synthesis of Synthetic Intermediate 1-13

A mixture of synthetic intermediate 1-12 (2.1 g, 8.9 mmol) and acetonitrile (30 mL) was cooled to 0° C., and methanesulfonyl chloride (0.69 mL, 8.9 mmol) was added thereto. Triethylamine (1.26 mL, 8.9 mmol) was dropped thereinto, and agitated for 10 min. Thereafter, synthetic intermediate 1-5 (2.4 g, 8.2 mmol) was added, and agitated at room temperature for 3 hr. The thus obtained reaction mixture was treated with dilute hydrochloric acid, extracted with ethyl acetate, dried and concentrated, thereby obtaining a crude product. The crude product was purified by silica gel column chromatography, thereby obtaining synthetic intermediate 1-13 (3 g, 66%).

Synthesis of Compound Example 1-118

Barium hydroxide octahydrate (3.7 g, 11.7 mmol) was added to a solution of synthetic intermediate 1-13 (3 g, 5.9 mmol) in methanol, and agitated at room temperature overnight. The thus obtained white solid was harvested by filtration, washed with methanol, and treated with dilute hydrochloric acid. The resultant mixture was extracted with ethyl acetate, dried, concentrated and washed with chloroform. Consequently, compound example 1-118 (0.5 g, 20%) was obtained.

$^1$H NMR (DMSO d6); δ=1.9–2.1 (m, 2H), 2.5–2.9 (m, 2H), 4.0 (m, 1H), 6.6–6.8 (m, 2H), 7.0 (m, 1H), 7.5–7.7 (m, 2H), 7.8–7.9 (m, 1H), 8.35 (s, 1H), 10.5 (s, 1H)

Synthesis of Compound Example 1-13

Compound example 1-13 was synthesized in the same manner as in the synthesis of the compound example 1-118, except that 5-carboxyl-2-methylquinoline was used in place of the synthetic intermediate 1-7 and that 3,5-dimercapto-4-(3-aminophenyl)-1,2,4-triazole was used in place of the synthetic intermediate 1-5.

Synthesis of Compound Example 1-34

Compound example 1-34 was synthesized in accordance with the following synthetic scheme 1-3.

Synthetic scheme 1-3

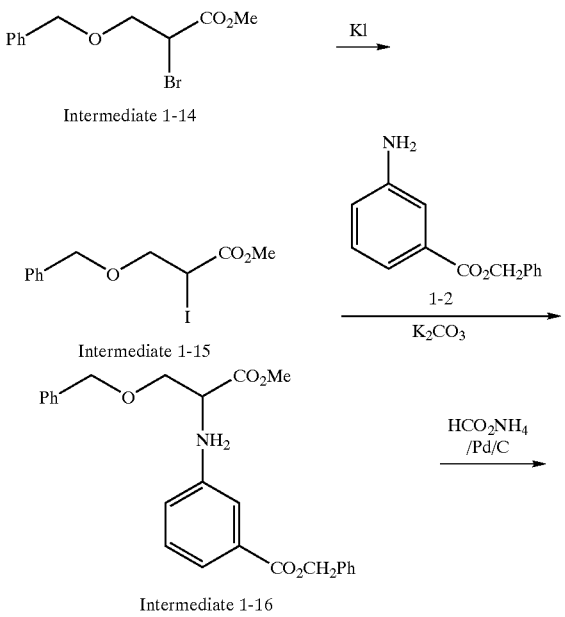

-continued

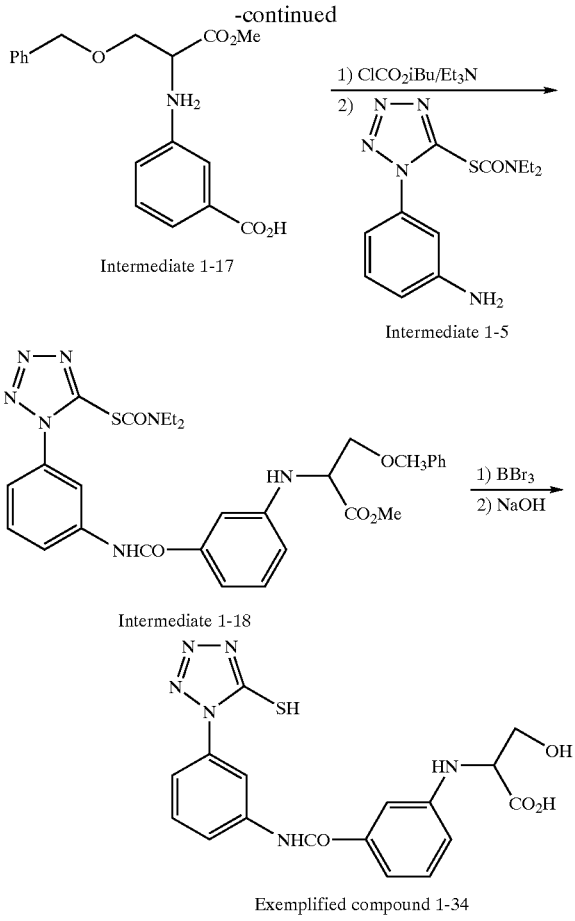

Synthesis of Synthetic Intermediate 1-15

A mixture of synthetic intermediate 1-14 (9.1 g, 33 mmol) indicated in the synthetic scheme 1-3, potassium iodide (27.7 g, 167 mmol) and acetone (100 mL) was refluxed by heating, and agitated for 6 hr. The mixture was cooled, and a solid was filtered off. The filtrate was concentrated, and water was added to the concentrate, followed by extraction with ethyl acetate. The extract was dried and concentrated. As a result, synthetic intermediate 1-15 (10 g, 95%) was obtained.

Synthesis of Synthetic Intermediate 1-16

A mixture of synthetic intermediate 1-15 (9.6 g, 30 mmol), synthetic intermediate 1-2 (8.8 g, 39 mmol), potassium carbonate (4.2 g, 30 mmol) and dimethylacetamide (10 mL) was heated to 80° C. and agitated for 5 hr. The thus obtained reaction mixture was treated with dilute hydrochloric acid, and extracted with ethyl acetate. The extract was dried and concentrated, thereby obtaining a crude product. The crude product was purified by silica gel column chromatography, thereby obtaining synthetic intermediate 1-16 (10 g, 79%).

Synthesis of Synthetic Intermediate 1-17

Ammonium formate (10 g, 159 mmol) was added to a mixture of synthetic intermediate 1-16 (10 g, 23.8 mmol), palladium black (50% hydrate, 10%, 10 g) and methanol, and agitated at room temperature for 2 hr. The reaction mixture was filtered. The filtrate was concentrated, dissolved in ethyl acetate, and washed with dilute hydrochloric acid. The thus obtained oil layer was dried and concentrated. The resultant oily substance was purified by silica gel column chromatography. As a result, synthetic intermediate 1-17 (5 g, 65%) was obtained.

Synthesis of Synthetic Intermediate 1-18

A solution of synthetic intermediate 1-17 (5 g, 15.2 mmol) in acetonitrile (20 mL) was cooled to 0° C., and isobutyl chloroformate (2.1 g, 15.2 mmol) was added thereto. Further, triethylamine (1.54 g, 15.2 mmol) was dropped thereinto, and agitated for 20 min. Still further, synthetic intermediate 1-5 (4.4 g, 15.2 mmol) was added, and agitated at room temperature for 2 hr. The thus obtained reaction mixture was treated with dilute hydrochloric acid, and extracted with ethyl acetate. The extract was dried and concentrated, thereby obtaining a crude product. The crude product was purified by silica gel column chromatography, thereby obtaining synthetic intermediate 1-18 (3 g, 33%).

Synthesis of Compound Example 1-34

$BBr_3$ (methylene chloride solution, 1 M, 10 mL) was dropped into a solution of synthetic intermediate 1-18 (3 g, 5 mmol) in methylene chloride at 0° C., and agitated for 2 hr. The reaction mixture was poured into water, and a liquid separation was effected. The oil layer was dried and concentrated. Methanol (10 mL) was added to the concentrate. Further, an aqueous solution of NaOH (5 M, 3 mL) was added, and refluxed by heating for 6 hr. The reaction mixture was concentrated, and a hydrochloric acid of pH 2 and ethyl acetate were added, so that the reaction product was extracted into an oil layer. The oil layer was dried and concentrated, thereby obtaining a crude product. The crude product was purified by silica gel column chromatography, thereby obtaining compound example 1-34 (0.2 g, 10%).

$^1$H NMR (DMSO d6); δ=3.84 (dd, J=9.4 Hz, 3.8 Hz, 1H), 3.91 (dd, J=9.4, 3.9 Hz, 1H), 4.31 (m, 1H), 4.77 (d, J=9.0 Hz, 1H), 6.80 (m, 1H), 7.1–7.4 (m, 4H), 7.53 (dd, J=8.1, 8.1 Hz, 1H), 7.81 (m, 1H), 7.90 (s, 1H), 7.97 (m, 1H)

Synthesis of Compound Example 1-39

Compound example 1-39 was synthesized in the same manner as in the synthesis of the compound example 1-34, except that methyl 3-dimethylamino-2-bromopropionate was used in place of the synthetic intermediate 1-14 and that 3-mercapto-4-(3-aminophenyl)-1,2,4-triazole was used in place of the synthetic intermediate 1-5.

Synthesis of Compound Example 1-301
Compound example 1-301 was synthesized in accordance with the following synthetic scheme 1-4.
Synthetic Scheme 1-4
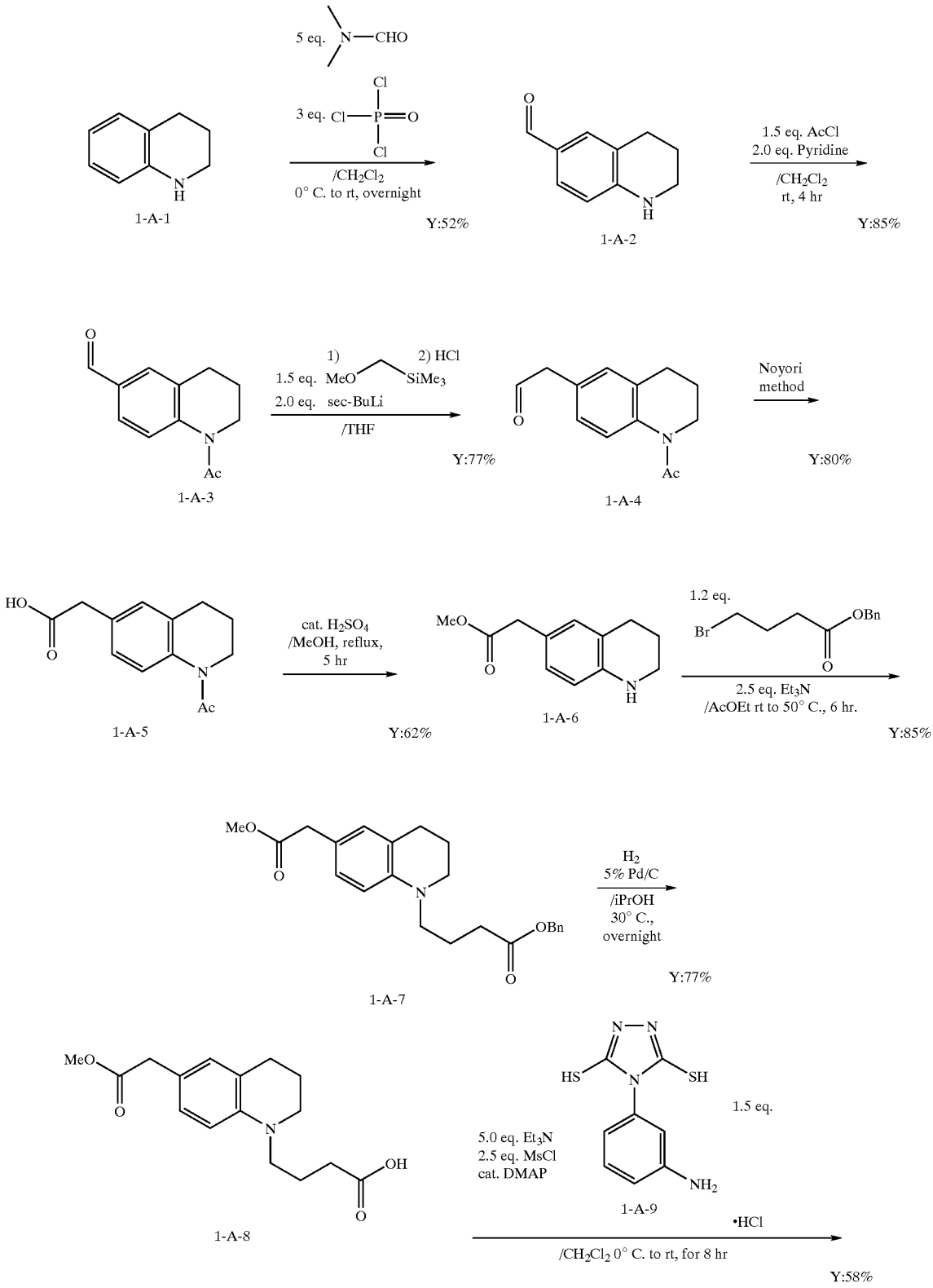

-continued

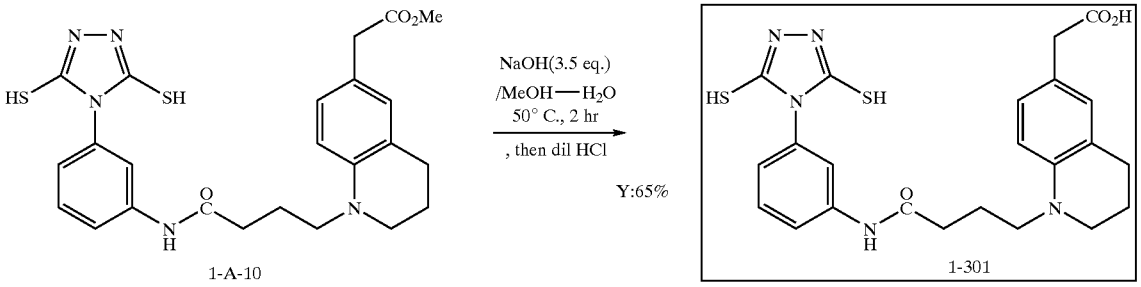

Synthesis of Synthetic Intermediate 1-A-2

Compound 1-A-1 (20 g), 50 mL of DMF and 70 g of phosphorus oxychloride were added to 300 mL of methylene chloride at 0° C., and agitated at room temperature around the clock. Water was added so as to terminate the reaction, and extraction and concentration were carried out. The thus obtained residue was purified by column chromatography. As a result, 12.6 g of synthetic intermediate 1-A-2 was obtained (yield 52%).

Synthesis of Synthetic Intermediate 1-A-3

Synthetic intermediate 1-A-2 (12 g), 8.7 g of acetyl chloride and 11.7 g of pyridine were added to 200 mL of methylene chloride at room temperature, and agitated for 4 hr. Water was added so as to terminate the reaction, and extraction and concentration were carried out. The thus obtained residue was purified by column chromatography. As a result, 12.8 g of synthetic intermediate 1-A-3 was obtained (yield 85%).

Synthesis of Synthetic Intermediate 1-A-4

10.5 g of methoxymethyltrimethylsilane was added to 200 mL of THF at −78° C. Further, 118 mL of sec-butyllithium (1.0 M, cyclohexane solution) was dropped thereinto with the temperature thereof slowly raised to −25° C. Subsequently, synthetic intermediate 1-A-3 (12 g) was dropped with the temperature thereof slowly raised to room temperature. A saturated aqueous solution of ammonium chloride was added so as to terminate the reaction, and extraction with ether and concentration were carried out. The thus obtained residue was purified by column chromatography. As a result, 9.9 g of synthetic intermediate 1-A-4 was obtained (yield 77%).

Synthesis of Synthetic Intermediate 1-A-5

Synthetic intermediate 1-A-4 (9.0 g), 0.14 g of sodium tungstate dihydrate, 5.8 g of tri(n-octyl)methylammonium sulfate and 7.0 g of a 30% aqueous solution of hydrogen peroxide were added to 50 mL of toluene, and agitated at 50° C. for 5 hr. The reaction mixture was concentrated, and the thus obtained residue was purified by column chromatography. As a result, 7.7 g of synthetic intermediate 1-A-5 was obtained (yield 80%).

Synthesis of Synthetic Intermediate 1-A-6

Synthetic intermediate 1-A-5 (7.0 g) was dissolved in 150 mL of methanol, and 0.5 mL of concentrated sulfuric acid was added to the solution. The mixture was refluxed so as to effect a reaction for 5 hr. The reaction mixture was cooled to room temperature, and concentrated. The thus obtained residue was purified by column chromatography. As a result, 3.8 g of synthetic intermediate 1-A-6 was obtained (yield 62%).

Synthesis of Synthetic Intermediate 1-A-7

Synthetic intermediate 1-A-6 (3.5 g), 5.3 g of γ-bromobutyric acid benzyl ester and 4.3 g of triethylamine were mixed with 50 mL of ethyl acetate, and agitated at 50° C. for 6 hr. The reaction mixture was cooled to room temperature, extracted with water, and concentrated. The thus obtained residue was purified by column chromatography. As a result, 5.5 g of synthetic intermediate 1-A-7 was obtained (yield 85%).

Synthesis of Synthetic Intermediate 1-A-8

Synthetic intermediate 1-A-7 (5.2 g) was dissolved in 50 mL of isopropyl alcohol. 1.0 g of 5% Pd/C was added to the solution, and reacted in a hydrogen atmosphere under atmospheric pressure around the clock. The hydrogen atmosphere was replaced by nitrogen, and catalysts were filtered off with the use of Celite. The filtrate was concentrated, and the thus obtained residue was purified by column chromatography. As a result, 3.0 g of synthetic intermediate 1-A-8 was obtained (yield 77%).

Synthesis of Synthetic Intermediate 1-A-10

Synthetic intermediate 1-A-8 (2.8 g) was dissolved in 30 mL of methylene chloride. 4.9 g of triethylamine, 2.8 g of mesyl chloride and 0.1 g of 4-(N,N-dimethylamino)pyridine were added to the solution at 0° C., and agitated for 30 min. Thereafter, 3.8 g of synthetic intermediate 1-A-9 was slowly added, and agitated at room temperature for 8 hr. Water was added so as to terminate the reaction, and extraction and concentration were carried out. The thus obtained residue was purified by column chromatography. As a result, 2.8 g of synthetic intermediate 1-A-10 was obtained (yield 58%).

Synthesis of Compound Example 1-301

Synthetic intermediate 1-A-10 (2.5 g) was dissolved in 25 mL of methanol. 3.5 mL of a 5 M aqueous solution of sodium hydroxide was added to the solution, and agitated at 50° C. for 2 hr. The reaction mixture was cooled to room temperature, and aqueous hydrochloric acid was added thereto to acidify the same. The resultant mixture was concentrated, and the residue was purified. As a result, 1.6 g of compound example 1-301 was obtained (yield 65%).

Synthesis of Compound Example 1-311
Compound example 1-311 was synthesized in accordance with the following synthetic scheme 1-5.
Synthesis of Synthetic Intermediate 1-B-2
In a nitrogen atmosphere, synthetic intermediate 1-B-1 (35 g), 0.7 g of $PdCl_2(PPh_3)_2$, 1.2 g of triphenylphosphine,
Synthetic scheme 1-5
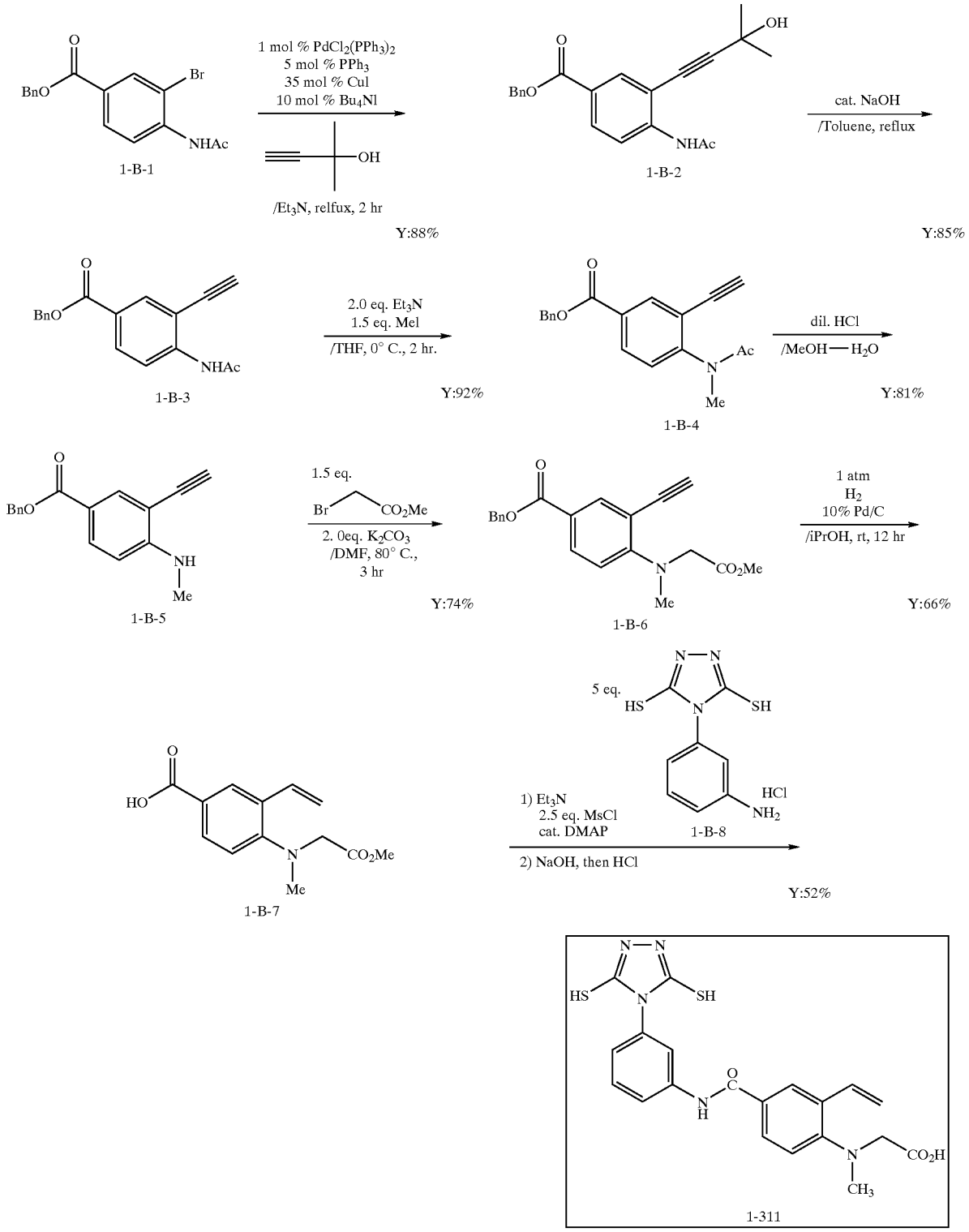

6.7 g of copper iodide, 3.7 g of tetrabutylammonium iodide and 25.4 g of 2-methyl-3-butyn-2-ol were dissolved in 500 mL of triethylamine and refluxed to effect a reaction for 2 hr. Triethylamine was distilled off, and ethyl acetate and water were added to thereby effect extraction. The extract was concentrated, and the thus obtained residue was purified by column chromatography. As a result, 31 g of synthetic intermediate 1-B-2 was obtained (yield 88%).

Synthesis of Synthetic Intermediate 1-B-3

Synthetic intermediate 1-B-2 (30 g) was dissolved in 300 mL of toluene. 1 g of sodium hydroxide was added to the solution, and refluxed under agitation for 3 hr. The reaction mixture was cooled, and toluene was distilled off. The thus obtained residue was purified by column chromatography. As a result, 21 g of synthetic intermediate 1-B-3 was obtained (yield 85%).

Synthesis of Synthetic Intermediate 1-B-4

Synthetic intermediate 1-B-3 (20 g), 13.8 g of triethylamine and 14.5 g of methyl iodide were added to 200 mL of THF at 0° C., and agitated for 2 hr. Water was added so as to terminate the reaction, and extraction with ether and concentration were carried out. The thus obtained residue was purified by column chromatography. As a result, 19.3 g of synthetic intermediate 1-B-4 was obtained (yield 92%).

Synthesis of Synthetic Intermediate 1-B-5

Synthetic intermediate 1-B-4 (19 g) was dissolved in 200 mL of methanol. 21 mL of 3 M hydrochloric acid was added to the solution, and agitated at 70° C. for 2 hr. The reaction mixture was cooled, and concentrated. The thus obtained residue was purified by column chromatography. As a result, 13.3 g of synthetic intermediate 1-B-5 was obtained (yield 81%).

Synthesis of Synthetic Intermediate 1-B-6

Synthetic intermediate 1-B-5 (13 g), 11.2 g of methyl bromoacetate and 13.5 g of potassium carbonate were mixed with 200 mL of DMF, and agitated at 80° C. for 3 hr. The reaction mixture was cooled, and aqueous hydrochloric acid was added so as to neutralize the reaction mixture. Extraction with ethyl acetate and concentration were carried out. The thus obtained residue was purified by column chromatography. As a result, 12.2 g of synthetic intermediate 1-B-6 was obtained (yield 74%).

Synthesis of Synthetic Intermediate 1-B-7

Synthetic intermediate 1-B-6 (12 g) was dissolved in 150 mL of isopropyl alcohol. 1.2 g of 10% Pd/C was added to the solution, and agitated in a hydrogen atmosphere under atmospheric pressure around the clock. The hydrogen atmosphere was replaced by nitrogen, and catalysts were filtered off with the use of Celite. The filtrate was concentrated, and the thus obtained residue was purified by column chromatography. As a result, 5.9 g of synthetic intermediate 1-B-7 was obtained (yield 66%).

Synthesis of Compound Example 1-311

Synthetic intermediate 1-B-7 (5.5 g), 11.2 g of triethylamine, 6.3 g of mesyl chloride and 0.2 g of 4-(N,N-dimethylamino)pyridine were dissolved in 120 mL of methylene chloride at 0° C., and agitated for 1 hr. Further, synthetic intermediate 1-B-8 (5.8 g) was slowly added, and agitated at room temperature for 3 hr. Water was added so as to terminate the reaction, and extraction with ethyl acetate and concentration were carried out. The thus obtained residue was dissolved in 60 mL of methanol. 16 mL of a 5 M aqueous solution of sodium hydroxide was added to the solution, and agitated at 50° C. for 1 hr. The reaction mixture was cooled, and acidified with the use of dilute hydrochloric acid. The solvent was distilled off, and the residue was purified. As a result, 5.1 g of compound example 1-311 was obtained (yield 52%).

Synthesis of Compound Example 1-331

Compound example 1-331 was synthesized in accordance with the following synthetic scheme 1-6.

Synthetic schme 1-6

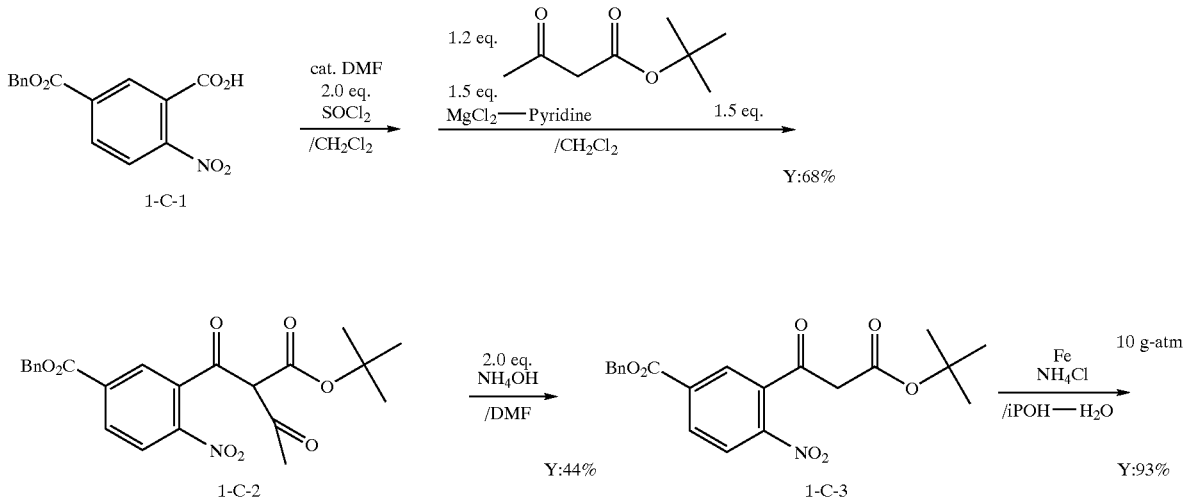

-continued

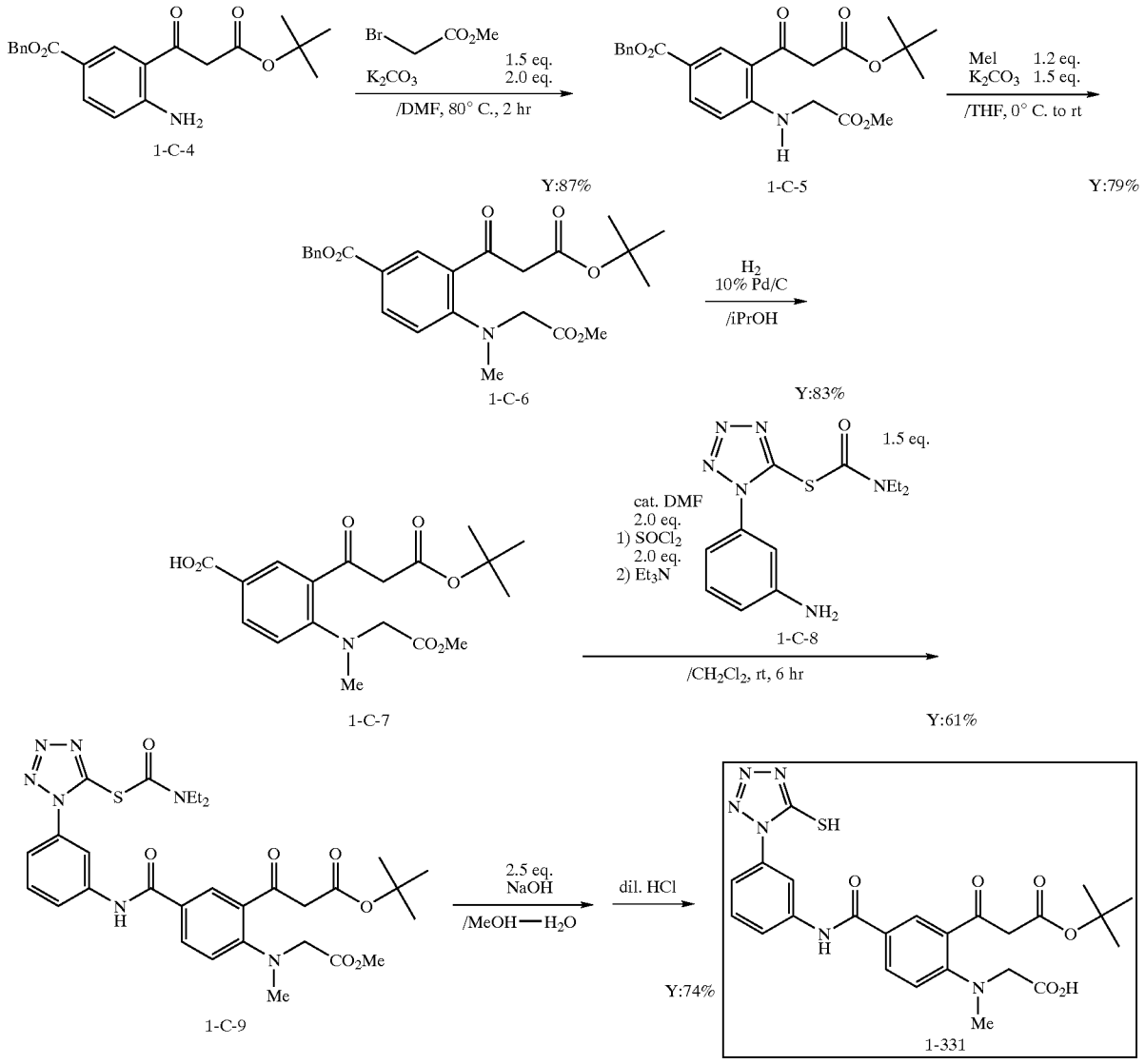

Synthesis of Synthetic Intermediate 1-C-2

Synthetic intermediate 1-C-1 (30 g) was dissolved in 300 mL of methylene chloride. 23.8 g of thionyl chloride and one drop of DMF were added to the solution, and agitated for 2 hr. The mixture was concentrated, and dissolved in 300 mL of methylene chloride. Further, 19 g of acetoacetic acid t-butyl ester, 14.3 g of magnesium chloride and 11.9 g of pyridine were added to the solution, and agitated at 50° C. for 5 hr. Water was added so as to terminate the reaction, and extraction with ethyl acetate and concentration were carried out. The thus obtained residue was purified by column chromatography. As a result, 30 g of synthetic intermediate 1-C-2 was obtained (yield 68%).

Synthesis of Synthetic Intermediate 1-C-3

Synthetic intermediate 1-C-2 (30 g) was dissolved in 250 mL of DMF. 9.3 g of 25% aqueous ammonia was added to the solution, and agitated at 50° C. for 3 hr. The reaction mixture was cooled, neutralized with the use of dilute hydrochloric acid, and extracted with ethyl acetate. The extract was concentrated, and the thus obtained residue was purified by column chromatography. As a result, 11.9 g of synthetic intermediate 1-C-3 was obtained (yield 44%).

Synthesis of Synthetic Intermediate 1-C-4

100 mL of isopropanol, 20 mL of water, 1.4 g of ammonium chloride and 14 g of reduced iron were mixed together, and agitated at 80° C. for 1 hr. The mixture was cooled, and synthetic intermediate 1-C-3 (10 g) was added thereto. The mixture was agitated at 80° C. for 3 hr, and filtered through Celite at 60° C. The filtrate was concentrated, and the thus obtained residue was purified by column chromatography. As a result, 8.6 g of synthetic intermediate 1-C-4 was obtained (yield 93%).

Synthesis of Synthetic Intermediate 1-C-5

Synthetic intermediate 1-C-4 (8.5 g), 5.3 g of methyl bromoacetate and 6.4 g of potassium carbonate were dissolved in 60 mL of DMF, and agitated at 80° C. for 2 hr. The reaction mixture was cooled, and water was added. Extraction with ethyl acetate and concentration were carried out.

The thus obtained residue was purified by column chromatography. As a result, 8.8 g of synthetic intermediate 1-C-5 was obtained (yield 87%).

Synthesis of Synthetic Intermediate 1-C-6

Synthetic intermediate 1-C-5 (8.0 g), 3.1 g of methyl iodide and 3.8 g of potassium carbonate were dissolved in 60 mL of THF, and agitated at room temperature for 12 hr. Water was added so as to terminate the reaction, and extraction with ether and concentration were carried out. The thus obtained residue was purified by column chromatography. As a result, 6.5 g of synthetic intermediate 1-C-6 was obtained (yield 79%).

Synthesis of Synthetic Intermediate 1-C-7

Synthetic intermediate 1-C-6 (6.0 g) was dissolved in 120 mL of isopropyl alcohol. 1.2 g of 10% Pd/C was added to the solution, and agitated in a hydrogen atmosphere under atmospheric pressure at room temperature around the clock. The hydrogen atmosphere was replaced by nitrogen, and catalysts were filtered off with the use of Celite. The filtrate was concentrated, and the thus obtained residue was purified by column chromatography. As a result, 4.0 g of synthetic intermediate 1-C-7 was obtained (yield 83%).

Synthesis of Synthetic Intermediate 1-C-9

Synthetic intermediate 1-C-7 (4.0 g) was dissolved in 60 mL of methylene chloride. 2.6 g of thionyl chloride and one drop of DMF were added to the solution, and agitated for 2 hr. The mixture was concentrated, and dissolved in 60 mL of methylene chloride once more. 4.8 g of synthetic intermediate 1-C-8 and 2.2 g of triethylamine were added to the solution, and agitated at room temperature for 6 hr. Water was added, and extraction and concentration were carried out. The thus obtained residue was purified by column chromatography. As a result, 4.3 g of synthetic intermediate 1-C-9 was obtained (yield 61%).

Synthesis of Compound Example 1-331

Synthetic intermediate 1-C-9 (4.5 g) was dissolved in 50 mL of methanol. 3.5 mL of a 5 M aqueous solution of sodium hydroxide was added to the solution, and agitated at 60° C. for 1 hr. The reaction mixture was cooled, and acidified with the use of dilute aqueous hydrochloric acid. The mixture was concentrated, and the residue was purified. As a result, 2.7 g of compound example 1-331 was obtained (yield 74%).

2-1

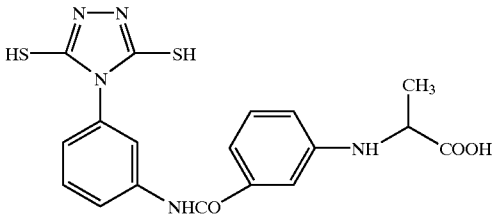

2-2

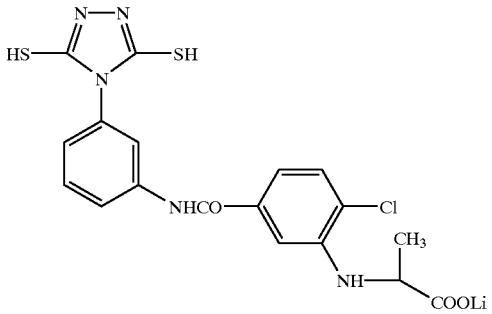

2-3

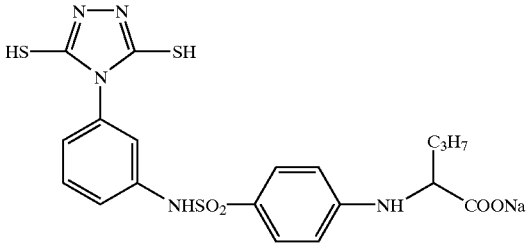

2-4

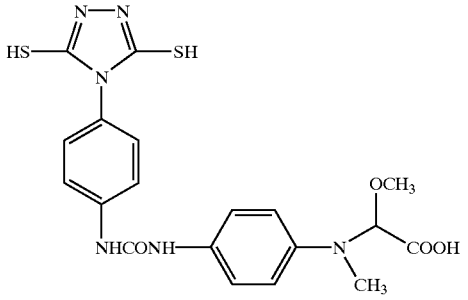

2-5

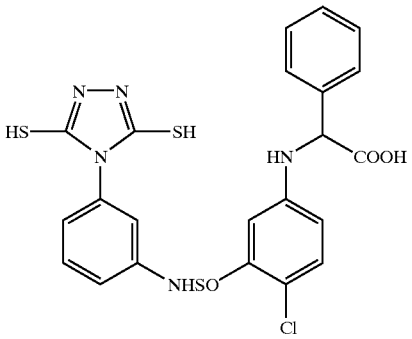

2-6

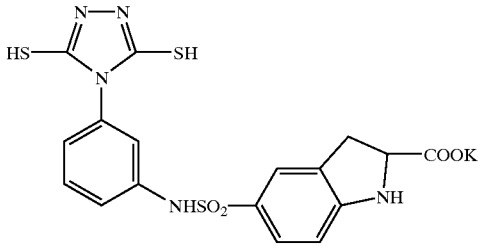

-continued
2-7
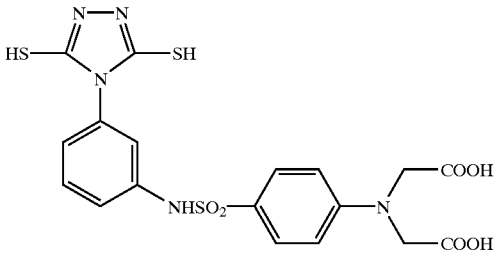
2-8
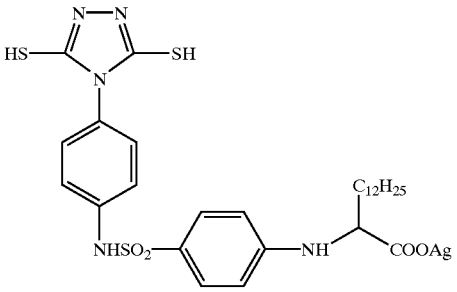
2-9
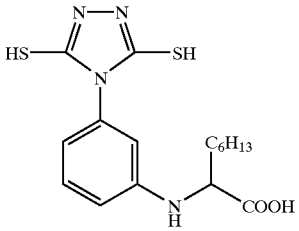
2-10
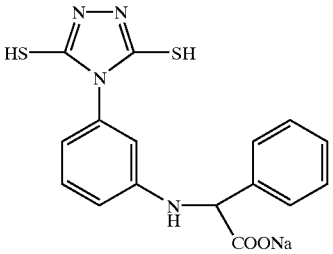
2-11
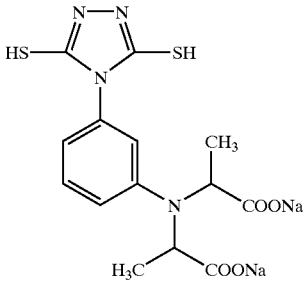
2-12
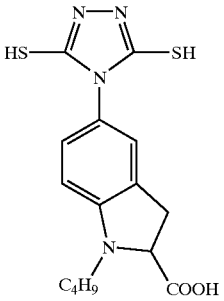
2-13
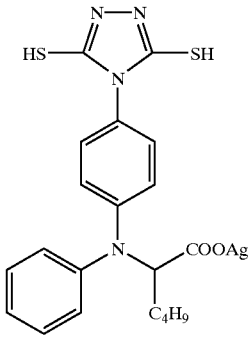
2-14
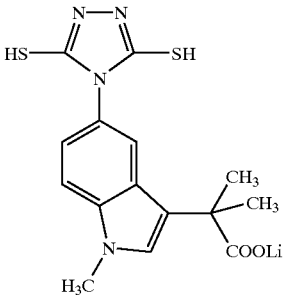
2-15
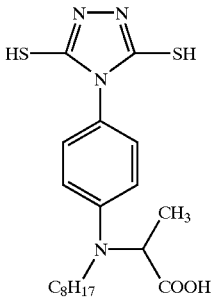
2-16
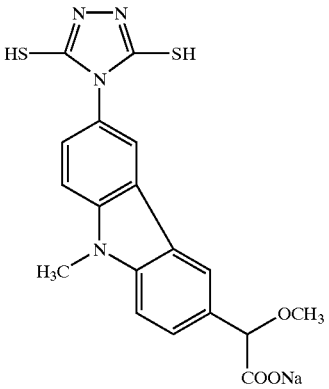

-continued
2-17
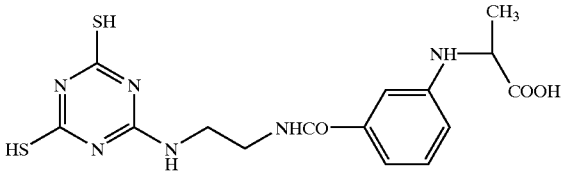
2-18
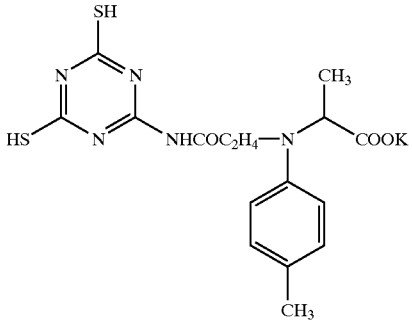
2-19
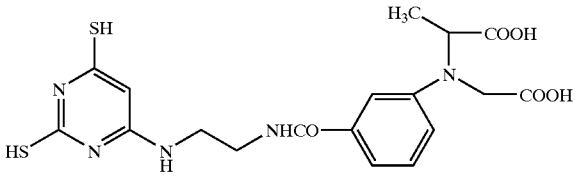
2-20
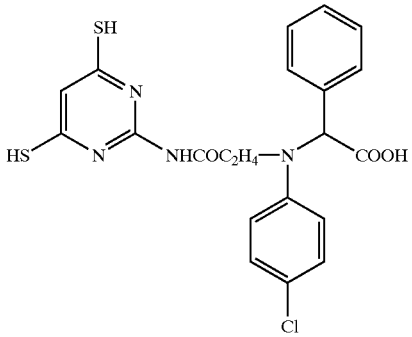
2-21
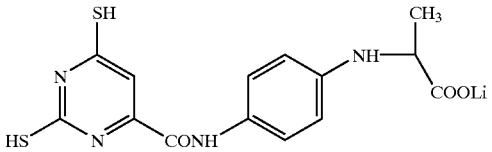
2-22
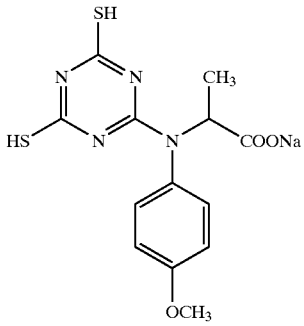
2-23
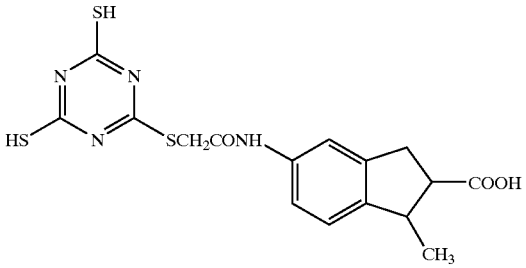
2-24
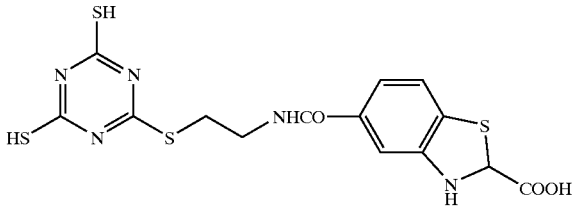
2-25
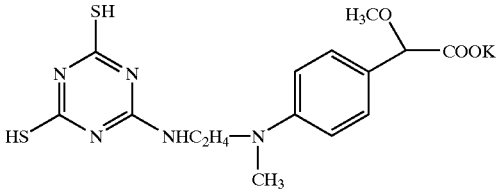

-continued
2-26
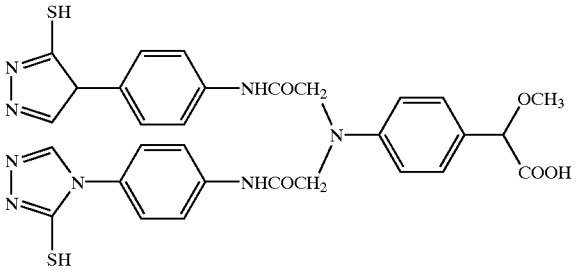
2-27
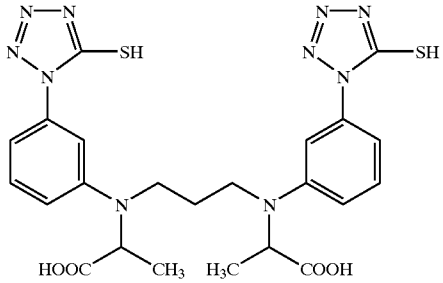
2-28
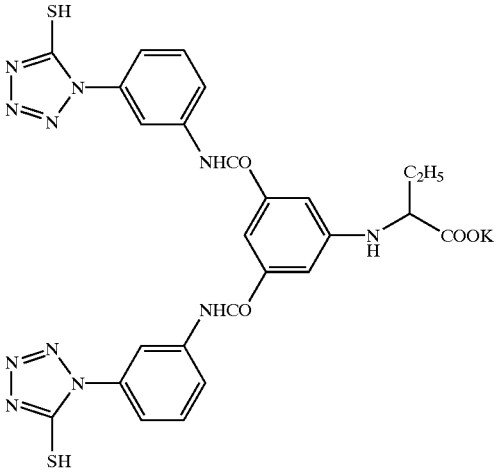
2-29
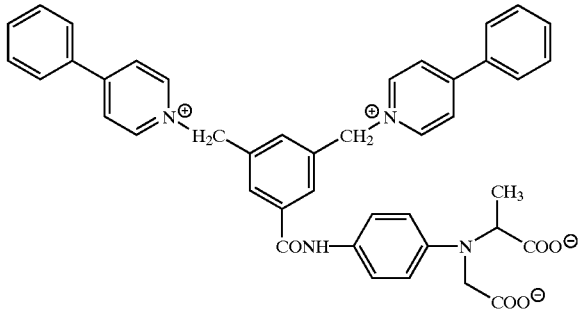
2-30
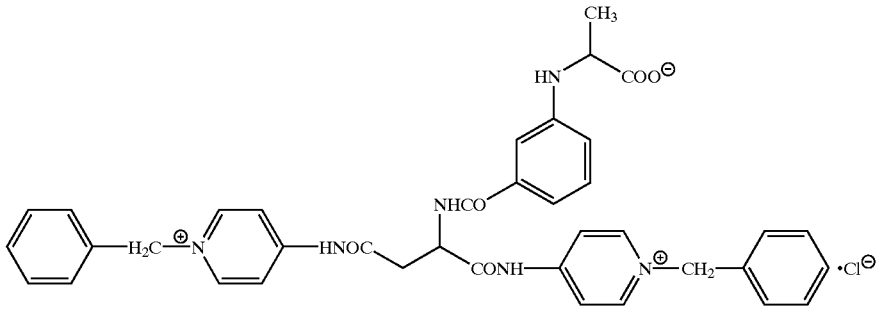
2-31
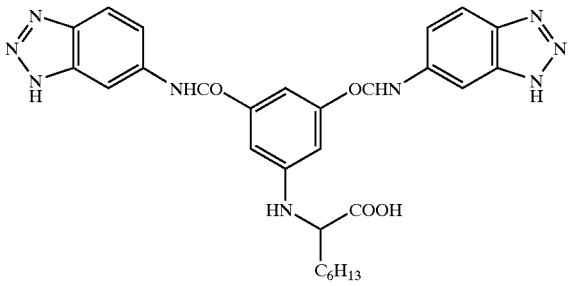
2-32
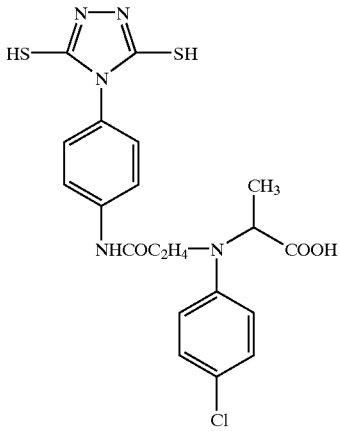

-continued
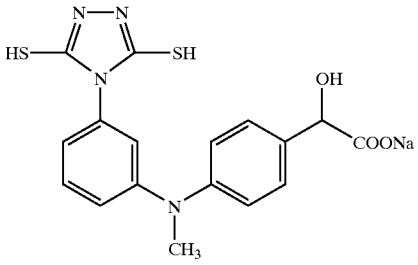
2-33
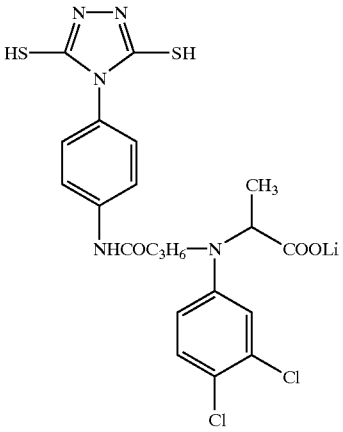
2-34
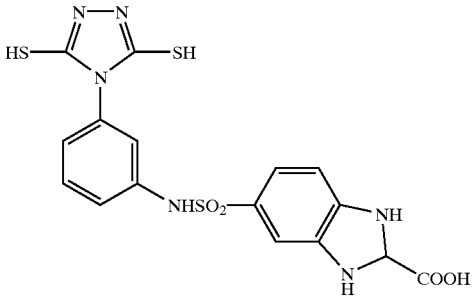
2-35
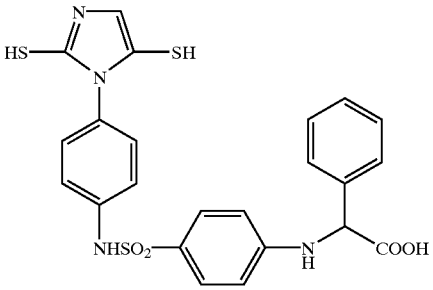
2-36
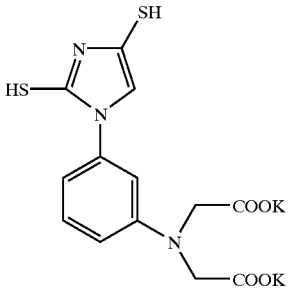
2-37
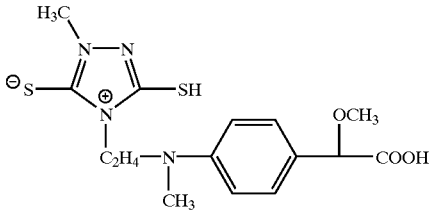
2-38
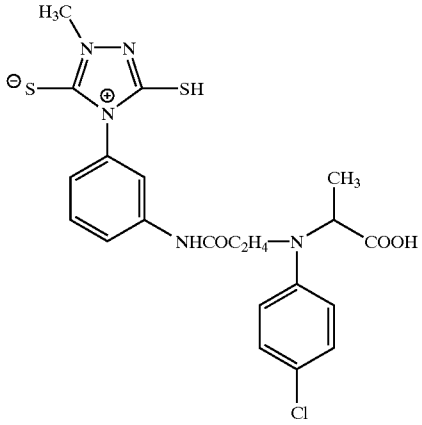
2-39
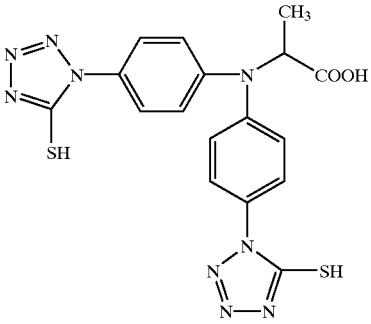
2-40

-continued
2-41
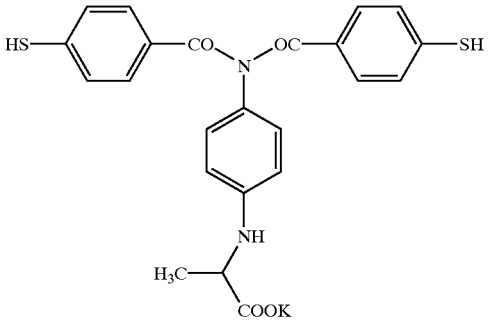
2-42
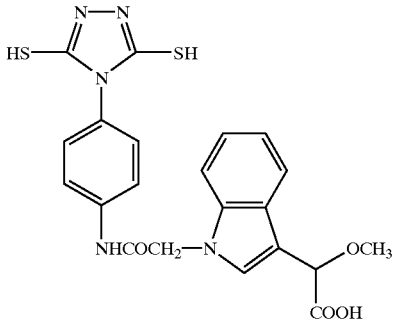
2-43
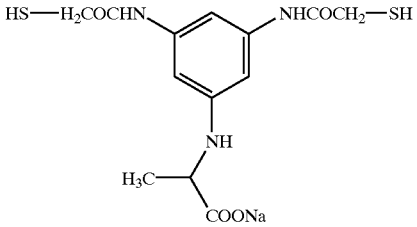
2-44
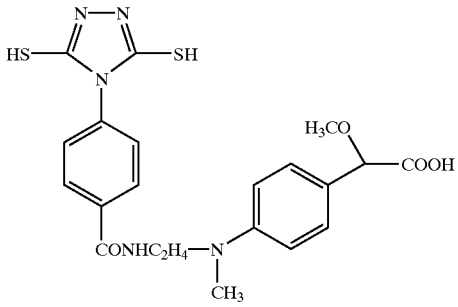
2-45
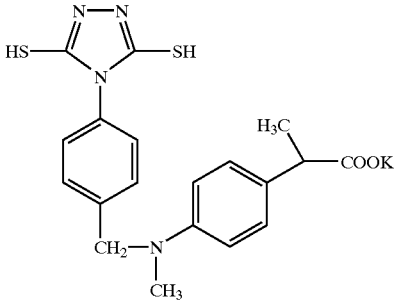
2-46
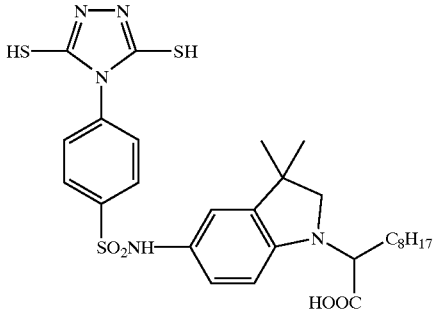
2-47
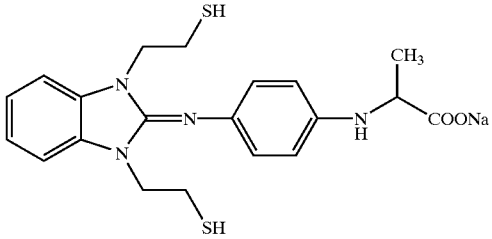
2-48
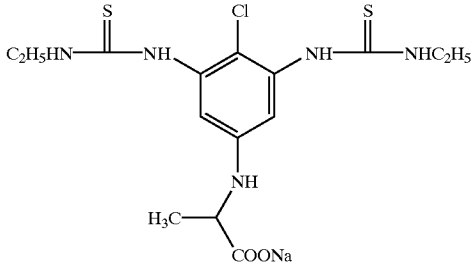
2-50
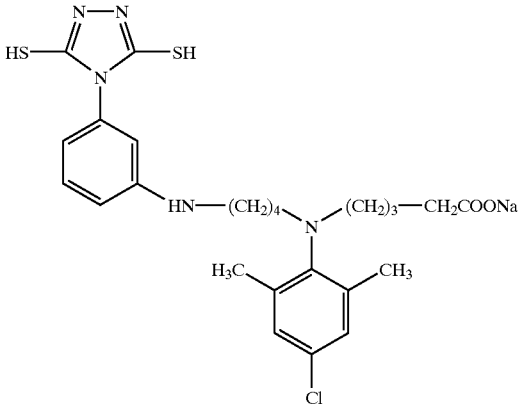
2-51
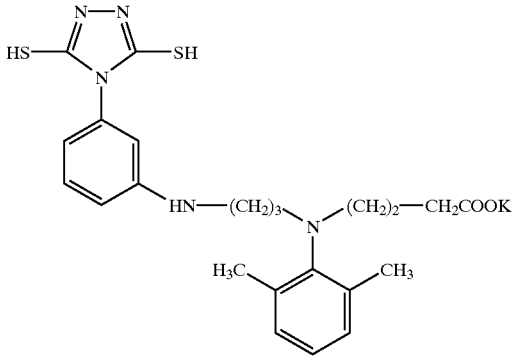

-continued
2-52
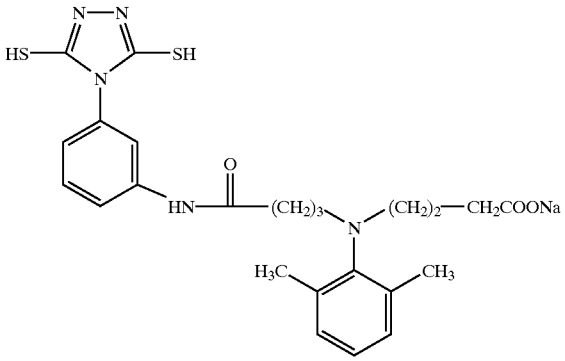
2-53
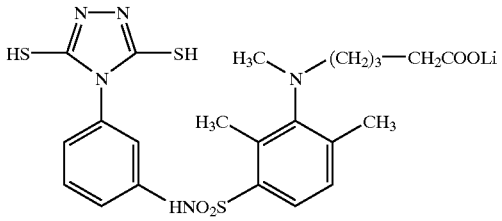
2-54
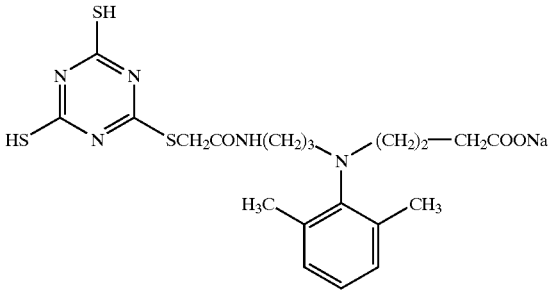
2-55
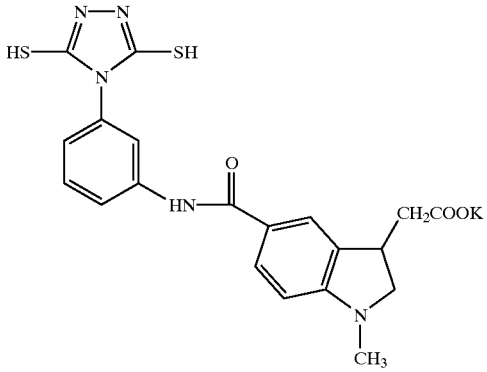
2-56
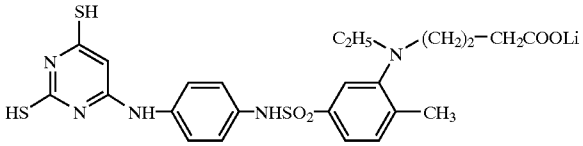
2-57
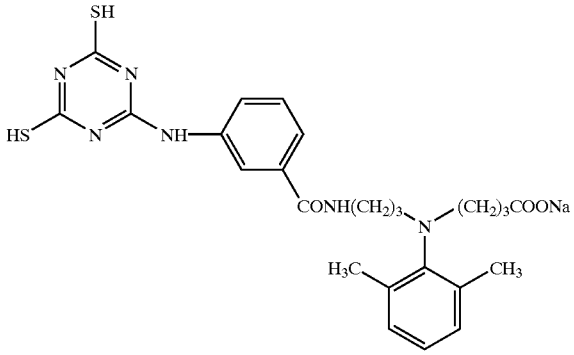
2-58
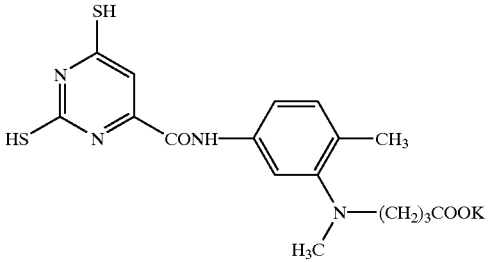

-continued
2-59
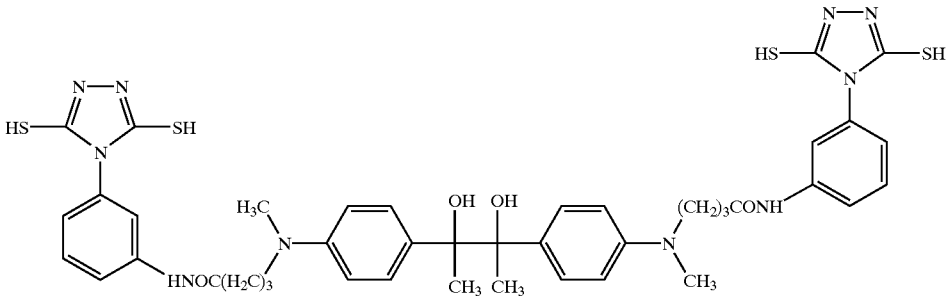
2-60
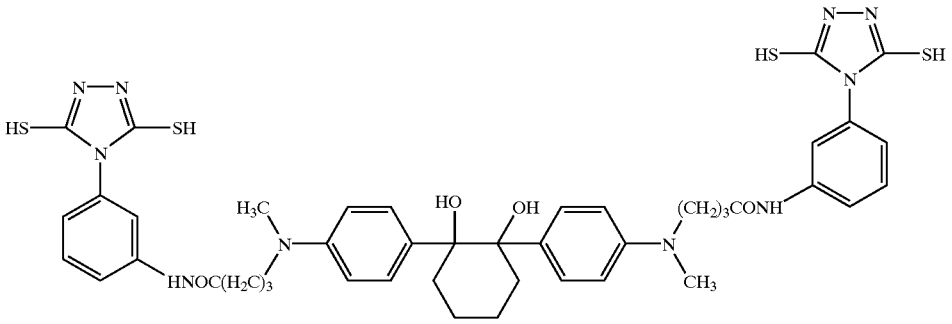
2-61
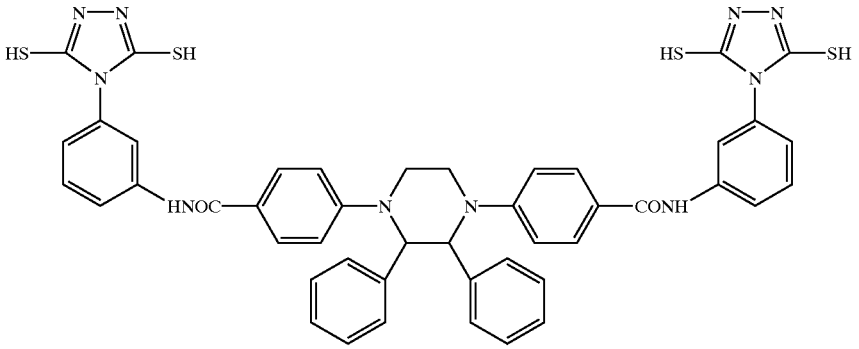
2-62
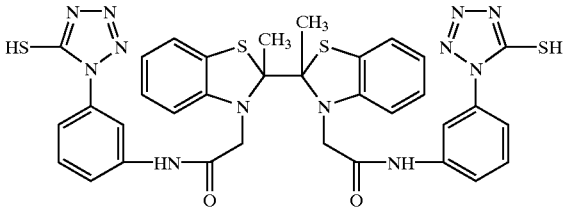
2-63
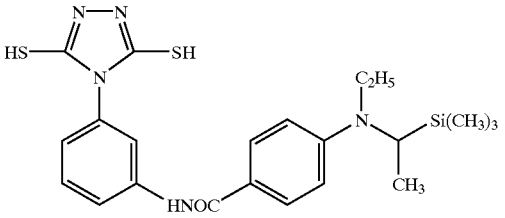

Synthetic Example

Compounds of Type 2 according to the present invention can be easily synthesized by known processes. Particular synthetic examples thereof will be described below.

Synthesis of Compound Example 2-1

Compound example 2-1 was synthesized in accordance with the following synthetic scheme 2-1.

Synthetic scheme 2-1

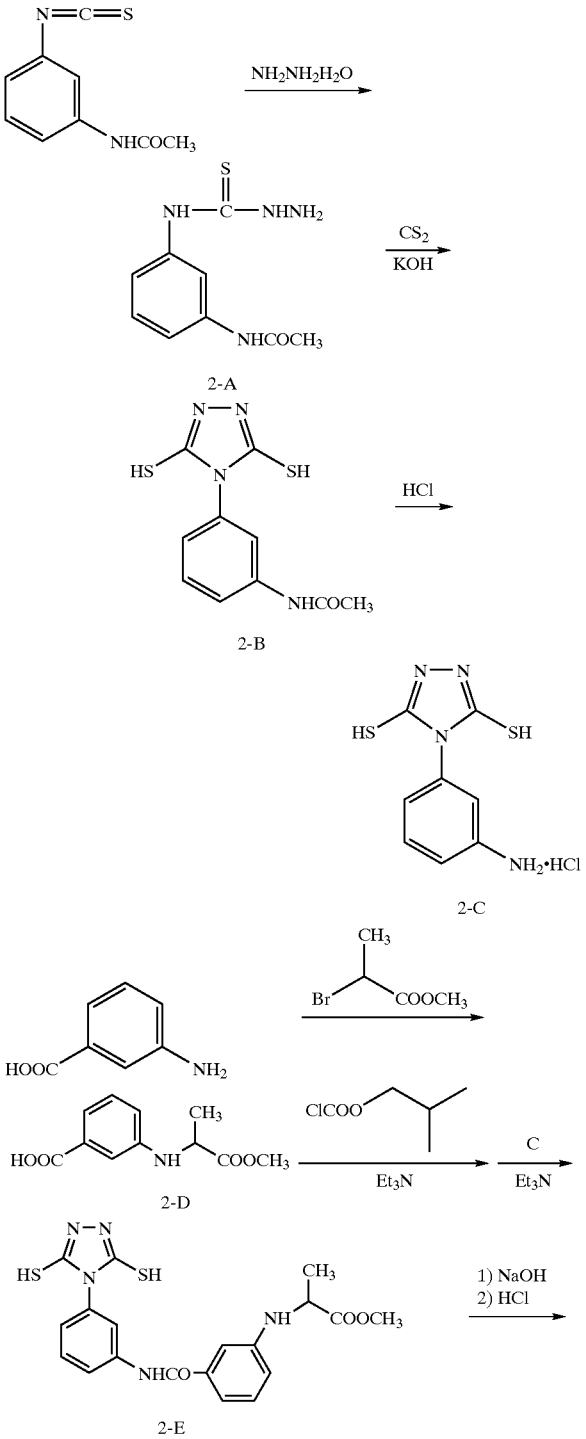

-continued

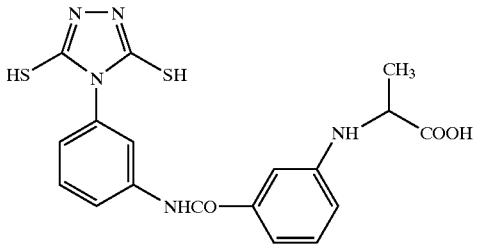

Exemplified compound 2-1

Synthesis of Synthetic Intermediate 2-A

Isopropanol (50 mL) was added to hydrazine monohydrate (15.0 g). A solution of m-acetylamino isothiocyanate (19.2 g) in a 1:1 mixture of acetonitrile and tetrahydrofuran (400 mL) was dropped thereinto under agitation at 10° C. or below. After the agitation at this temperature for 1 hr, the reaction mixture was concentrated to thereby effect crystallization. The crystal was washed with acetonitrile. As a result, 19.6 g of desired synthetic intermediate 2-A was obtained (yield 87%).

Synthesis of Synthetic Intermediate 2-B

Ethanol (200 mL) and water (40 mL) were added to potassium hydroxide (5.4 g), and synthetic intermediate 2-A (18.4 g) and carbon disulfide (10 mL) were sequentially added thereto under agitation. The mixture was slowly heated to 70° C. and reacted for 6 hr. Thereafter, water (1 L) and concentrated hydrochloric acid (7.2 mL) were sequentially added to the mixture, thereby effecting crystallization. The crystal was harvested by filtration. As a result, 17.3 g of desired synthetic intermediate 2-B was obtained (yield 79%).

Synthesis of Synthetic Intermediate 2-C

Synthetic intermediate 2-B (16.0 g), water (150 mL) and concentrated hydrochloric acid (300 mL) were refluxed by heating for 5 hr, and cooled. Thereafter, acetonitrile (300 mL) was added to the mixture, thereby effecting crystallization. The crystal was harvested by filtration. As a result, 14.8 g of desired synthetic intermediate 2-C was obtained (yield 95%).

Synthesis of Synthetic Intermediate 2-D m-Aminobenzoic acid (96 g), methyl 2-bromopropionate (94 mL), 2,6-lutidine (179 mL) and acetonitrile (300 mL) were refluxed by heating for 10 hr. Ethyl acetate and 1 N hydrochloric acid were added to the reaction mixture, and a liquid separation was effected. The thus obtained organic layer was washed with water twice, and dried over magnesium sulfate. The solvent was distilled off in vacuum, and crystallization from a mixture of ethyl acetate and hexane was effected. The crystal was harvested by filtration. As a result, 100.2 g of desired synthetic intermediate 2-D was obtained (yield 64%).

Synthesis of Synthetic Intermediate 2-E

N,N-dimethylacetamide (50 mL) and acetonitrile (50 mL) were added to synthetic intermediate 2-D (5.6 g). Isobutyl chloroformate (3.6 mL) and triethylamine (3.8 mL) were sequentially dropped into the mixture under agitation at 0° C. or below, and agitated at this temperature for 30 min. At 0° C. or below, compound 2-C (7.2 g) was added, and subsequently triethylamine (3.8 mL) was dropped thereinto. Reaction was effected at room temperature for 3 hr. Ethyl acetate and 1 N hydrochloric acid were added to the reaction mixture, and a liquid separation was effected. The thus obtained organic layer was washed with water twice, and dried over magnesium sulfate. The solvent was distilled off in vacuum, thereby obtaining a crude product. The crude product was purified by silica gel column chromatography, thereby obtaining 3.4 g of desired synthetic intermediate 2-E (yield 32%).

Synthesis of Compound Example 2-1

Synthetic intermediate 2-E (3.0 g) and 1 N sodium hydroxide (28 mL) were reacted with each other at room temperature for 3 hr. Ethyl acetate and 1 N hydrochloric acid were added to the reaction mixture, and a liquid separation was effected. The thus obtained organic layer was washed with water twice, and dried over magnesium sulfate. The solvent was distilled off in vacuum, thereby obtaining a crude product. The crude product was subjected to crystallization from ethyl acetate. The crystal was harvested by filtration. As a result, 2.7 g of desired compound example 2-1 was obtained (yield 93%).

Synthesis of Compound Example 2-17

Compound example 2-17 was synthesized in exactly the same manner as in the synthesis of compound example 2-1, except that 2-(2-aminoethylamino)-4,6-dimercaptotriazine was employed in place of synthetic intermediate 2-C.

Synthesis of Compound Example 2-5

Compound example 2-5 was synthesized in exactly the same manner as in the synthesis of compound example 2-1, except that 3-(α-phenyl-α-methoxycarbonylmethylamino)-6-chlorobenzoic acid was employed in place of synthetic intermediate 2-D.

3-1

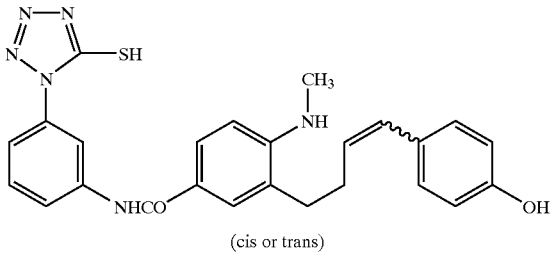

3-2

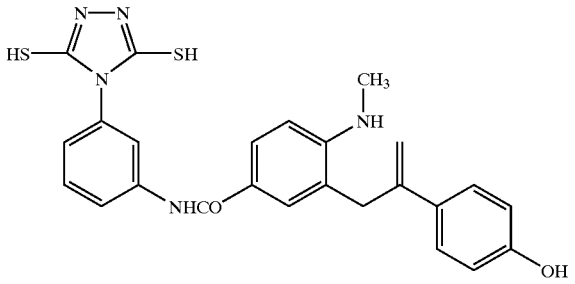

3-3

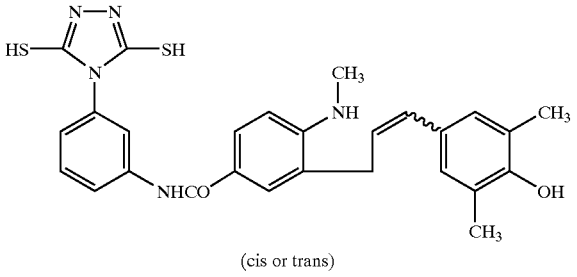

3-4

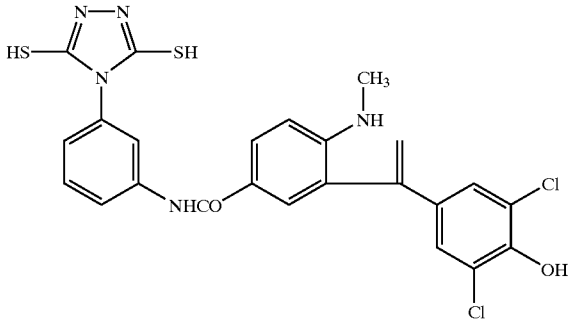

3-5

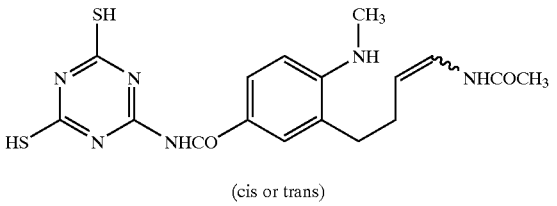

3-6

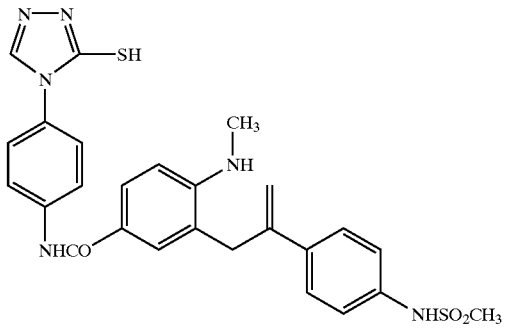

-continued
3-7
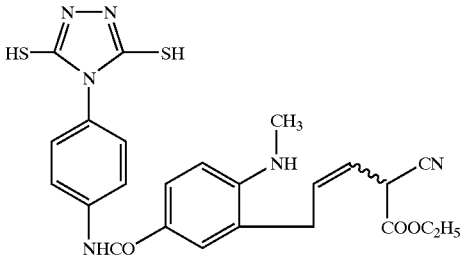
(cis or trans)
3-8
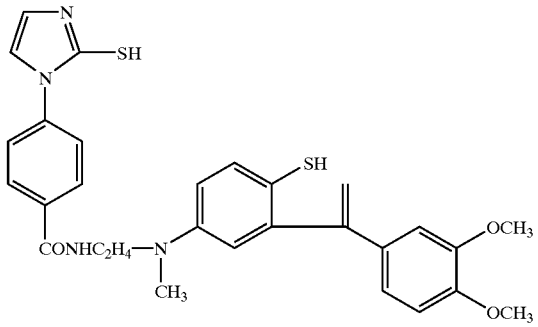
3-9
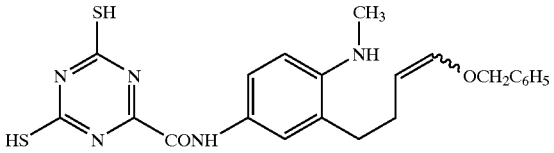
(cis or trans)
3-10
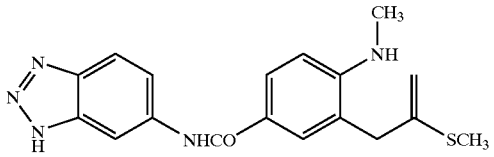
3-11
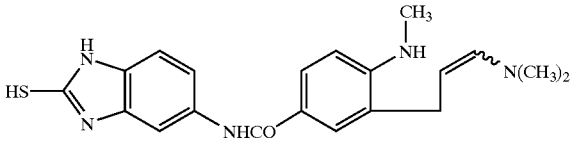
(cis or trans)
3-12
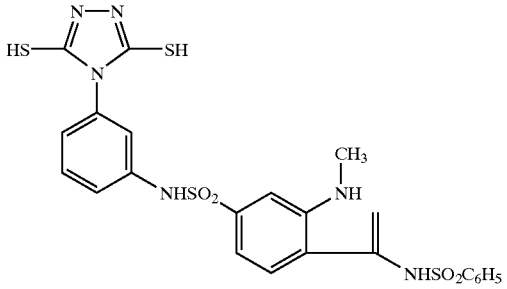
3-13
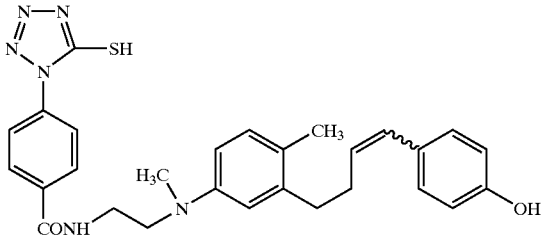
(cis or trans)
3-14
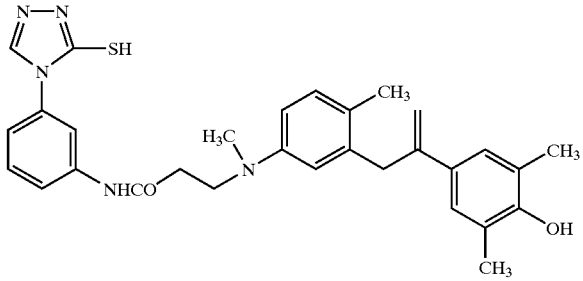
3-15
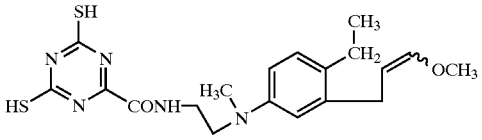
(cis or trans)
3-16
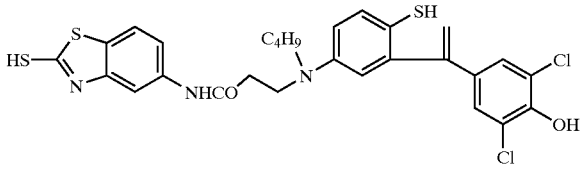
3-17
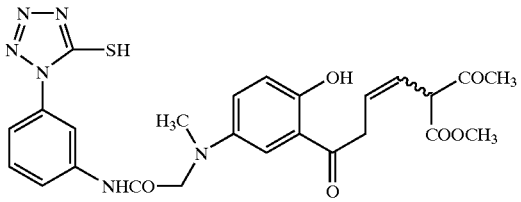
(cis or trans)
3-18
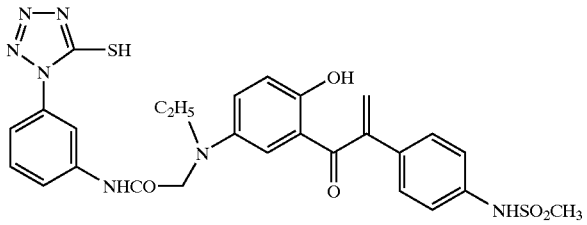

-continued
3-19
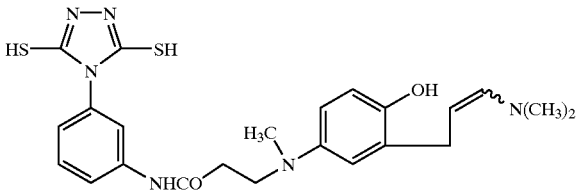
(cis or trans)
3-20
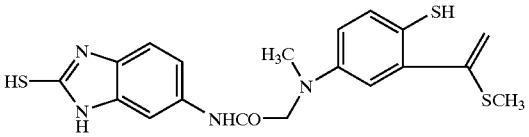
3-21
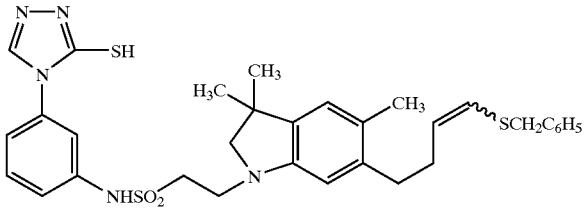
(cis or trans)
22
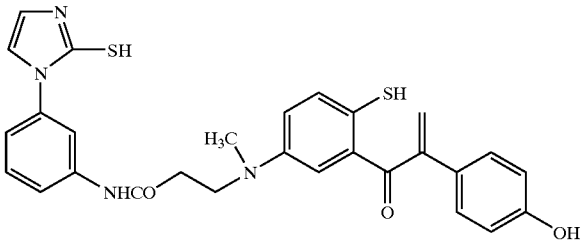
3-23
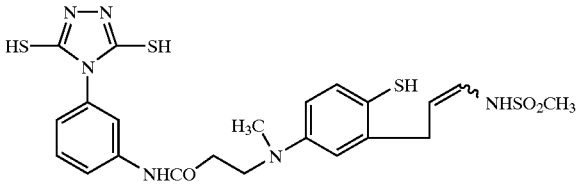
(cis or trans)
3-24
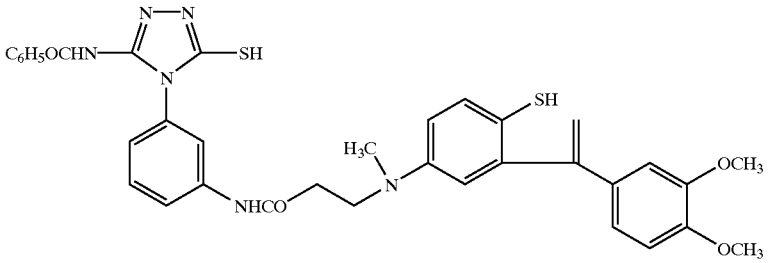
3-25
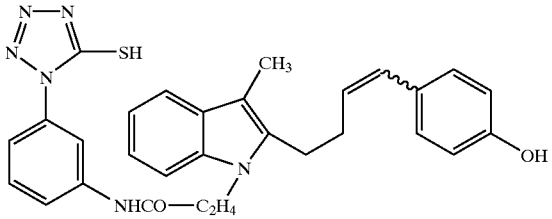
(cis or trans)
3-26
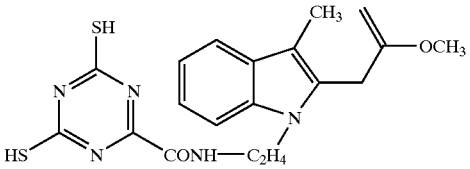

-continued
3-27
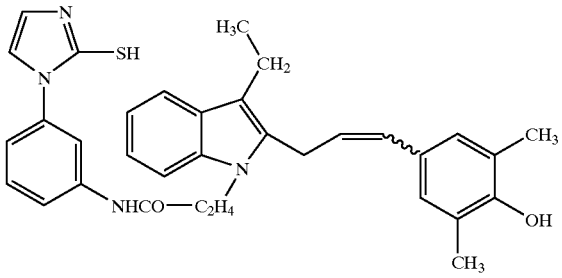
(cis or trans)
3-28
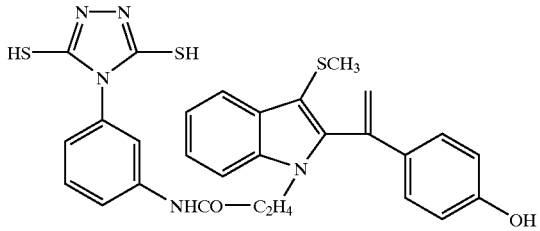
3-29
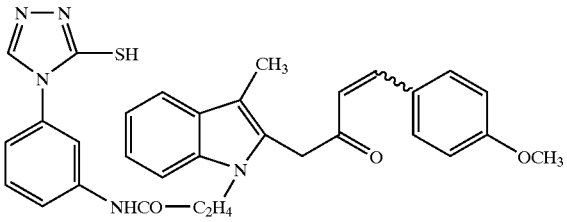
(cis or trans)
3-30
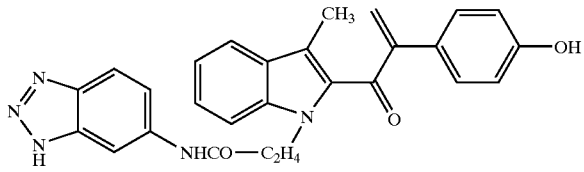
3-31
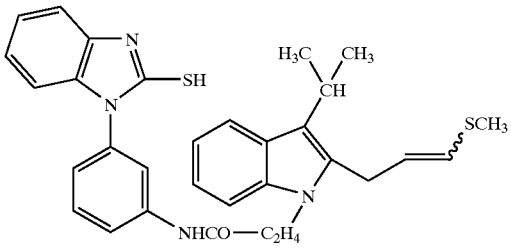
(cis or trans)
3-32
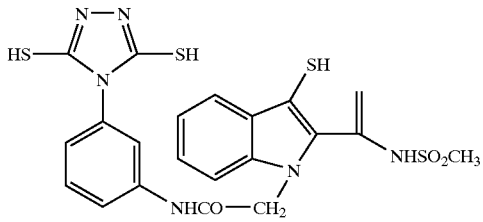
3-33
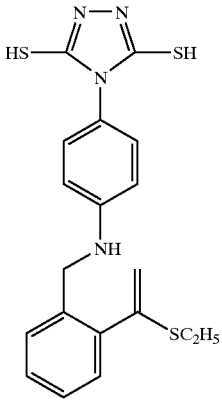
3-34
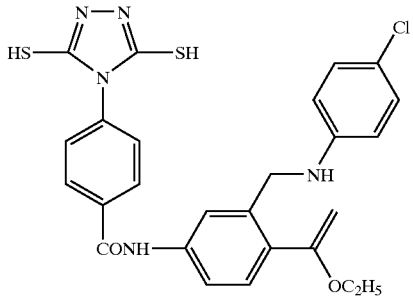
3-35
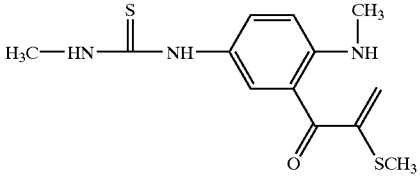
3-36
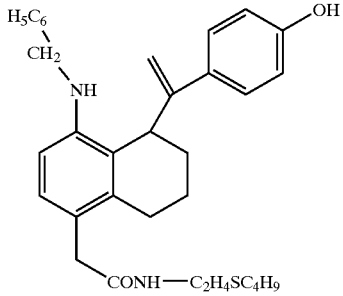

-continued
3-37
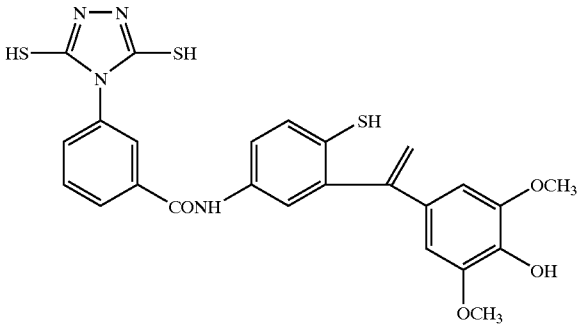
3-38
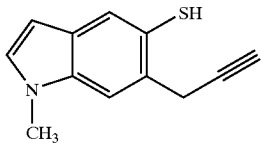
3-39
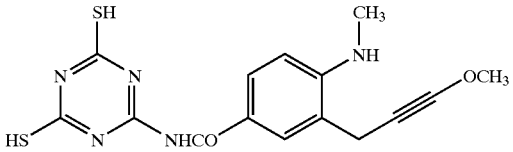
3-40
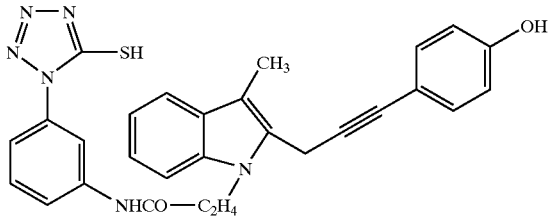
3-41
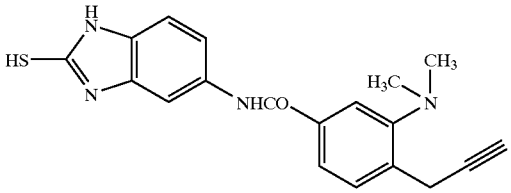
3-42
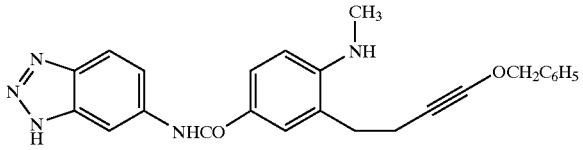
3-43
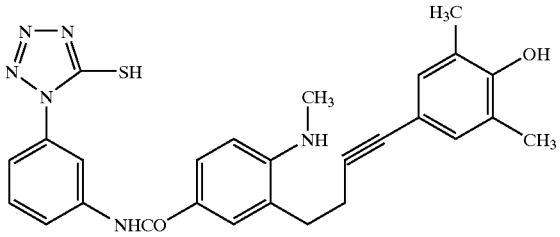
3-44
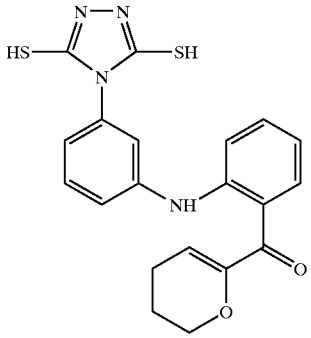
3-45
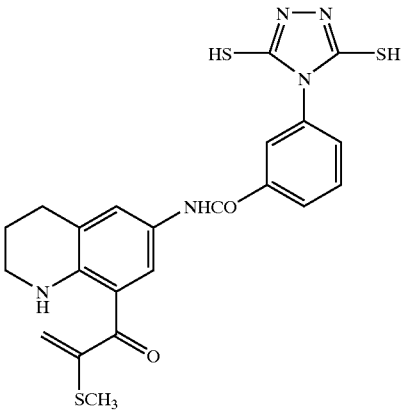
3-46
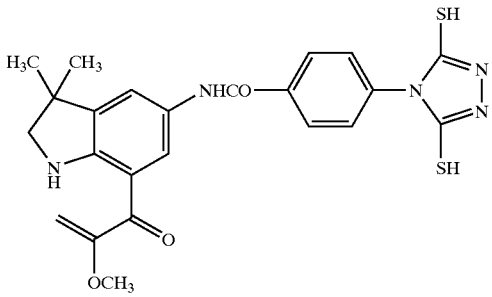

-continued
3-47
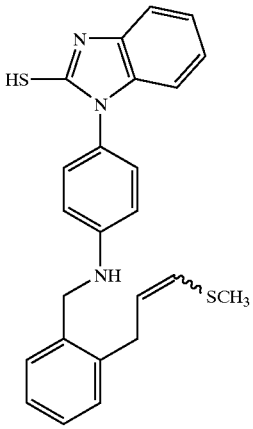
(cis or trans)
3-48
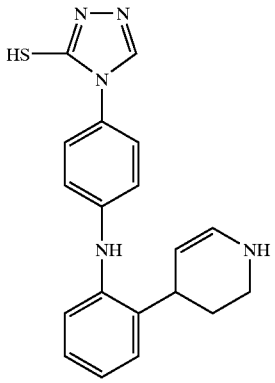
3-49
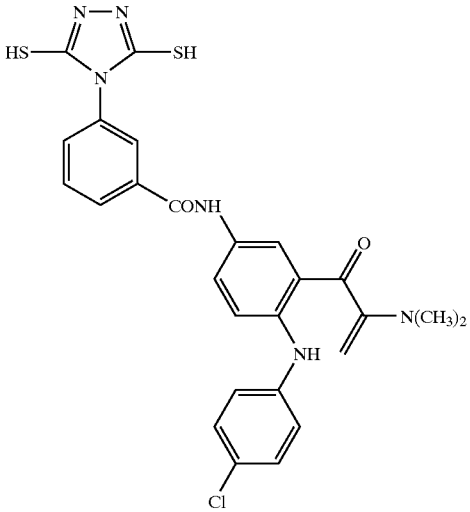
3-50
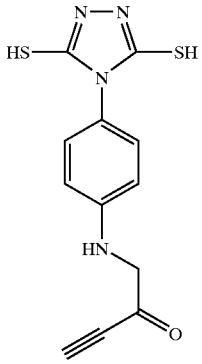
3-51
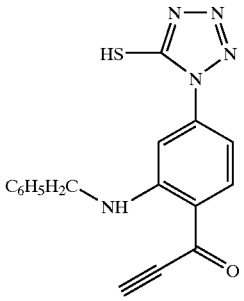
3-52
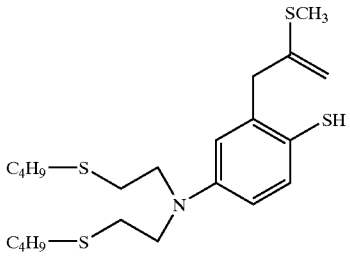
3-53
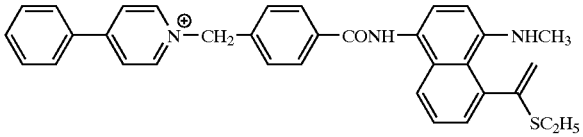
3-54
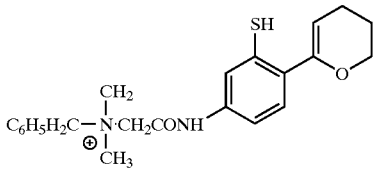
•Cl⊖

-continued
3-55
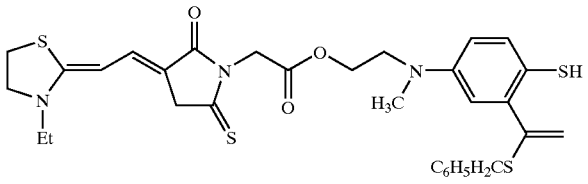
3-56
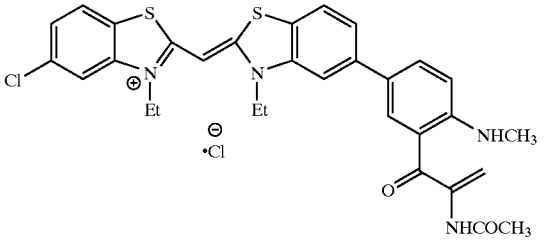
3-57
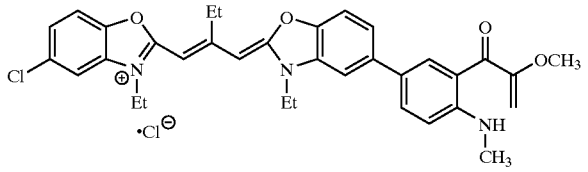
3-58
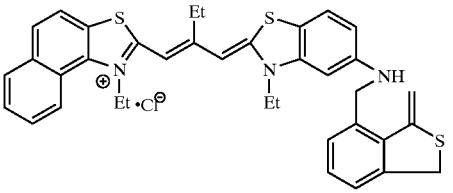
3-59
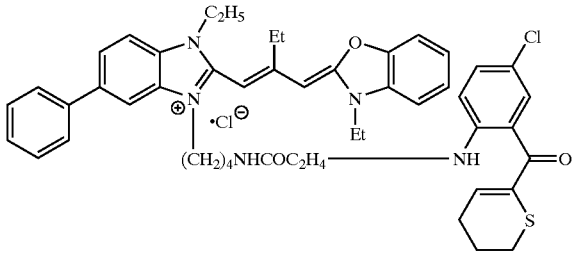
3-60
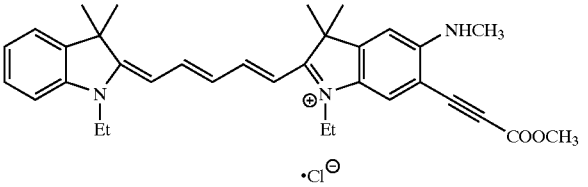
3-61
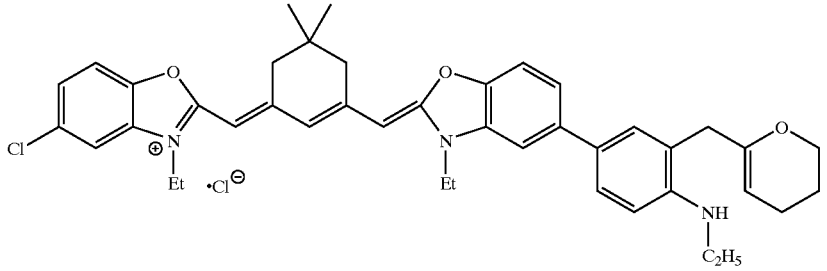
3-62
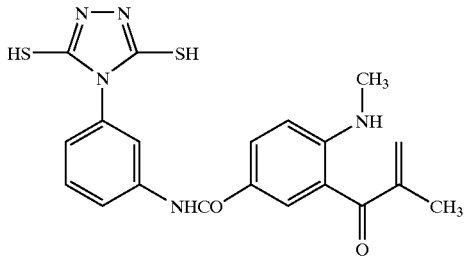
3-63
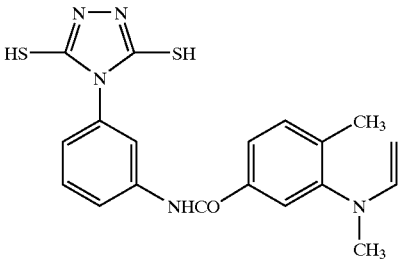
3-64
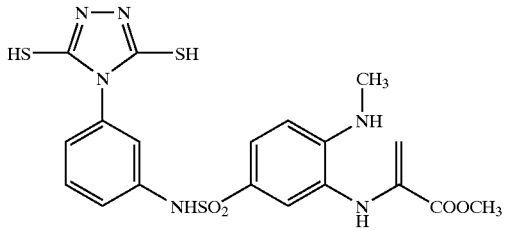
3-65
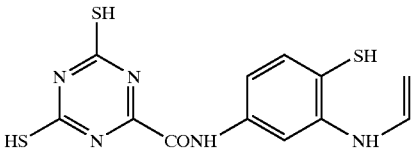

-continued
3-66
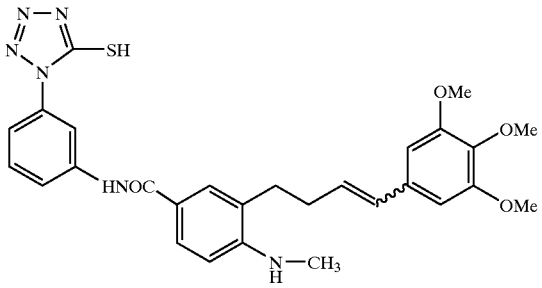
(cis or trans)
3-67
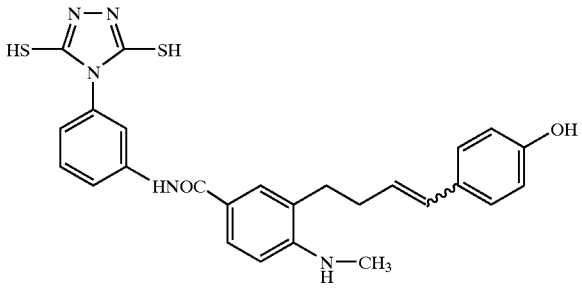
(cis or trans)
3-68
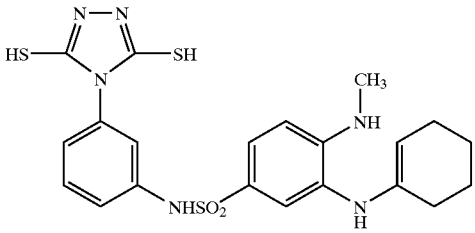
3-69
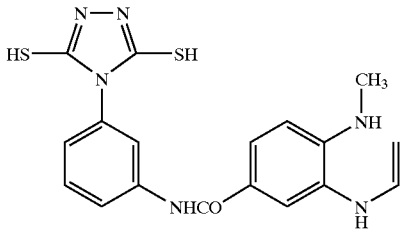
3-70
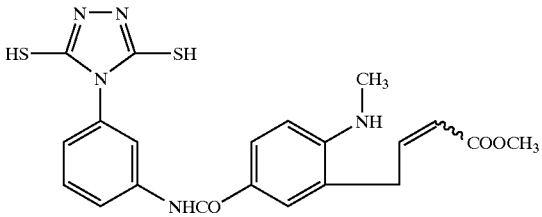
(cis or trans)
3-71
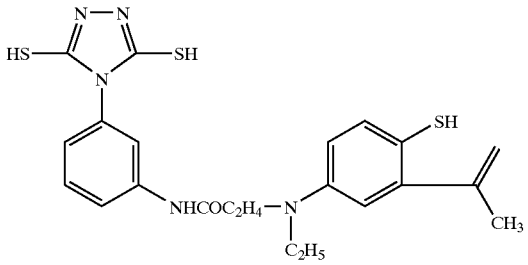
3-72
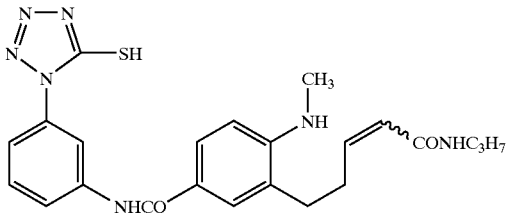
(cis or trans)
3-73
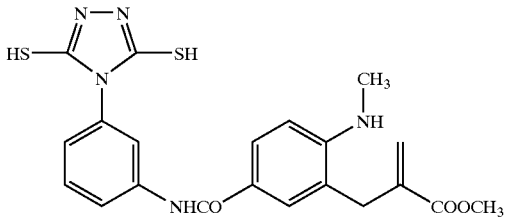
3-74
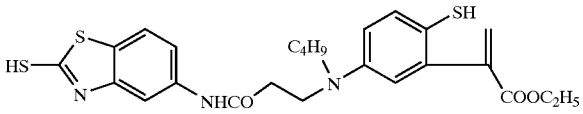
3-75
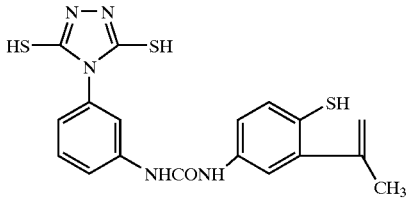

-continued
3-76
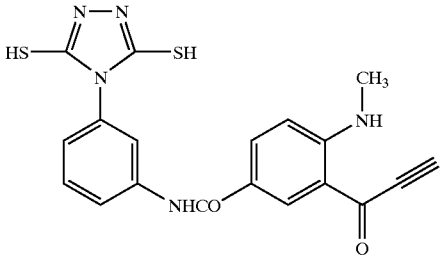
3-77
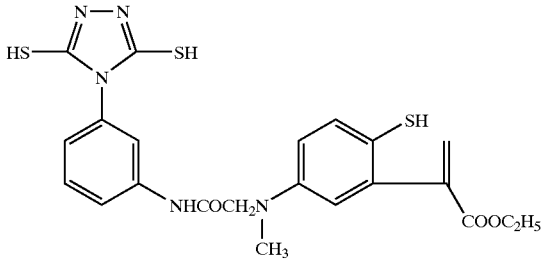
3-78
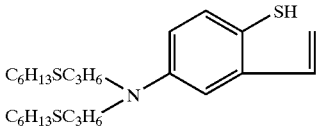
3-79
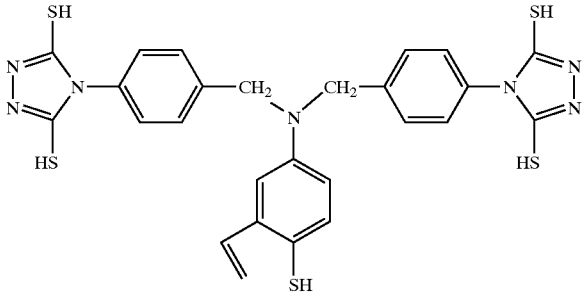
3-80
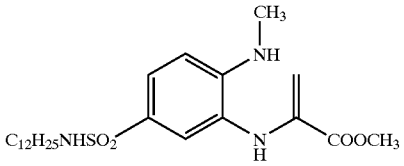
3-81
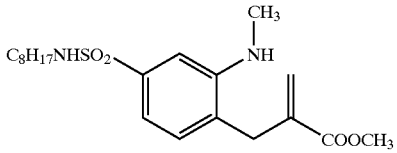
3-82
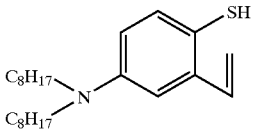
3-83
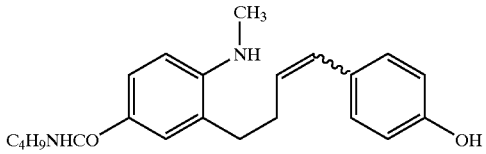
(cis or trans)
3-84
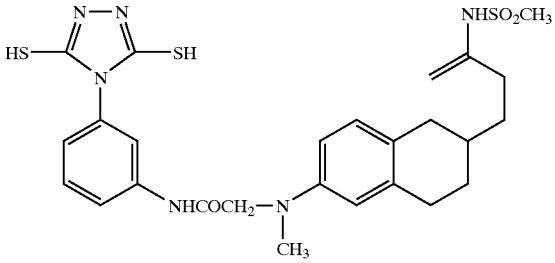
3-85
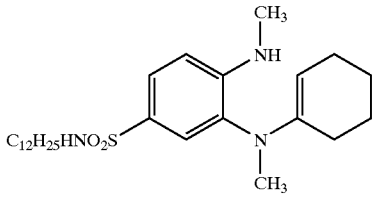
3-86
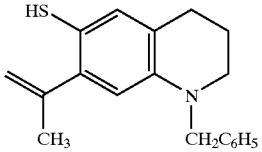
3-87
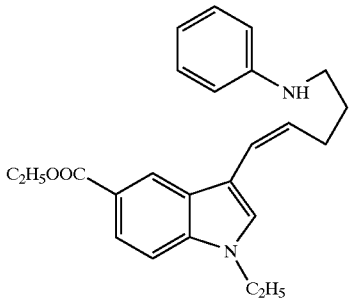

-continued
3-88
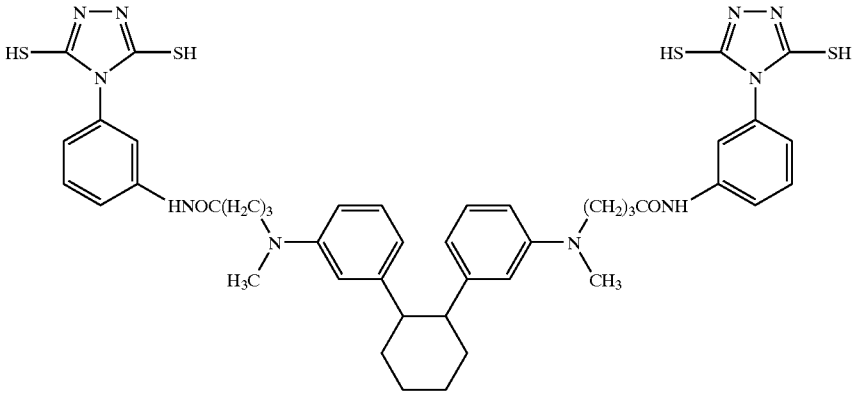
3-89
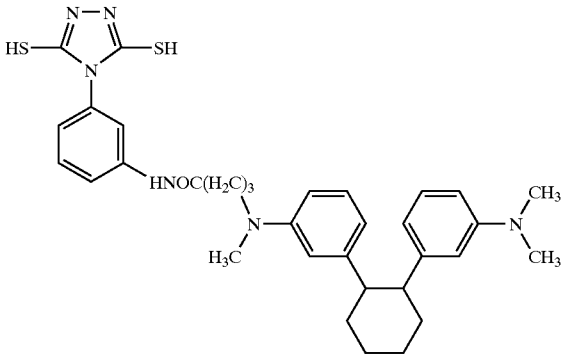
3-90
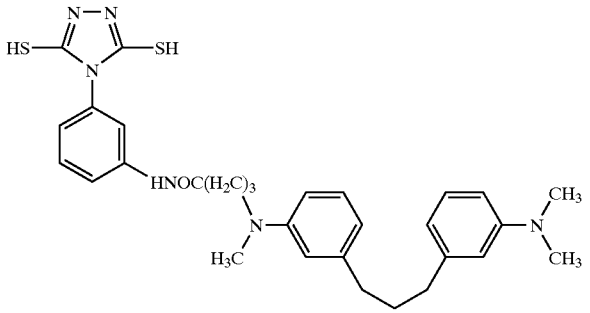
3-91
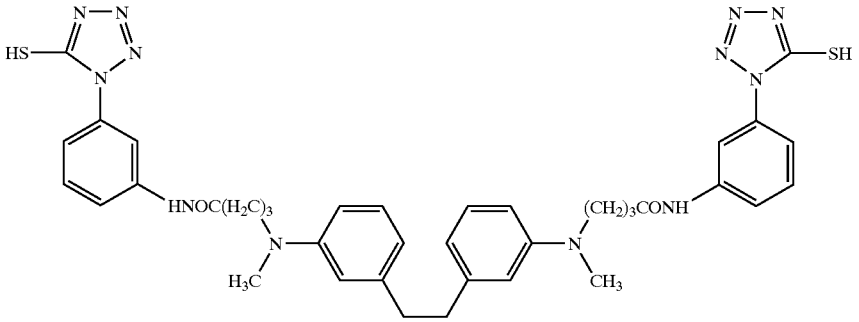
3-92
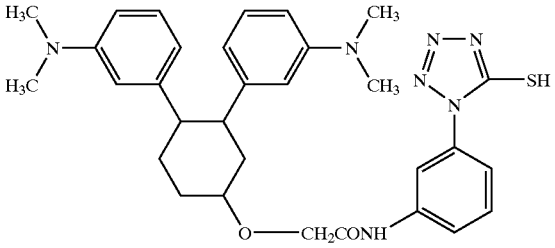
3-93
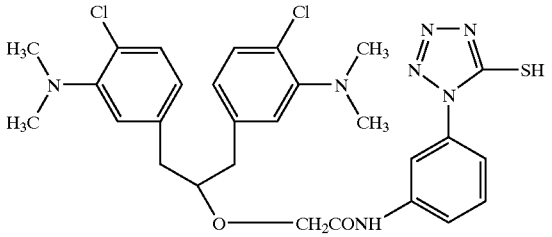

-continued
3-94
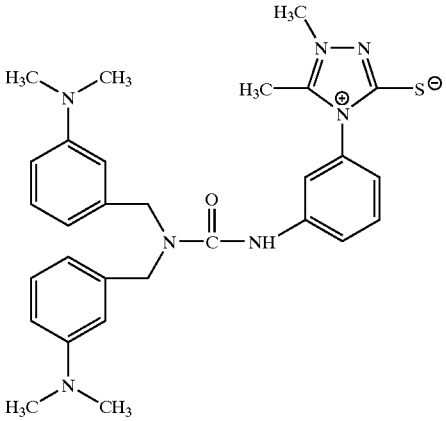
3-95
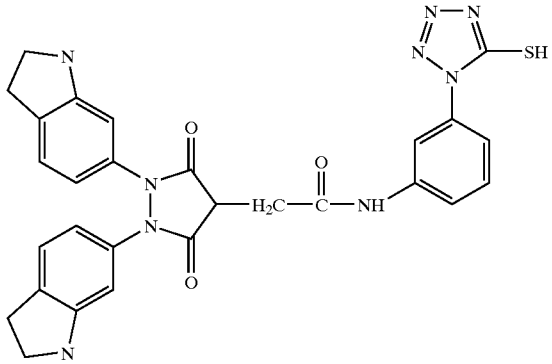
3-96
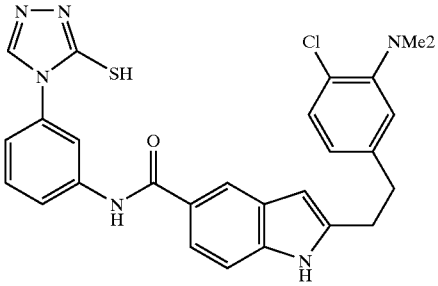
3-97
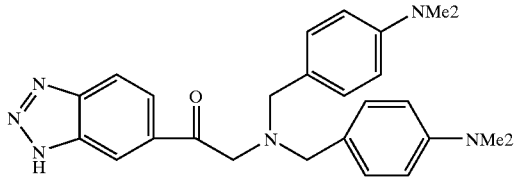
3-98
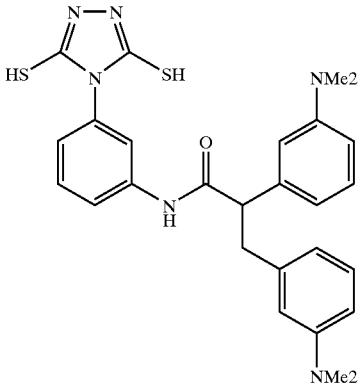
3-99
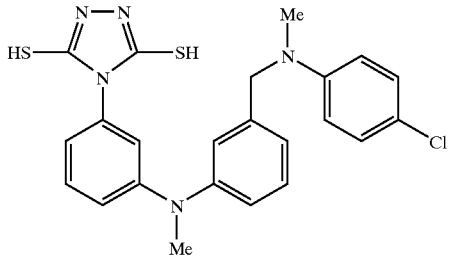
3-100
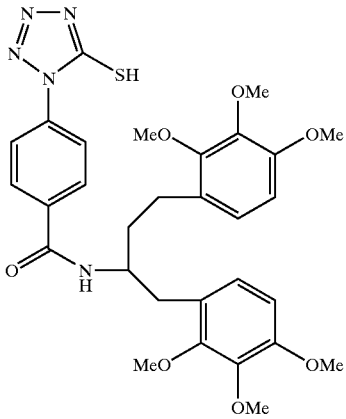
3-101
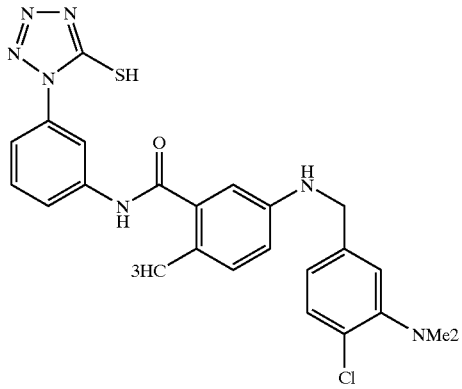

-continued
3-102
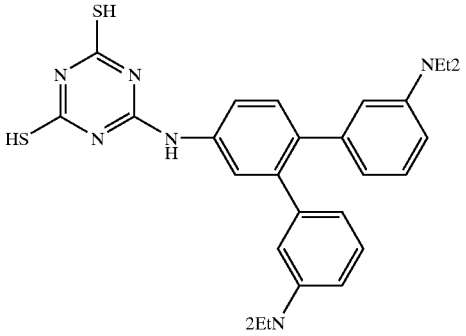
3-103
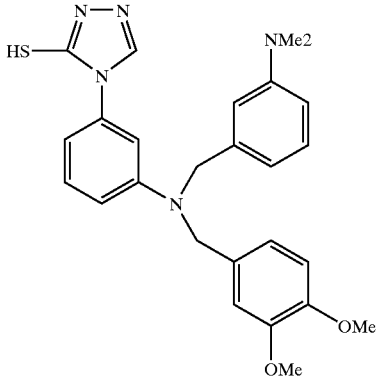
3-104
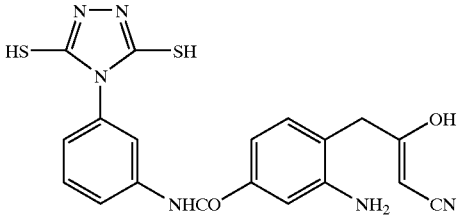
3-105
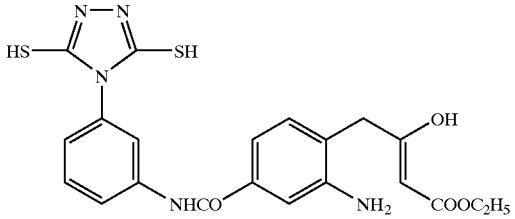
3-106
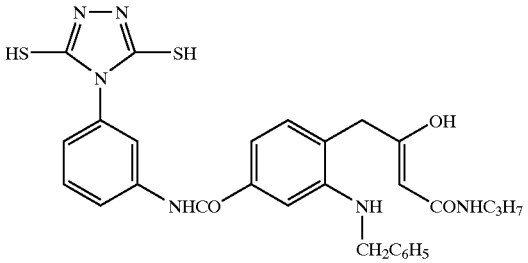
3-107
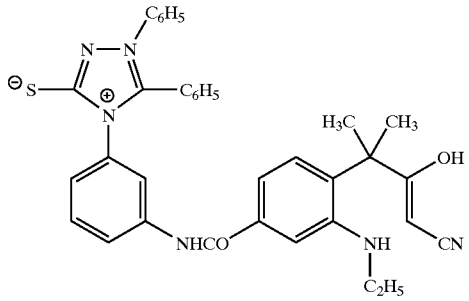
3-108
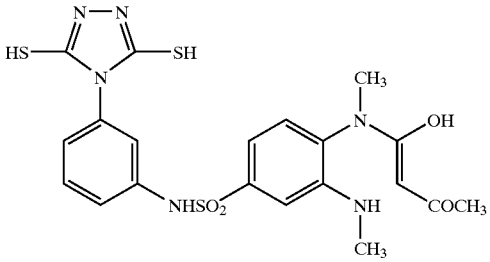
3-109
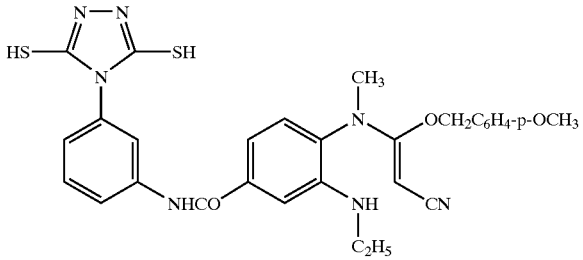
3-110
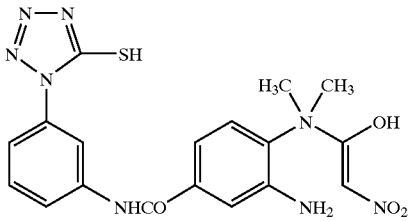
3-111
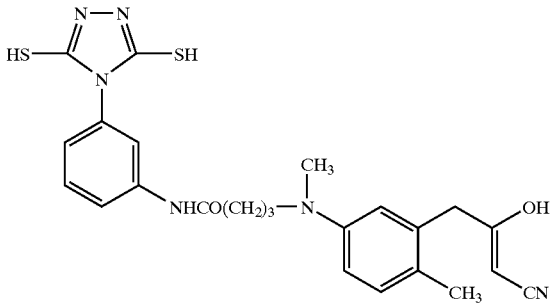

-continued
3-112
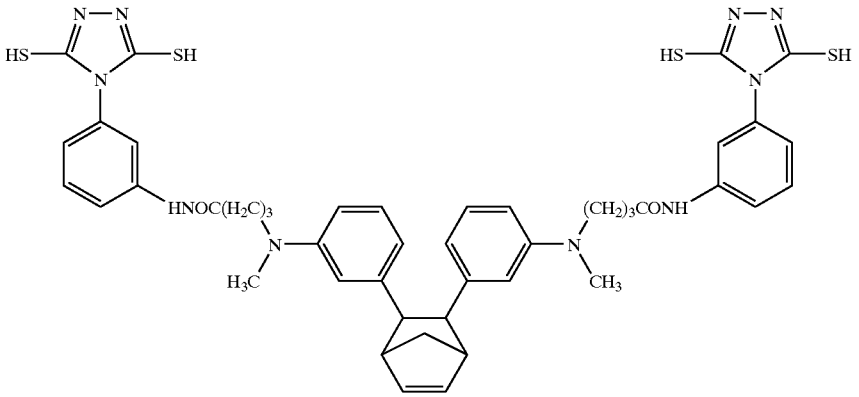
3-113
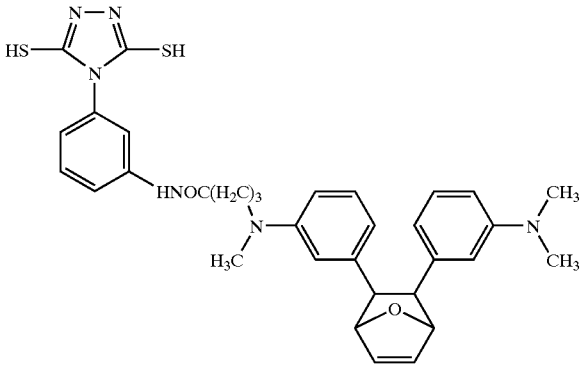
3-114
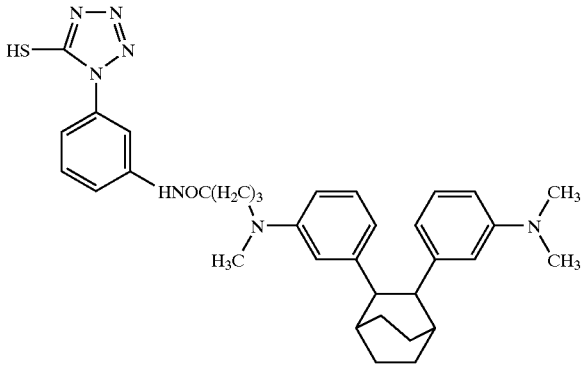
3-115
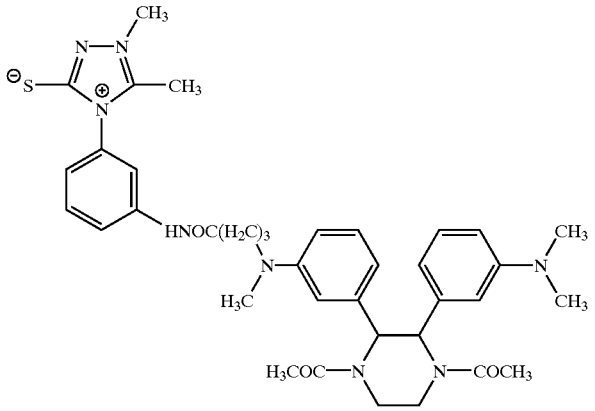
3-116
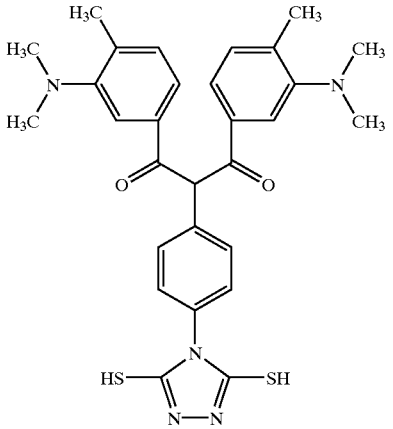

Synthetic Example
Compounds of Type 3 according to the present invention can be easily synthesized by known processes. Particular examples thereof will be described below.
Synthesis of Compound Example 3-1
Compound example 3-1 was synthesized in accordance with the following synthetic scheme 3-1.
Synthetic scheme 3-1
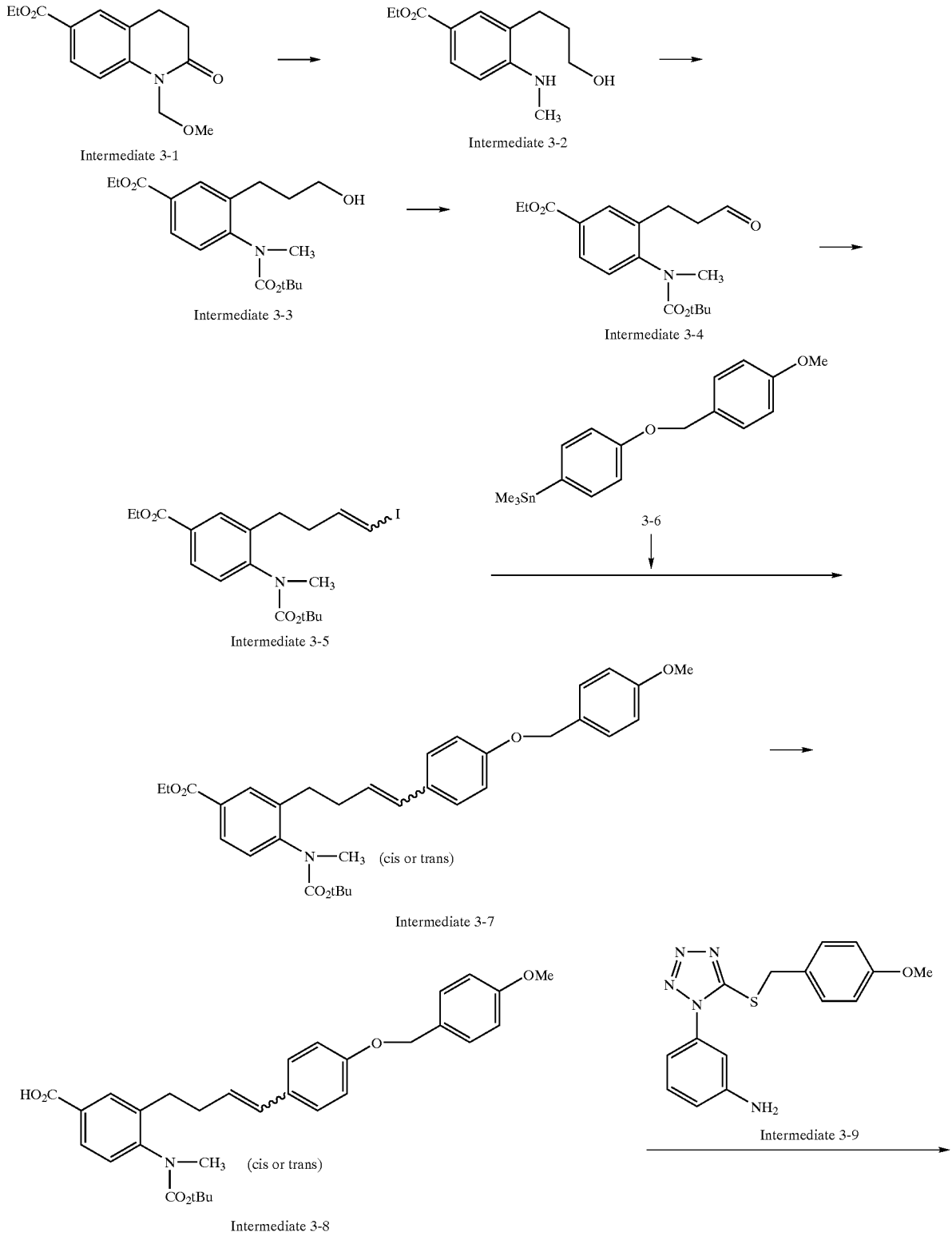

-continued

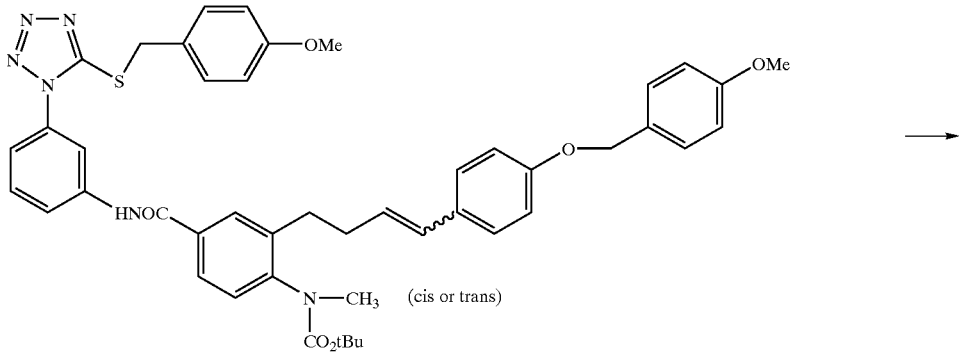

Intermediate 3-10

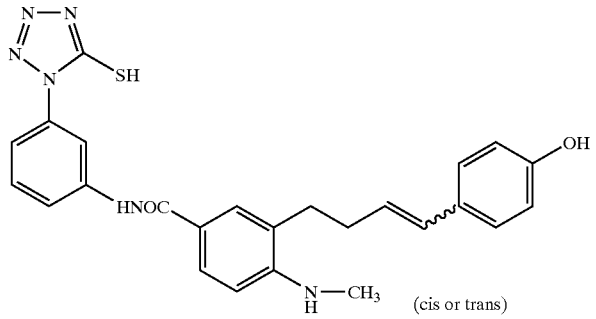

Exemplified compound 3-1

Synthesis of Synthetic Intermediate 3-2

Sodium boron hydride (3.8 g, 0.1 mol) was added to an ethanol solution (100 mL) of synthetic intermediate 3-1 (26.3 g, 0.1 mol), and agitated at room temperature for 5 hr. The reaction mixture was concentrated in vacuum, treated with dilute hydrochloric acid, and extracted with ethyl acetate. The thus obtained oil layer was dried and concentrated, thereby obtaining a crude product. The crude product was purified by silica gel column chromatography, thereby obtaining synthetic intermediate 3-2 (19 g, 80%).

Synthesis of Synthetic Intermediate 3-3

$Boc_2O$ (17.5 g, 80 mmol) was added to a THF solution of synthetic intermediate 3-2 (19 g, 80 mmol). Triethylamine (10 mL) was dropped thereinto at room temperature, and agitated for 3 hr. The reaction mixture was treated with water, and extracted with ethyl acetate. The thus obtained oil layer was dried and concentrated, thereby obtaining a crude product. The crude product was purified by silica gel column chromatography, thereby obtaining synthetic intermediate 3-3 (22.9 g, 68 mmol).

Synthesis of Synthetic Intermediate 3-4

PDC oxidizer (26.3 g, 70 mmol) was added little by little to a solution of synthetic intermediate 3-3 (22.9 g, 68 mmol) in $CH_2Cl_2$ (100 mL) under vigorous agitation while cooling the solution with water. Precipitate was filtered off, and the filtrate was concentrated, thereby obtaining a crude product. The crude product was purified by silica gel column chromatography, thereby obtaining synthetic intermediate 3-4 (19 g, 83%).

Synthesis of Synthetic Intermediate 3-5

In an argon atmosphere, a mixture of $Me_3SiCl$ (39 mL, 0.3 mol), $CrCl_3$ (1.9 g, 12 mmol), zinc (18 g, 270 mmol), NaI (9 g, 60 mmol) and dioxane (300 mL) was agitated at room temperature for 1 hr. A dioxane solution (150 mL) of synthetic intermediate 3-4 (19 g, 56.4 mmol) and $CHI_3$ (36 g, 90 mmol) was added to the mixture, and agitated at room temperature for 21 hr. The reaction mixture was poured into water, and extracted with ethyl acetate. The thus obtained oil layer was dried and concentrated, thereby obtaining a crude product. The crude product was purified by silica gel column chromatography, thereby obtaining synthetic intermediate 3-5 (20.6 g, 80%, cis/trans=10/90).

Synthesis of Synthetic Intermediate 3-7

$Pd(PPh_3)_4$ (1.7 g, 10 mol %) was added to a THF solution (100 mL) of synthetic intermediate 3-5 (20.6 g, 45 mmol) and synthetic intermediate 3-6 (17 g, 45 mmol), and refluxed by heating for 8 hr. The reaction mixture was diluted with ethyl acetate, and washed with an aqueous solution of KF. Insoluble matter was filtered off. The filtrate was subjected to a liquid separation. The thus obtained oil layer was dried, concentrated, and purified by silica gel column chromatography. As a result, synthetic intermediate 3-7 (14.7 g, 60%) was obtained.

Synthesis of Synthetic Intermediate 3-8

Synthetic intermediate 3-7 (14.7 g, 27 mmol) was dissolved in a 5:1 mixture of methanol and water. LiOH (2.4 g, 0.1 mol) was added to the solution, and agitated at room temperature for 5 hr. The reaction mixture was poured into a dilute hydrochloric acid of pH 2, and extracted with ethyl acetate. The thus obtained oil layer was dried, concentrated, and purified by silica gel column chromatography. As a result, synthetic intermediate 3-8 (12.5 g, 90%) was obtained.

Synthesis of Synthetic Intermediate 3-10

DCC (5 g, 24 mmol) was added to a $CH_2Cl_2$ solution of synthetic intermediate 3-8 (12.5 g, 24 mmol) and synthetic intermediate 3-9 (7.6 g, 24 mmol), and agitated at room temperature for 5 hr. Insoluble matter was filtered off, followed by concentration and purification by silica gel column chromatography. As a result, synthetic intermediate 3-10 (3.9 g, 20%) was obtained.

Synthesis of Compound Example 3-1

Synthetic intermediate 3-10 (3.9 g, 4.8 mmol) was dissolved in trifluoroacetic acid (10 mL), and agitated at room temperature for 3 hr. The reaction mixture was diluted with ethyl acetate, and washed with water. The thus obtained oil layer was dried, concentrated, and purified by silica gel column chromatography. As a result, compound example 3-1 (0.23 g, 10%) was obtained.

Synthesis of Compound Example 3-66

Compound example 3-66 was obtained in the same manner as in the synthesis of compound example 3-1, except that 3,4,5-trimethoxyphenyl-trimethyltin was employed in place of the synthetic intermediate 3-6.

Synthesis of Compound Example 3-67

Compound example 3-67 was obtained in the same manner as in the synthesis of compound example 3-1, except that 4-(3-aminophenyl)-3,5-bis(p-methoxyphenylmethylthio)-[1,2,4]triazole was employed in place of the synthetic intermediate 3-9.

4-1

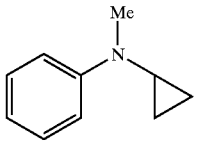

4-2

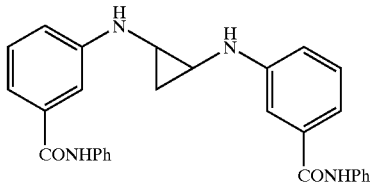

4-3

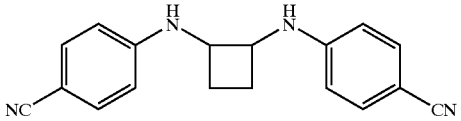

4-4

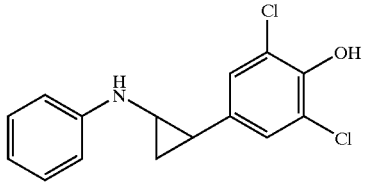

4-5

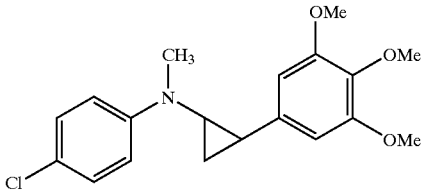

4-6

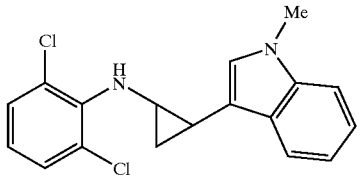

4-7

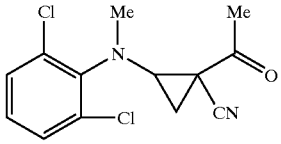

4-8

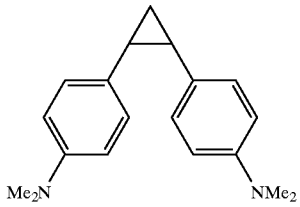

4-9

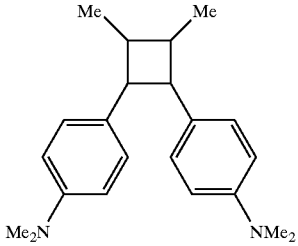

4-10

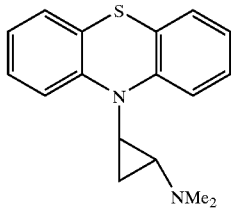

-continued
4-11
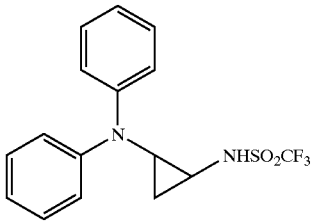
4-12
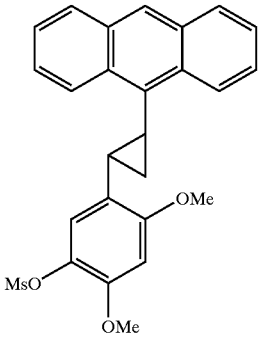
4-13
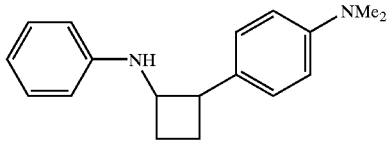
4-14
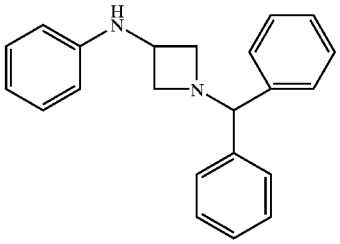
4-15
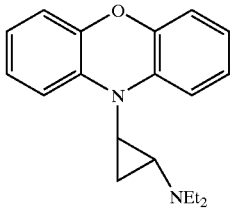
4-16
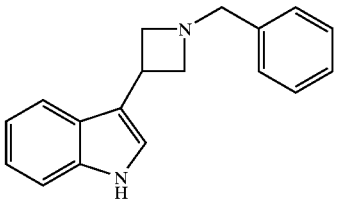
4-17
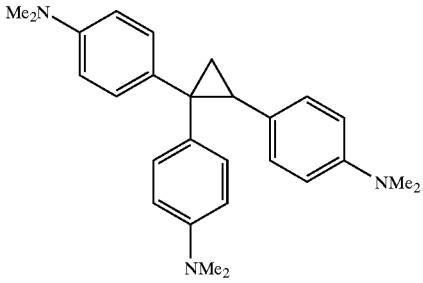
4-18
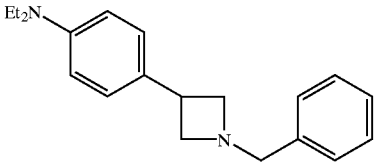
4-19
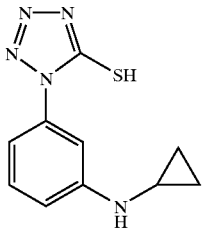
4-20
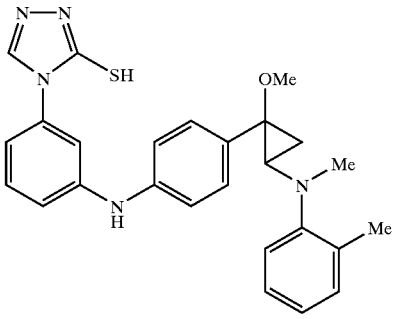

-continued
4-21
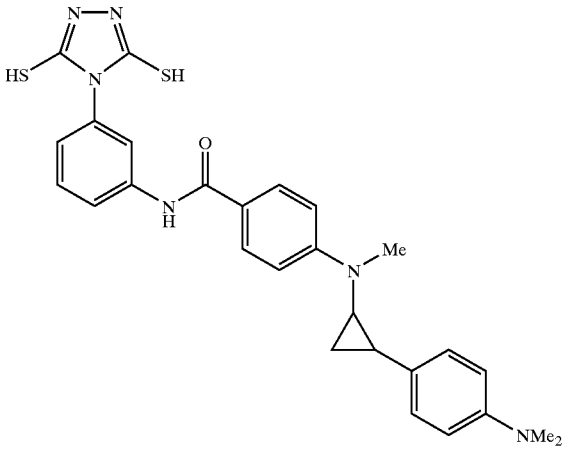
4-22
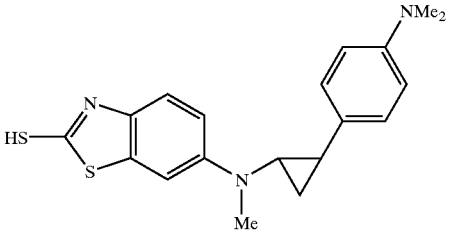
4-23
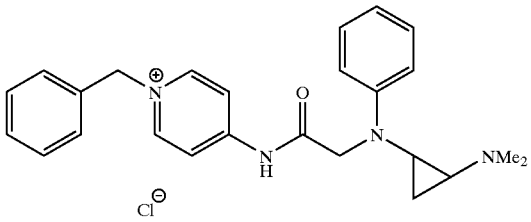
4-24
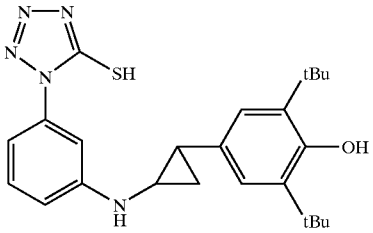
4-25
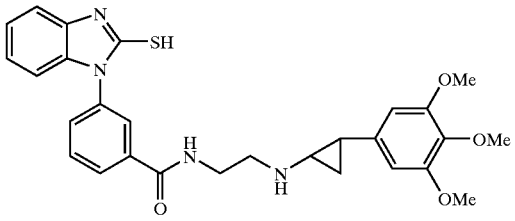
4-26
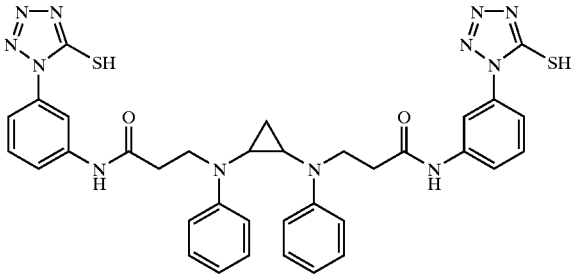
4-27
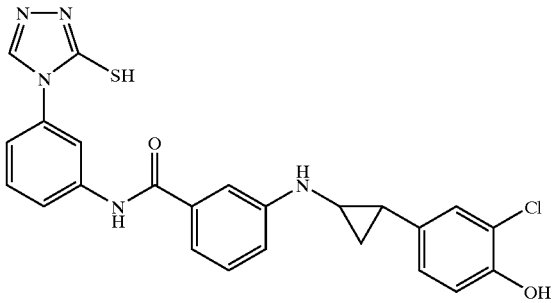
4-28
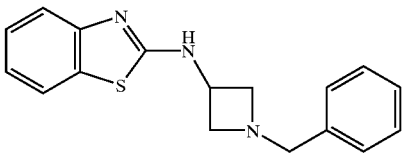
4-29
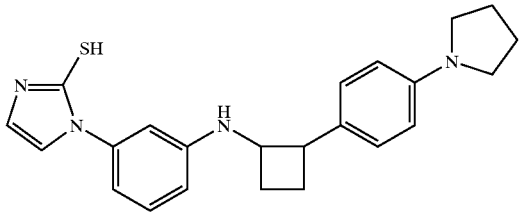
4-30
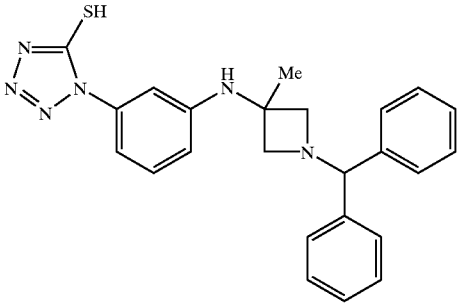

-continued
4-31
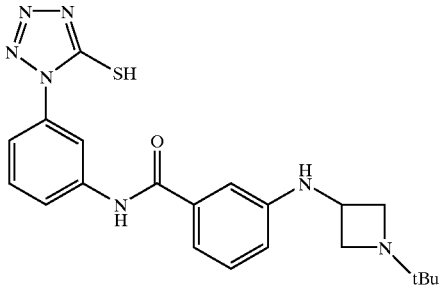
4-32
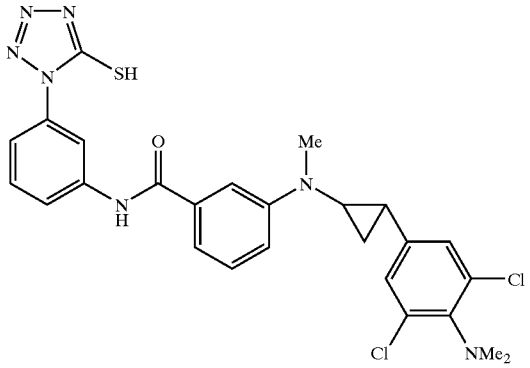
4-33
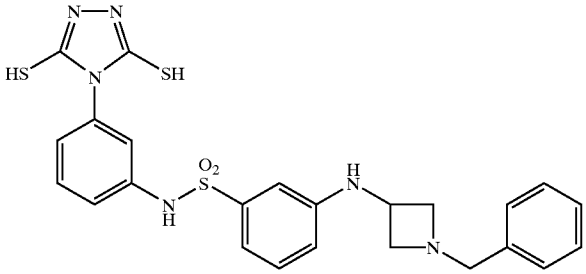
4-34
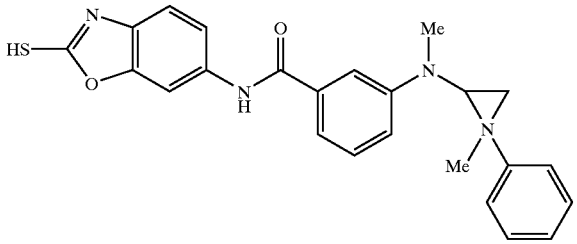
4-35
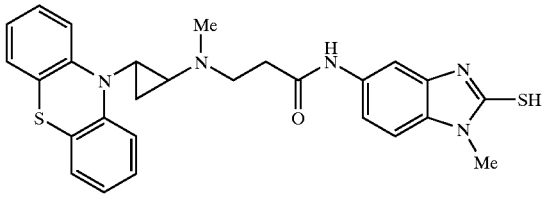
4-36
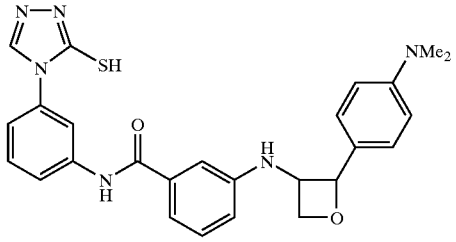
4-37
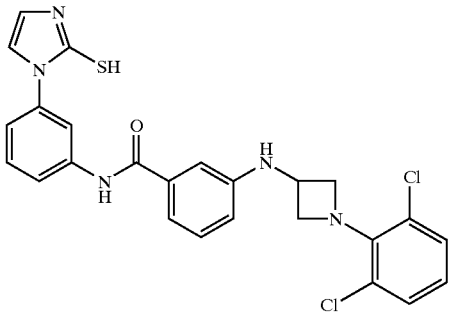
4-38
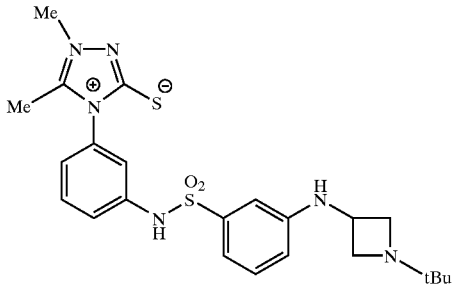
4-39
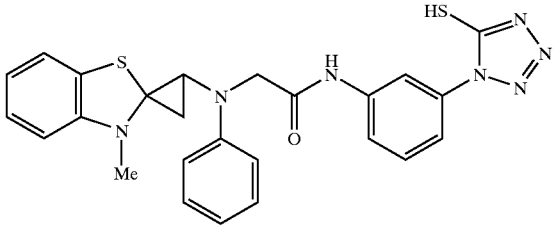
4-40
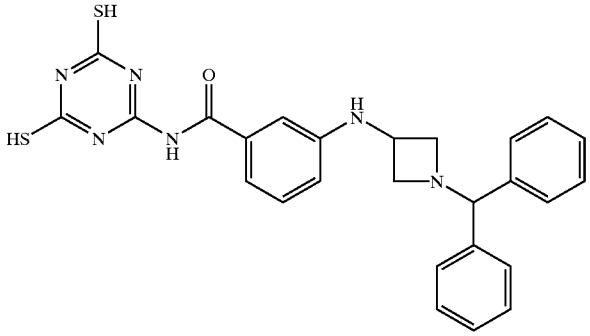

-continued
4-41
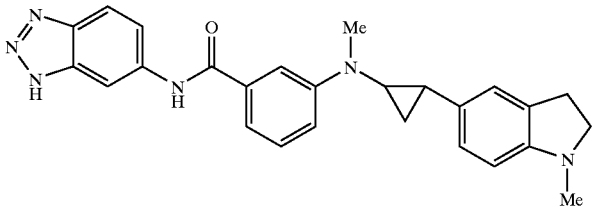
4-42
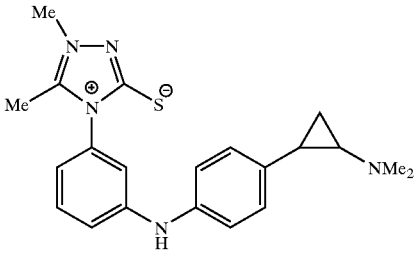
4-43
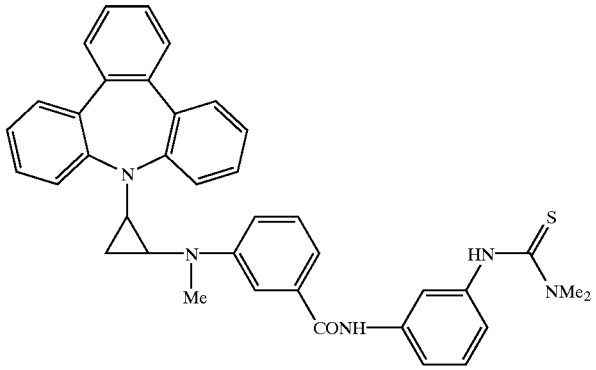
4-44
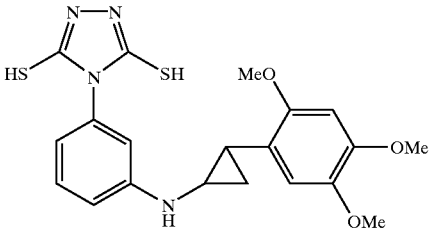
4-45
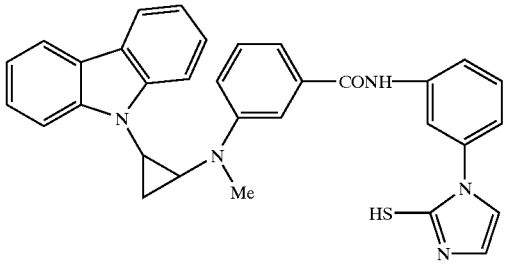
4-46
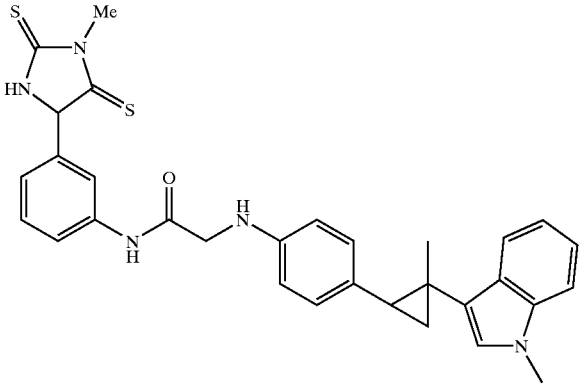
4-47
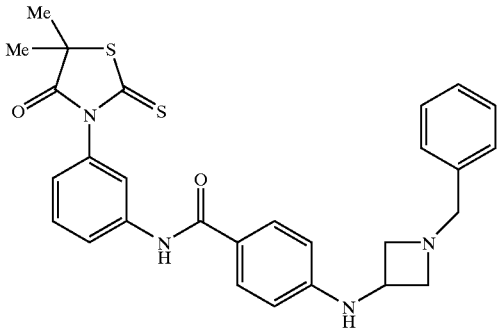
4-48
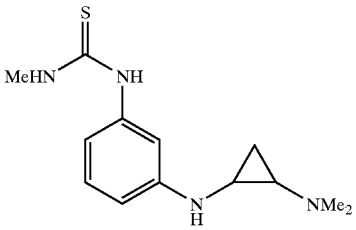

-continued
4-49
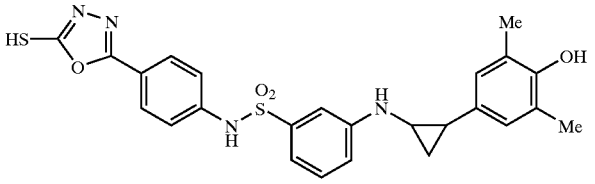
4-50
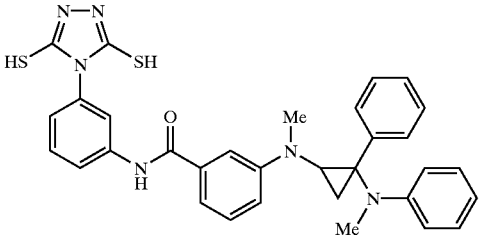
4-51
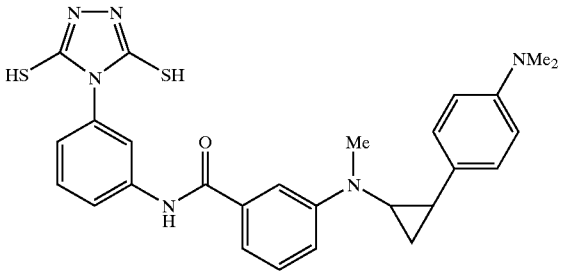
4-52
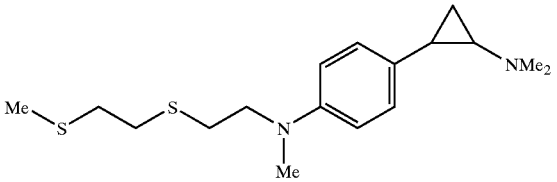
4-53
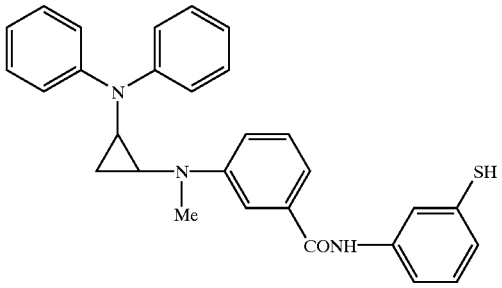
4-54
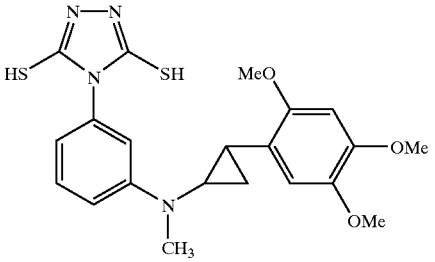
4-55
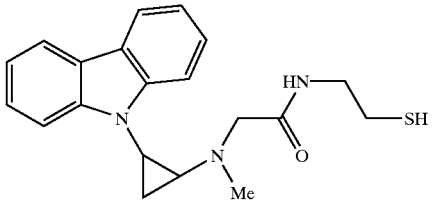
4-56
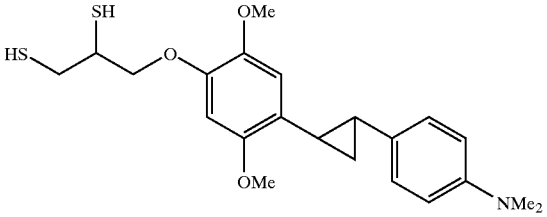
4-57
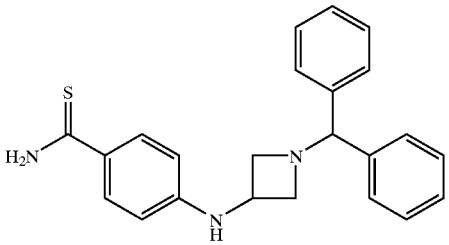
4-58
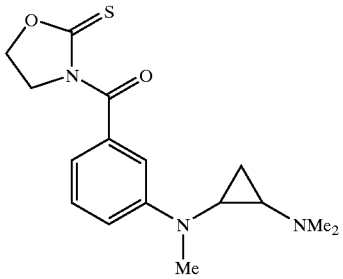
4-59
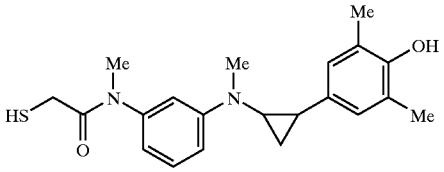
4-60
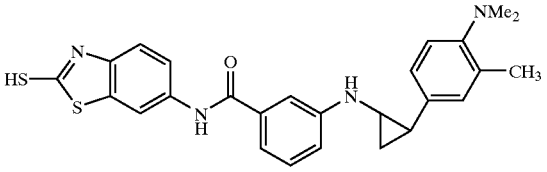

-continued
4-61
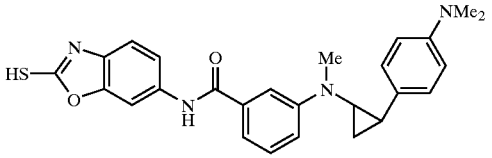
4-62
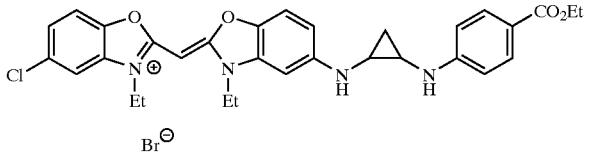
4-63
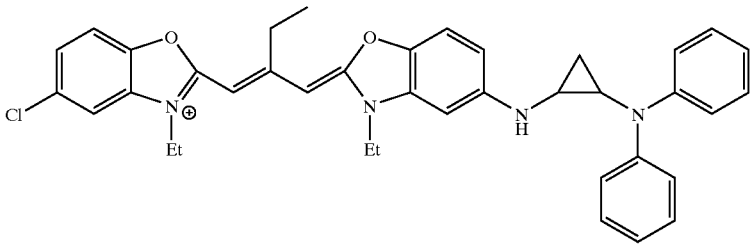
4-64
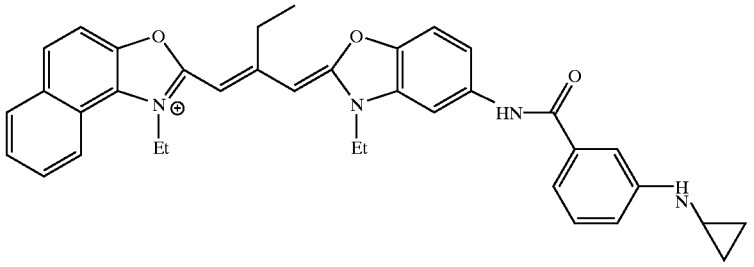
4-65
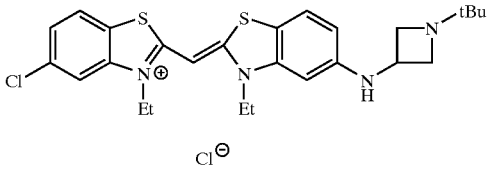
4-67
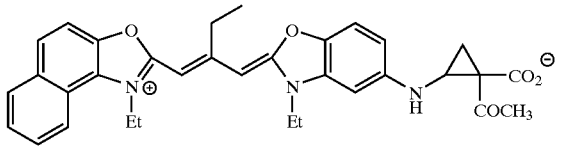
4-68
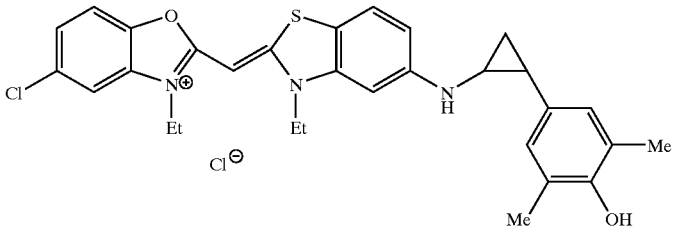
4-69
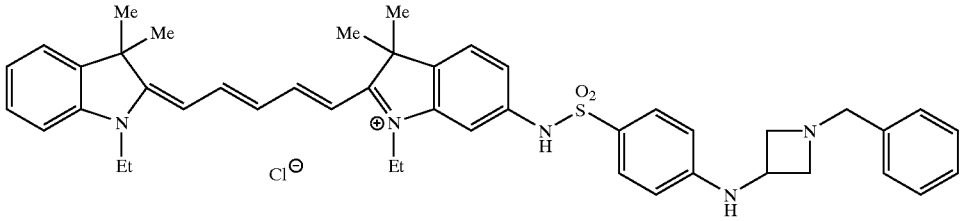
4-70
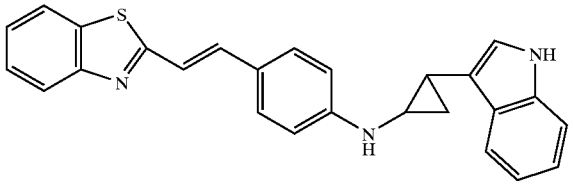

-continued
4-71
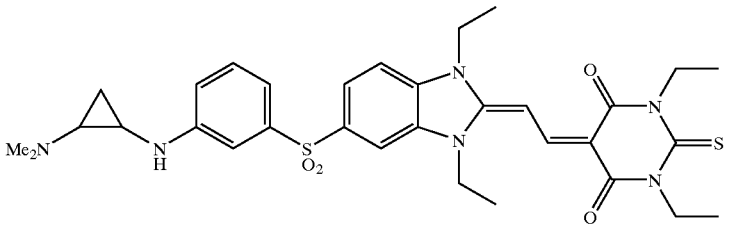
4-72
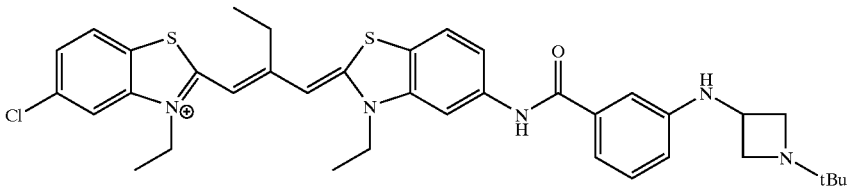
4-73
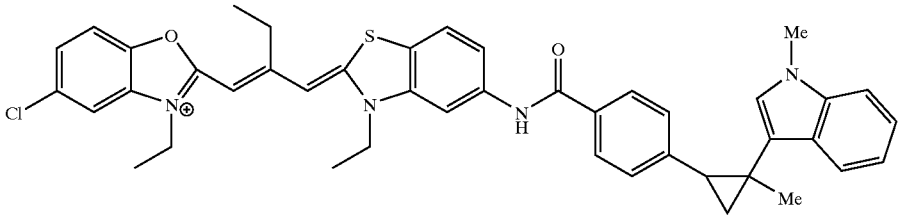
4-74
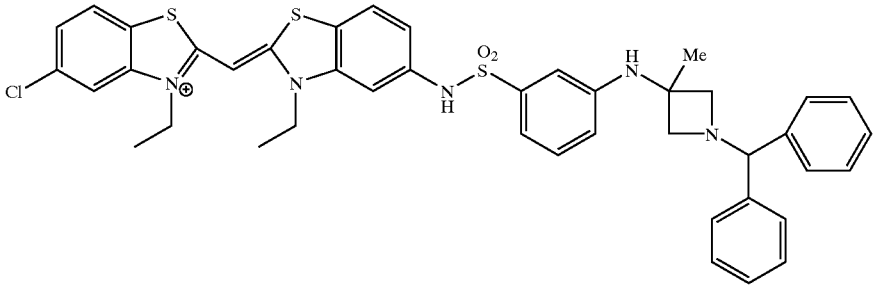
4-75
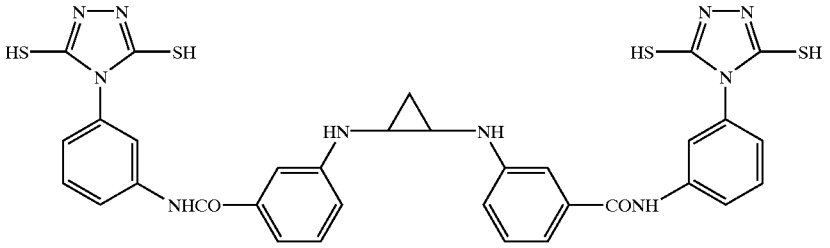
4-76
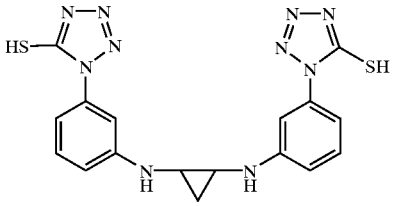
4-77
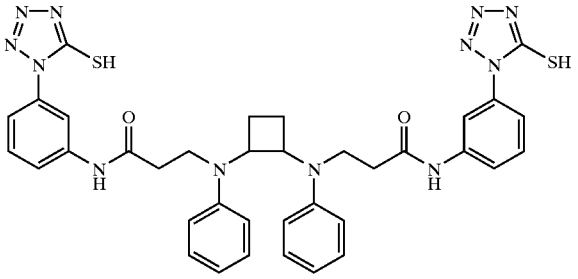

-continued 4-78

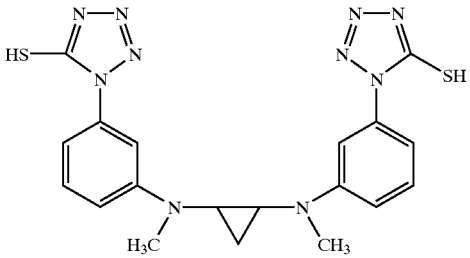

4-79

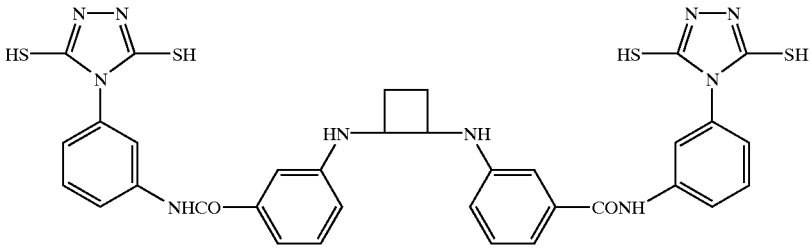

4-80

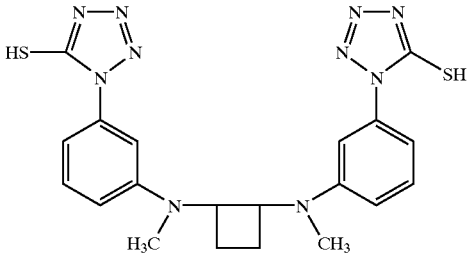

Compounds of Type 4 according to the present invention can be easily synthesized by known processes. Particular synthetic examples thereof will be described below.

Synthesis of Compound Example 4-10

Compound example 4-10 was synthesized by the process described in the report of Kaiser et al. (J. Med. Chem. 14, 179 (1971)).

Synthesis of Compound Example 4-30

Compound example 4-30 was synthesized in accordance with the following synthetic scheme 4-1.

Synthetic scheme 4-1

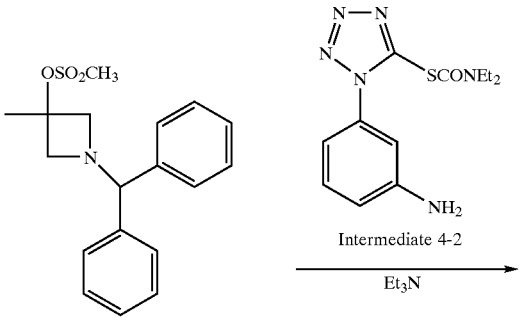

-continued

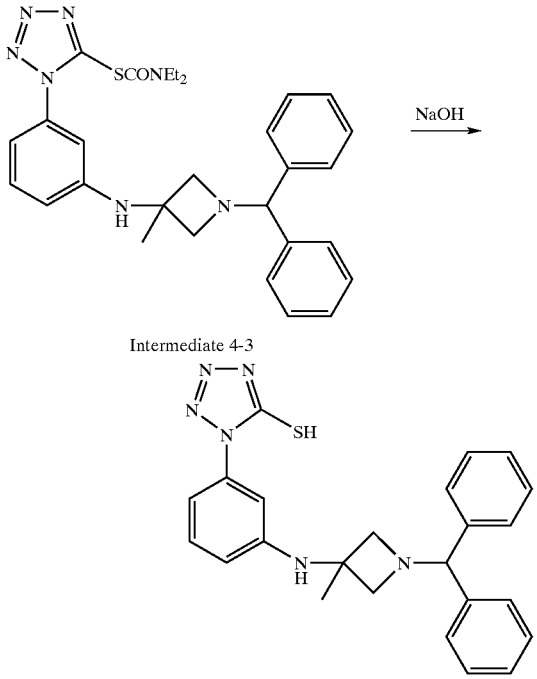

Triethylamine (2.8 mL, 20 mmol) was added to an acetonitrile solution (50 mL) of synthetic intermediate 4-1 (3.3 g, 10 mmol) and synthetic intermediate 4-2 (2.9 g, 10 mmol), and heated at 60° C. under agitation for 8 hr. The reaction mixture was washed with dilute hydrochloric acid, and extracted with ethyl acetate. The extract was dried, concentrated, and purified by silica gel column chromatography. As a result, synthetic intermediate 4-3 (1 g, 19%) was obtained. The thus obtained synthetic intermediate 4-3 was dissolved in methanol (10 mL). A 5 N aqueous solution of NaOH (2 mL) was added thereto, and agitated at room temperature for 5 hr. The reaction mixture was washed with dilute hydrochloric acid, and extracted with ethyl acetate. The extract was dried, concentrated, and purified by silica gel column chromatography. As a result, compound example 4-30 (0.6 g, 74%) was obtained.

Synthesis of Compound Example 4-51

Compound example 4-51 was synthesized in accordance with the following synthetic scheme 4-2.

Synthetic scheme 4-2

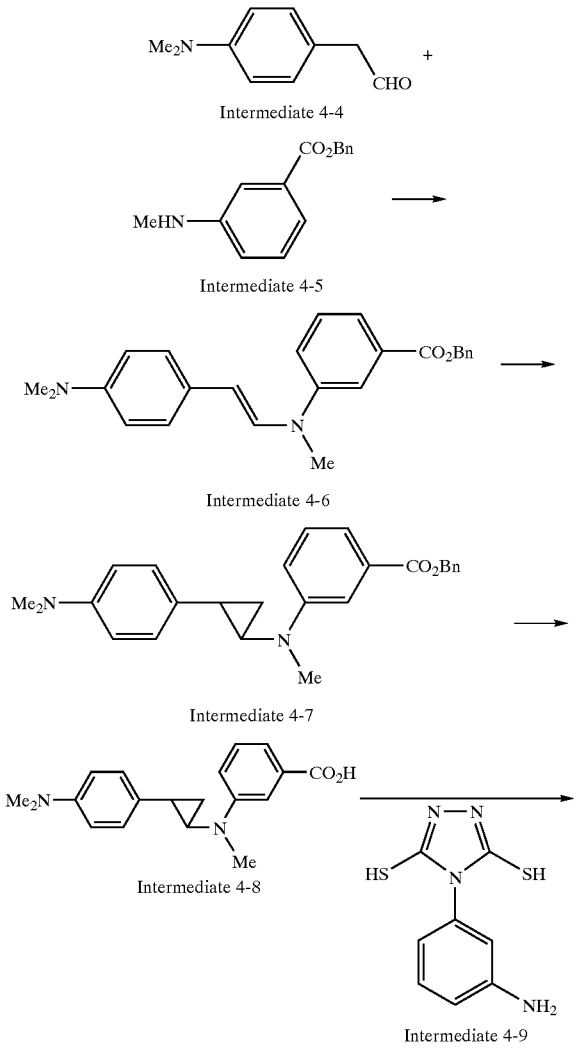

-continued

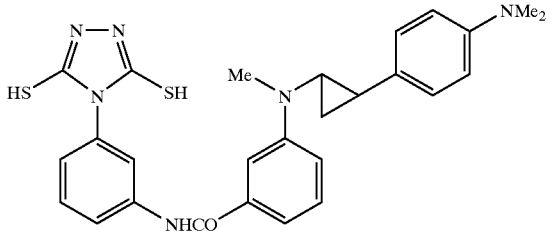

Exemplified compound 4-51

Synthesis of Synthetic Intermediate 4-6

A benzene solution of synthetic intermediate 4-4 (24 g, 0.1 mol) and synthetic intermediate 4-5 (18 g, 0.11 mol) was heated. Formed water was distilled off together with benzene. The heating was continued for 3 hr, and the termination of water formation was confirmed. Remaining benzene was concentrated in vacuum. The thus obtained crude product of synthetic intermediate 4-6 was directly subjected to the subsequent step.

Synthesis of Synthetic Intermediate 4-7

Synthetic intermediate 4-6 was dissolved in dry benzene (600 mL), and cooled to 0° C. Diethylzinc (125 mL, 0.1 M hexane solution) was added to the solution. $CH_2I_2$ (32.3 g, 125 mmol) was dropped into the reaction mixture over a period of 30 min, and agitated at room temperature for 2 hr. The resultant reaction mixture was carefully added to dilute aqueous ammonia, and extracted with ethyl acetate. The thus obtained oil layer was washed with water, dried and concentrated, thereby obtaining a crude product. The crude product was purified by silica gel column chromatography, thereby obtaining synthetic intermediate 4-7 (24 g, 60% through not only the current step but also the previous step).

Synthesis of Synthetic Intermediate 4-8

Synthetic intermediate 4-7 (8 g, 20 mmol) was dissolved in methanol. Pd/C (10%, 2 g) was added to the solution, and a benzyl-removing reaction was carried out in a hydrogen atmosphere of 1 atm. Disappearance of synthetic intermediate 4-7 was confirmed by thin-layer chromatography, and the catalyst was filtered off. The thus obtained filtrate was concentrated, thereby obtaining synthetic intermediate 4-8 (6 g, 97%).

Synthesis of Compound Example 4-51

A dimethylacetamide solution of synthetic intermediate 4-8 (6 g, 19.4 mmol) was cooled to 0° C., and isobutyl chloroformate (2.73 g, 20 mmol) and triethylamine (2.02 g, 20 mmol) were sequentially dropped into the solution. The mixture was agitated for 1 hr, and synthetic intermediate 4-9 (4.5 g, 20 mmol) was added thereto. The mixture was agitated at 0° C. for 1 hr and at room temperature for 2 hr. The reaction mixture was treated with water, and extracted with ethyl acetate. The thus obtained oil layer was washed with water thrice, dried and concentrated, thereby obtaining a crude product. The crude product was purified by silica gel column chromatography, thereby obtaining compound example 4-51 (1 g, 10%).

The compounds of types 1 to 4 according to the present invention may be used at any stage during the emulsion preparation or during the lightsensitive material production.

For example, the use may be made at the time of grain formation, desilvering step, chemical sensitization, or prior to coating step. The compounds can be added in a plurality of divisions during these stages. The addition point is preferably after the completion of grain formation but prior to desilvering step, or at the time of chemical sensitization (from just before the initiation of chemical sensitization to just after the completion thereof), or prior to coating. The addition point is more preferably at the time of chemical sensitization, or prior to coating.

The compounds of types 1 to 4 according to the present invention are preferably dissolved in water, a water soluble solvent such as methanol or ethanol, or a mixture thereof before the addition. When the dissolution is conducted in water, compounds whose solubility is increased at high or low pH values may be dissolved at high or low pH values before the addition.

Although the compounds of types 1 to 4 according to the present invention are preferably incorporated in emulsion layers, it is also appropriate to add them to not only emulsion layers but also protective layers and interlayers so as to effect diffusion thereof at the time of coating. The timing of addition of the compounds of the present invention is irrespective of whether it is before or after sensitizing dyes, and each thereof is preferably incorporated in silver halide emulsion layers in an amount of $1\times10^{-9}$ to $5\times10^{-2}$ mol, more preferably $1\times10^{-8}$ to $2\times10^{-3}$ mol, per mol of silver halides.

In the present invention, a combined use of a reducing compound is preferable.

The reducing compound herein means a compound selected from hydroxylamines, hydroxamic acids, hydroxyureas, hydroxyurethanes, hydroxysemicarbazides, reductons (including reduction derivatives), anilines, phenols (including chroman-6-ols, 2,3-dihydrobenzofuran-5-ols, aminophenols, sulfonamidephenols, and polyphenols such as hydroquinones, catechols, resorcinols, benzenetriols, and bisphenols), hydrazines, hydrazides, and Phenidones. Preferably, the reducing compounds are selected from hydroxylamines, hydroxamic acids, hydroxyureas, hydroxyurethanes, hydroxysemicarbazides, reductons (including reduction derivatives), phenols (including, e.g., chroman-6-ols, hydroquinones, catechols, resorcinols, and bisphenols), hydrazines and Phenidones. More preferably, the reducing compound is selected from hydroxylamines, hydroxamic acids, hydroxyureas, hydroxysemicarbazides, phenols and hydrazines. Herein hydroxylamines, hydroxamic acids, hydroxyureas, hydroxysemicarbazides and hydrazines are compounds each having the following partial structures: >N—OH, —C(=O)—N(-)—OH, —N(-)—C(=O)—N(-)OH, —NHNH—C(=O)—N(-)OH, —N(-)—N(-)—, respectively. Further, phenols (including chroman-6-ols, hydroquinones, catechols, resorcinols, and bisphenols) herein mean compounds each having a partial structure of hydroxybenzene, except for couplers (i.e., compounds each capable of reacting with a color developing agent thereby forming a dye by a color developing processing).

These reducing compounds are known compounds in the photographic industry, and examples thereof are described in the following patent publications: JP-A-2001-42466 (Compounds represented by general formulas (II) to (VI) and compound examples thereof), JP-A's-8-114884, 8-314051, 8-333325, 9-133983, 11-282117, 10-246931, 10-90819, 9-54384, 10-171060, and 7-77783. In addition, compounds described in U.S. Pat. No. 6,054,260 (the general formulas described in columns 60 to 63 and compound examples thereof), may also be mentioned, as examples of phenols.

In the present invention, use can be made of one compound selected from the reducing compounds of the invention, but is also preferable that two or more compounds are simultaneously selected and used. In this case, arbitral two or more compounds may be selected form the reducing compounds of the invention. Among those, when the reducing compounds are classified into (i) those each having an adsorbing group; (ii) those each having a non-diffusing group (i.e., a ballast group, which is known in the photographic industry as being contained, for example, in a coupler); and (iii) those each not having both of these (i.e., hereinafter referred to as reducing compounds of diffusion characteristics, use can be made of from two or three kinds of compounds selected from the three classifications, which is also a preferable use method. When two or more compounds are used, these may be contained in a single layer, or may be contained in separate layers, and the addition method thereof may be different.

The reducing compound of the invention may be added to a photographic material by dissolving it to water and a water-soluble solvent such as methanol and ethanol, or a mixture of these. At that time, pH may be properly adjusted by an acid or base. A surfactant may also be co-existed. Further, the reducing compound of the invention may be added to a photographic material in a form of emulsified dispersion by dissolving the reducing compound to a high-boiling organic solvent. The reducing compound may be added to a photographic material as a solid dispersion (fine crystal dispersion) using a known dispersing method.

The reducing compound of the invention may be added to a silver halide emulsion layer, or may be added to other than the emulsion layer, such as a non-lightsensitive layer. Use of the reducing compound in an emulsion layer is preferable, but may be added to also a neighboring protective layer or intermediate layer in addition to an emulsion layer, and make the reducing compound diffuse during coating. The reducing compound may be added during emulsion preparation, such as before chemical sensitization, during chemical sensitization, or at the completion of chemical sensitization, but the addition timing is preferably before coating the coating liquid or during coating.

Preferable addition amount largely depends on the above-mentioned addition method and specie of the compound to be added, but the preferable addition amount per mol of lightsensitive silver halide is $1\times10^{-8}$ to $5\times10^{-2}$ mol, more preferably $1\times10^{-7}$ to $1\times10^{-3}$ mol for (i) those each having an adsorbing group; $5\times10^{-6}$ to $5\times10^{-2}$ mol, more preferably $1\times10^{-5}$ to $1\times10^{-2}$ mol for (iii) reducing compounds of diffusion characteristics; and $5\times10^{-5}$ to $5\times10^{-1}$ mol, more preferably $1\times10^{-4}$ to $1\times10^{-1}$ mol for (ii) those each having a ballast group, which are more preferably added by emulsification dispersion.

The silver halide grains of the photographic emulsion may be not onyl cubic, octahedral, tetradecahedral, rhombododecahedral, spherical or platy, but also those having a higher order, such as (h k 1) face, or grain mixture of there crystal forms. The silver halide grains are preferably tabular grains, which will be described in detail later.

The lightsensitive material of the present invention preferably contains a lightsensitive silver halide emulsion comprising tabular grains, which are silver halide grains each having two opposing, parallel main planes, hereinafter referred to as tabular grains. The tabular grain will be described in detail below. The aspect ratio of the tabular grain used in the present invention is defined as a value obtained by dividing the equivalent-circle diameter of two opposing parallel main planes, which is a diameter of a circle having the same projected area as the main planes, by the distance between the main planes, i.e., the thickness of the grain.

The average aspect ratio of the tabular grains, in order to exhibit the effect of the present invention, is preferably 5 or more and 100 or less, more preferably 8 or more and 80 or less, and particularly preferably 10 or more and 50 or less. Average aspect ratios less than 2 or those greater than 100 are undesirable because if the average aspect ratio is less than 2, the merit of the tabular grains in improvement in speed cannot be fully used and because if the average aspect ratio exceeds 100, the pressure resistance becomes poor. Further, as for the tabular grains of the present invention, the ratio occupied by the tabular grains is preferably 60% or more, more preferably 80% or more, and particularly preferably 90% or more of the total projected area. The average grain thickness of the tabular grains used in the present invention is an arithmetical average of the thicknesses of all of the tabular grains. The average grain thickness of the tabular grains used in the present invention is preferably 0.01 to 0.3 $\mu$m, more preferably 0.01 to 0.12 $\mu$m and particularly preferably 0.01 to 0.07 $\mu$m.

In the present invention, the diameter (equivalent-circle diameter) of the tabular grains may be selected arbitrary, but is preferably 0.3 to 20 $\mu$m, and more preferably 0.5 to 10 $\mu$m. The grain diameter and the grain thickness can be obtained from an electron micrograph according to the method disclosed in U.S. Pat. No. 4,434,226. One example of an aspect ratio measurement method comprises taking a transmission electron micrograph by a replica method and obtaining the diameter of a circle whose area is the same as the projected area of each grain (the equivalent-circle diameter) and the thickness of each grain. In this method, the thickness can be calculated from the length of a shadow of replica.

It is preferable that the tabular grains of the present invention be monodisperse. The variation coefficient of the grain diameter distribution of the total silver halide gains is preferably 35% or less, more preferably 25% or less, and particularly preferably 20% or less. When exceeding 35%, it is not undesirable from the viewpoint of uniformity among grains. The variation coefficient of grain diameter distribution is a value obtained in such a manner that a dispersion (standard deviation) of the equivalent-sphere diameters of the silver halide grains is divided by the average equivalent-sphere diameter and the resulting value is multiplied by 100.

There are known the tabular grains whose main planes are (100) planes and the tabular grains whose main planes are (111) planes, both of which the technique of the present invention can be applied to. The silver bromide of the former type are disclosed in U.S. Pat. No. 4,063,951 and JP-A-5-281640, while the silver chloride of the former type are disclosed in EP 534395 A1 and U.S. Pat. No. 5,264,337. The tabular grains of the latter type can have various shapes wherein at least one twin plane is present, and those of silver chloride are described in U.S. Pat. Nos. 4,399,215, 4,983,508 and 5,183,732, and JP-A's-3-137632 and 3-116113.

As a method for forming the tabular grains, various methods can be used and, for example, the grain forming method disclosed in U.S. Pat. No. 5,494,789 can be used. In order to form tabular grains having a high aspect ratio, it is important to grow small, twin nuclei. For this purpose, it is preferable to grow the nuclei at low temperature, high pBr and low pH, using a small amount of gelatin in a short time. As the kind of gelatin, gelatin with a low molecular weight, gelatin with a low methionine content, gelatin that has been phthalated, and the like are preferred. After the formation of the nuclei, physical ripening is carried out to grow only tabular grain nuclei (parallel, multiple-layered twin nuclei) by eliminating other nuclei, i.e., nuclei of normal habit crystals, single-layered twin nuclei and non-parallel, multiple-layered twin nuclei, thereby causing the parallel, multiple-layered twin nuclei to remain selectively. Then, a soluble silver salt and a soluble halogen salt are added to the obtained nuclei to promote grain growth, and an emulsion comprising tabular grains is prepared.

It is preferable that the tabular grains used in the present invention have dislocation lines. When tabular grains used in the present invention have dislocation lines, the dislocation lines may be formed, for example, on the apex or fringe portions of grains or over the main plane of gains. As used herein, the fringe portion is the peripheral region of a tabular grain. More specifically, in the distribution of silver iodide from the edge to the center of a tabular grain, the fringe portion is a region outside a certain point at which the silver iodide content exceeds or becomes lower than the average silver iodide content of the whole grain for the first time when viewed from the edge.

When tabular grains have dislocation lines, the density of the dislocation lines is optional and any density may be selected, for example, 10 lines or more, 30 lines or more, 50 lines or more, per grain. The dislocation lines in silver halide grains can be observed, for example, by the direct method using a transmission electron microscope at a low temperature. The tabular grains used in the present invention may have a dislocation line inside the grain. With regard to the technique of introducing dislocation under control inside the grain, there is a description in JP-A-63-220238. Tabular grains into which a dislocation line is introduced are shown to attain advantages, for example, in improvement of photographic characteristics such as speed and reciprocal rule, improvement in storability, improvement in latent image stability and reduction of pressure fog, compared to tabular grains having no dislocation lines.

As the tabular grains in the present invention, silver bromide, silver chlorobromide, silver iodobromide, silver iodochloride, silver chloride, silver chloroiodobromide and the like can be used. It is preferable to use silver bromide, silver iodobromide, and silver chloroiodobromide. Also, using silver chlorobromide, silver chloroiodide, silver chloroiodobromide or silver chloride grains containing 50 mol % or more of silver chloride and having an aspect ratio of 2 or more is also preferable in view of rapid processability. Although there is no particular upper limit of the silver chloride content, 99.6 mol % or less is preferable. When the silver halide grains have a phase containing iodides or chlorides, the phase may be uniformly distributed within the grain or they may be localized. Other silver salts, such as silver rhodanide, silver sulfide, silver selenide, silver carbonate, silver phosphate and silver salts of organic acids, may be contained as separate grains or as part of the silver halide grains.

The preferable range of silver iodide content in the tabular grains of the present invention is preferably 0.1 to 20 mol %, more preferably 0.1 to 15 mol %, and particularly preferably 0.2 to 10 mol %. A silver iodide content of less than 0.1 mol % is undesirable because it is difficult to obtain the effects of enhancing dye adsorption and increasing the intrinsic sensitivity. A silver iodide content exceeding 20 mol % is also undesirable because the developing speed generally lowers. In the case of tabular grains each containing 50 mol % or more silver chloride and having an aspect ratio of 2 or more, silver iodide may be contained, but the silver iodide content is preferably 6 mol % or less, more preferably 2 mol % or less.

The coefficient of variation of distribution of silver iodide content between grains of the tabular grains of the present invention is preferably 30% or less, more preferably 25% or less, and particularly preferably 20% or less. If it exceeds 30%, it is not preferable from the viewpoint of uniformity between grains. The silver iodide content of individual tabular grain can be measured by analyzing the composition of the grain one by one with an X-ray microanalyzer. The coefficient of variation of distribution of silver iodide content used herein is a is value obtained by dividing the standard deviation of the silver iodide content distribution of individual grain by the average silver iodide content.

The tabular grains used in the present invention may be epitaxial silver halide grains comprising host tabular grains having, on surfaces thereof, at least one kind of silver salt epitaxy. In the present invention, a silver salt epitaxy may be formed in selected portions in the surface of a host tabular grain, and alternatively, may be formed restrictedly in corners or edges of the host tabular grain. In the case of forming a silver salt epitaxy, it is preferable to form the silver salt epitaxy in selected sites in the surfaces of host tabular grains uniformly in individual grain and between the grains. As a concrete site-direct method of a silver salt epitaxy, there are known a method, which is disclosed in U.S. Pat. No. 4,435,501, of causing host grains to adsorb a spectral sensitizing dye (for example, a cyanine dye) or an aminoazaindene (for example, adenine) before the formation of the silver salt epitaxy, a method of causing host grains to contain silver iodide, and the like. These methods may be employed. Further, it is also possible to add iodide ions before the formation of the silver salt epitaxy, thereby precipitating them on host grains. These site-directing methods may be chosen case by case and may be employed in combination of them.

In the case of forming a silver salt epitaxy, the ratio of the area occupied by the silver salt epitaxy with respect to the surface are of the host tabular grain on which the silver salt epitaxy is formed is preferably 1 to 50%, more preferably 2 to 40%, and particularly preferably 3 to 30%. The amount of silver in the silver salt epitaxy relative to the total amount of silver in the silver halide tabular grains is preferably 0.3 to 50 mol %, more preferably 0.3 to 25 mol %, and particularly preferably 0.5 to 15 mol %. The composition of the silver salt epitaxy can be selected depending on a situation, and it may be silver halide containing any of a chloride ion, a bromide ion and an iodide ion.

In a lightsensitive material of the present invention, it is possible to mix, in a single layer, two or more types of emulsions different in at least one of characteristics of a lightsensitive silver halide emulsion, i.e., a grain size, grain size distribution, halogen composition, grain shape, and sensitivity.

The lightsensitive silver halide emulsion for use in the present invention may contain, for various purposes, a heavy metal such as iridium, rhodium, platinum, cadmium, zinc, thallium, lead, iron and osmium. These compounds may be used individually or in combination of two or more thereof. The addition amount varies depending on the use purpose, however, it is generally on the order of from $10^{-9}$ to $10^{-3}$ mol per mol of silver halide. The heavy metal may be incorporated uniformly into the grain or may be localized in the inside or on the surface of the grain. Specifically, emulsions described in JP-A's-2-236542, 1-116637 and the like are preferably used. At the stage of forming grains of the lightsensitive silver halide emulsion of the present invention, a rhodanate, an ammonia, a tetra-substituted thiourea compound, an organic thioether derivative described in Jpn. Pat Appln. KOKOKU Publication No. (hereinafter referred to as JP-B-) 47-11386, a sulfur-containing compound described in JP-A-53-144319 and the like may be used as a silver halide solvent.

With respect to other conditions, description in P. Glafkides, Chimie et Phisigue Photographique, Paul Montel (1967), G. F. Duffin, Photographic Emulsion Chemistry, The Focal Press (1966) and V. L. Zelikman et al, Making and Coating Photographic Emulsion, The Focal Press (1964) may be referred to. More specifically, any of an acid process, a neutral process and an ammonia process may be used, and as a method of reacting a soluble silver salt with a soluble halogen salt, any of a single jet method, a double jet method and a combination thereof may be used. In order to obtain a monodisperse emulsion, a double jet method is preferably used.

The lightsensitive silver halide emulsion is usually a silver halide emulsion subjected to chemical sensitization, the chemical sensitization herein means those except for the chemical sensitization using the compounds of types 1 to 4 according to the present invention. In the chemical sensitization of the lightsensitive silver halide emulsion for use in the present invention, chalcogen sensitization such as sulfur sensitization, selenium sensitization and tellurium sensitization, noble metal sensitization using gold, platinum, palladium or the like, and reduction sensitization, which are all known to the emulsion for normal type lightsensitive materials, may be used individually or in combination (see, JP-A-3-110555). The chemical sensitization may also be performed in the presence of a nitrogen-containing heterocyclic compound (see, JP-A-62-253159). Further, an antifoggant that will be described later, may be added after completion of the chemical sensitization. Specifically, the methods described in JP-A's-5-45833 and 62-40446 may be used.

At the time of chemical sensitization, the pH is preferably from 5.3 to 10.5, more preferably from 5.5 to 8.5, and the pAg is preferably from 6.0 to 10.5, more preferably from 6.8 to 9.0.

The lightsensitive silver halide emulsion for use in the present invention may be spectrally sensitized with a methine dye or the like so that the lightsensitive silver halide emulsion can have spectral sensitivity such as green sensitivity and red sensitivity. Further, spectral sensitization in the blue region may be applied to the blue-sensitive emulsion, if desired. Examples of the dye used include a cyanine dye, a merocyanine dye, a complex cyanine dye, a complex merocyanine dye, a holopolar cyanine dye, a hemicyanine dye, a styryl dye and a hemioxonol dye. These sensitizing dyes may be used individually or in combination and the combination of sensitizing dyes is often used for the purpose of supersensitization or for controlling the wavelength of spectral sensitization.

Further, it is preferable that the present invention is used in combination with a technique of improving light absorption efficiency using a spectral sensitizing dye, which technique, for example, is that of using intermolecular force thereby letting spectral sensitizing dyes absorb in more than a single-layer-saturation absorption (i.e., one layer absorption) on the surfaces of silver halide grains, or that of letting so-called combined dyes, which are dyes each having two or more unconjugated but covalently bonded chromophores, absorb. Among the techniques it is preferable to use the present invention in combination with the techniques described in the patent publications as flows:

JP-A's-10-239789, 11-133531, 2000-267216, 2000-275772, 2001-75222, 2001-75247, 2001-75221, 2001-

75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173 and 2001-356442, and EP's 985965A, 985964A, 985966A, 985967A, 1085372A, 1085373A, 1172688A, 1199595A and 887700A1. Among the techniques, those described in the following patent publications: JP-A's-10-239789, 2001-75222 and 10-171058 are especially preferably used in combination.

In combination with a sensitizing dye, a dye which itself has no spectral sensitization effect or a compound which absorbs substantially no visible light, but which exhibits supersensitization, may be contained in the emulsion. With respect to the timing when the spectral sensitizing dye is added to the emulsion, it may be added before, during or after chemical sensitization or may be added before or after nucleation of silver halide grains according to U.S. Pat. Nos. 4,183,756 and 4,225,666. The sensitizing dye or the supersensitizing dye may be added as a solution in an organic solvent such as methanol, a dispersion, for example, in gelatin, or a solution in a surface active agent. The addition amount is generally in the order of from $10^{-8}$ to $10^{-2}$ mol per mol of silver halide.

The photographic additives useful in the invention are described in the Research Disclosures, the disclosures of which are incorporated herewith by reference, and associating descriptions are set forth below.

| Types of Additives | RD17643 (December, 1978) | RD18716 (November, 1979) | RD307105 (November, 1989) |
|---|---|---|---|
| 1. Chemical sensitizers | page 23 | page 648 right column | page 866 |
| 2. Sensitivity increasing agents | | page 648 right column | |
| 3. Spectral sensitizers, super-sensitizers | pages 23 –24 | page 648, right column to page 649, right column | pages 866 –868 |
| 4. Brighteners | page 24 | page 647, right column | page 868 |
| 5. Light absorbents, filter dyes, ultraviolet absorbents | pages 25 –26 | page 649, right column to page 650, left column | page 873 |
| 6. Binders | page 26 | page 651, left column | pages 873 –874 |
| 7. Plasticizers, lubricants | page 27 | page 650, right column | page 876 |
| 8. Coating aids, surfactants | pages 26 –27 | page 650, right column | pages 875 –876 |
| 9. Antistatic agents | page 27 | page 650, right column | pages 876 –877 |
| 10. Matting agents | | | pages 878 –879 |

The present invention is also applicable to a thermally developable lightsensitive material. In such an application, it is preferred that an organometallic salt be used as an oxidizer in combination with a lightsensitive silver halide emulsion. Among suitable organometallic salts, an organosilver salt is most preferably employed. The organosilver salt suitable for use in the present invention is a silver salt which is relatively stable to light but forms a silver image when heated at 80° C. or above in the presence of exposed photocatalyst (for example, latent image of lightsensitive silver halide) and reducing agent. The organosilver salt may be any arbitrary organic substance containing a source capable of reducing silver ions. A silver salt of organic acid, especially a silver salt of long-chain aliphatic carboxylic acid (the number of carbon atoms is in the range of 10 to 30, preferably 15 to 28), is preferred. A complex of organic or inorganic silver salt whose ligand has a complex stability constant ranging from 4.0 to 10.0 is also preferred. Silver supplying substances can preferably constitute about 5 to 30% by weight of image forming layers. Further, a silver salt of compound having a mercapto group or thione group or a derivative thereof can be used as the organosilver salt. Still further, use can be made of a compound having an imino group, or various silver acetylide compounds. A plurality of organosilver salts may be used in combination.

The layer to be loaded with the organosilver salt is not limited, and the organosilver salt may be incorporated in one layer or a plurality of layers. Incorporating the organosilver salt in a layer containing no lightsensitive silver halide emulsion in the hydrophilic colloid layers provided on the side having silver halide emulsion layers, such as a protective layer, an interlayer or a so-called substratum disposed between a support and an emulsion layer, is preferred from the viewpoint of storability improvement. This organosilver salt can be jointly used in an amount of 0.01 to 10 mol, preferably 0.05 to 1 mol, per mol of lightsensitive silver halide that is contained in the layer to which the organosilver salt is added. It is appropriate for the coating amount total of lightsensitive silver halide and organosilver salt to be in the range of 0.02 to 20 g/m$^2$, preferably 0.1 to 12 g/m$^2$, more preferably 6 g/m$^2$ or more in terms of silver.

The silver halide emulsion and/or organosilver salt of the present invention can be protected against additional fogging and can be stabilized so as to be free from sensitivity change during storage by the use of an antifoggant, a stabilizer and a stabilizer precursor. As a suitable antifoggant, stabilizer and stabilizer precursor which can be used individually or in combination, there can be mentioned thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechols described in U.S. Pat. No. 3,235,652; oximes, nitrons and nitroindazoles described in GB No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogenated organic compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

As the antifoggant which can preferably be employed in the present invention, there can be mentioned organic halides, examples of which include compounds disclosed in, for example, JP-A's 50-119624, 50-120328, 51-121332, 54-58022, 56-70543, 56-99335, 59-90842, 61-129642, 62-129845, 6-208191, 7-5621, 7-2781 and 8-15809, and U.S. Pat. Nos. 5,340,712, 5,369,000 and 5,464,737. The lightsensitive material of the present invention may contain benzoic acids for attaining sensitivity enhancement and fogging prevention. Although the benzoic acids for use in the present invention may be any of benzoic acid derivatives, compounds described in, for example, U.S. Pat. Nos. 4,784,939 and 4,152,160 can be mentioned as providing preferable forms of structures thereof.

The lightsensitive material of the present invention can be loaded with a mercapto compound, a disulfide compound and a thione compound in order to control development through development inhibition or acceleration, to enhance spectral sensitization efficiency and to improve storability before and after development. When a mercapto compound is used in the present invention, although the structure thereof is not limited, compounds of the formula Ar—SM or Ar—S—S—Ar can preferably be employed. In the formula, M represents a hydrogen atom or an alkali metal atom. Ar represents an aromatic ring group or condensed aromatic ring group containing at least one nitrogen, sulfur, oxygen, selenium or tellurium atom. The addition amount of these mercapto compounds is preferably in the range of 0.001 to 1.0 mol, more preferably 0.01 to 0.3 mol, per mol of silver in an emulsion layer.

In the lightsensitive material using the emulsion of the present invention, there can be employed a silver halide solvent. For example, there can be employed thiosulphates, sulfites, thiocyanates, thioether compounds described in JP-B-47-11386, compounds having a 5- or 6-membered imido group, such as uracil or hydantoin, described in JP-A-8-179458, compounds having a carbon to sulfur double bond as described in JP-A-53-144319, and mesoionic thiolate compounds such as trimethyltriazolium thiolate as described in Analytica Chimica Acta, vol. 248, pages 604 to 614 (1991). Also, compounds which can fix and stabilize silver halides as described in JP-A-8-69097 can be used as the silver halide solvent. The amount of silver halide solvent contained in the lightsensitive material is in the range of 0.01 to 100 mmol/$m^2$, preferably 0.1 to 50 mmol/$m^2$, and more preferably 10 to 50 mmol/$m^2$. The silver halide solvents may be used individually. Also, preferably, a plurality thereof can be used in combination.

Hydrophilic binders are preferably employed in the lightsensitive material and constituent layers thereof. Examples of such hydrophilic binders include those described in the aforementioned RD's and JP-A-64-13546, pages 71 to 75. In particular, transparent or translucent hydrophilic binders are preferred, which can be constituted of, for example, natural compounds including a protein, such as gelatin or a gelatin derivative, and a polysaccharide, such as a cellulose derivative, starch, gum arabic, dextran or pulluran, or synthetic polymer compounds, such as polyvinyl alcohol, modified polyvinyl alcohol (e.g., terminal-alkylated Poval MP 103 and MP 203 produced by Kuraray Co., Ltd.), polyvinylpyrrolidone and an acrylamide polymer. Also, use can be made of highly water absorbent polymers described in, for example, U.S. Pat. No. 4,960,681 and JP-A-62-245260, namely, a homopolymer of any of vinyl monomers having —COOM or —$SO_3$M (M is a hydrogen atom or an alkali metal), a copolymer of such vinyl monomers and a copolymer of any of such vinyl monomers and another vinyl monomer (e.g., sodium methacrylate or ammonium methacrylate, Sumikagel L-5H produced by Sumitomo Chemical Co., Ltd.). These binders can be used individually or in combination. A combination of gelatin and other binder mentioned above is preferred. The gelatin can be selected from among lime-processed gelatin, acid-processed gelatin and delimed gelatin which is one having a content of calcium and the like reduced in conformity with variable purposes. These can be used in combination.

Polymer latex is also preferably employed as the binder in the present invention. The polymer latex is a dispersion of a water-insoluble hydrophobic polymer, as fine particles, in a water-soluble dispersion medium. The state of dispersion is not limited, and the polymer latex may be any of a latex comprising a polymer emulsified in a dispersion medium, a product of emulsion polymerization, a micelle dispersion, and a molecular dispersion of molecular chains per se due to the presence of partial hydrophilic structure in polymer molecule. The average particle diameter of dispersed particles is preferably in the range of about 1 to 50,000 nm, more preferably 5 to 1000 nm. The polymer species for use in the polymer latex are, for example, an acrylic resin, a vinyl acetate resin, a polyester resin, a polyurethane resin, a rubber resin, a vinyl chloride resin, a vinylidene chloride resin and a polyolefin resin. The molecular weight of the polymer is preferably in the range of about 0.5 to 1000 thousand, more preferably 1 to 500 thousand, in terms of number average molecular weight Mn.

The lightsensitive material using the emulsion of the present invention preferably contains a dye-forming coupler. Those preferably used as the coupler are compounds generically designated as active methylene, 5-pyrazolone, pyrazoloazole, phenol, naphthol, pyrrolotriazole. The compounds referred to on pages 616 to 624 of RD No. 38957 (September, 1996) are preferably used as the couples. These couplers may be classified into so-called two-equivalent couplers and four-equivalent couplers, and both of them may be used. Besides the above compounds described in RD No. 38957, the following couplers can also preferably be employed.

As active methylene couplers, there can be employed couplers represented by the formulae (I) and (II) of EP No. 502,424A; couplers represented by the formulae (1) and (2) of EP No. 513,496A; couplers represented by the formula (I) of claim 1 of EP No. 568,037A; couplers represented by the general formula (I) of column 1, lines 45–55, of U.S. Pat. No. 5,066,576; couplers represented by the general formula (I) of paragraph 0008 of JP-A-4-274425; couplers recited in claim 1 of page 40 of EP No. 498,381A1; couplers represented by the formula (Y) of page 4 of EP No. 447,969A1; and couplers represented by the formulae (II) to (IV) of column 7, lines 36–58, of U.S. Pat. No. 4,476,219.

As 5-pyrazolone magenta couplers, there can preferably be employed compounds described in JP-A's 57-35858 and 51-20826. As pyrazoloazole couplers, there can preferably be employed imidazo[1, 2-b]pyrazoles described in U.S. Pat. No. 4,500,630; pyrazolo[1, 5-b][1, 2, 4]triazoles described in U.S. Pat. No. 4,540,654; and pyrazolo[5, 1-c][1, 2, 4]triazoles described in U.S. Pat. No. 3,725,067. Of these, pyrazolo[1, 5-b][1, 2, 4]triazoles are most preferred from the viewpoint of light fastness. Also, there can preferably be employed pyrazoloazole couplers comprising a pyrazolotriazole group having a branched alkyl group directly bonded to 2-, 3- or 6-position thereof as described in JP-A-61-65245; pyrazoloazole couplers having a sulfonamido group in molecules thereof as described in JP-A-61-65245; pyrazoloazole couplers having an alkoxyphenylsulfonamido ballast group as described in JP-A-61-147254; pyrazolotriazole couplers having an alkoxy or aryloxy group at 6-position thereof as described in JP-A's 62-209457 and 63-307453; and pyrazolotriazole couplers having a carbonamido group in molecules thereof as described in JP-A-2-201443.

As preferred examples of phenol couplers, there can be mentioned, for example, 2-alkylamino-5-alkylphenol couplers described in U.S. Pat. Nos. 2,369,929, 2,801,171, 2,772,162, 2,895,826 and 3,772,002; 2,5-diacylaminophenol couplers described in U.S. Pat. Nos. 2,772,162, 3,758,308, 4,126,396, 4,334,011 and 4,327,173, DE No. 3,329,729 and JP-A-59-166956; and 2-phenylureido-5-acylaminophenol couplers described in U.S. Pat. Nos. 3,446,622, 4,333,999, 4,451,559 and 4,427,767. As preferred examples of naphthol couplers, there can be mentioned, for example, 2-carbamoyl-1-naphthol couplers described in U.S. Pat. Nos. 2,474,293, 4,052,212, 4,146,396, 4,228,233 and 4,296,200; and 2-carbamoyl-5-amido-1-naphthol couplers described in U.S. Pat. No. 4,690,889.

As preferred examples of pyrrolotriazole couplers, there can be mentioned those described in EP Nos. 488,248A1, 491,197A1 and 545,300.

Moreover, use can be made of couplers with the condensed ring phenol, imidazole, pyrrole, 3-hydroxypyridine, active methine, 5,5-condensed heterocycle and 5,6-condensed heterocycle structures. As condensed ring phenol couplers, there can be employed those described in, for example, U.S. Pat. Nos. 4,327,173, 4,564,586 and 4,904,575.

As imidazole couplers, there can be employed those described in, for example, U.S. Pat. Nos. 4,818,672 and 5,051,347. As pyrrole couplers, there can be employed those described in, for example, JP-A's 4-188137 and 4-190347. As 3-hydroxypyridine couplers, there can be employed those described in, for example, JP-A-1-315736. As active methine couplers, there can be employed those described in, for example, U.S. Pat. Nos. 5,104,783 and 5,162,196.

As 5,5-condensed heterocycle couplers, there can be employed, for example, pyrrolopyrazole couplers described in U.S. Pat. No. 5,164,289 and pyrroloimidazole couplers described in JP-A-4-174429. As 5,6-condensed heterocycle couplers, there can be employed, for example, pyrazolopyrimidine couplers described in U.S. Pat. No. 4,950,585, pyrrolotriazine couplers described in JP-A-4-204730 and couplers described in EP No. 556,700.

In the present invention, besides the above couplers, use can also be made of couplers described in, for example, DE Nos. 3,819,051A and 3,823,049, U.S. Pat. Nos. 4,840,883, 5,024,930, 5,051,347 and 4,481,268, EP Nos. 304,856A2, 329,036, 354,549A2, 374,781A2, 379,110A2 and 386,930A1, JP-A's 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731 and 4-204732. These couplers are used in an amount of 0.05 to 10 mmol/$m^2$, preferably 0.1 to 5 mmol/$m^2$, for each color.

Furthermore, the following functional couplers may be contained. As couplers for forming a colored dye with appropriate diffusibility, there can preferably be employed those described in U.S. Pat. No. 4,366,237, GB No. 2,125,570, EP No. 96,873B and DE No. 3,234,533.

As couplers for correcting any unneeded absorption of a colored dye, there can be mentioned yellow colored cyan couplers of formula (CI), (CII), (CIII), and (CIV) (especially YC-86 on page 84) described in EP No. 456,257A1; yellow colored magenta couplers ExM-7 (page 202) and Ex-1 (page 249), described in the same EP; magenta colored cyan couplers CC-9 (column 8) and CC-13 (column 10) described in U.S. Pat. No. 4,833,069; colorless masking couplers represented by the formula (2) (column 8) of U.S. Pat. No. 4,837,136 and represented by the formula (A) of claim 1 of WO 92/11575 (especially, compound examples of pages 36 to 45).

As compounds (including couplers) capable of reacting with a developing agent in an oxidized form to thereby release photographically useful compound residues, there can be mentioned the following:

Development inhibitor-releasing compounds: compounds represented by the formulae (I) to (IV) of page 11 (especially, T-101 (page 30), T-104 (page 31), T-113 (page 36), T-131 (page 45), T-144 (page 51) and T-158 (page 58)) of EP No. 378,236A1, compounds represented by the formula (I) of page 7 (especially, D-49 (page 51)) of EP No. 436,938A2, compounds represented by the formula (I) (especially, (23) (page 11)) of EP No. 568,037A, and compounds represented by the formulae (I), (II) and (III) of pages 5-6 (especially I-(1) on page 29) of EP No. 440,195A2;

Bleaching accelerator-releasing compounds: compounds represented by the formulae (I) and (I') of page 5 (especially (60) and (61) on page 61) of EP No. 310,125A2 and compounds represented by the formula (I) of claim 1 (especially, (7) (page 7) of JP-A-6-59411;

Ligand-releasing compounds: compounds represented by LIG-X described in claim 1 (especially compounds in lines 21 o 41 of column 12) of U.S. Pat. No. 4,555,478;

Leuco dye-releasing compounds: compounds 1 to 6 of columns 3 to 8 of U.S. Pat. No. 4,749,641;

Fluorescent dye-releasing compounds: compounds represented by COUP-DYE of claim 1 (especially compounds 1 to 11 in columns 7 to 10) of U.S. Pat. No. 4,774,181;

Development accelerator or fogging agent-releasing compounds: compounds represented by the formulae (1), (2) and (3) of column 3 (especially, (I-22) in column 25) of U.S. Pat. No. 4,656,123 and ExZK-2 of page 75, lines 36 to 38, of EP No. 450,637A2; and Compounds which release a group becoming a dye only after its splitting off: compounds represented by the formula (I) of claim 1 (especially Y-1 to Y-19 in columns 25 to 36) of U.S. Pat. No. 4,857,447.

The following compounds are preferable as additives other than the couplers.

Dispersing medium for oil-soluble organic compounds: P-3, 5, 16, 19, 25, 30, 42, 49, 54, 55, 66, 81, 85, 86, and 93 (pages 140 to 144) of JP-A-62-215273;

Latex for impregnating oil-soluble organic compounds: latex described in U.S. Pat. No. 4,199,363;

Scavengers of an developing agent in an oxidized form: compounds represented by formula (I) in lines 54 to 62 of column 2 (especially, I-(1), (2) (6) and (12) (columns 4 to 5) of U.S. Pat. No. 4,978,606, the formula in lines 5 to 10 of column 2 (especially, compound 1 (column 3)) of U.S. Pat. No. 4,923,787;

Stain-preventing agents: formulas (I) to (III) in lines 30 to 33 on page 4, especially I-47, 72, III-1 and 27 (pages 24 to 48) of EP 298,321A;

Color-fading-preventing agents: A-6, 7, 20, 21, 23, 24, 25, 26, 30, 37, 40, 42, 48, 63, 90, 92, 94, and 164 (pages 69 to 118) of EP 298,321A, II-I to III-23, especially III-10, of columns 25 to 38 of U.S. Pat. No. 5,122,444, I-1 to III-4, especially II-2, on pages 8 to 12 of EP 471,347A, and A-1 to 48, especially A-39 and 42, in columns 32 to 40 of U.S. Pat. No. 5,139,931;

Substances that reduce use amount of a color-increasing agent or color-mixing-preventing agent: I-1 to II-15, especially I-46, on pages 5 to 24 of EP 41,132A;

Formalin scavengers: SCV-1 to 28, especially SCV-8, on pages 24 to 29 of EP 477,932A;

Film hardeners: H-1, 4, 6, 8 and 14 on page 17 of JP-A-1-214845, Compounds (H-1 to 54) represented by formulas (VII) to (XII) in columns 13 to 23 of U.S. Pat. No. 4,618,573, Compounds (H-1 to 76), especially H-14, represented by formula (6) lower right on page 8 of JP-A-2-214852, compounds described in claim 1 of U.S. Pat. No. 3,325,287;

Development-inhibiting agent precursors: P-24, 37, and 39 (pages 6 to 7) of JP-A-62-168139, Compounds described in claim 1, especially compounds 28 and 29 in column 7 of U.S. Pat. No. 5,019,492;

Antiseptic and mildewproofing agents: I-1 to III-43, especially II-1, 9, 10, 18 and III-25, in columns 3 to 15 of U.S. Pat. No. 4,923,790;

Stabilizers and fogging-preventing agents: I-1 to (14), especially I-1, 60 (2) and (13), in columns 6 to 16 of U.S. Pat. No. 4,923,793, compounds 1 to 65, especially 36, in columns 25 to 32 of U.S. Pat. No. 4,952,483;

Chemical sensitizers: triphenylphosphine selenide, compounds 50 of JP-A-5-40324;

Dyes: a-1 to b-20, especially a-1, 12, 18, 27, 35 and 36, and b-5, on pages 15 to 18, and V-1 to 23, especially V-1, on pages 27 to 29 of JP-A-3-156450, F-I-1 to F-II-43, especially F-I-11 and F-II-8, on pages 33 to 55 of EP 445,627A, III-1 to 36, especially III-1 and 3, on pages 17 to 28 of EP 457,153A, fine grain dispersions of Dye-1 to 124 on pages 8 to 26 of International Patent No. 88/04794, compounds 1 to 22, especially compound 1 on pages 6 to 11 of EP 319,999A, Compounds D-1 to 87 (pages 3 to 28) represented by formulas (1) to (3) of EP 519,306A, compounds 1 to 22 (column 3 to 10) represented by formula (I) of U.S. Pat. No. 4,268,622, compounds (1) to (31) (columns 2 to 9) represented by formula (I) of U.S. Pat. No. 4,923,788;

UV absorbents: compounds 101 to 427 (pages 6 to 9) and compounds (18b) to (18r) represented by formula (1) of JP-A-46-3335, compounds (3) to (66) (pages 10 to 44) represented by formula (I) and compounds HBT-1 to 10 (page 14) represented by formula (III) of EP 520,938A and compounds (1) to (31) represented by formula (I) (columns 2 to 9) of EP 521,823A.

These functional couplers and additives are preferably used in a molar amount of 0.05 to 10 times, more preferably 0.1 to 5 times, that of the aforementioned couplers which contribute to coloring.

Hydrophobic additives such as couplers and color developing agents can be introduced in layers of lightsensitive materials by known methods such as the method described in U.S. Pat. No. 2,322,027. In the introduction, use can be made of high-boiling organic solvents described in, for example, U.S. Pat. Nos. 4,555,470, 4,536,466, 4,536,467, 4,587,206, 4,555,476 and 4,599,296 and JP-B-3-62256, optionally in combination with low-boiling organic solvents having a boiling point of 50 to 160° C.

For the lightsensitive material using the emulsion of the present invention, it is only required that at least one silver halide emulsion layer be formed on a support. A typical example is a silver halide photographic lightsensitive material having, on its support, at least one lightsensitive layer constituted by a plurality of silver halide emulsion layers which are sensitive to essentially the same color but have different speed. These lightsensitive layers include a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color. Various non-lightsensitive layers can be formed between the silver halide lightsensitive layers and as the uppermost layer and the lowermost layer. These intermediate layers may contain, e.g., couplers described above, developing agents, DIR compounds, color-mixing inhibitors and dyes. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045. Further, a non-lightsensitive layer may be provided between respective halide emulsion layers. Also, as described in JP-A's-57-112751, 62-200350, 62-206541 and 62-206543, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH) /low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH. In addition, as described in JP-B-55-34932 layers can be arranged from the farthest side from a support in the order of blue-sensitive layer/GH/RH/GL/RL. Furthermore, as described in JP-A's-56-25738 and 62-63936 layers can be arranged from the farthest side from a support in the order of blue-sensitive layer/GL/RL/GH/RH.

As described in JP-B-49-15495 three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different speeds, these layers can be arranged in the order of medium-speed emulsion layer/high-speed emulsion layer/low-speed emulsion layer from the farthest side from a support in a layer sensitive to one color as described in JP-A-59-202464. In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed. In order to improve color reproduction, an inter layer effect-donating layer (CL), whose spectral sensitivity distribution is different from those of the main lightsensitive layers of BL, GL and RL, can be arranged adjacent to the main lightsensitive layer or near the main lightsensitive layer, as described in U.S. Pat. Nos. 4,663,271, 4,705,744 and 4,707,436, and JP-A's-62-160448 and 63-89850.

Various layer structures and arrangements may be selected depending on the purpose of each lightsensitive material, as mentioned above.

In the present invention, a silver halide emulsion and a color-forming coupler and a color developing agent may be contained in the same layer, but may be separately added in different layers if there are in a reaction-capable condition. For example, when a layer containing a developing agent and a layer containing a silver halide emulsion are separately arranged, raw storability of a material can be accomplished. Although the relationship between spectral sensitivity and coupler hue of each layer is arbitrary, the use of cyan coupler in a red-sensitive layer, magenta coupler in a green-sensitive layer and yellow coupler in a blue-sensitive layer enables direct projection exposure on conventional color paper or the like. In the lightsensitive material, various non-lightsensitive layers such as a protective layer, a substratum, an interlayer, a yellow filter layer and an antihalation layer may be provided between aforementioned silver halide emulsion layers, or as an uppermost layer or a lowermost layer. The opposite side of the support can be furnished with various auxiliary layers such as a back layer.

The dye which can be used in a yellow filter layer and an antihalation layer is preferably one decolorized or removed at the time of development and hence not contributing to density after processing. Specifically, there can be mentioned dyes described in EP No. 549,489A and ExF2 to 6 dyes described in JP-A-7-152129. Also, use can be made of solid-dispersed dyes as described in JP-A-8-101487. The dye can be mordanted in advance with the use of a mordant and a binder. As the mordant and dye, there can be employed those known in the art of photography. For example, use can be made of mordant described in U.S. Pat. No. 4,500,626 columns 58-59, JP-A-61-88256 pages 32–41, and JP-A's 62-244043 and 62-244036.

Further, use can be made of a compound capable of reacting with a reducing agent to thereby release a diffusive dye together with a reducing agent, so that a mobile dye can be released by an alkali at the time of development, transferred to the processing material and removed. Relevant descriptions are found in U.S. Pat. Nos. 4,559,290 and 4,783,396, EP No. 220,746A2, JIII Journal of Technical Disclosure No. 87-6119. A decolorizable leuco dye or the like can also be employed. For example, JP-A-1-150132 discloses a silver halide lightsensitive material containing a leuco dye which has been colored in advance by the use of a developer of a metal salt of organic acid. The complex of leuco dye and developer is decolorized by heating or reaction with an alkali agent.

The coating layers of the lightsensitive material using the emulsion of the present invention are preferably hardened by film hardeners. Examples of film hardeners include those described in, for example, U.S. Pat. Nos. 4,678,739 column 41 and 4,791,042, and JP-A's 59-116655, 62-245261, 61-18942 and 4-218044. More specifically, use can be made of aldehyde film hardeners (e.g., formaldehyde), aziridine film hardeners, epoxy film hardeners, vinylsulfone film hardeners (e.g., N,N'-ethylene-bis(vinylsulfonylacetamido) ethane), N-methylol film hardeners (e.g., dimethylolurea), and boric acid, metaboric acid or polymer film hardeners (compounds described in, for example, JP-A-62-234157). These film hardeners are used in an amount of 0.001 to 1 g, preferably 0.005 to 0.5 g, per g of hydrophilic binder.

In the lightsensitive material, various surfactants can be used for the purpose of coating aid, frilling amelioration, sliding improvement, static electricity prevention, development acceleration, etc. Examples of surfactants are described in, for example, Public Technology No. 5 (Mar. 22, 1991, issued by Aztek) pages 136–138 and JP-A's 62-173463 and 62-183457. An organic fluorocompound may be incorporated in the lightsensitive material for the purpose of sliding prevention, static electricity prevention, frilling amelioration, etc. As representative examples-of organic fluorocompounds, there can be mentioned fluorinated surfactants described in, for example, JP-B-57-9053 columns 8 to 17 and JP-A's 61-20944 and 62-135826, and hydrophobic fluorocompounds including an oily fluorocompound such as fluoroil and a solid fluorocompound resin such as ethylene tetrafluoride resin. Fluorinated surfactants having a hydrophilic group can also preferably be employed for the purpose of reconciling the wettability and static electricity prevention of lightsensitive material.

It is preferred that the lightsensitive material has sliding properties. A layer containing a sliding agent is preferably provided on both the lightsensitive layer side and the back side. Examples of suitable sliding agents include polyorganosiloxanes, higher fatty acid amides, higher fatty acid metal salts and esters of higher fatty acids and higher alcohols. As the polyorganosiloxanes, there can be employed, for example, polydimethylsiloxane, polydiethylsiloxane, polystyrylmethylsiloxane and polymethylphenylsiloxane. The layer to be loaded with the sliding agent is preferably an outermost one of emulsion layers or a back layer. Polydimethylsiloxane and an ester having a long-chain alkyl group are especially preferred. For preventing silver halide pressure marks and desensitization, silicone oil and chlorinated paraffin are preferably used.

In the present invention, further, an antistatic agent is preferably used. As the antistatic agent, there can be mentioned a polymer containing a carboxylic acid and a carboxylic acid salt or sulfonic acid salt, a cationic polymer and an ionic surfactant compound. Most preferable antistatic agent consists of fine particles of a crystalline metal oxide of $10^7$ Ω·cm or less, preferably $10^5$ Ω·cm or less, volume resistivity with a particle size of 0.001 to 1.0 μm, constituted of at least one member selected from among ZnO, $TiO_2$, $SnO_2$, $Al_2O_3$, $In_2O_3$, $SiO_2$, MgO, BaO, $MoO_3$ and $V_2O_5$, or a composite oxide thereof (e.g., Sb, P, B, In, S, Si or C), or fine particles of such a metal oxide or composite oxide thereof in sol form. The content of antistatic agent in the lightsensitive material is preferably in the range of 5 to 500 $mg/m^2$. The quantitative ratio of conductive crystalline oxide or composite oxide thereof to binder is preferably in the range of 1:300 to 100:1, more preferably 1:100 to 100:5. The back of the support of the lightsensitive material is preferably coated with a water resistant polymer described in JP-A-8-292514. The lightsensitive material or later described processing material constitution (including back layer) can be loaded with various polymer latexes for the purpose of film property improvements, such as dimension stabilization, curling prevention, sticking prevention, film cracking prevention and pressure increase desensitization prevention. For example, use can be made of any of polymer latexes described in JP-A's 62-245258, 62-136648 and 62-110066. In particular, when a polymer latex of low glass transition temperature (40° C. or below) is used in a mordant layer, the cracking of the mordant layer can be prevented. Further, when a polymer latex of high glass transition temperature is used in a back layer, a curling preventive effect can be exerted.

The lightsensitive material using the emulsion of the present invention may use a matting agent. The addition position of the matting agent may be either in an emulsion layer or back layer, but the outermost layer on the back surface or the outermost layer on the emulsion surface upon the support is preferable. The matting agent may be soluble or insoluble to a processing liquid, and the matting agents of the both natures may be used in combination. For example, polymethyl methacrylate, poly(methyl methacrylate/methacrylic acid=9/1 to 5/5 (molar ratio), polystyrene grains are preferable. Regarding the grain size, 0.8 to 10 μm is preferable. The distribution of the grain size is preferably narrow. It is preferable that the 90% or more of all grains are those having a grain size of 0.9 to 1.1 times the average grain size. Also, in order to enhance matte performance, simultaneous addition of fine grains of 0.8 μm or less, such as polymethyl methacrylate (0.2 μm), poly(methyl methacrylate/methacrylic acid=9/1 (molar ratio), 0.3 μm), polystyrene grains (0.25 μm), and colloidal silica (0.03 μm), is preferable.

In the present invention, as the support of the lightsensitive material, there can be employed a transparent one capable of resisting processing temperatures. Generally, use can be made of photographic supports of paper, synthetic polymers (films), etc. as described in pages 223 to 240 of "Shashinkogaku no Kiso—Gin-en Shashin Hen—(Fundamental of Photographic Technology—Silver Salt Photography—)" edited by The Society of Photographic Science and Technologh of Japan and published by CMC Co., Ltd. (1979). For example, use can be made of supports of polyethylene terephthalate, polyethylene naphthalate, polycarbonate, polyvinyl chloride, polystyrene, polypropylene, polyimide and cellulose (e.g., triacetylcellulose). Also, use can be made of supports described in, for example, JP-A's 62-253159 pages 29 to 31, 1-161236 pages 14 to 17, 63-316848, 2-22651 and 3-56955 and U.S. Pat. No. 5,001,033. In order to improve optical properties and physical properties, these supports can be subjected to, for example, heat treatment (crystallization degree and orientation control), monoaxial or biaxial drawing (orientation control), blending of various polymers and surface treatment. When requirements on heat resistance and curling properties are especially strict, supports described in JP-A's 6-41281, 6-43581, 6-51426, 6-51437, and 6-51442 can preferably be employed as the support of the lightsensitive material. Moreover, a support of a styrene polymer of mainly syndiotactic structure can preferably be employed. The thickness of the supports is preferably in the range of 5 to 200 μm, more preferably 40 to 120 μm.

The polyester support preferably used in the present invention will be described below. Particulars thereof together with the below mentioned light-sensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol. % are especially preferred. Polyethylene 2,6-naphthalate is most preferred. The average molecular weight thereof ranges from approximately 5,000 to 200,000. The Tg of the polyester for use in the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.), or a ultraviolet ray absorbent may be mixed in this polyester. Also, a dye or colorant that is commercially available for use in polyester may be mixed in order to prevent light piping. Surface treatment is preferably performed for adhering the support and the lightsensitive material constituting layers to each other. Examples thereof include chemical, mechanical, corona discharge, flaming, ultraviolet irradiation, high-frequency, glow discharge, active plasma, laser, mixed acid, ozonization and other surface activating treatments. Of these surface treatments, ultraviolet irradiation, flaming, corona discharge and glow discharge treatments are preferred.

Now, the substratum will be described below. The substratum may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose, gelatin, polyvinyl alcohol and modified polymere of these polymers. Resorcin or p-chlorophenol is used as a support-swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-s-triazine), an epichlorohydrin resin or an active vinyl sulfone compound can be used in the substratum. Also, $SiO_2$, $TiO_2$, inorganic fine grains or polymethyl methacrylate copolymer fine grains (0.01 to 10 μm) may be incorporated therein as a matting agent. Further, it is preferable to record photographed information and etc. using, as a support, the support having a magnetic recording layer as described in JP-A's 4-124645, 5-40321, 6-35092 and 6-317875.

The magnetic recording layer herein is the one obtained by coating a support with a water-base or organic solvent coating liquid having magnetic material grains dispersed in a binder. The magnetic material grains for use in the present invention can be composed of any of ferromagnetic iron oxides such as $\gamma Fe_2O_3$, Co coated $\gamma Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of SBET. The saturation magnetization (σs) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652. The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred.

The thickness of the magnetic recording layer ranges from 0.1 to 10 μm, preferably 0.2 to 5 μm. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15.

Next, the film patrone capable of loading a lightsensitive material will be described. The main material composing the patrone for use in the present invention may be a metal or a synthetic plastic. Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538.

The above-described lightsensitive material of the present invention is also suitable for use in a lens-fitted film unit described in JP-B-2-32615 and Japanese Utility Model Application KOKAI Publication No. 3-39784. The lens-fitted film unit refers to a unit made up of a package unit body provided with a photographing lens and shutter in advance and accommodates an unexposed lightsensitive material in the form of a sheet or a roll either directly or by loading it in a container, in which the unit is sealed in a light-tight manner and is further packaged in an exterior packaging material. In addition, the package unit body may be provided with a finder and mechanisms for, e.g., forwarding frames, accommodating an exposed lightsensitive material and taking it out. Further, the finder may be provided with a parallax-correcting support, while the photographing mechanism may be provided with an auxiliary illuminating mechanism described in Japanese Utility Model Application KOKAI Publication No. 1-93723, 1-57738 and 1-57740, JP-A's-1-93723 and 1-152437.

The lightsensitive material of the present invention can be developed by customary processes as described in the aforementioned RD No. 17643 pages 28 to 29, RD No. 18716 page 651 left column to right column, and RD No. 307105 pages 880 to 881. As the development processing for color negative films which can be used in the present invention, there can be mentioned the C-41 processing of Eastman Kodak and the CN-16 processing of Fuji Photo Film Co., Ltd. With respect to the development processing for color reversal films which can be used in the present invention, particulars are described in detail in Public Technology No. 6 (Apr. 1, 1991) issued by Aztek, page 1 line 5 to page 10 line 5 and page 15 line 8 to page 24 line 2, any of which can be preferably applied. As preferred development processings involving the above particulars, there can be mentioned the E-6 processing of Eastman Kodak and the CR-56 processing of Fuji Photo Film Co., Ltd. On the lightsensitive material of the present invention, an image can be formed through the activator processing or the development with a processing solution containing a developing agent and a base. Herein, the activator processing refers to a processing method wherein a color developing agent is incorporated in the lightsensitive material and wherein the development processing is performed with the use of a processing solution containing no color developing agent. This processing solution is characterized in that any color developing agent contained in customary development processing solution components is not contained therein, and may contain other components (for example, an alkali, an auxiliary developing agent, etc.). With respect to examples of activator processings, reference can be made to literature such as EP's 545,491A1 and 565.165A1.

On the lightsensitive material of the present invention, it is also preferred to effect an image formation by thermal development after imagewise exposure. The thermal processing of lightsensitive materials is known in the art to which the present invention pertains. With respect to thermally developable lightsensitive materials and processings thereof, reference can be made to, for example, *Shashin Kogaku no Kiso* (Fundamentals of Photographic Engineering) published by Corona in 1970, pages 553 to 555; *Eizo Joho* (Projected Image Information) published in Apr. 1, 1978, page 40; Nabletts Handbook of Photography and Reprography, 7th ed., published by Vna Nostrand and Reinhold Company, pages 32 to 33; U.S. Pat. Nos. 3,152,904, 3,301,678, 3,392,020 and 3,457,075; GB Nos. 1,131,108 and 1,167.777; and RD No. 17029 (1978) pages 9 to 15. Although the heating temperature for thermal development is in the range of about 50 to 250° C., it is especially effective to perform heating at 60 to 180° C.

In the lightsensitive material of the present invention, a base or a base precursor can be used for the purpose of accelerating silver development and dye forming reaction. Examples of the base precursor include a salt of a base with an organic acid capable of decarboxylation by heat and a compound that releases an amine by intramolecular nucleophilic substitution reaction, Rossen rearrangement or Beckmann rearrangement. Specific examples thereof are described in U.S. Pat. Nos. 4,514,493 and 4,657,848 and Known Technology No. 5, (issued on Mar. 22, 1991, by Aztek Limited), pp. 55 to 86. Also, a method of generating a base by the combination of a sparingly water-soluble basic metal compound with a compound (referred to as a complex forming compound) that is capable of complex formation reaction with the metal ion constituting the basic metal compound using water as a medium, may also be used. The amount of the base or the base precursor used is from 0.1 to 20 $g/m^2$, preferably from 1 to 10 $g/m^2$.

In the performing of thermal development with the use of processing members, it is preferred to use a small amount of water for the purpose of development acceleration, acceleration of transfer on processing materials, or acceleration of diffusion of unwanted matter. With respect to particular examples, reference can be made to, for example, U.S. Pat. Nos. 4,704,245 and 4,470,445 and JP-A-61-238056.

Known thermal solvents can be added to the thermally developable lightsensitive material for the purpose of accelerating the thermal development. Herein, the thermal solvent refers to an organic material which is solid at ambient temperature but, at employed thermal processing temperature or below, joins with other components to thereby exhibit a mixed melting point and which is liquefied at the time of thermal development, exerting an activity of accelerating the thermal development or thermal transfer of dyes. As a useful thermal solvent, there can be mentioned, for example, a compound capable of being a solvent of developing agent, a compound which is a substance of high dielectric constant and is known as accelerating the physical development of a silver salt, or a compound which is miscible with binders and is capable of swelling binders.

In the present invention, although image information can be incorporated without removing the developed silver resulting from development and undeveloped silver halides, it is also practical to effect the image incorporation after the removal thereof. In the latter instance, means for removing them can be applied simultaneously with the development or after the development. When it is intended to remove the developed silver from the lightsensitive material, or complex or solubilize silver halides, simultaneously with the development, there can be employed means comprising loading processing members with a silver oxidizer or re-halogenating agent capable of acting as a bleaching agent or a silver halide solvent capable of acting as a fixing agent, and inducing reaction thereof at the time of thermal development. Alternatively, there can be employed means comprising, after the completion of image forming development, sticking a second member containing a silver oxidizer or re-halogenating agent or a silver halide solvent to the lightsensitive material to thereby carry out removal of developed silver or complexing or solubilization of silver halides.

Common silver bleaching agents can be arbitrarily used in processing members of the present invention. Such bleaching agents are described in U.S. Pat. Nos. 1,315,464 and 1,946,640 and Photographic Chemistry, vol. 2, chapter 30, Foundation Press, London, England. As the fixing agent, use can be made of silver halide solvents which can be contained in the processing members (first processing members) for developing the lightsensitive material. The same binder, support and other additives as in the first processing members can be used in the second processing members.

In the present invention, it is preferred to photoelectrically read images formed on the lightsensitive material by thermal development and to convert image readings to digital signals. As an image reader, use can be made of generally known image input devices. With respect to details of image input devices, reference can be made to Takao Ando, et al. "*Digital Gazo Nyuryoku no Kiso* (Fundamentals of Digital Image Input)" published by Corona (1998), pages 58 to 98.

Image processing methods which can preferably be used in the image formation process according to the present invention are, for example, as follows. JP-A-6-139323 describes an image processing system and image processing method wherein a subject image is formed on a color negative, the subject image converted to corresponding image data by means of a scanner, etc., and the same color as that of the subject is outputted from demodulated color information to thereby enable faithfully reproducing the subject color from the negative film. These image processing system and image processing method can be used in the image formation process according to the present invention. Further, as an image processing method for intensifying the sharpness of digitalized images while suppressing the graininess and noise thereof, there may be employed the method described in JP-A-10-243238 wherein, for example, the weighting and granulation of edge and noise are carried out on the basis of sharpness-intensified image data, smoothed image data and edge detection data, or the method described in JP-A-10-243239 wherein edge components are determined on the basis of sharpness-intensified image data and smoothed image data and, for example, the weighting and granulation thereof are carried out.

Moreover, for correcting the variation of color reproduction in final prints, depending on differences in photographing material storage conditions, development conditions, etc., with respect to a digital color print system, there can be employed the method described in JP-A-10-255037 wherein unexposed portion of the photographing material is subjected to 4 or more stage, or 4 or more color, patch exposure and developed, wherein patch densities are measured, thereby determining a lookup table and color conversion matrix required for correction, and wherein a color correction of photographic images is carried out by the use of lookup table conversion and matrix computation.

As means for converting a color reproduction region of image data, there can be employed, for example, the method described in JP-A-10-229502 wherein color signals are decomposed into chromatic color components and achromatic color components with respect to image data represented by color signals which become a color visually recognized as a neutral color when component numeric values have been equaled, which chromatic color components and achromatic color components are each individually processed. Further, as an image processing method for removing image quality deteriorations, such as aberration attributed to camera lens and decrease of brightness of the edge of image field, with respect to images having been photographed with the use of a camera, there may be employed the image processing method and device described in JP-A-11-69277 wherein a latticed correction pattern for preparing correction data as to image deterioration is recorded in a film in advance, wherein, after photographing, images and the correction pattern are read by means of, for example, a film scanner to thereby prepare data for correcting deterioration factors attributed to camera lens, and wherein, with the use of the image deterioration correction data, digital image data are corrected.

Excess intensification of sharpness with respect to skin color and blue sky leads to intensification of graininess (noise) with the result that unpleasant impression would be given. Therefore, it is desirable to restrain the degree of sharpness intensification with respect to skin color and blue sky. As means therefor, there may be employed, for example, the method described in JP-A-11-103393 wherein, in the sharpness intensification processing with the use of unsharp masking (USM), USM coefficient is regarded as a function of (B-A)(R-A).

Moreover, skin color, grass green color and blue sky color are regarded as key colors from the viewpoint of color reproduction, and selective color reproduction processings are required therefor. In particular, with respect to lightness reproduction, it is said that finishing skin color lightly while finishing blue sky densely is visually preferable. As means for reproducing key colors with visually preferable brightness, there may be employed, for example, the method described in JP-A-11-177835 wherein color signal for each individual picture element is converted with the use of a coefficient having a small value when corresponding hue is yellowish red while having a large value when corresponding hue is cyan blue, like (R-G) is or (R-B).

Furthermore, for effecting natural intensification processing while suppressing nonconformities, such as highlight increment and high density portion dulling, and suppressing data generation outside defined regions at the time of, for example, saturation increase or sharpness increase processing, there can be employed the image processing method and device described in JP-A-11-177832 wherein individual color density data among color image data are converted to exposure density data with the use of characteristic curve, and wherein the exposure density data are subjected to image processings including color intensification and further converted to density data with the use of characteristic curve.

EXAMPLES

The following are examples of the present invention. However, the present invention is not limited to the examples.

Example 1

Silver halide emulsions Em-1-A1 to Em-1-A20 were prepared by the methods set forth below:

(Em-1-A1)

42.2 L of an aqueous solution containing 31.7 g of a low-molecular-weight gelatin of 15,000 molecular weight converted to phthalate at a ratio of 97% and 31.7 g of KBr was vigorously agitated while maintaining the temperature at 35° C. 1583 mL of an aqueous solution containing 316.7 g of $AgNO_3$ and 1583 mL of an aqueous solution containing 221.5 g of KBr and 52.7 g of a low-molecular-weight gelatin whose molecular weight was 15,000 were added by the double jet method over a period of 1 min. Immediately after the completion of the addition, 52.8 g of KBr was added, 2485 mL of an aqueous solution containing 398.2 g of $AgNO_3$ and 2581 mL of an aqueous solution containing 291.1 g of KBr were added by the double jet method over a period of 2 min. Immediately after the completion of the addition, 47.8 of KBr was added and heated to 40° C., and the mixture was ripened. After the completion of the ripening, 923 g of a gelatin of 100,000 molecular weight converted to phthalate at a ratio of 97% and 79.2 g of KBr were added, and an aqueous solution of KBr and 15,947 mL of an aqueous solution containing 5,103 g of $AgNO_3$ were added by the double jet method over a period of 12 min while increasing the flow rate so that the final flow rate was 1.4 times the initial flow rate. During this period, the silver potential was maintained at −60 mV against saturated calomel electrode. The mixture was washed with water, and gelatin was added, effecting adjustments to a pH of 5.7, a pAg of 8.8, a gelatin weight to 64.1 g and weight of the emulsion, in terms of silver, to 131.8 g per kg of emulsion. Thus, a seed emulsion was obtained.

1211 mL of an aqueous solution containing 46 g of a gelatin converted to phthalate at a ratio of 97% and 1.7 g of KBr was vigorously agitated while maintaining the temperature at 75° C. 9.9 g of the above seed emulsion and then 0.3 g of modified silicon oil (L7602, produced by Nippon Unicar Company, Limited) were added thereto. $H_2SO_4$ was added to thereby adjust the pH to 5.5, and 67.6 mL of an aqueous solution containing 7.0 g of $AgNO_3$ and an aqueous solution of KBr were added by the double jet method over a period of 6 min while increasing the flow rate so that the final flow rate was 5.1 times the initial flow rate. During this period, the silver potential was maintained at −20 mV against saturated calomel electrode. 2 mg of sodium benzenethiosulfonate was added, an aqueous solution containing 144.5 g of $AgNO_3$ and 410 mL of a mixed aqueous solution of KBr and KI containing 7 mol % of KI were added by the double jet method over a period of 56 min while increasing the flow rate so that the final flow rate was 3.7 times the initial flow rate. During this period the silver potential was maintained at −30 mV against saturated calomel electrode. Still further, an aqueous solution of KBr and 121.3 mL of an aqueous solution containing 45.6 g of $AgNO_3$ were added by the double jet method over a period of 22 min. During this period, the silver potential was maintained at +20 mV against saturated calomel electrode. The mixture was heated to 82° C., and KBr was added to thereby adjust the silver potential to −80 mV. Thereafter, an AgI fine grain emulsion of 0.037 $\mu$m grain size was added in an amount, in terms of the weight of KI, of 6.33 g. Immediately after the completion of the addition, 206.2 mL of an aqueous solution containing 66.4 g of $AgNO_3$ was added over a period of 16 min. For 5 min in the initial stage of addition, the silver potential was maintained at −80 mV by the use of an aqueous solution of KBr.

The mixture was washed with water, and gelatin was added, adjusting the pH and pAg thereof at 40° C. to 5.8 and 8.7, respectively. The gelatin contains ingredients having a molecular weight of 280,000, which was measured according to PAGI method, in an amount of 30%. Compounds 11 and 12 were added, and the mixture was heated to 60° C. Sensitizing dyes 11 and 12 were added and potassium thiocyanate, chloroauric acid, sodium thiosulphate and N,N-dimethylselenourea were added to thereby effect optimum chemical sensitization. At the completion of chemical sensitization, Compounds 13 and 14 were added. The terminology "optimum chemical sensitization" used herein means that the addition amount of sensitizing dye or each compound has been selected so as to fall within the range of $10^{-1}$ to $10^{-8}$ mol per mol of silver halide.

Compound 11

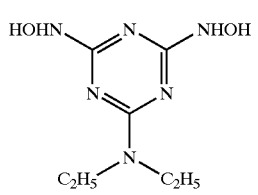

Compound 12

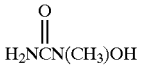

Sensitizing dye 11

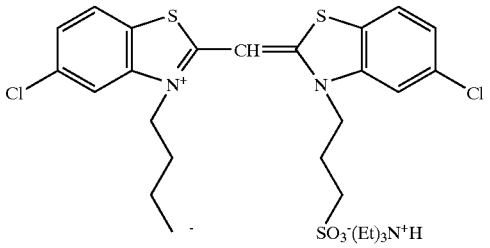

Sensitizing dye 12

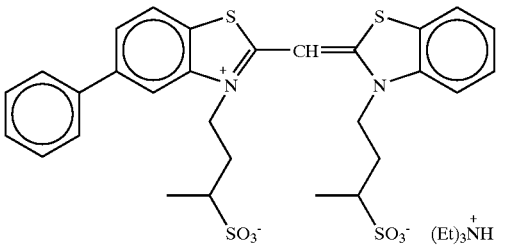

Compound 13

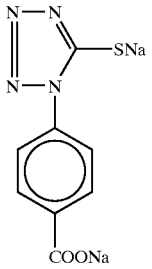

-continued

Compound 14

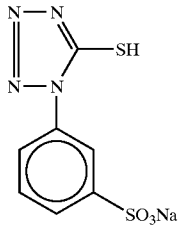

Comparative compound A

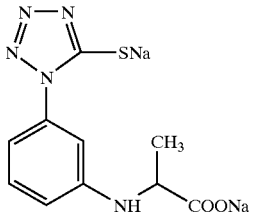

described in U.S. Pat. No. 6,054,260

Comparative compound B

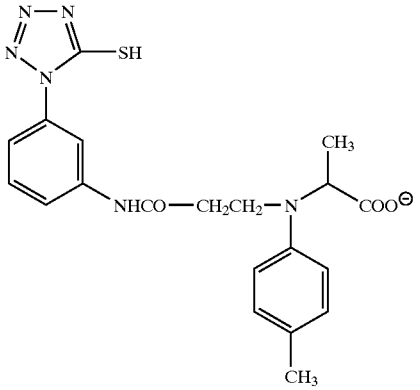

described in U.S. Pat. No. 5,747,235

The thus obtained grains were observed through transmission electron microscope while cooling the grains with liquid nitrogen, as a result, 10 or more dislocation lines per grain were observed at fringe portion thereof. (The characteristics of the thus obtained silver halide emulsions Em-1-A1 to Em-1-A20 are set forth in Table 5 of Example 3.)

(Em-1-A2 to Em-1-A7)

Emulsions Em-1-A2 to Em-1-A7 were prepared in the same manner as in (Em-1-A1), except that, before the addition of Compounds 11 and 12, each of the compounds according to the present invention or each of the comparative compounds was added in an amount per silver amount that is contained in each of the emulsions, was added as set froth in Table 1. The timing of before the addition of Compounds 11 and 12 is hereinafter referred to as "Addition pattern A".

(Em-1-A8 to Em-1-A13)

Emulsions Em-1-A8 to Em-1-A13 were prepared in the same manner as in (Em-1-A1), except that, before the addition of Compounds 13 and 14, each of the compounds according to the present invention or each of the comparative compounds was added in an amount per silver amount that is contained in each of the emulsions, was added as set froth in Table 1. The timing of before the addition of Compounds 13 and 14 is hereinafter referred to as "Addition pattern B".

(Em-1-A14 to Em-1-A20)

Emulsions Em-1-A14 to Em-1-A20 were prepared in the same manner as in (Em-1-A1), except that, after the addition of Compounds 13 and 14, followed by lowering the temperature of the emulsion that was chemically sensitized to 40° C., each of the compounds according to the present invention or each of the comparative compounds was added in an amount per silver amount that is contained in each of the emulsions, was added as set froth in Table 1. The timing of after the addition of Compounds 13 and 14, which is followed by lowering the temperature of the emulsion that was chemically sensitized to 40° C., is hereinafter referred to as "Addition pattern C".

TABLE 1

Addition amount and addition timing of the compounds of the invention and those for comparison into Em-1-A1 to -A20

| Emulsion No. | Compounds added to emulsion | Addition timing | Addition amount with respect to silver amount mol/Ag-mol |
|---|---|---|---|
| 1-A1 | none | — | — |
| 1-A2 | Comparative compound A | A | $15 \times 10^{-6}$ |
| 1-A3 | Exemplified compound 1–4 | A | $10 \times 10^{-6}$ |
| 1-A4 | Exemplified compound 1–13 | A | $10 \times 10^{-6}$ |
| 1-A5 | Exemplified compound 1–34 | A | $10 \times 10^{-6}$ |
| 1-A6 | Exemplified compound 1–24 | A | $8 \times 10^{-6}$ |
| 1-A7 | Exemplified compound 1–28 | A | $8 \times 10^{-6}$ |
| 1-A8 | Comparative compound A | B | $15 \times 10^{-6}$ |
| 1-A9 | Exemplified compound 1–4 | B | $10 \times 10^{-6}$ |
| 1-A10 | Exemplified compound 1–13 | B | $10 \times 10^{-6}$ |
| 1-A11 | Exemplified compound 1–34 | B | $10 \times 10^{-6}$ |
| 1-A12 | Exemplified compound 1–24 | B | $8 \times 10^{-6}$ |
| 1-A13 | Exemplified compound 1–28 | B | $8 \times 10^{-6}$ |
| 1-A14 | Comparative compound A | C | $15 \times 10^{-6}$ |
| 1-A15 | Exemplified compound 1–4 | C | $10 \times 10^{-6}$ |
| 1-A16 | Exemplified compound 1–13 | C | $10 \times 10^{-6}$ |
| 1-A17 | Exemplified compound 1–34 | C | $10 \times 10^{-6}$ |
| 1-A18 | Exemplified compound 1–1 | C | $10 \times 10^{-6}$ |
| 1-A19 | Exemplified compound 1–24 | C | $8 \times 10^{-6}$ |
| 1-A20 | Exemplified compound 1–28 | C | $8 \times 10^{-6}$ |

Samples 1-101 to 1-120 were prepared by coating, on a cellulose triacetate film support on which a subbing layer is provided, the above Emulsions Em-1-A1to Em-1-A20 with the coating condition as set forth in Table A below.

TABLE A

Emulsion coating condition (1) Emulsion layer

Emulsion: Each emulsion
($1.63 \times 10^{-2}$ mol/m$^2$ (in terms of silver))
Coupler ($2.26 \times 10^{-3}$ mol/m$^2$)

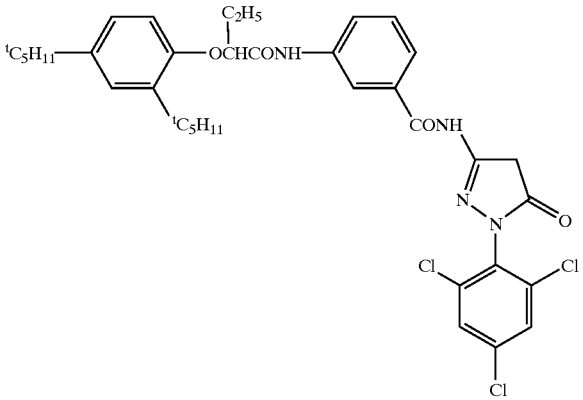

Tricresyl phosphate (1.32 g/m$^2$)
Gelatin (3.24 g/m$^2$)
(2) Protective layer 2,4-dichloro-6-hydroxy-s-triazine sodium salt (0.08 g/m$^2$)
Gelatin (1.80 g/m$^2$)

These samples were subjected to film hardening for 14 hr at 40° C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. Photographic performance was evaluated for samples that were subjected to the following development processing, by measuring density with a green filter. Also, the same processing as above was performed for each sample that was left to stand for three days under conditions of 50° C. and 80%RH.

By using the FP-350 negative processor manufactured by Fuji Photo Film Co., Ltd., the resultant samples were processed by the following method (until the accumulated replenisher amount of each solution was three times the mother solution tank volume).

(Processing Method)

| Step | Time | Temperature | Replenishment rate* |
|---|---|---|---|
| Color development | 2 min. 45 sec. | 38° C. | 45 mL |
| Bleaching | 1 min. 00 sec. | 38° C. | 20 mL bleaching solution overflow was entirely supplied into bleach-fix tank |
| Bleach-fix | 3 min. 15 sec. | 38° C. | 30 mL |
| Washing (1) | 40 sec. | 35° C. | counter flow piping from (2) to (1) |
| Washing (2) | 1 min. 00 sec. | 35° C. | 30 mL |

-continued (Processing Method)

| Step | Time | Temperature | Replenishment rate* |
|---|---|---|---|
| Stabilization | 40 sec. | 38° C. | 20 mL |
| Drying | 1 min. 15 sec. | 55° C. | |

*The replenishment rate is represented by a value per 1.1 m of a 35-mm wide sample (equivalent to one role of 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxyaminesulfate | 2.4 | 2.8 |
| 4-[N-ethyl-N-(β-hydroxy ethyl) amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |

| (Bleaching solution) common to tank solution and replenisher | (g) |
|---|---|
| Ferric ammonium ethylenediamine tetraacetate dihydrate | 120.0 |
| Disodium ethylenediamine tetraacetate | 10.0 |
| Ammonium bromide | 100.0 |
| Ammonium nitrate | 10.0 |
| Bleaching accelerator $(CH_3)_2N\text{-}CH_2\text{-}CH_2\text{-}S\text{-}S\text{-}CH_2\text{-}CH_2\text{-}N(CH_3)_2\cdot 2HCl$ | 0.005 mol |
| Ammonia water (27%) | 15.0 mL |
| Water to make | 1.0 L |
| pH (adjusted by ammonia water and nitric acid) | 6.3 |

| (Bleach-fix bath) | Tank solution (g) | Replenisher (g) |
|---|---|---|
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulphate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

Results of the photographic performance are set forth in Table 2 below. Sensitivity was expressed in a relative value of a logarithm value of reciprocal of an exposure amount required to attain a density of fog density plus 0.2.

It is apparent from Table 2 that the compounds of the present invention have a greater sensitivity-increasing effect and lower density at unexposed portion (fog), regardless of the small use amount, in any of addition patterns A, B and C, and the density (fog) at a unexposed area is low, compared with the comparative compounds. With respect to the samples left for 3 days under the conditions of 50° C. and 80%RH, the sensitivity decrease of the compounds of the present invention is small after the raw storage, and the level of the fog is reduced, compared with the comparative compounds.

Example 2

Silver halide emulsions Em-1-Q1 to Em-1-Q15 were prepared by the following producing method.

(Em-1-Q1)

1,200 mL of an aqueous solution containing 0.38 g of phthalated gelatin whose phthalation ration is 97% and whose molecular weight is 100,000, and 0.99 g of KBr was held at 60° C. and stirred with violence at pH 2.0. An aqueous solution containing 1.96 g of $AgNO_3$ and an aqueous solution containing 1.97 g of KBr and 0.172 g of KI

TABLE 2

Photographic performance of Samples 1-101 to -120

| | | | Photographic performance with green filter | | Photographic performance after thermal treatment | | |
|---|---|---|---|---|---|---|---|
| Sample | Added compound | Addition timing | Relative sensitivity | Fog | Relative sensitivity | Thermal fog | Remarks |
| 1-101 | none | A | 100 (Control) | 0.21 | 98 | 0.23 | Comp. |
| 1-102 | Comparative compound A | A | 112 | 0.30 | 105 | 0.38 | Comp. |
| 1-103 | Exemplified compound 1-4 | A | 117 | 0.25 | 115 | 0.28 | Inv. |
| 1-104 | Exemplified compound 1-13 | A | 120 | 0.27 | 118 | 0.30 | Inv. |
| 1-105 | Exemplified compound 1-34 | A | 121 | 0.26 | 120 | 0.29 | Inv. |
| 1-106 | Exemplified compound 1-24 | A | 118 | 0.23 | 116 | 0.25 | Inv. |
| 1-107 | Exemplified compound 1-28 | A | 116 | 0.24 | 115 | 0.26 | Inv. |
| 1-108 | Comparative compound A | B | 111 | 0.28 | 103 | 0.35 | Comp. |
| 1-109 | Exemplified compound 1-4 | B | 117 | 0.27 | 114 | 0.29 | Inv. |
| 1-110 | Exemplified compound 1-13 | B | 118 | 0.25 | 116 | 0.27 | Inv. |
| 1-111 | Exemplified compound 1-34 | B | 116 | 0.23 | 113 | 0.25 | Inv. |
| 1-112 | Exemplified compound 1-24 | B | 119 | 0.24 | 117 | 0.27 | Inv. |
| 1-113 | Exemplified compound 1-28 | B | 116 | 0.22 | 115 | 0.23 | Inv. |
| 1-114 | Comparative compound A | C | 115 | 0.32 | 110 | 0.40 | Comp. |
| 1-115 | Exemplified compound 1-4 | C | 123 | 0.28 | 120 | 0.29 | Inv. |
| 1-116 | Exemplified compound 1-13 | C | 125 | 0.25 | 123 | 0.27 | Inv. |
| 1-117 | Exemplified compound 1-34 | C | 122 | 0.24 | 121 | 0.26 | Inv. |
| 1-118 | Exemplified compound 1-1 | C | 120 | 0.24 | 119 | 0.28 | Inv. |
| 1-119 | Exemplified compound 1-24 | C | 119 | 0.26 | 116 | 0.27 | Inv. |
| 1-120 | Exemplified compound 1-28 | C | 124 | 0.27 | 120 | 0.30 | Inv. |

were added over 30 sec by the double jet method. After the completion of the ripening, 12.8 g of trimellitated gelatin whose amino groups were chemically modified with trimellitic acid and containing, 35 μmol per gram of methionine and having a molecular weight of 10,000 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the silver potential was maintained at −50 mV against saturated calomel electrode. An aqueous solution containing 65.6 g of $AgNO_3$ and an aqueous KBr solution were added over 37 min by the double jet method while the flow rate was accelerated so that the final flow rate was 2.1 times the initial flow rate. During the addition, the AgI fine grain emulsion used in the preparation of Em-1-A1 was simultaneously added in am accelerated flow rate such that the silver iodide content was 6.5 mol %, and the silver potential was maintained at +40 mV.

After 2 mg of sodium benzenethiosulfonate was added, the silver potential was adjusted to −100 mV by the addition of KBr. 6.2 g, in terms of a KI weight, of the before mentioned AgI fine grain emulsion was added. Immediately after the completion of the addition, 300 mL of an aqueous solution containing 88.5 g of $AgNO_3$ was added over 8 min. The addition of the KBr solution was so adjusted that the silver potential at the completion of the addition was +60 mV. After washing with water, gelatin was added, and the pH and the pAg were adjusted to 6.5 and 8.2, respectively at 40° C. After adding Compounds 11 and 12, the temperature was raised to 61° C. After spectral sensitizing dyes 15, 16 and 17 were added, $K_2IrCl_6$, potassium thiocyanate, chloroauric acid, sodium thiosulphate, and N,N-dimethylselenourea were subsequently added to optimally perform chemical sensitization. At the completion of the chemical sensitization, Compounds 13 and 14 were added.

Sensitizing dye 15

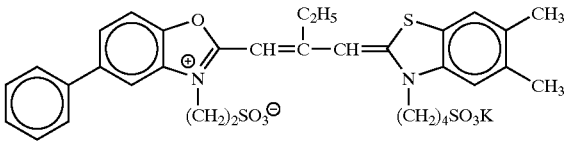

Sensitizing dye 16

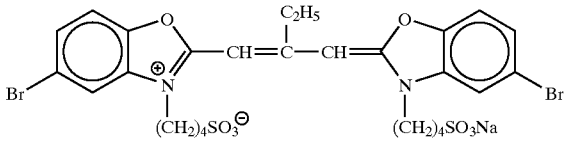

Sensitizing dye 17

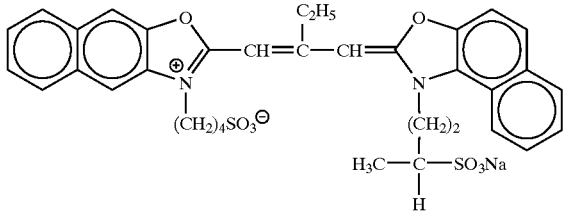

(Em-1-Q2 to Em-1-Q15)

Emulsions Em-1-Q2 to Em-1-Q15 were obtained in the same manner as in (Em-1-Q1), except that after the addition of Compounds 13 and 14, followed by lowering the temperature of the emulsion that was chemically sensitized to 40° C., each of the compounds according to the present invention or each of the comparative compounds was added in an amount per silver amount that is contained in each of the emulsions, was added as set froth in Table 3. Similar to in Example 1, the timing of after the addition of Compounds 13 and 14, which is followed by lowering the temperature of the emulsion that was chemically sensitized to 40° C., is also referred to as "Addition pattern C". (The characteristics of the thus obtained silver halide emulsions Em-1-Q1 to Em-1-Q15 are set forth in Table 5 of Example 3.)

TABLE 3

Addition amount and addition timing of the compounds of the invention and those for comparison into Em-1-Q1 to -Q15

| Emulsion No. | Compounds added to emulsion | Addition timing | Addition amount with respect to silver amount mol/Ag-mol |
|---|---|---|---|
| 1-Q1 | none | — | — |
| 1-Q2 | Comparative compound A | C | $10 \times 10^{-6}$ |
| 1-Q3 | Comparative compound B | C | $10 \times 10^{-6}$ |
| 1-Q4 | Exemplified compound 1-4 | C | $7 \times 10^{-6}$ |
| 1-Q5 | Exemplified compound 1-13 | C | $7 \times 10^{-6}$ |
| 1-Q6 | Exemplified compound 1-34 | C | $7 \times 10^{-6}$ |
| 1-Q7 | Exemplified compound 1-1 | C | $7 \times 10^{-6}$ |
| 1-Q8 | Exemplified compound 1-3 | C | $7 \times 10^{-6}$ |
| 1-Q9 | Exemplified compound 1-10 | C | $7 \times 10^{-6}$ |
| 1-Q10 | Exemplified compound 1-12 | C | $7 \times 10^{-6}$ |
| 1-Q11 | Exemplified compound 1-38 | C | $7 \times 10^{-6}$ |
| 1-Q12 | Exemplified compound 1-24 | C | $4 \times 10^{-6}$ |
| 1-Q13 | Exemplified compound 1-28 | C | $4 \times 10^{-6}$ |
| 1-Q14 | Exemplified compound 1-19 | C | $4 \times 10^{-6}$ |
| 1-Q15 | Exemplified compound 1-39 | C | $4 \times 10^{-6}$ |

Samples 1-201 to 1-215 were prepared in the same manner as in Example 1, by coating the before mentioned Emulsions Em-1-Q1 to Em-1-Q15, respectively.

These samples were subjected to film hardening for 14 hr at 40° C. and a relative humidity of 70%. After that, the samples were exposed for 1/100 sec through a gelatin filter SC-50 (a long-wavelength light transmitting filter having a cutoff wavelength of 500 nm) manufactured by Fuji Photo Film Co., Ltd. and a continuous wedge. Photographic performance was evaluated for samples that were subjected to the similar development to Example 1, by measuring density with a green filter. Also, the same processing as above was performed for each sample that was left to stand for three days under conditions of 50° C. and 80%RH.

Results of the photographic performance are set forth in Table 4 below. Sensitivity was expressed in a relative value of a logarithm value of reciprocal of an exposure amount required to attain a density of fog density plus 0.2. (Sensitivity of Sample 1-201 was made control, i.e., 100.)

TABLE 4

Addition amount and addition timing of the compounds of the invention and those for comparison into Em-1-201 to -215

| Sample | Added compound | Addition timing | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|
| 1-201 | none | C | 100 (Control) | 0.21 | 98 | 0.23 | Comp. |
| 1-202 | Comparative compound A | C | 111 | 0.33 | 104 | 0.40 | Comp. |
| 1-203 | Comparative compound B | C | 114 | 0.35 | 107 | 0.43 | Comp. |
| 1-204 | Exemplified compound 1-4 | C | 120 | 0.27 | 117 | 0.32 | Inv. |
| 1-205 | Exemplified compound 1-13 | C | 121 | 0.26 | 119 | 0.33 | Inv. |
| 1-206 | Exemplified compound 1-34 | C | 118 | 0.24 | 114 | 0.29 | Inv. |
| 1-207 | Exemplified compound 1-1 | C | 117 | 0.23 | 113 | 0.29 | Inv. |
| 1-208 | Exemplified compound 1-3 | C | 119 | 0.26 | 115 | 0.31 | Inv. |
| 1-209 | Exemplified compound 1-10 | C | 117 | 0.24 | 114 | 0.30 | Inv. |
| 1-210 | Exemplified compound 1-12 | C | 118 | 0.25 | 115 | 0.29 | Inv. |
| 1-211 | Exemplified compound 1-38 | C | 119 | 0.23 | 116 | 0.28 | Inv. |
| 1-212 | Exemplified compound 1-24 | C | 121 | 0.24 | 117 | 0.30 | Inv. |
| 1-213 | Exemplified compound 1-28 | C | 118 | 0.26 | 115 | 0.32 | Inv. |
| 1-214 | Exemplified compound 1-19 | C | 120 | 0.29 | 116 | 0.34 | Inv. |
| 1-215 | Exemplified compound 1-39 | C | 123 | 0.31 | 119 | 0.35 | Inv. |

It is apparent from Table 4 that the compounds of the present invention have a greater sensitivity-increasing effect and lower density at unexposed portion (fog), also in a green-sensitive silver halide photographic emulsion, regardless of the small use amount, compared with the comparative compounds. With respect to the samples left for 3 days under the conditions of 50° C. and 80%RH, the sensitivity decrease of the compounds of the present invention is small after the raw storage, and the level of the fog is reduced, compared with the comparative compounds.

Example 3

(Em-1-A1 to Em-1-A20) (An Emulsion for a High-speed Blue-sensitive Emulsion Layer)

These emulsions were prepared in Example 1.

(Em-1-B) (An Emulsion for Low-speed Blue-Sensitive Emulsion Layer)

1,192 mL of an aqueous solution containing 0.96 g of low-molecular weight gelatin and 0.9 g of KBr were vigorously stirred at 40° C. 37.5 mL of an aqueous solution containing 1.49 g of $AgNO_3$ and 37.5 mL of an aqueous solution containing 1.5 g of KBr were added over 30 sec by the double jet method. After 1.2 g of KBr were added, the temperature was raised to 75° C. to ripen the material. After the completion of the ripening, 30 g of trimellitated gelatin whose amino groups were chemically modified with trimellitic acid and containing, 35 $\mu$mol per gram of methionine and having a molecular weight of 10,000 were added, and the pH was adjusted to 7.6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the silver potential was maintained at −20 mV against saturated calomel electrode. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of Em-1-A1 was simultaneously added at an accelerated flow rate so that the silver iodide content was 15.8 mol %. At the same time, the silver potential was maintained at 0 mV against saturated calomel electrode. After 26 mg of sodium ethylthiosulfonate were added, the temperature was decreased to 55° C., an aqueous KBr solution was added to adjust the silver potential at −90 mV. The aforementioned AgI fine grain emulsion was added in an amount of 8.5 g in terms of a KI weight. Immediately after the addition, 228 mL of an aqueous solution containing 57 g of $AgNO_3$ were added over 5 min. The addition of the KBr solution was so adjusted that the silver potential at the termination of the addition was +20 mV. Washing with water and chemical sensitization were performed in almost the same manner as in Em-1-A1.

(Em-1-C) (An Emulsion for a Low-speed Blue-sensitive Layer)

1,192 mL of an aqueous solution containing 1.02 g of phthalated gelatin with a phthalation ratio of 97%, containing 35 μmol per gram of methionine and having a molecular weight of 10,000, and 0.97 g of KBr was vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 66° C. to fully ripen the material. After the completion of the ripening, 41.2 g of trimellitated gelatin having a molecular weight of 10,000, which was used in the preparation of Em-1-B, and 18.5 g of NaCl were added, and the pH was adjusted to 7.2, and 8 mg of dimethylamineborane was added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the silver potential was maintained at −30 mV against saturated calomel electrode. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of Em-1-A1was simultaneously added at an accelerated flow rate so that the silver iodide content was 2.3 mol %. At the same time, the silver potential was maintained at −20 mV against saturated calomel electrode. After 10.7 mL of iN potassium thiocyanate solution was added, 153.5 mL of an aqueous solution containing 24.1 g of $AgNO_3$ and a KBr solution were added by the double jet method over 2 min 30 sec. During the addition, the silver potential was maintained at 10 mV. The addition of KBr solution controlled the silver potential at −70 mV. The aforementioned AgI fine grain emulsion was added in an amount of 6.4 g in terms of a KI weight. Immediately after the addition, 404 mL of an aqueous solution containing 57 g of $AgNO_3$ were added over 45 min. The addition of the KBr solution was so adjusted that the silver potential at the termination of the addition was −30 mV. Washing with water and chemical sensitization were performed in almost the same manner as in Em-1-A1.

(Em-1-D) (An Emulsion for Low-speed Blue-sensitive Emulsion Layer)

In the preparation of Em-1-C, the addition amount of $AgNO_3$ during nucleation was changed to two times. Then, the potential at the termination of the final addition of 404 mL of aqueous solution containing 57 g of $AgNO_3$ was changed to +90 mV by the KBr solution. Emulsion Em-1-D was prepared in almost the similar manner as in Em-1-C, except for the above mentioned changes.

(Em-1-E) (A Magenta-coloring Layer Having its Peak of Spectral Sensitivity at 480–550 nm) (A Inter Layer Effect-donating Layer to a Red-sensitive Layer)

1,200 mL of an aqueous solution containing 0.71 g of low-molecular weight gelatin having a molecular weight of 15,000, 0.92 g of KBr and 0.2 g of the modified silicone oil used in the preparation of Em-1-A1 were held at 39° C. and stirred with violence at pH 1.8. An aqueous solution containing 0.45 g of $AgNO_3$ and an aqueous KBr solution containing 1.5 mol % of KI were added over 17 sec by the double jet method. During the addition, the excess KBr concentration was held constant. The temperature was raised to 56° C. to ripen the material. After the completion of the ripening, 20 g of phthalated gelatin with a phthalation ratio of 97%, containing 35 μmol per gram of methionine and having a molecular weight of 10,000 were added. After the pH was adjusted to 5.9, 2.9 g of KBr were added. 288 mL of an aqueous solution containing 28.8 g of $AgNO_3$ and an aqueous KBr solution were added over 53 min by the double jet method. During the addition, an AgI fine grains used in the preparation of Em-1-A1 was added so that the silver iodide content became 4.1 mol %. At the same time, the silver potential was maintained at −60 mV against saturated calomel electrode. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, the aforementioned AgI fine grain emulsion prepared by mixing immediately before addition was simultaneously added at an accelerated flow rate such that the silver iodide content was 10.5 mol %. At the same time, the silver potential was maintained at −70 mV.

After 1 mg of thiourea dioxide was added, 132 mL of an aqueous solution containing 41.8 g of $AgNO_3$ and an aqueous KBr solution were added over 25 min by the double jet method. The addition of the aqueous KBr solution was so adjusted that the silver potential was maintained at +20 mV. After 2 mg of sodium benzenethiosulfonate was added, the pH was adjusted to 7.3. KBr was added to adjust the silver potential at −70 mV, then, the aforementioned AgI fine grain emulsion was added in an amount of 5.73 g in terms of a KI weight. Immediately after the completion of the addition, 609 mL of an aqueous solution containing 66.4 g of $AgNO_3$ were added over 10 min. For the first 6 min of the addition, the silver potential was maintained at −70 mV. After the resultant emulsion was washed with water, gelatin was added and the pH and pAg were adjusted to 6.5 and 8.2, respectively. After Compounds 11 and 12 were added, the temperature was raised to 56° C. After 0.004 mol per mol of silver of the aforementioned AgI fine grain emulsion was added, chemical sensitizers 13 and 14 were added. Optimal chemical sensitization was performed by adding potassium thiocyanate, sodium thiosulphate and N,N-dimethylselenourea. At the completion of the chemical sensitization, Compounds 13 and 14 were added.

Sensitizing dye 13

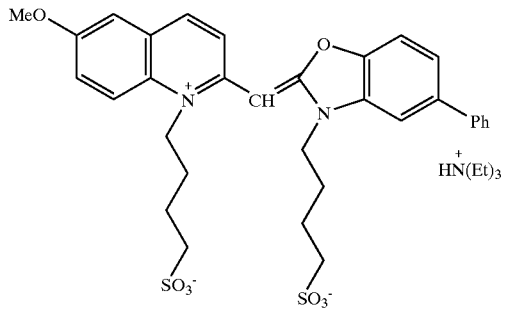

Sensitizing dye 14

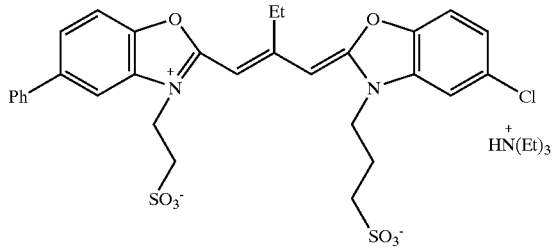

(Em-1-F) (An Emulsion for Medium-speed Green-sensitive Layer)

Emulsion Em-1-F was prepared in almost the similar manner as in Em-1-E, except that in the preparation of Em-1-E, the addition amount of $AgNO_3$ during nucleation was changed to 3.1 times. Provided that the sensitizing dyes of Em-1-E were changed to sensitizing dyes 15, 16 and 17.

Sensitizing dye 15

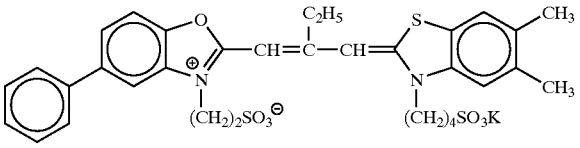

Sensitizing dye 16

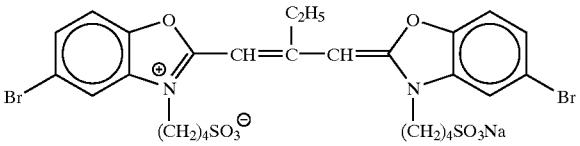

Sensitizing dye 17

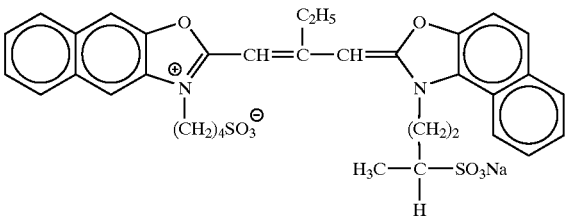

(Em-1-G) (An Emulsion for a Low-speed Green-sensitive Emulsion Layer)

1,200 mL of an aqueous solution containing 0.70 g of low-molecular weight gelatin having a molecular weight of 15,000, 0.9 g of KBr, and 0.2 g of the modified silicone oil used in the preparation of Em-1-A1 was held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 69° C. to ripen the material. After the completion of the ripening, 27.8 g of trimellitated gelatin whose amino groups were chemically modified with trimellitic acid and containing, 35 $\mu$mol per gram of methionine and having a molecular weight of 10,000 were added. After the pH was adjusted to 6.3, 2.9 g of KBr were added. 270 mL of an aqueous solution containing 27.58 g of $AgNO_3$ and 270 mL of an aqueous KBr solution were added over 37 min by the double jet method. During the addition, an AgI fine grains having grain size of 0.008 $\mu$m was added so that the silver iodide content became 4.1 mol %, and the silver potential was maintained at −60 mV against saturated calomel electrode. The AgI fine grains were prepared by mixing low-molecular weight gelatin having a molecular weight of 15,000, an aqueous $AgNO_3$ solution and an aqueous KI solution in a separate chamber having an agitator of magnetic coupling induced type described in JP-A-10-43570, just before the addition of the thus prepared emulsion. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion was simultaneously added at an accelerated flow rate such that the silver iodide content was 7.5 mol %. At the same time, the silver potential was maintained at −70 mV.

After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the silver potential at the termination of the addition was maintained at +20 mV. The temperature was raised to 78° C., and the pH of adjusted to 9.1, and then the potential was adjusted to −60 mV by the addition of KBr. The AgI fine grain emulsion used of the preparation of Em-1-A1 was added in an amount of 5.73 g in terms of a KI weight. Immediately after the completion of the addition, 321 mL of an aqueous solution containing 66.4 g of $AgNO_3$ were added over 4 min. For the first 2 min of the addition, the silver potential was maintained at −60 mV. After the resultant emulsion was washed with water and chemically sensitized in almost the same manner as in Em-1-F.

(Em-1-H) (An Emulsion for a Low-speed Green-sensitive Layer)

An aqueous solution containing 17.8 g of ion-exchanged gelatin having a molecular weight of 10.000, 6.2 g of KBr and 0.46 g of KI was held at 45° C. and stirred with violence. An aqueous solution containing 11.85 g of $AgNO_3$ and an aqueous solution containing 3.8 g of KBr were added over 47 sec by the double jet method. After the temperature was raised to 63° C., 24.1 g of ion-exchanged gelatin having a molecular weight of 100,000 was added, and ripened. After the completion of the ripening, an aqueous solution containing 133.4 g of $AgNO_3$ and an aqueous KBr solution were added over 20 min by the double jet method so that the final flow rate was 2.6 times the initial flow rate. During the addition, the silver potential was maintained at +40 mV against saturated calomel electrode. And 0.1 mg of K2IrCl6 was added at 10 min after the initiation of the addition. After 7 g of NaCl was added, an aqueous solution containing 45.6 g of $AgNO_3$ and an aqueous KBr solution were added over 12 min by the double jet method. During this, the silver potential was maintained at +90 mV. Further, 100 mL of an aqueous solution containing 29 mg of yellow prussiate was added over 6 min from the initiation of the addition. After 14.4 g of KBr was added, 6.3 g of the AgI fine grain emulsion used in the preparation of Em-1-A1 was added. Immediately after the completion of the addition, an aqueous solution containing 42.7 g of $AgNO_3$ and a KBr aqueous solution were added over 11 min by the double jet method. The silver potential during the addition was maintained at +90 mV. The emulsion was washed with water and chemically sensitized in almost the similar manner as in Em-1-F.

(Em-1-I) (An Emulsion for Low-speed Green-sensitive Layer)

Em-1-I was prepared in almost the same manner as in Em-1-H, except that the temperature during the nucleation was changed to 38° C.

(Em-1-J1) (An Emulsion for a High-speed Red-sensitive Layer)

1,200 mL of an aqueous solution containing 0.38 g of phthalated gelatin whose phthalation ration is 97% and whose molecular weight is 100,000, and 0.99 g of KBr was held at 60° C. and stirred with violence at pH 2. An aqueous solution containing 1.96 g of $AgNO_3$ and an aqueous solution containing 1.97 g of KBr and 0.172 g of KI were added over 30 sec by the double jet method. After the completion of the ripening, 12.8 g of trimellitated gelatin whose amino groups were chemically modified with trimellitic acid and containing, 35 $\mu$mol per gram of methionine and having a molecular weight of 10,000 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 35 min by the double jet method. During the addition, the silver potential was maintained at −50 mV against saturated calomel electrode. An aqueous solution containing 65.6 g of $AgNO_3$ and an aqueous KBr solution were added over 37 min by the double jet method while the flow rate was accelerated so that the final flow rate was 2.1 times the initial flow rate. During the addition, the AgI fine grain emulsion used in the preparation of Em-1-A1 was simultaneously added in an accelerated flow rate such that the silver iodide content was 6.5 mol %, and the silver potential was maintained at −50 mV.

After 1.5 mg of sodium thiourea dioxide was added, 132 mL of an aqueous solution containing 41.8 g of $AgNO_3$ and a KBr solution were added over 13 min by the double jet method. The addition of the KBr solution was so adjusted that the silver potential at the completion of the addition was +40 mV. After 2 mg of sodium benzenethiosulfonate was added, KBr was added to adjust the silver potential at −100 mV. 6.2 g, in terms of KI weight, of the aforementioned AgI fine grain emulsion was added. Immediately after the completion of the addition, 300 mL of an aqueous solution containing 88.5 g of $AgNO_3$ was added over a period of 8 min. The addition of the KBr solution was so adjusted that the potential was +60 mV. After washing with water, gelatin was added and adjusted the pH and pAg at 40° C. to 6.5 and 8.2, respectively. After Compounds 11 and 12 were added, the temperature was raised to 61° C. After sensitizing dyes 18, 19, 20, 21 and 22 were added, $K_2IrCl_6$, potassium thiocyanate, chloroauric acid, sodium thiosulphate and N,N-dimethylselenourea were added to optimally sensitize the emulsion. At the termination of the chemical sensitization, Compounds 13 and 14 were added.

Sensitizing dye 18

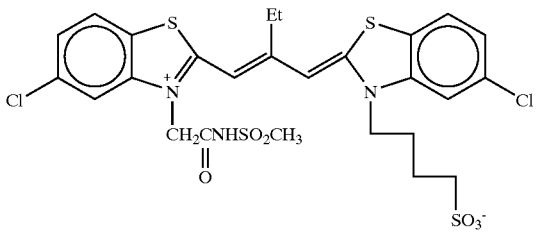

Sensitizing dye 19

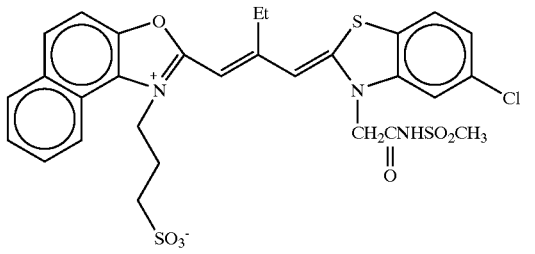

Sensitizing dye 20

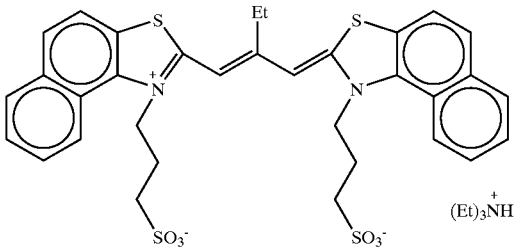

-continued

Sensitizing dye 21

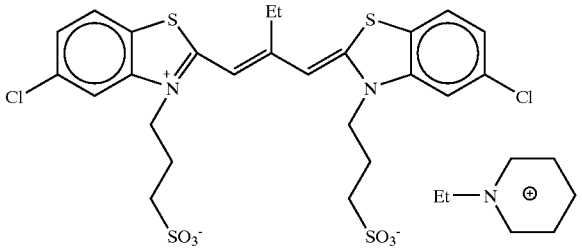

Sensitizing dye 22

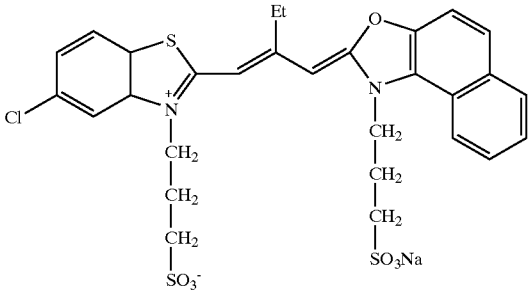

(Em-1-K) (An Emulsion for a Medium-speed Red-sensitive Emulsion Layer)

1,200 mL of an aqueous solution containing 4.9 g of low-molecular weight gelatin having a molecular weight of 15,000, and 5.3 g of KBr was held at 60° C. and stirred with violence. 27 mL of an aqueous solution containing 8.75 g of $AgNO_3$ and 36 mL of an aqueous solution containing 6.45 g of KBr were added over 1 min by the double jet method. After the temperature was raised to 77° C., 21 mL of an aqueous solution containing 6.9 g of $AgNO_3$ was added over 2.5 min. 26 g of $NH_4NO_3$, 56 mL of 1N NaOH were added subsequently , and then ripened. After the termination of the ripening, pH was adjusted to 4.8. 438 mL of an aqueous solution containing 141 g of $AgNO_3$ and 458 mL of an aqueous solution containing 102.6 g of KBr were added by the double jet method while the flow rate was accelerated so that the final flow rate was 4 times the initial flow rate. After the temperature was raised to 55° C., 240 mL of an aqueous solution containing 7.1 g of $AgNO_3$ and an aqueous solution containing 6.46 g of KI were added by the double jet method over 5 min. After 7.1 g of KBr was added, 4 mg of sodium benzenethiosulphonate and 0.05 mg of $K_2KrCl_6$ were added. 177 mL of an aqueous solution containing 57.2 g of $AgNO_3$ and 223 mL of an aqueous solution containing 40.2 g of KBr were added over 8 min by the double jet method. Water washing and chemical sensitization were performed in almost the same manner as in Em-1-J1.

(Em-1-L) (An Emulsion for a Medium-speed Red-sensitive Layer)

Emulsion Em-1-L was prepared in almost the same manner as in Em-1-K, except that the temperature during the nucleation was changed to 42° C.

(Em-1-M, Em-1-N and Em-1-O)

Em-1-M, Em-1-N and Em-1-O were prepared in almost the same manner as in Em-1-H or Em-1-I, except that the chemical sensitization was performed in almost the same manner ass in Em-1-J.

(Em-1-P1) (An Emulsion for a High-speed Green-sensitive Layer)

Em-1-P1 was prepared in the same manner as in Em-1-P1, except that the spectral sensitizing dyes were changed to sensitizing dyes 15, 16 and 17, performing an optimal chemical sensitization.

The characteristics of the thus obtained silver halide emulsions Em-1-A1 to Em-1-Q15 are shown in Table 5.

TABLE 5

Grain characteristics of silver halide emulsions Em-1-A1 to -A20, Em-1-B to -P1, and Em-1-Q1 to -Q15

| Emulsion No. | Equivalent sphere diameter μm | Projected area diameter μm | Aspect ratio | Iodide content mol % | Index of main plane | Cl content mol % |
|---|---|---|---|---|---|---|
| Em-1-A1 to A20 | 1.7 | 3.15 | 9.5 | 6.1 | (111) | 0 |
| Em-1-B | 1.0 | 2.0 | 12.2 | 10.0 | (111) | 0 |
| Em-1-C | 0.7 | — | 1 | 4.0 | (111) | 1.0 |
| Em-1-D | 0.4 | 0.53 | 3.5 | 4.1 | (111) | 2.0 |
| Em-1-E | 1.1 | 2.63 | 20.6 | 6.7 | (111) | 0 |
| Em-1-F | 1.2 | 2.74 | 18 | 6.9 | (111) | 0 |
| Em-1-G | 0.9 | 1.98 | 15.9 | 6.1 | (111) | 0 |
| Em-1-H | 0.7 | 1.22 | 8 | 6.0 | (111) | 2.0 |
| Em-1-I | 0.4 | 0.63 | 6 | 6.0 | (111) | 2.0 |
| Em-1-J1 | 1.3 | 3.18 | 22 | 3.5 | (111) | 0 |
| Em-1-K | 1.0 | 2.37 | 20 | 4.0 | (111) | 0 |
| Em-1-L | 0.8 | 1.86 | 19 | 3.6 | (111) | 0 |
| Em-1-M | 0.6 | 1.09 | 8.9 | 2.9 | (111) | 2.0 |
| Em-1-N | 0.4 | 0.63 | 6 | 2.0 | (111) | 2.0 |
| Em-1-O | 0.3 | 0.38 | 3 | 1.0 | (111) | 2.0 |
| Em-1-P1 | 1.3 | 3.18 | 22 | 3.5 | (111) | 0 |
| Em-1-Q1 to Q15 | 1.3 | 3.18 | 22 | 3.5 | (111) | 0 |

Also, summary of formulation of the emulsified product of the invention is set forth below.

An ethyl acetate solution into which a coupler is dissolved, a high-boiling solvent, and a surfactant were added to a 10% gelatin solution, and mixed the solution using a homogenizer (manufactured by NIHONSEIKI), thereby emulsify and obtaining an emulsified product.

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of DB of the magnetic recording layer measured by an X-light (blue filter) was about 0.1. The saturation magnetization moment, coercive force, and squareness ratio of the magnetic recording layer were 4.2 $Am^2/kg$, $7.3\times10^4$ A/m, and 65%, respectively.

3-3) Preparation of Slip Layer

The surface was then coated with diacetylcellulose (25 $mg/m^2$) and a mixture of $C_6H_{13}CH(OH)C_{10}H_{20}COOC_{40}H_{81}$ (compound a, 6 $mg/m^2$)/$C_{50}H_{101}O(CH_2CH_2O)_{16}H$ (compound b, 9 $mg/m^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 $mg/m^2$ of silica grains (0.3 μm) were added as a matting agent, and 15 $mg/m^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

Next, the surface of the support on the side away from the back layers formed as above was multi-coated with a plurality of layers having the following compositions to form a color negative photographic material of Sample 1-301. Further, Samples 1-302 to 1-320 were prepared by replacing Em-1-A1 with Em-1-A2 to Em-1-A20, respectively.

(Compositions of Sensitive Layers)

The main ingredients used in the individual layers are classified as follows, however, the use thereof are not limited to those specified below.

ExC: Cyan coupler UV: Ultraviolet absorbent
ExM: Magenta coupler HBS: High-boiling organic solvent
ExY: Yellow coupler H: Gelatin hardener (In the following description, practical compounds have numbers attached to their symbols. Formulas of these compounds will be presented later.)

The number corresponding to each component indicates the coating amount in units of $g/m^2$. The coating amount of a silver halide is indicated by the amount of silver.

| | | |
|---|---|---|
| First layer (First antihalation layer) | | |
| Black colloidal silver | silver | 0.155 |
| Surface-fogged AgBrI (2) of 0.07 μm | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| Second layer (Second antihalation layer) | | |
| Black colloidal silver | silver | 0.066 |
| Gelatin | | 0.407 |
| ExM-1 | | 0.050 |
| ExF-1 | | $2.0\times10^{-3}$ |

-continued

| | | |
|---|---|---|
| HBS-1 | | 0.074 |
| Solid disperse dye ExF-2 | | 0.015 |
| Solid disperse dye ExF-3 | | 0.020 |
| Third layer (Intermediate layer) | | |
| AgBrI (2) of 0.07 μm | | 0.020 |
| ExC-2 | | 0.022 |
| HBS-1 | | 0.068 |
| Cpd-1 | | 0.075 |
| Polyethylacrylate latex | | 0.085 |
| Gelatin | | 0.294 |
| Fourth layer (Low-speed red-sensitive emulsion layer) | | |
| Silver iodobromide emulsion 1-M | silver | 0.065 |
| Silver iodobromide emulsion 1-N | silver | 0.100 |
| Silver iodobromide emulsion 1-0 | silver | 0.158 |
| ExC-1 | | 0.109 |
| ExC-3 | | 0.044 |
| ExC-4 | | 0.072 |
| ExC-5 | | 0.011 |
| ExC-6 | | 0.003 |
| ExC-8 | | 0.052 |
| Cpd-2 | | 0.025 |
| Cpd-4 | | 0.025 |
| HBS-1 | | 0.17 |
| Gelatin | | 0.80 |
| Fifth layer (Medium-speed red-sensitive emulsion layer) | | |
| Silver iodobromide emulsion 1-K | silver | 0.21 |
| Silver iodobromide emulsion 1-L | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| ExC-8 | | 0.007 |
| Cpd-2 | | 0.036 |
| Cpd-4 | | 0.028 |
| HBS-1 | | 0.16 |
| Gelatin | | 1.18 |
| Sixth layer (High-speed red-sensitive emulsion layer) | | |
| Silver iodobromide emulsion 1-J1 | silver | 1.67 |
| ExC-1 | | 0.18 |
| ExC-3 | | 0.07 |
| ExC-6 | | 0.047 |
| Cpd-2 | | 0.046 |
| Cpd-4 | | 0.077 |
| HBS-1 | | 0.25 |
| HBS-2 | | 0.12 |
| Gelatin | | 2.12 |
| Seventh layer (Intermediate layer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| Eighth layer (layer for donating multilayer effect to red-sensitive layer) | | |
| Silver iodobromide emulsion 1-E | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| Ninth layer (Low-speed green-sensitive emulsion layer) | | |
| Silver iodobromide emulsion 1-G | silver | 0.39 |
| Silver iodobromide emulsion 1-H | silver | 0.28 |
| Silver iodobromide emulsion 1-I | silver | 0.35 |
| ExM-2 | | 0.36 |
| ExM-3 | | 0.045 |
| ExC-9 | | 0.008 |

-continued

| | | |
|---|---|---|
| ExG-1 | | 0.005 |
| HBS-1 | | 0.28 |
| HBS-3 | | 0.01 |
| HBS-4 | | 0.27 |
| Gelatin | | 1.39 |
| Tenth layer (Medium-speed green-sensitive emulsion layer) | | |
| Silver iodobromide emulsion 1-F | silver | 0.20 |
| Silver iodobromide emulsion 1-G | silver | 0.25 |
| ExC-6 | | 0.005 |
| ExC-8 | | 0.005 |
| ExC-9 | | 0.004 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| Eleventh layer (High-speed green-sensitive emulsion layer) | | |
| Silver iodobromide emulsion 1-P1 | silver | 1.200 |
| ExC-6 | | 0.003 |
| ExC-8 | | 0.007 |
| ExC-9 | | 0.002 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| Cpd-4 | | 0.007 |
| HBS-1 | | 0.18 |
| Polyethylacrylate latex | | 0.099 |
| Gelatin | | 1.11 |
| Twelfth layer (Yellow filter layer) | | |
| Yellow colloidal silver | silver | 0.047 |
| Cpd-1 | | 0.16 |
| Dye ExE-5 | | 0.010 |
| Solid disperse dye ExF-6 | | 0.010 |
| HBS-1 | | 0.082 |
| Gelatin | | 1.057 |
| Thirteenth layer (Low-speed blue-sensitive emulsion layer) | | |
| Silver iodobromide emulsion 1-B | silver | 0.18 |
| Silver iodobromide emulsion 1-C | silver | 0.20 |
| Silver iodobromide emulsion 1-D | silver | 0.07 |
| ExC-1 | | 0.041 |
| ExC-7 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| Fourteenth layer (High-speed blue-sensitive emulsion layer) | | |
| Emulsion 1-A1 of Example 1 | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| Fifteenth layer (First protective layer) | | |
| AgBrI (2) of 0.07 μm | silver | 0.30 |
| UV-1 | | 0.21 |
| UV-2 | | 0.10 |

-continued

| | | |
|---|---|---|
| UV-3 | | 0.18 |
| UV-4 | | 0.025 |
| UV-5 | | 0.07 |
| E-18 | | 0.009 |
| F-19 | | 0.005 |
| HBS-1 | | 0.12 |
| HBS-4 | | $5.0 \times 10^{-2}$ |
| Gelatin | | 2.3 |
| Sixteenth layer (Second protective layer) | | |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.75 |

In addition to the above components, to improve the storage stability, processability, resistance to pressure, antiseptic and mildewproofing properties, antistatic properties, and coating properties, the individual layers contained B-4 to B-6, F-1 to F-18, iron salt, lead salt, gold salt, platinum salt, palladium salt, iridium salt, ruthenium salt and rhodium salt. Also in the coating liquids for the eighth and the eleventh layers, $8.5\times10^{-3}$ g and $8.5\times10^{-3}$ g, respectively, per mole of silver halide of calcium was added in the form of calcium nitrate, thereby preparing samples. In addition, at least one of W-1, -6, -7 and -8 was added in order to improve anti-electron static property, and at least one of W-2 and -5 was added in order to improve coating property.

Preparation of Dispersions of Organic Solid Disperse Dyes

ExF-2 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-2 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-4 was obtained. The average grain sizes of these fine dye grains was 0.45. ExF-3 was dispersed by a microprecipitation dispersion method described in Example 1 of EP549,489A. The average grain size was found to be 0.06 μm.

A solid dispersion ExF-6 was dispersed by the following method.

4000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Compounds used in the formation of each layer were as follows.

ExC-1
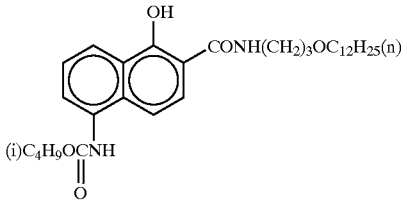
ExC-2
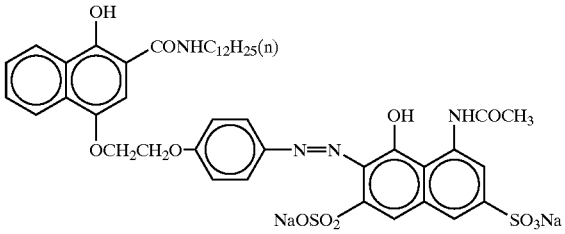
ExC-3
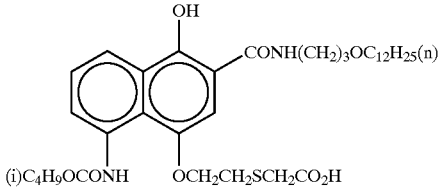
ExC-4
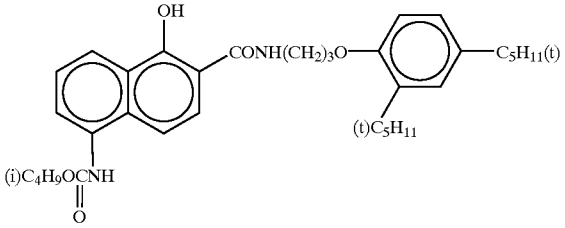
ExC-5
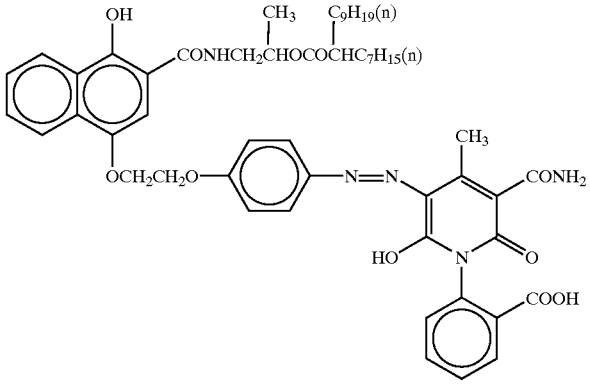
ExC-6
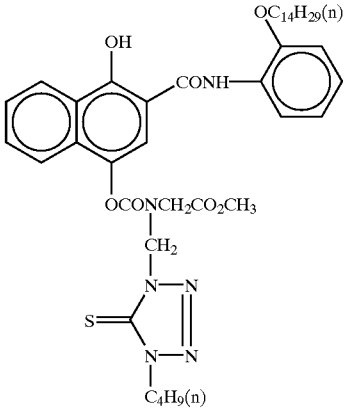
ExC-7
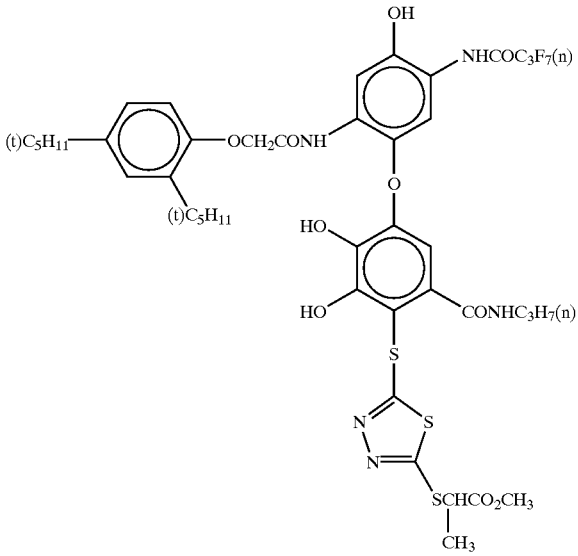

-continued
ExC-8
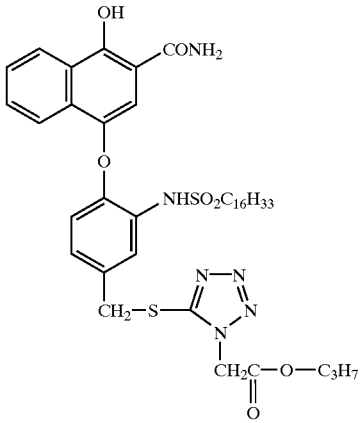
ExC-9
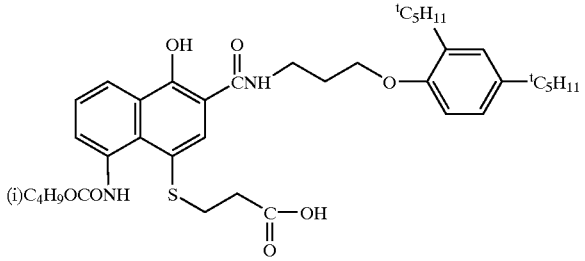
ExM-1
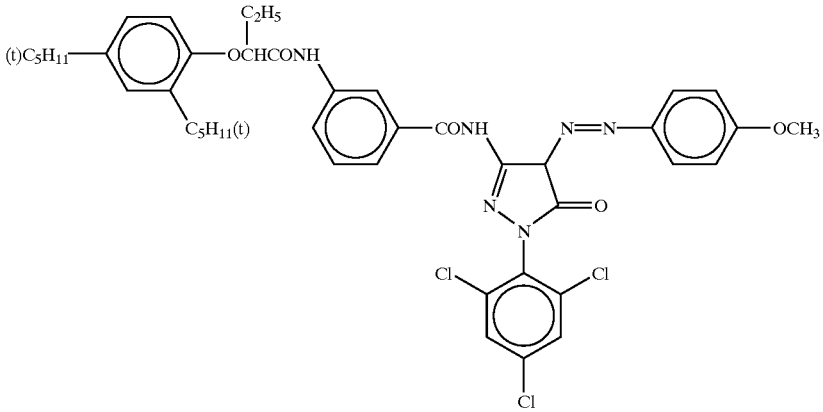
ExM-2
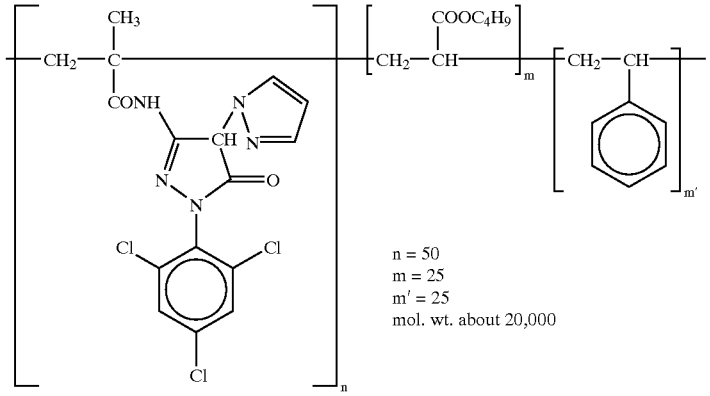
n = 50
m = 25
m′ = 25
mol. wt. about 20,000
ExM-3
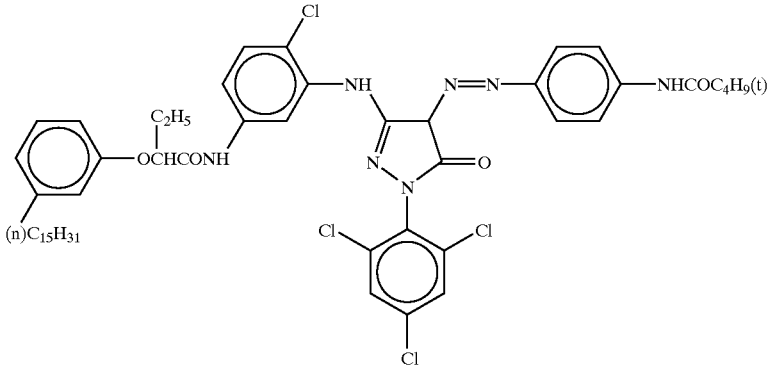

-continued
ExM-4
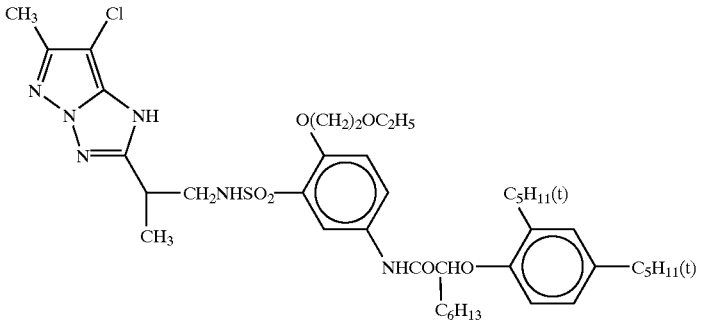
ExM-5
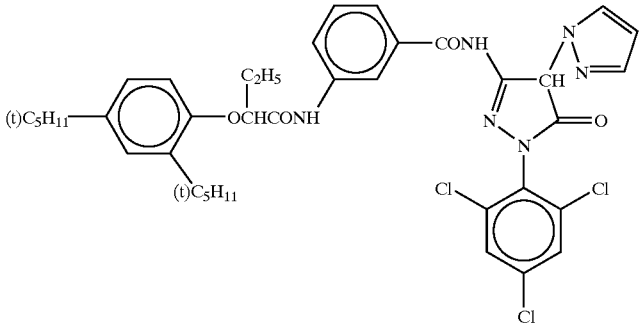
ExY-1
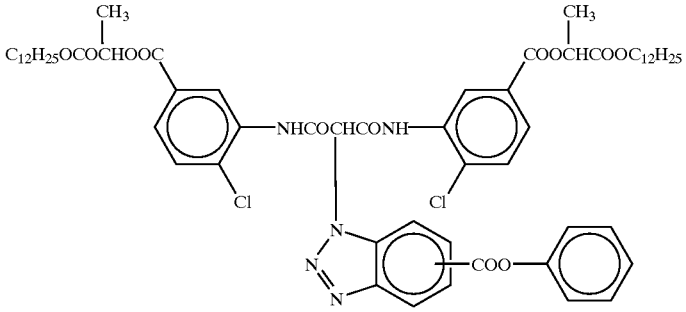
ExY-2
ExY-3
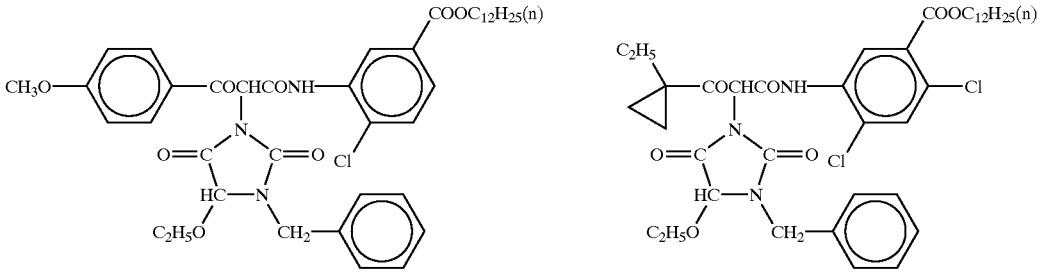
ExY-4
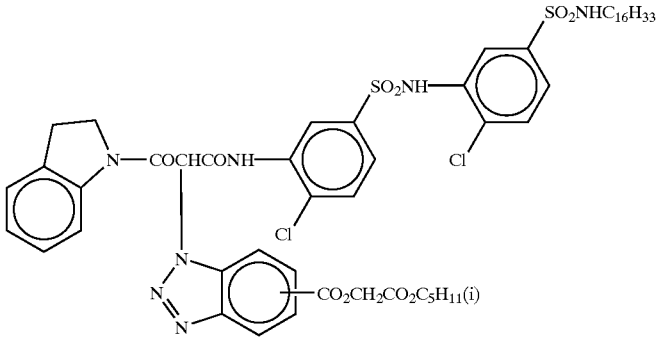

-continued
ExY-5
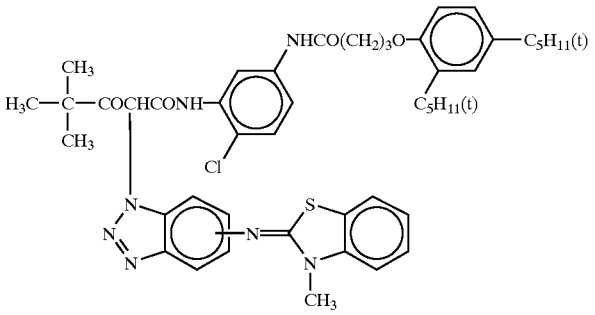
ExG-1
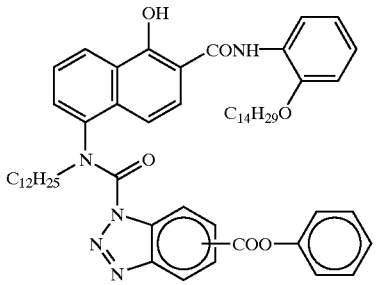
ExY-6
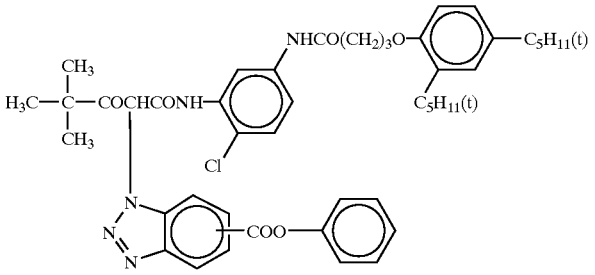
ExF-1
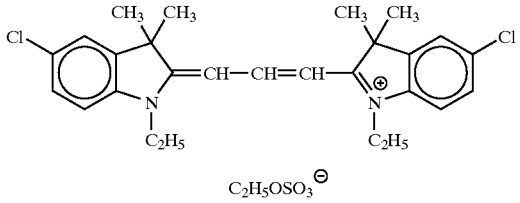
ExF-2
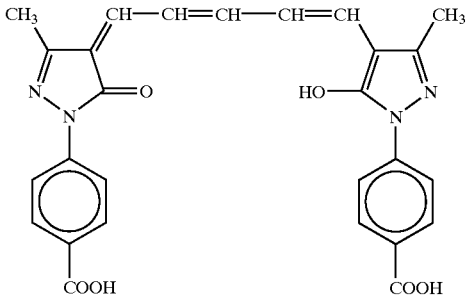
ExF-3
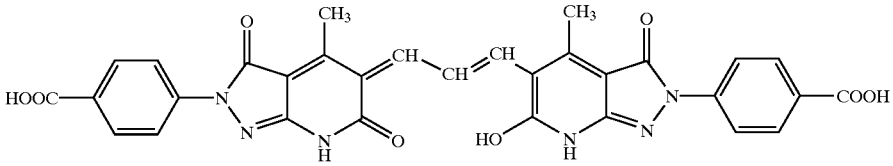
ExF-4
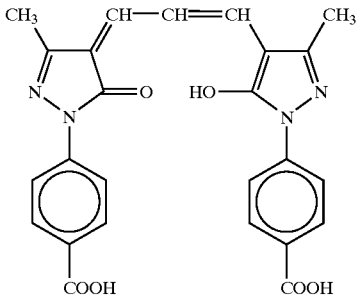
ExF-5
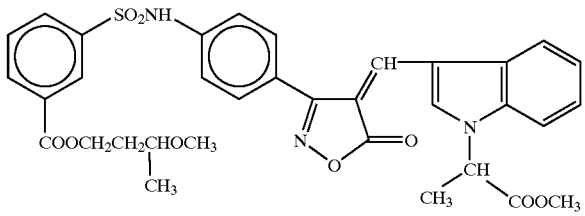

-continued
ExF-6
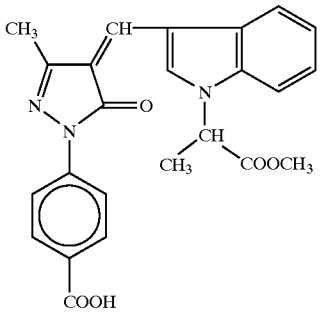
Cpd-1
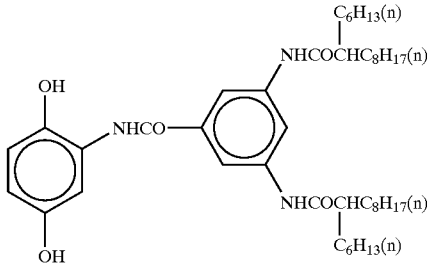
Cpd-2
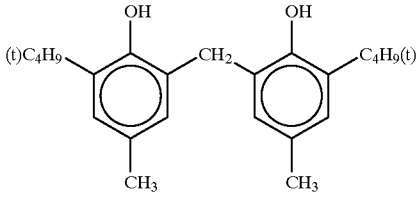
Cpd-3
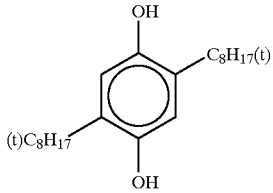
Cpd-4
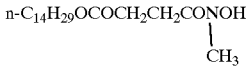
UV-1
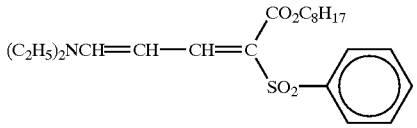
UV-2
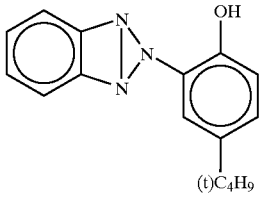
UV-3
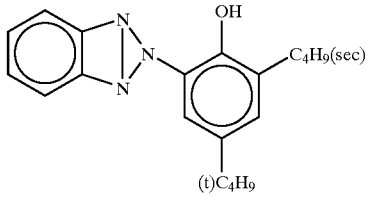
UV-4
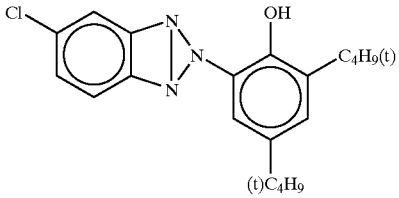
UV-5
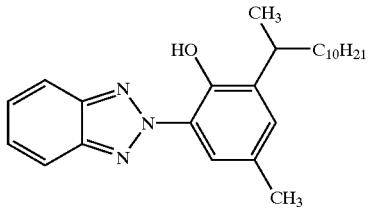
HBS-1
Tricresyl phosphate
HBS-2
Di-n-butyl phthalate
HBS-3
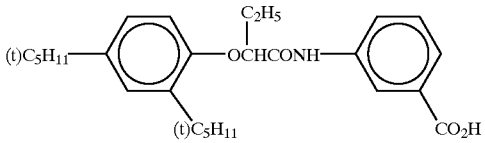
HBS-4
Tri(2-ethylhexyl)phosphate
H-1
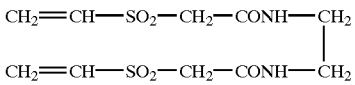
S-1
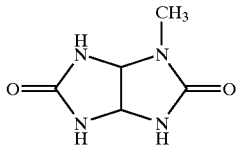
B-1
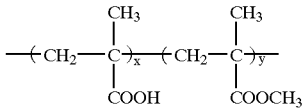
x/y = 10/90 (wt. ratio)
Av.mol.wt.:about 35,000
B-2
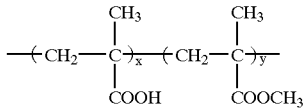
x/y = 40/60 (wt. ratio)
Av.mol.wt.:about 20,000

-continued
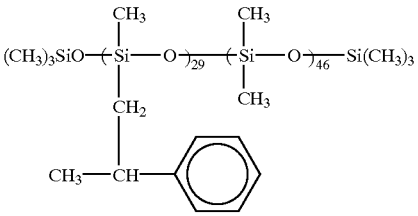
(Molar ratio)
Av.mol.wt.:about 8,000
B-3
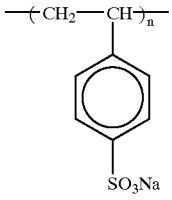
Av.mol.wt.:about 750,000
B-4
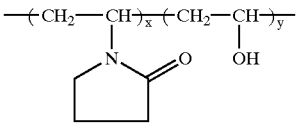
x/y = 70/30 (wt. ratio)
Av.mol.wt.:about 17,000
B-5
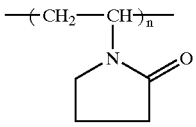
Av.mol.wt.:about 10,000
B-6
W-1
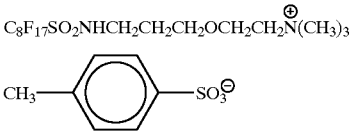
W-2
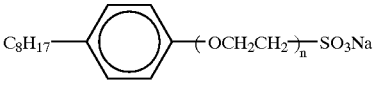
n = 2 to 4
W-4
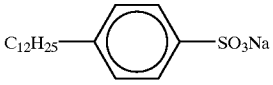
W-5
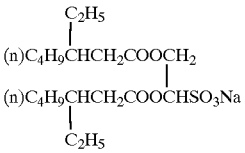
W-6
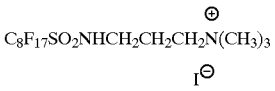
W-7
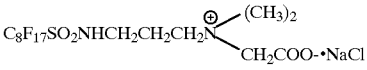
W-8
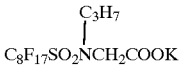
F-1
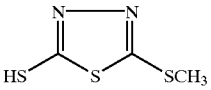
F-2
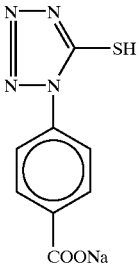
F-3
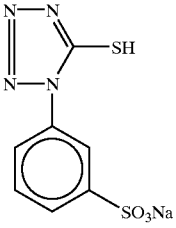
F-4
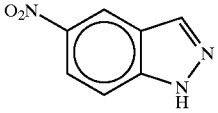

-continued
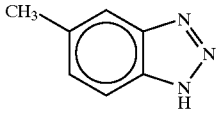
F-5
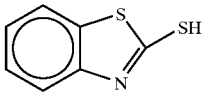
F-6
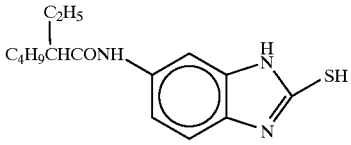
F-7
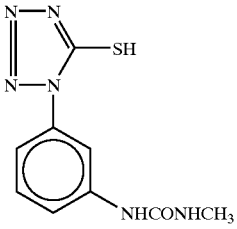
F-8
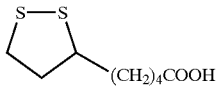
F-9
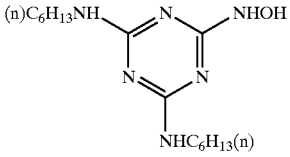
F-10
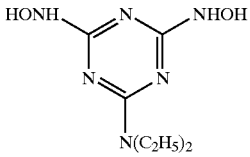
F-11
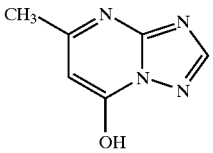
F-12
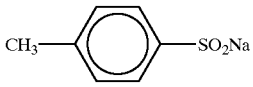
F-13
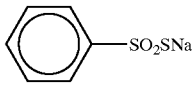
F-14
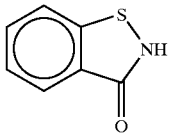
F-15
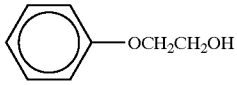
F-16
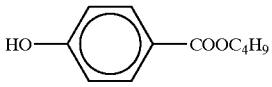
F-17
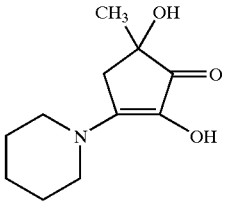
F-18
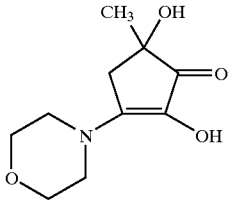
F-19

The evaluation method of the samples are as follows. These samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. Development was performed as follows by using an automatic developer FP-360B manufactured by Fuji Photo Film Co., Ltd. Note that FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitized material (equivalrnt to one 24 Ex. 1)

The stabilizer and fixer were counterflowed from (2) to (1), and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (controlled by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (controlled by ammonia water) | 4.6 | 4.0 |
| (Fixing (1) tank solution) | | |
| A 5:95 (volume ratio) mixture of the above bleaching tank solution and the following fixing tank solution (pH 6.8). | | |
| (Fixer (2)) | | |
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (controlled by ammonia water and acetic acid) | 7.4 | 7.45 |

(Washing Water) Common to Tank Solution and Replenisher

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher (g) | |
|---|---|
| Sodium p-toluenesulfinate | 0.03 |
| Polyoxyethylene-p-monononylphenylether (average polymerization degree 10) | 0.2 |
| 1,2-benzoisothiazoline-3-one sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

The above described processing was performed to samples 1-301 to 1-320. In addition, samples that were left to stand for three days under conditions of 50° C. and 80%RH were subjected to the same processing. Evaluation of photographic performance was conducted by measuring density of the processed samples with a blue filer. Results obtained are set forth in Table 6. (Sensitivity of Sample 1-301 was made control, i.e., 100.)

TABLE 6

Photographic performance of Samples 1-301 to -320

| Sample | Added compound | Addition timing | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|
| 1-301 | none | A | 100 (Control) | 0.25 | 98 | 0.30 | Comp. |
| 1-302 | Comparative compound A | A | 111 | 0.29 | 102 | 0.39 | Comp. |
| 1-303 | Exemplified compound 1-4 | A | 115 | 0.28 | 110 | 0.32 | Inv. |
| 1-304 | Exemplified compound 1-13 | A | 114 | 0.27 | 109 | 0.31 | Inv. |
| 1-305 | Exemplified compound 1-34 | A | 117 | 0.28 | 113 | 0.32 | Inv. |
| 1-306 | Exemplified compound 1-24 | A | 118 | 0.26 | 114 | 0.30 | Inv. |
| 1-307 | Exemplified compound 1-28 | A | 116 | 0.27 | 111 | 0.33 | Inv. |
| 1-308 | Comparative compound A | B | 111 | 0.28 | 103 | 0.39 | Comp. |
| 1-309 | Exemplified compound 1-4 | B | 114 | 0.28 | 109 | 0.33 | Inv. |
| 1-310 | Exemplified compound 1-13 | B | 116 | 0.26 | 112 | 0.32 | Inv. |
| 1-311 | Exemplified compound 1-34 | B | 115 | 0.24 | 111 | 0.31 | Inv. |
| 1-312 | Exemplified compound 1-24 | B | 118 | 0.25 | 113 | 0.32 | Inv. |
| 1-313 | Exemplified compound 1-28 | B | 117 | 0.26 | 114 | 0.30 | Inv. |
| 1-314 | Comparative compound A | C | 113 | 0.30 | 110 | 0.40 | Comp. |
| 1-315 | Exemplified compound 1-4 | C | 120 | 0.28 | 117 | 0.31 | Inv. |
| 1-316 | Exemplified compound 1-13 | C | 118 | 0.26 | 115 | 0.33 | Inv. |
| 1-317 | Exemplified compound 1-34 | C | 119 | 0.27 | 114 | 0.35 | Inv. |
| 1-318 | Exemplified compound 1-1 | C | 117 | 0.26 | 111 | 0.34 | Inv. |
| 1-319 | Exemplified compound 1-24 | C | 119 | 0.26 | 113 | 0.32 | Inv. |
| 1-320 | Exemplified compound 1-28 | C | 120 | 0.27 | 115 | 0.33 | Inv. |

It is apparent from Table 6 that the compounds of the present invention have a greater sensitivity-increasing effect and lower density at unexposed portion (fog), regardless of the small use amount, in any of addition patterns A, B and C, and the density (fog) at a unexposed area is low, compared with the comparative compounds. With respect to the samples left for 3 days under the conditions of 50° C. and 80%RH, the sensitivity decrease of the compounds of the present invention is small after the raw storage, and the level of the fog is reduced, compared with the comparative compounds.

As is apparent from the above results, the use of the compounds of Type 1 of the present invention can attain silver halide photographic lightsensitive materials having high sensitivity, low fog, small sensitivity decrement after raw stock storage, and small increment of fog.

Example 4

Silver halide emulsion Em-2-A1 was prepared in the same manner as Em-1-A1 in Example 1.

(Em-2-A2 to Em-2-A7)

Emulsions Em-2-A2 to Em-2-A7 were prepared in the same manner as in (Em-2-A1), except that, before the addition of Compounds 11 and 12, each of the compounds according to the present invention or each of the comparative compounds was added in an amount per silver amount that is contained in each of the emulsions, was added as set froth in Table 7. The timing of before the addition of Compounds 11 and 12 is hereinafter referred to as "Addition pattern A", as in Example 1.

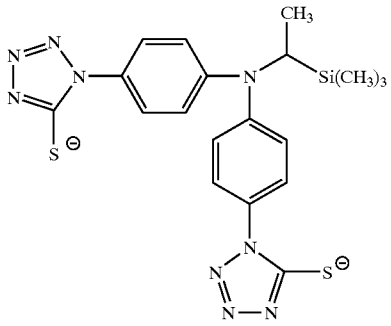

Comparative compound C
described in U. S. P 6,054,260

(Em-2-A8 to Em-2-A13)

Emulsions Em-2-A8 to Em-2-A13 were prepared in the same manner as in (Em-2-A1), except that, before the addition of Compounds 13 and 14, each of the compounds according to the present invention or each of the comparative compounds was added in an amount per silver amount that is contained in each of the emulsions, was added as set froth in Table 7. The timing of before the addition of Compounds 13 and 14 is hereinafter referred to as "Addition pattern B", as in Example 1.

(Em-2-A14 to Em-2-A20)

Emulsions Em-2-A14 to Em-2-A20 were prepared in the same manner as in (Em-2-A1), except that, after the addition of Compounds 13 and 14, followed by lowering the temperature of the emulsion that was chemically sensitized to 40° C., each of the compounds according to the present invention or each of the comparative compounds was added in an amount per silver amount that is contained in each of the emulsions, was added as set froth in Table 7. The timing of after the addition of Compounds 13 and 14, which is followed by lowering the temperature of the emulsion that was chemically sensitized to 40° C., is hereinafter referred to as "Addition pattern C", as in Example 1.

TABLE 7

Addition amount and addition timing of the compounds of the invention and those for comparison into Em-2-A1 to -A20

| Emulsion No. | Compounds added to emulsion | Addition timing | Addition amount with respect to silver amount mol/Ag-mol |
|---|---|---|---|
| 2-A1 | none | — | — |
| 2-A2 | Comparative compound A | A | $15 \times 10^{-6}$ |

TABLE 7-continued

Addition amount and addition timing of the compounds of the invention and those for comparison into Em-2-A1 to -A20

| Emulsion No. | Compounds added to emulsion | Addition timing | Addition amount with respect to silver amount mol/Ag-mol |
|---|---|---|---|
| 2-A3 | Comparative compound B | A | $15 \times 10^{-6}$ |
| 2-A4 | Comparative compound C | A | $15 \times 10^{-6}$ |
| 2-A5 | Exemplified compound 2-1 | A | $15 \times 10^{-6}$ |
| 2-A6 | Exemplified compound 2-3 | A | $15 \times 10^{-6}$ |
| 2-A7 | Exemplified compound 2-32 | A | $15 \times 10^{-6}$ |
| 2-A8 | Exemplified compound 2-21 | A | $15 \times 10^{-6}$ |
| 2-A9 | Comparative compound A | B | $15 \times 10^{-6}$ |
| 2-A10 | Comparative compound B | B | $15 \times 10^{-6}$ |
| 2-A11 | Exemplified compound 2-1 | B | $15 \times 10^{-6}$ |
| 2-A12 | Exemplified compound 2-3 | B | $15 \times 10^{-6}$ |
| 2-A13 | Exemplified compound 2-32 | B | $15 \times 10^{-6}$ |
| 2-A14 | Comparative compound A | C | $15 \times 10^{-6}$ |
| 2-A15 | Comparative compound C | C | $15 \times 10^{-6}$ |
| 2-A16 | Exemplified compound 2-1 | C | $15 \times 10^{-6}$ |
| 2-A17 | Exemplified compound 2-3 | C | $15 \times 10^{-6}$ |
| 2-A18 | Exemplified compound 2-32 | C | $15 \times 10^{-6}$ |
| 2-A19 | Exemplified compound 2-21 | C | $15 \times 10^{-6}$ |
| 2-A20 | Exemplified compound 2-15 | C | $15 \times 10^{-6}$ |

Samples 2-101 to 2-120 were prepared by coating, on a cellulose triacetate film support on which a subbing layer is provided, the above Emulsions Em-2-A1 to Em-2-A20, respectively, with the same coating condition as in Example 1.

Results of the photographic performance that was evaluated in the same manner as in Example 1 are set forth in Table 8 below. Sensitivity was expressed in a relative value of a logarithm value of reciprocal of an exposure amount required to attain a density of fog density plus 0.2. Sensitivity of sample 2-101 was made control, i.e., 100.)

TABLE 8

Photographic performance of Samples 2-101 to -120

| | | | Photographic performance with green filter | | Photographic performance after thermal treatment | | |
|---|---|---|---|---|---|---|---|
| Sample | Added compound | Addition timing | Relative sensitivity | Fog | Relative sensitivity | Thermal fog | Remarks |
| 2-101 | none | A | 100 (Control) | 0.21 | 98 | 0.23 | Comp. |

TABLE 8-continued

Photographic performance of Samples 2-101 to -120

| Sample | Added compound | Addition timing | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|
| 2-102 | Comparative compound A | A | 112 | 0.30 | 105 | 0.38 | Comp. |
| 2-103 | Comparative compound B | A | 117 | 0.31 | 107 | 0.38 | Comp. |
| 2-104 | Comparative compound C | A | 115 | 0.30 | 106 | 0.36 | Comp. |
| 2-105 | Exemplified compound 2-1 | A | 121 | 0.26 | 120 | 0.29 | Inv. |
| 2-106 | Exemplified compound 2-3 | A | 123 | 0.23 | 119 | 0.26 | Inv. |
| 2-107 | Exemplified compound 2-32 | A | 121 | 0.24 | 118 | 0.26 | Inv. |
| 2-108 | Exemplified compound 2-21 | A | 119 | 0.28 | 116 | 0.30 | Inv. |
| 2-109 | Comparative compound A | B | 111 | 0.28 | 103 | 0.35 | Comp. |
| 2-110 | Comparative compound B | B | 112 | 0.31 | 107 | 0.38 | Comp. |
| 2-111 | Exemplified compound 2-1 | B | 118 | 0.23 | 113 | 0.25 | Inv. |
| 2-112 | Exemplified compound 2-3 | B | 120 | 0.24 | 117 | 0.27 | Inv. |
| 2-113 | Exemplified compound 2-32 | B | 119 | 0.22 | 115 | 0.24 | Inv. |
| 2-114 | Comparative compound A | C | 115 | 0.32 | 110 | 0.40 | Comp. |
| 2-115 | Comparative compound C | C | 113 | 0.29 | 108 | 0.34 | Comp. |
| 2-116 | Exemplified compound 2-1 | C | 125 | 0.26 | 122 | 0.27 | Inv. |
| 2-117 | Exemplified compound 2-3 | C | 122 | 0.24 | 121 | 0.26 | Inv. |
| 2-118 | Exemplified compound 2-32 | C | 120 | 0.25 | 118 | 0.28 | Inv. |
| 2-119 | Exemplified compound 2-21 | C | 119 | 0.26 | 116 | 0.28 | Inv. |
| 2-120 | Exemplified compound 2-15 | C | 124 | 0.27 | 120 | 0.30 | Inv. |

It is apparent from Table 8 that the compounds of the present invention have a greater sensitivity-increasing effect and lower density at unexposed portion (fog), regardless of the small use amount, in any of addition patterns A, B and C, and the density (fog) at a unexposed area is low, compared with the comparative compounds. With respect to the samples left for 3 days under the conditions of 50° C. and 80%RH, the sensitivity decrease of the compounds of the present invention is small after the raw storage, and the level of the fog is reduced, compared with the comparative compounds.

Example 5

Silver halide emulsion Em-2-Q1 was prepared in the same manner as Em-1-Q1 of Example 2.

(Em-2-Q2 to Em-2-Q15)

Emulsions Em-2-Q2 to Em-2-Q15 were prepared in the same manner as in (Em-2-Q1), except that, after the addition of Compounds 13 and 14, followed by lowering the temperature of the emulsion that was chemically sensitized to 40° C., each of the compounds according to the present invention or each of the comparative compounds was added in an amount per silver amount that is contained in each of the emulsions, was added as set froth in Table 9. The timing of after the addition of Compounds 13 and 14, which is followed by lowering the temperature of the emulsion that was chemically sensitized to 40° C., is hereinafter referred to as "Addition pattern C", as in Example 1.

TABLE 9

Addition amount and addition timing of the compounds of the invention and those for comparison into Em-2-Q1 to -Q15

| Emulsion No. | Compounds added to emulsion | Addition timing | Addition amount with respect to silver amount mol/Ag-mol |
|---|---|---|---|
| 2-Q1 | none | — | — |
| 2-Q2 | Comparative compound A | C | $10 \times 10^{-6}$ |
| 2-Q3 | Comparative compound B | C | $10 \times 10^{-6}$ |
| 2-Q4 | Comparative compound C | C | $10 \times 10^{-6}$ |

TABLE 9-continued

| Addition amount and addition timing of the compounds of the invention and those for comparison into Em-2-Q1 to -Q15 | | | |
|---|---|---|---|
| Emulsion No. | Compounds added to emulsion | Addition timing | Addition amount with respect to silver amount mol/Ag-mol |
| 2-Q5 | Exemplified compound 2-1 | C | $10 \times 10^{-6}$ |
| 2-Q6 | Exemplified compound 2-3 | C | $10 \times 10^{-6}$ |
| 2-Q7 | Exemplified compound 2-32 | C | $10 \times 10^{-6}$ |
| 2-Q8 | Exemplified compound 2-21 | C | $10 \times 10^{-6}$ |
| 2-Q9 | Exemplified compound 2-15 | C | $10 \times 10^{-6}$ |
| 2-Q10 | Exemplified compound 2-2 | C | $10 \times 10^{-6}$ |
| 2-Q11 | Exemplified compound 2-7 | C | $10 \times 10^{-6}$ |
| 2-Q12 | Exemplified compound 2-12 | C | $10 \times 10^{-6}$ |
| 2-Q13 | Exemplified compound 2-17 | C | $10 \times 10^{-6}$ |
| 2-Q14 | Exemplified compound 2-18 | C | $10 \times 10^{-6}$ |

TABLE 9-continued

| Addition amount and addition timing of the compounds of the invention and those for comparison into Em-2-Q1 to -Q15 | | | |
|---|---|---|---|
| Emulsion No. | Compounds added to emulsion | Addition timing | Addition amount with respect to silver amount mol/Ag-mol |
| 2-Q15 | Exemplified compound 2-27 | C | $10 \times 10^{-6}$ |

Samples 2-201 to 2-215 were prepared by coating, Emulsions Em-2-Q1 to Em-2-Q15, respectively, in the same manner as in Example 2, thereby preparing Samples 2-201 to 2-215. These samples were processed in the same manner as in Example 2, and evaluated the samples.

Results of the photographic performance are set forth in Table 10 below. Sensitivity was expressed in a relative value of a logarithm value of reciprocal of an exposure amount required to attain a density of fog density plus 0.2.

TABLE 10

| Photographic performance of Samples 2-201 to -215 | | | | | | | |
|---|---|---|---|---|---|---|---|
| | | | Photographic performance with green filter | | Photographic performance after thermal treatment | | |
| Sample | Added compound | Addition timing | Relative sensitivity | Fog | Relative sensitivity | Thermal fog | Remarks |
| 2-201 | none | C | 100 (Control) | 0.21 | 98 | 0.23 | Comp. |
| 2-202 | Comparative compound A | C | 111 | 0.33 | 104 | 0.40 | Comp. |
| 2-203 | Comparative compound B | C | 114 | 0.35 | 107 | 0.43 | Comp. |
| 2-204 | Comparative compound C | C | 112 | 0.31 | 108 | 0.40 | Comp. |
| 2-205 | Exemplified compound 2-1 | C | 123 | 0.26 | 120 | 0.32 | Inv. |
| 2-206 | Exemplified compound 2-3 | C | 122 | 0.24 | 120 | 0.29 | Inv. |
| 2-207 | Exemplified compound 2-32 | C | 119 | 0.25 | 117 | 0.29 | Inv. |
| 2-208 | Exemplified compound 2-21 | C | 116 | 0.26 | 113 | 0.31 | Inv. |
| 2-209 | Exemplified compound 2-15 | C | 117 | 0.24 | 114 | 0.28 | Inv. |
| 2-210 | Exemplified compound 2-2 | C | 121 | 0.26 | 117 | 0.30 | Inv. |
| 2-211 | Exemplified compound 2-7 | C | 122 | 0.27 | 118 | 0.29 | Inv. |
| 2-212 | Exemplified compound 2-12 | C | 120 | 0.24 | 117 | 0.30 | Inv. |
| 2-213 | Exemplified compound 2-17 | C | 118 | 0.26 | 115 | 0.32 | Inv. |
| 2-214 | Exemplified compound 2-18 | C | 120 | 0.24 | 116 | 0.31 | Inv. |

TABLE 10-continued

Photographic performance of Samples 2-201 to -215

| Sample | Added compound | Addition timing | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|
| 2-215 | Exemplified compound 2-27 | C | 123 | 0.31 | 121 | 0.35 | Inv. |

It is apparent from Table 10 that the compounds of the present invention have a greater sensitivity-increasing effect and lower density at unexposed portion (fog), also in a green-sensitive silver halide photographic emulsion, compared with the comparative compounds. With respect to the samples left for 3 days under the conditions of 50° C. and 80%RH, the sensitivity decrease of the compounds of the present invention is small after the raw storage, and the level of the fog is reduced, compared with the comparative compounds.

Example 6

Color negative lightsensitive materials of samples 2-301 to 2-320 using the emulsion for a high-speed blue-sensitive layer prepared in Example 4, were prepared in the same manner as in Example 3.

The same processing as in Example 3 was performed for Samples 2-301 to 2-320, and photographic performance was evaluated. Results obtained are set forth in Table 11.

In addition, the density of the processed samples was measured using a green filter, thereby evaluate storability under conditions of 50° C. and 80%RH for three days. Results obtained are set forth in Table 11. (Sensitivity of Sample 2-301 was made control, i.e., 100.)

TABLE 11

Photographic performance of samples 2-301 to 2-320

| Sample | Emulsion | Addition pattern | Photographic performance with green filter: Relative sensitivity | Photographic performance with green filter: Fog | Photographic performance after thermal treatment: Relative sensitivity | Photographic performance after thermal treatment: Thermal fog | Green filter Green-sensitive fog | Remarks |
|---|---|---|---|---|---|---|---|---|
| 2-301 | None | A | 100 (control) | 0.25 | 98 | 0.30 | 0.32 | Comp. |
| 2-302 | Comparative compound A | A | 111 | 0.29 | 102 | 0.39 | 0.60 | Comp. |
| 2-303 | Comparative compound B | A | 113 | 0.28 | 104 | 0.40 | 0.58 | Comp. |
| 2-304 | Comparative compound C | A | 110 | 0.27 | 107 | 0.38 | 0.44 | Comp. |
| 2-305 | Exemplified compound 2-1 | A | 118 | 0.26 | 116 | 0.32 | 0.32 | Inv. |
| 2-306 | Exemplified compound 2-3 | A | 117 | 0.25 | 115 | 0.33 | 0.33 | Inv. |
| 2-307 | Exemplified compound 2-32 | A | 120 | 0.26 | 118 | 0.30 | 0.33 | Inv. |
| 2-308 | Exemplified compound 2-21 | A | 119 | 0.26 | 116 | 0.28 | 0.34 | Inv. |
| 2-309 | Comparative compound A | B | 111 | 0.28 | 103 | 0.39 | 0.54 | Comp. |
| 2-310 | Comparative compound B | B | 112 | 0.29 | 102 | 0.38 | 0.55 | Comp. |
| 2-311 | Exemplified compound 2-1 | B | 116 | 0.27 | 114 | 0.31 | 0.32 | Inv. |
| 2-312 | Exemplified compound 2-3 | B | 119 | 0.25 | 118 | 0.33 | 0.33 | Inv. |
| 2-313 | Exemplified compound 2-32 | B | 118 | 0.26 | 115 | 0.32 | 0.33 | Inv. |
| 2-314 | Comparative compound A | C | 113 | 0.30 | 110 | 0.40 | 0.56 | Comp. |
| 2-315 | Comparative compound C | C | 114 | 0.27 | 107 | 0.42 | 0.38 | Comp. |
| 2-316 | Exemplified compound 2-1 | C | 121 | 0.27 | 118 | 0.33 | 0.32 | Inv. |
| 2-317 | Exemplified compound 2-3 | C | 120 | 0.26 | 117 | 0.34 | 0.33 | Inv. |

TABLE 11-continued

Photographic performance of samples 2-301 to 2-320

| Sample | Emulsion | Addition pattern | Photographic performance with green filter: Relative sensitivity | Photographic performance with green filter: Fog | Photographic performance after thermal treatment: Relative sensitivity | Photographic performance after thermal treatment: Thermal fog | Green filter Green-sensitive fog | Remarks |
|---|---|---|---|---|---|---|---|---|
| 2-318 | Exemplified compound 2-32 | C | 118 | 0.25 | 114 | 0.31 | 0.31 | Inv. |
| 2-319 | Exemplified compound 2-21 | C | 117 | 0.26 | 115 | 0.32 | 0.34 | Inv. |
| 2-320 | Exemplified compound 2-15 | C | 119 | 0.25 | 116 | 0.32 | 0.33 | Inv. |

It is apparent from Table 11 that the compounds of the present invention have a greater sensitivity-increasing effect and lower density at unexposed portion (fog), in any of addition patterns A, B and C, and the density (fog) at a unexposed area is low, compared with the comparative compounds.

With respect to the samples left for 3 days under the conditions of 50° C. and 80%RH, the sensitivity decrease in the blue-sensitive layer of the compounds of the present invention is small after the raw storage, the level of the fog is reduced, and the influence (fog increase) to the neighboring green-sensitive layer is small, compared with the comparative compounds.

It is apparent from the above results, the use of the compound of Type 2 of the present invention can attain silver halide photographic materials having high sensitivity, low fog, and small sensitivity decrement of the layer itself (blue-sensitive layer) after left to stand in a thermal condition, and fog increment of other layer (green-sensitive layer) in the photographic material is small.

Example 7

Silver halide emulsion Em-3-A1 was prepared in the same manner as Em-1-A1 of Example 1.

(Em-3-A2 to Em-3-A7)

Emulsions Em-3-A2 to Em-3-A7 were prepared in the same manner as in (Em-3-A1), except that, before the addition of Compounds 11 and 12, each of the compounds according to the present invention or each of the comparative compounds was added in an amount per silver amount that is contained in each of the emulsions, was added as set froth in Table 12. The timing of before the addition of Compounds 11 and 12 is hereinafter referred to as "Addition pattern A", as in Example 1.

(Em-3-A8 to Em-3-A13)

Emulsions Em-3-A8 to Em-3-A13 were prepared in the same manner as in (Em-3-A1), except that, before the addition of Compounds 13 and 14, each of the compounds according to the present invention or each of the comparative compounds was added in an amount per silver amount that is contained in each of the emulsions, was added as set froth in Table 12. The timing of before the addition of Compounds 13 and 14 is hereinafter referred to as "Addition pattern B", as in Example 1.

(Em-3-A14 to Em-3-A20)

Emulsions Em-3-A14 to Em-3-A20 were prepared in the same manner as in (Em-3-A1), except that, after the addition of Compounds 13 and 14, followed by lowering the temperature of the emulsion that was chemically sensitized to 40° C., each of the compounds according to the present invention or each of the comparative compounds was added in an amount per silver amount that is contained in each of the emulsions, was added as set froth in Table 12. The timing of after the addition of Compounds 13 and 14, which is followed by lowering the temperature of the emulsion that was chemically sensitized to 40° C., is hereinafter referred to as "Addition pattern C", as in Example 1.

TABLE 12

Addition amount and addition timing of the compounds of the invention and those for comparison into Em-2-A1 to -A20

| Emulsion No. | Compounds added to emulsion | Addition timing | Addition amount with respect to silver amount mol/Ag-mol |
|---|---|---|---|
| 3-A1 | none | — | — |
| 3-A2 | Comparative compound A | A | $15 \times 10^{-6}$ |
| 3-A3 | Exemplified compound 3-67 | A | $10 \times 10^{-6}$ |
| 3-A4 | Exemplified compound 3-70 | A | $10 \times 10^{-6}$ |
| 3-A5 | Exemplified compound 3-71 | A | $10 \times 10^{-6}$ |
| 3-A6 | Exemplified compound 3-2 | A | $8 \times 10^{-6}$ |
| 3-A7 | Exemplified compound 3-68 | A | $8 \times 10^{-6}$ |
| 3-A8 | Comparative compound A | B | $15 \times 10^{-6}$ |
| 3-A9 | Exemplified compound 3-67 | B | $10 \times 10^{-6}$ |
| 3-A10 | Exemplified compound 3-70 | B | $10 \times 10^{-6}$ |
| 3-A11 | Exemplified compound 3-71 | B | $10 \times 10^{-6}$ |
| 3-A12 | Exemplified compound 3-2 | B | $8 \times 10^{-6}$ |
| 3-A13 | Exemplified compound 3-68 | B | $8 \times 10^{-6}$ |
| 3-A14 | Comparative compound A | C | $15 \times 10^{-6}$ |
| 3-A15 | Exemplified compound 3-67 | C | $10 \times 10^{-6}$ |
| 3-A16 | Exemplified compound 3-70 | C | $10 \times 10^{-6}$ |
| 3-A17 | Exemplified compound 3-71 | C | $10 \times 10^{-6}$ |
| 3-A18 | Exemplified compound 3-2 | C | $8 \times 10^{-6}$ |
| 3-A19 | Exemplified compound 3-64 | C | $8 \times 10^{-6}$ |
| 3-A20 | Exemplified compound 3-68 | C | $8 \times 10^{-6}$ |

Samples 3-101 to 3-120 were prepared by coating, on a cellulose triacetate film support on which a subbing layer is provided, the above Emulsions Em-3-A1 to Em-3-A20, respectively, with the same coating condition as in Example 1.

Results of the photographic performance that was evaluated in the same manner as in Example 1 are set forth in Table 13 below. Sensitivity was expressed in a relative value of a logarithm value of reciprocal of an exposure amount required to attain a density of fog density plus 0.2. (Sensitivity of Sample 3-101 was made control, i.e., 100.)

TABLE 13

Photographic performance of Samples 3-101 to -120

| Sample | Added compound | Addition timing | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|
| 3-101 | none | A | 100 (Control) | 0.21 | 98 | 0.23 | Comp. |
| 3-102 | Comparative compound A | A | 112 | 0.30 | 105 | 0.38 | Comp. |
| 3-103 | Exemplified compound 3-67 | A | 117 | 0.25 | 115 | 0.28 | Inv. |
| 3-104 | Exemplified compound 3-70 | A | 120 | 0.27 | 118 | 0.30 | Inv. |
| 3-105 | Exemplified compound 3-71 | A | 121 | 0.26 | 120 | 0.29 | Inv. |
| 3-106 | Exemplified compound 3-2 | A | 118 | 0.23 | 116 | 0.25 | Inv. |
| 3-107 | Exemplified compound 3-68 | A | 116 | 0.24 | 115 | 0.26 | Inv. |
| 3-108 | Comparative compound A | B | 111 | 0.28 | 103 | 0.35 | Comp. |
| 3-109 | Exemplified compound 3-67 | B | 117 | 0.27 | 114 | 0.29 | Inv. |
| 3-110 | Exemplified compound 3-0 | B | 118 | 0.25 | 116 | 0.27 | Inv. |
| 3-111 | Exemplified compound 3-71 | B | 116 | 0.23 | 113 | 0.25 | Inv. |
| 3-112 | Exemplified compound 3-2 | B | 119 | 0.24 | 117 | 0.27 | Inv. |
| 3-113 | Exemplified compound 3-68 | B | 116 | 0.22 | 115 | 0.23 | Inv. |
| 3-114 | Comparative compound A | C | 115 | 0.32 | 110 | 0.40 | Comp. |
| 3-115 | Exemplified compound 3-67 | C | 123 | 0.28 | 120 | 0.29 | Inv. |
| 3-116 | Exemplified compound 3-70 | C | 125 | 0.25 | 123 | 0.27 | Inv. |
| 3-117 | Exemplified compound 3-71 | C | 122 | 0.24 | 121 | 0.26 | Inv. |
| 3-118 | Exemplified compound 3-2 | C | 120 | 0.24 | 119 | 0.28 | Inv. |
| 3-119 | Exemplified compound 3-64 | C | 119 | 0.26 | 116 | 0.27 | Inv. |
| 3-120 | Exemplified compound 3-68 | C | 124 | 0.27 | 120 | 0.30 | Inv. |

It is apparent from Table 13 that the compounds of the present invention have a greater sensitivity-increasing effect and lower density at unexposed portion (fog), regardless of the small use amount, in any of addition patterns A, B and C, compared with the comparative compounds. With respect to the samples left for 3 days under the conditions of 50° C. and 80%RH, the sensitivity decrease of the compounds of the present invention is small after the raw storage, and the level of the fog is reduced, compared with the comparative compounds.

Example 8

Silver halide emulsion Em-3-Q1 was prepared in the same manner as Em-1-Q1 of Example 2.

(Em-3-Q2 to Em-3-Q15)

Emulsions Em-3-Q2 to Em-3-Q15 were prepared in the same manner as in (Em-3-Q1), except that, after the addition of Compounds 13 and 14, followed by lowering the temperature of the emulsion that was chemically sensitized to 40° C., each of the compounds according to the present invention or each of the comparative compounds was added in an amount per silver amount that is contained in each of the emulsions, was added as set froth in Table 14. The timing of after the addition of Compounds 13 and 14, which is followed by lowering the temperature of the emulsion that was chemically sensitized to 40° C., is hereinafter referred to as "Addition pattern C", as in Example 1.

TABLE 14

Addition amount and addition timing of the compounds of the invention and those for comparison into Em-3-Q1 to -Q15

| Emulsion No. | Compounds added to emulsion | Addition timing | Addition amount with respect to silver amount mol/Ag-mol |
|---|---|---|---|
| 3-Q1 | none | — | — |
| 3-Q2 | Comparative compound A | C | $10 \times 10^{-6}$ |
| 3-Q3 | Comparative compound B | C | $10 \times 10^{-6}$ |
| 3-Q4 | Exemplified compound 3-67 | C | $7 \times 10^{-6}$ |
| 3-Q5 | Exemplified compound 3-70 | C | $7 \times 10^{-6}$ |
| 3-Q6 | Exemplified compound 3-71 | C | $7 \times 10^{-6}$ |
| 3-Q7 | Exemplified compound 3-75 | C | $7 \times 10^{-6}$ |
| 3-Q8 | Exemplified compound 3-1 | C | $7 \times 10^{-6}$ |
| 3-Q9 | Exemplified compound 3-10 | C | $7 \times 10^{-6}$ |
| 3-Q10 | Exemplified compound 3-11 | C | $7 \times 10^{-6}$ |
| 3-Q11 | Exemplified compound 3-63 | C | $7 \times 10^{-6}$ |

TABLE 14-continued

Addition amount and addition timing of the compounds of the invention and those for comparison into Em-3-Q1 to -Q15

| Emulsion No. | Compounds added to emulsion | Addition timing | Addition amount with respect to silver amount mol/Ag-mol |
|---|---|---|---|
| 3-Q12 | Exemplified compound 3-2 | C | $4 \times 10^{-6}$ |
| 3-Q13 | Exemplified compound 3-64 | C | $4 \times 10^{-6}$ |
| 3-Q14 | Exemplified compound 3-68 | C | $4 \times 10^{-6}$ |
| 3-Q15 | Exemplified compound 3-73 | C | $4 \times 10^{-6}$ |

Samples 3-201 to 3-215 were prepared by coating, Emulsions Em-3-Q1 to Em-3-Q15, respectively, in the same manner as in Example 2, thereby preparing Samples 3-201 to 3-215. These samples were processed in the same manner as in Example 2, and evaluated the samples.

Results of the photographic performance are set forth in Table 15 below. Sensitivity was expressed in a relative value of a logarithm value of reciprocal of an exposure amount required to attain a density of fog density plus 0.2. (Sensitivity of Sample 3-201 was made control, i.e., 100.)

TABLE 15

Photographic performance of Samples 3-201 to -215

| | | | Photographic performance with green filter | | Photographic performance after thermal treatment | | |
|---|---|---|---|---|---|---|---|
| Sample | Added compound | Addition timing | Relative sensitivity | Fog | Relative sensitivity | Thermal fog | Remarks |
| 3-201 | none | C | 100 (Control) | 0.21 | 98 | 0.23 | Comp. |
| 3-202 | Comparative compound A | C | 111 | 0.33 | 104 | 0.40 | Comp. |
| 3-203 | Comparative compound B | C | 114 | 0.35 | 107 | 0.43 | Comp. |
| 3-204 | Exemplified compound 3-67 | C | 120 | 0.27 | 117 | 0.32 | Inv. |
| 3-205 | Exemplified compound 3-70 | C | 121 | 0.26 | 119 | 0.33 | Inv. |
| 3-206 | Exemplified compound 3-71 | C | 118 | 0.24 | 114 | 0.29 | Inv. |
| 3-207 | Exemplified compound 3-75 | C | 117 | 0.23 | 113 | 0.29 | Inv. |
| 3-208 | Exemplified compound 3-1 | C | 119 | 0.26 | 115 | 0.31 | Inv. |
| 3-209 | Exemplified compound 3-10 | C | 117 | 0.24 | 114 | 0.30 | Inv. |
| 3-210 | Exemplified compound 3-11 | C | 118 | 0.25 | 115 | 0.29 | Inv. |
| 3-211 | Exemplified compound 3-63 | C | 119 | 0.23 | 116 | 0.28 | Inv. |

TABLE 15-continued

Photographic performance of Samples 3-201 to -215

| Sample | Added compound | Addition timing | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|
| 3-212 | Exemplified compound 3-2 | C | 121 | 0.24 | 117 | 0.30 | Inv. |
| 3-213 | Exemplified compound 3-64 | C | 118 | 0.26 | 115 | 0.32 | Inv. |
| 3-214 | Exemplified compound 3-68 | C | 120 | 0.29 | 116 | 0.34 | Inv. |
| 3-215 | Exemplified compound 3-73 | C | 123 | 0.31 | 119 | 0.35 | Inv. |

It is apparent from Table 15 that the compounds of the present invention have a greater sensitivity-increasing effect and lower density at unexposed portion (fog), also in a green-sensitive silver halide photographic emulsion, compared with the comparative compounds. With respect to the samples left for 3 days under the conditions of 50° C. and 80%RH, the sensitivity decrease of the compounds of the present invention is small after the raw storage, and the level of the fog is reduced, compared with the comparative compounds.

Example 9

Color negative lightsensitive materials of samples 3-301 to 3-320 using the emulsion for a high-speed blue-sensitive layer prepared in Example 7, were prepared in the same manner as in Example 3.

The same processing as in Example 3 was performed for Samples 3-301 to 3-320, and photographic performance was evaluated. Results obtained are set forth in Table 16. (Sensitivity of sample 3-301 is made control, i.e., 100.)

TABLE 16

Photographic performance of samples 3-301 to 3-320

| Sample | Emulsion | Addition pattern | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|
| 2-301 | none | A | 100 (control) | 0.25 | 98 | 0.30 | Com. |
| 3-302 | Comparative compound A | A | 111 | 0.29 | 102 | 0.39 | Com. |
| 3-303 | Exemplified compound 3-67 | A | 115 | 0.28 | 110 | 0.32 | Inv. |
| 3-304 | Exemplified compound 3-70 | A | 114 | 0.27 | 109 | 0.31 | Inv. |
| 3-305 | Exemplified compound 3-71 | A | 117 | 0.28 | 113 | 0.32 | Inv. |
| 3-306 | Exemplified compound 3-2 | A | 118 | 0.26 | 114 | 0.30 | Inv. |
| 3-307 | Exemplified compound 3-68 | A | 116 | 0.27 | 111 | 0.33 | Inv. |
| 3-308 | Comparative compound A | B | 111 | 0.28 | 103 | 0.39 | Com. |
| 3-309 | Exemplified compound 3-67 | B | 14 | 0.28 | 109 | 0.33 | Inv. |
| 3-310 | Exemplified compound 3-70 | B | 116 | 0.26 | 112 | 0.32 | Inv. |
| 3-311 | Exemplified compound 3-71 | B | 115 | 0.24 | 111 | 0.31 | Inv. |
| 3-312 | Exemplified compound 3-2 | B | 118 | 0.25 | 113 | 0.32 | Inv. |
| 3-313 | Exemplified compound 3-68 | B | 117 | 0.26 | 114 | 0.30 | Inv. |
| 3-314 | Comparative compound A | C | 113 | 0.30 | 110 | 0.40 | Com. |
| 3-315 | Exemplified compound 3-67 | C | 120 | 0.28 | 117 | 0.31 | Inv. |
| 2-316 | Exemplified compound 3-70 | C | 118 | 0.26 | 115 | 0.33 | Inv. |

TABLE 16-continued

Photographic performance of samples 3-301 to 3-320

| Sample | Emulsion | Addition pattern | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|
| 3-317 | Exemplified compound 3-71 | C | 119 | 0.27 | 114 | 0.35 | Inv. |
| 3-318 | Exemplified compound 3-2 | C | 117 | 0.26 | 111 | 0.34 | Inv. |
| 3-319 | Exemplified compound 3-64 | C | 119 | 0.26 | 113 | 0.32 | Inv. |
| 3-320 | Exemplified compound 3-68 | C | 120 | 0.27 | 115 | 0.33 | Inv. |

It is apparent from Table 16 that, also in full color silver halide photographic material, the compounds of the present invention have a greater sensitivity-increasing effect and lower density at unexposed portion (fog), in any of addition patterns A, B and C, although the addition amount is small, and the density (fog) at a unexposed area is low, compared with the comparative compounds.

With respect to the samples left for 3 days under the conditions of 50° C. and 80%RH, the sensitivity decrease in the blue-sensitive layer of the compounds of the present invention is small after the raw storage, the level of the fog is reduced, compared with the comparative compounds.

It is apparent from the above results, the use of the compound of Type 3 of the present invention can attain silver halide photographic materials having high sensitivity, low fog, and small sensitivity decrement after raw storage, and fog increment in the photographic material is small.

Example 10

Silver halide emulsion Em-4-A1 was prepared in the same manner as Em-1-A1 of Example 1.

(Em-4-A2 to Em-4-A7)

Emulsions Em-4-A2 to Em-4-A7 were prepared in the same manner as in (Em-4-A1), except that, before the addition of Compounds 11 and 12, each of the compounds according to the present invention or each of the comparative compounds was added in an amount per silver amount that is contained in each of the emulsions, was added as set froth in Table 17. The timing of before the addition of Compounds 11 and 12 is hereinafter referred to as "Addition pattern A", as in Example 1.

(Em-4-A8 to Em-4-A13)

Emulsions Em-4-A8 to Em-4-A13 were prepared in the same manner as in (Em-4-A1), except that, before the addition of Compounds 13 and 14, each of the compounds according to the present invention or each of the comparative compounds was added in an amount per silver amount that is contained in each of the emulsions, was added as set froth in Table 17. The timing of before the addition of Compounds 13 and 14 is hereinafter referred to as "Addition pattern B", as in Example 1.

(Em-4-A14 to Em-4-A20)

Emulsions Em-4-A14 to Em-4-A20 were prepared in the same manner as in (Em-4-A1), except that, after the addition of Compounds 13 and 14, followed by lowering the temperature of the emulsion that was chemically sensitized to 40° C., each of the compounds according to the present invention or each of the comparative compounds was added in an amount per silver amount that is contained in each of the emulsions, was added as set froth in Table 17. The timing of after the addition of Compounds 13 and 14, which is followed by lowering the temperature of the emulsion that was chemically sensitized to 40° C., is hereinafter referred to as "Addition pattern C", as in Example 1.

TABLE 17

Addition amount and addition timing of the compounds of the invention and those for comparison into Em-4-A1 to -A20

| Emulsion No. | Compounds added to emulsion | Addition timing | Addition amount with respect to silver amount mol/Ag-mol |
|---|---|---|---|
| 4-A1 | none | — | — |
| 4-A2 | Comparative compound A | A | $15 \times 10^{-6}$ |
| 4-A3 | Exemplified compound 4-33 | A | $15 \times 10^{-6}$ |
| 4-A4 | Exemplified compound 4-30 | A | $15 \times 10^{-6}$ |
| 4-A5 | Exemplified compound 4-34 | A | $15 \times 10^{-6}$ |
| 4-A6 | Exemplified compound 4-50 | A | $10 \times 10^{-6}$ |
| 4-A7 | Exemplified compound 4-51 | A | $10 \times 10^{-6}$ |
| 4-A8 | Comparative compound A | B | $15 \times 10^{-6}$ |
| 4-A9 | Exemplified compound 4-33 | B | $15 \times 10^{-6}$ |
| 4-A10 | Exemplified compound 4-30 | B | $15 \times 10^{-6}$ |
| 4-A11 | Exemplified compound 4-34 | B | $15 \times 10^{-6}$ |
| 4-A12 | Exemplified compound 4-50 | B | $10 \times 10^{-6}$ |
| 4-A13 | Exemplified compound 4-51 | B | $10 \times 10^{-6}$ |
| 4-A14 | Comparative compound A | C | $15 \times 10^{-6}$ |
| 4-A15 | Exemplified compound 4-33 | C | $15 \times 10^{-6}$ |
| 4-A16 | Exemplified compound 4-30 | C | $15 \times 10^{-6}$ |
| 4-A17 | Exemplified compound 4-34 | C | $15 \times 10^{-6}$ |
| 4-A18 | Exemplified compound 4-54 | C | $15 \times 10^{-6}$ |

TABLE 17-continued

Addition amount and addition timing of the compounds of the invention and those for comparison into Em-4-A1 to -A20

| Emulsion No. | Compounds added to emulsion | Addition timing | Addition amount with respect to silver amount mol/Ag-mol |
|---|---|---|---|
| 4-A19 | Exemplified compound 4-50 | C | $10 \times 10^{-6}$ |
| 4-A20 | Exemplified compound 4-51 | C | $10 \times 10^{-6}$ |

Samples 4-101 to 4-120 were prepared by coating, on a cellulose triacetate film support on which a subbing layer is provided, the above Emulsions Em-4-A1 to Em-4-A20, respectively, with the same coating condition as in Example 1.

Results of the photographic performance that was evaluated in the same manner as in Example 1 are set forth in Table 18 below. Sensitivity was expressed in a relative value of a logarithm value of reciprocal of an exposure amount required to attain a density of fog density plus 0.2. (Sensitivity of Sample 4-101 was made control, i.e., 100.)

TABLE 18

Photographic performance of Samples 4-101 to -120

| Sample | Added compound | Addition timing | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|
| 4-101 | none | A | 100 (Control) | 0.21 | 98 | 0.23 | Comp. |
| 4-102 | Comparative compound A | A | 112 | 0.30 | 105 | 0.38 | Comp. |
| 4-103 | Exemplified compound 4-33 | A | 115 | 0.25 | 111 | 0.27 | Inv. |
| 4-104 | Exemplified compound 4-30 | A | 117 | 0.27 | 115 | 0.29 | Inv. |
| 4-105 | Exemplified compound 4-34 | A | 118 | 0.26 | 116 | 0.29 | Inv. |
| 4-106 | Exemplified compound 4-50 | A | 116 | 0.24 | 114 | 0.26 | Inv. |
| 4-107 | Exemplified compound 4-51 | A | 116 | 0.23 | 115 | 0.26 | Inv. |
| 4-108 | Comparative compound A | B | 111 | 0.28 | 103 | 0.35 | Comp. |
| 4-109 | Exemplified compound 4-33 | B | 114 | 0.27 | 111 | 0.29 | Inv. |
| 4-110 | Exemplified compound 4-30 | B | 115 | 0.25 | 113 | 0.27 | Inv. |
| 4-111 | Exemplified compound 4-34 | B | 116 | 0.23 | 113 | 0.25 | Inv. |
| 4-112 | Exemplified compound 4-50 | B | 115 | 0.24 | 112 | 0.27 | Inv. |
| 4-113 | Exemplified compound 4-51 | B | 116 | 0.22 | 113 | 0.23 | Inv. |
| 4-114 | Comparative compound A | C | 115 | 0.32 | 110 | 0.40 | Comp. |
| 4-115 | Exemplified compound 4-33 | C | 120 | 0.27 | 118 | 0.30 | Inv. |
| 4-116 | Exemplified compound 4-30 | C | 121 | 0.30 | 117 | 0.33 | Inv. |
| 4-117 | Exemplified compound 4-34 | C | 122 | 0.30 | 121 | 0.32 | Inv. |
| 4-118 | Exemplified compound 4-54 | C | 120 | 0.29 | 118 | 0.31 | Inv. |
| 4-119 | Exemplified compound 4-50 | C | 119 | 0.26 | 116 | 0.27 | Inv. |
| 4-120 | Exemplified compound 4-51 | C | 122 | 0.27 | 119 | 0.30 | Inv. |

It is apparent from Table 18 that the compounds of the present invention have a greater sensitivity-increasing effect and lower density at unexposed portion (fog), regardless of the small use amount, in any of addition patterns A, B and C, compared with the comparative compounds. With respect to the samples left for 3 days under the conditions of 50° C. and 80%RH, the sensitivity decrease of the compounds of the present invention is small after the raw storage, and the level of the fog is reduced, compared with the comparative compounds.

Example 11

Silver halide emulsion Em-4-Q1 was prepared in the same manner as Em-1-Q1 of Example 2.

(Em-4-Q2 to Em-4-Q15)

Emulsions Em-4-Q2 to Em-4-Q15 were prepared in the same manner as in (Em-4-Q1), except that, after the addition of Compounds 13 and 14, followed by lowering the temperature of the emulsion that was chemically sensitized to 40° C., each of the compounds according to the present invention or each of the comparative compounds was added in an amount per silver amount that is contained in each of the emulsions, was added as set froth in Table 19. The timing of after the addition of Compounds 13 and 14, which is followed by lowering the temperature of the emulsion that was chemically sensitized to 40° C., is hereinafter referred to as "Addition pattern C", as in Example 1.

TABLE 19

Addition amount and addition timing of the compounds of the invention and those for comparison into Em-4-Q1 to -Q15

| Emulsion No. | Compounds added to emulsion | Addition timing | Addition amount with respect to silver amount mol/Ag-mol |
|---|---|---|---|
| 4-Q1 | none | — | — |
| 4-Q2 | Comparative compound A | C | $10 \times 10^{-6}$ |

TABLE 19-continued

Addition amount and addition timing of the compounds of the invention and those for comparison into Em-4-Q1 to -Q15

| Emulsion No. | Compounds added to emulsion | Addition timing | Addition amount with respect to silver amount mol/Ag-mol |
|---|---|---|---|
| 4-Q3 | Comparative compound B | C | $10 \times 10^{-6}$ |
| 4-Q4 | Exemplified compound 4-33 | C | $10 \times 10^{-6}$ |
| 4-Q5 | Exemplified compound 4-30 | C | $10 \times 10^{-6}$ |
| 4-Q6 | Exemplified compound 4-34 | C | $10 \times 10^{-6}$ |
| 4-Q7 | Exemplified compound 4-54 | C | $10 \times 10^{-6}$ |
| 4-Q8 | Exemplified compound 4-32 | C | $10 \times 10^{-6}$ |
| 4-Q9 | Exemplified compound 4-27 | C | $10 \times 10^{-6}$ |
| 4-Q10 | Exemplified compound 4-60 | C | $10 \times 10^{-6}$ |
| 4-Q11 | Exemplified compound 4-22 | C | $10 \times 10^{-6}$ |
| 4-Q12 | Exemplified compound 4-50 | C | $7 \times 10^{-6}$ |
| 4-Q13 | Exemplified compound 4-5i | C | $7 \times 10^{-6}$ |
| 4-Q14 | Exemplified compound 4-6i | C | $7 \times 10^{-6}$ |
| 4-Q15 | Exemplified compound 4-39 | C | $7 \times 10^{-6}$ |

Samples 4-201 to 4-215 were prepared by coating, Emulsions Em-4-Q1 to Em-4-Q15, respectively, in the same manner as in Example 2, thereby preparing Samples 4-201 to 4-215. These samples were processed in the same manner as in Example 2, and evaluated the samples.

Results of the photographic performance are set forth in Table 20 below. Sensitivity was expressed in a relative value of a logarithm value of reciprocal of an exposure amount required to attain a density of fog density plus 0.2. (Sensitivity of Sample 4-201 was made control, i.e., 100.)

TABLE 20

Photographic performance of Samples 4-201 to -215

| | | | Photographic performance with green filter | | Photographic performance after thermal treatment | | |
|---|---|---|---|---|---|---|---|
| Sample | Added compound | Addition timing | Relative sensitivity | Fog | Relative sensitivity | Thermal fog | Remarks |
| 4-201 | none | C | 100 (Control) | 0.21 | 98 | 0.23 | Comp. |
| 4-202 | Comparative compound A | C | 111 | 0.33 | 104 | 0.40 | Comp. |
| 4-203 | Comparative compound B | C | 114 | 0.35 | 107 | 0.43 | Comp. |
| 4-204 | Exemplified compound 4-33 | C | 116 | 0.28 | 112 | 0.32 | Inv. |
| 4-205 | Exemplified compound 4-30 | C | 118 | 0.28 | 114 | 0.33 | Inv. |
| 4-206 | Exemplified compound 4-34 | C | 118 | 0.24 | 114 | 0.29 | Inv. |

TABLE 20-continued

| Photographic performance of Samples 4-201 to -215 | | | | | | | |
|---|---|---|---|---|---|---|---|
| | | | Photographic performance with green filter | | Photographic performance after thermal treatment | | |
| Sample | Added compound | Addition timing | Relative sensitivity | Fog | Relative sensitivity | Thermal fog | Remarks |
| 4-207 | Exemplified compound 4-54 | C | 117 | 0.23 | 113 | 0.28 | Inv. |
| 4-208 | Exemplified compound 4-32 | C | 119 | 0.26 | 115 | 0.31 | Inv. |
| 4-209 | Exemplified compound 4-27 | C | 117 | 0.24 | 114 | 0.30 | Inv. |
| 4-210 | Exemplified compound 4-60 | C | 118 | 0.26 | 115 | 0.29 | Inv. |
| 4-211 | Exemplified compound 4-22 | C | 119 | 0.27 | 116 | 0.29 | Inv. |
| 4-212 | Exemplified compound 4-50 | C | 120 | 0.24 | 117 | 0.30 | Inv. |
| 4-213 | Exemplified compound 4-51 | C | 118 | 0.26 | 115 | 0.31 | Inv. |
| 4-214 | Exemplified compound 4-61 | C | 120 | 0.29 | 116 | 0.34 | Inv. |
| 4-215 | Exemplified compound 4-21 | C | 121 | 0.31 | 119 | 0.35 | Inv. |

It is apparent from Table 20 that the compounds of the present invention have a greater sensitivity-increasing effect and lower density at unexposed portion (fog), also in a green-sensitive silver halide photographic emulsion, compared with the comparative compounds. With respect to the samples left for 3 days under the conditions of 50° C. and 80%RH, the sensitivity decrease of the compounds of the present invention is small after the raw storage, and the level of the fog is reduced, compared with the comparative compounds.

Example 12

Color negative lightsensitive materials of samples 4-301 to 4-320 using the emulsion for a high-speed blue-sensitive layer prepared in Example 10, were prepared in the same manner as in Example 3.

The same processing as in Example 3 was performed for Samples 4-301 to 4-320, and photographic performance was evaluated. Results obtained are set forth in Table 21. (Sensitivity of sample 4-301 is made control, i.e., 100.)

TABLE 21

| Photographic performance of Samples 4-201 to 4-215 | | | | | | | |
|---|---|---|---|---|---|---|---|
| | | | Photographic performance with green filter | | Photographic performance after thermal treatment | | |
| Sample | Emulsion | Addition pattern | Relative sensitivity | Fog | Relative sensitivity | Fog | Remarks |
| 4-201 | none | C | 100 (control) | 0.21 | 98 | 0.23 | Comp. |
| 4-202 | Comparative compound A | C | 111 | 0.33 | 104 | 0.40 | Comp. |
| 4-203 | Comparative compound B | C | 114 | 0.35 | 107 | 0.43 | Comp. |
| 4-204 | Exemplified compound 4-33 | C | 116 | 0.28 | 112 | 0.32 | Inv. |
| 4-205 | Exemplified compound 4-30 | C | 118 | 0.28 | 114 | 0.33 | Inv. |
| 4-206 | Exemplified compound 4-34 | C | 118 | 0.24 | 114 | 0.29 | Inv. |
| 4-207 | Exemplified compound 4-54 | C | 117 | 0.23 | 113 | 0.28 | Inv. |
| 4-208 | Exemplified compound 4-32 | C | 119 | 0.26 | 115 | 0.31 | Inv. |
| 4-209 | Exemplified compound 4-27 | C | 117 | 0.24 | 114 | 0.30 | Inv. |
| 4-210 | Exemplified compound 4-60 | C | 118 | 0.26 | 115 | 0.29 | Inv. |
| 4-211 | Exemplified compound 4-22 | C | 119 | 0.27 | 116 | 0.29 | Inv. |
| 4-212 | Exemplified compound 4-50 | C | 120 | 0.24 | 117 | 0.30 | Inv. |

TABLE 21-continued

Photographic performance of Samples 4-201 to 4-215

| Sample | Emulsion | Addition pattern | Photographic performance with green filter: Relative sensitivity | Photographic performance with green filter: Fog | Photographic performance after thermal treatment: Relative sensitivity | Photographic performance after thermal treatment: Fog | Remarks |
|---|---|---|---|---|---|---|---|
| 4-213 | Exemplified compound 4-51 | C | 118 | 0.26 | 115 | 0.31 | Inv. |
| 4-214 | Exemplified compound 4-61 | C | 120 | 0.29 | 116 | 0.34 | Inv. |
| 4-215 | Exemplified compound 4-21 | C | 121 | 0.31 | 119 | 0.35 | Inv. |

It is apparent from Table 21 that, also in full color silver halide photographic material, the compounds of the present invention have a greater sensitivity-increasing effect and lower density at unexposed portion (fog), in any of addition patterns A, B and C, although the addition amount is small, and the density (fog) at a unexposed area is low, compared with the comparative compounds.

With respect to the samples left for 3 days under the conditions of 50° C. and 80%RH, the sensitivity decrease in the blue-sensitive layer of the compounds of the present invention is small after the raw storage, the level of the fog is reduced, compared with the comparative compounds.

It is apparent from the above results, the use of the compound of Type 4 of the present invention can attain silver halide photographic materials having high sensitivity, low fog, and small sensitivity decrement after raw storage, and fog increment in the photographic material is small.

Example 13

The emulsions Em-11-A1 to Em-11-A20 and the samples 11-101 to 11-120 were prepared in the same manner as in Example 1, using the compounds of Type 1 (general formulae (1) to (3)) of the present invention. The emulsions and samples prepared, and the results of evaluation are shown in Tables 22 and 23.

It is apparent from Table 23 that the compounds of the present invention have a greater sensitivity-increasing effect, regardless of the small volume used, in any of addition patterns A, B and C, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

TABLE 22

Addition amount and layer of the inventive and comparative compounds in emulsions 11-A1 to 11-A20

| Emulsion No. | Added compound | Addition pattern | Addition amount with respect to silver amount (mol/Ag-mol) |
|---|---|---|---|
| 11-A1 | none | — | — |
| 11-A2 | Comparative compound A | A | $15 \times 10^{-6}$ |
| 11-A3 | Exemplified compound 1-301 | A | $13 \times 10^{-6}$ |
| 11-A4 | Exemplified compound 1-302 | A | $13 \times 10^{-6}$ |
| 11-A5 | Exemplified compound 1-307 | A | $10 \times 10^{-6}$ |
| 11-A6 | Exemplified compound 1-303 | A | $10 \times 10^{-6}$ |
| 11-A7 | Exemplified compound 1-308 | A | $12 \times 10^{-6}$ |
| 11-A8 | Comparative compound A | B | $15 \times 10^{-6}$ |
| 11-A9 | Exemplified compound 1-301 | B | $13 \times 10^{-6}$ |
| 11-A10 | Exemplified compound 1-302 | B | $13 \times 10^{-6}$ |
| 11-A11 | Exemplified compound 1-307 | B | $10 \times 10^{-6}$ |
| 11-A12 | Exemplified compound 1-303 | B | $10 \times 10^{-6}$ |
| 11-A13 | Exemplified compound 1-308 | B | $12 \times 10^{-6}$ |
| 11-A14 | Comparative compound A | C | $15 \times 10^{-6}$ |
| 11-A15 | Exemplified compound 1-301 | C | $13 \times 10^{-6}$ |
| 11-A16 | Exemplified compound 1-302 | C | $13 \times 10^{-6}$ |
| 11-A17 | Exemplified compound 1-307 | C | $10 \times 10^{-6}$ |
| 11-A18 | Exemplified compound 1-303 | C | $10 \times 10^{-6}$ |
| 11-A19 | Exemplified compound 1-308 | C | $12 \times 10^{-6}$ |
| 11-A20 | Exemplified compound 1-309 | C | $15 \times 10^{-6}$ |

TABLE 23

Photographic performance of Samples 11-101 to 11-120

| Sample | Added compound | Addition pattern | Photographic performance with green filter: Relative sensitivity | Photographic performance with green filter: Fog | Photographic performance after thermal treatment: Relative sensitivity | Photographic performance after thermal treatment: Fog | Remarks |
|---|---|---|---|---|---|---|---|
| 11-101 | none | A | 100 (control) | 0.21 | 98 | 0.23 | Comp. |

TABLE 23-continued

Photographic performance of Samples 11-101 to 11-120

| Sample | Added compound | Addition pattern | Photographic performance with green filter: Relative sensitivity | Photographic performance with green filter: Fog | Photographic performance after thermal treatment: Relative sensitivity | Photographic performance after thermal treatment: Fog | Remarks |
|---|---|---|---|---|---|---|---|
| 11-102 | Comparative compound A | A | 112 | 0.30 | 105 | 0.38 | Comp. |
| 11-103 | Exemplified compound 1-301 | A | 118 | 0.25 | 114 | 0.29 | Inv. |
| 11-104 | Exemplified compound 1-302 | A | 120 | 0.27 | 116 | 0.30 | Inv. |
| 11-105 | Exemplified compound 1-307 | A | 126 | 0.26 | 122 | 0.29 | Inv. |
| 11-106 | Exemplified compound 1-303 | A | 117 | 0.24 | 113 | 0.27 | Inv. |
| 11-107 | Exemplified compound 1-308 | A | 123 | 0.26 | 119 | 0.30 | Inv. |
| 11-108 | Comparative compound A | B | 111 | 0.28 | 103 | 0.35 | Com. |
| 11-109 | Exemplified compound 1-301 | B | 117 | 0.27 | 114 | 0.29 | Inv. |
| 11-110 | Exemplified compound 1-302 | B | 119 | 0.27 | 116 | 0.30 | Inv. |
| 11-111 | Exemplified compound 1-307 | B | 123 | 0.25 | 118 | 0.29 | Inv. |
| 11-112 | Exemplified compound 1-303 | B | 119 | 0.24 | 116 | 0.28 | Inv. |
| 11-113 | Exemplified compound 1-308 | B | 125 | 0.27 | 120 | 0.31 | Inv. |
| 11-114 | Comparative compound A | C | 115 | 0.32 | 110 | 0.40 | Comp. |
| 11-115 | Exemplified compound 1-301 | C | 120 | 0.27 | 117 | 0.29 | Inv. |
| 11-116 | Exemplified compound 1-302 | C | 123 | 0.27 | 120 | 0.29 | Inv. |
| 11-117 | Exemplified compound 1-307 | C | 127 | 0.26 | 122 | 0.30 | Inv. |
| 11-118 | Exemplified compound 1-303 | C | 124 | 0.25 | 118 | 0.28 | Inv. |
| 11-119 | Exemplified compound 1-308 | C | 126 | 0.27 | 121 | 0.31 | Inv. |
| 11-120 | Exemplified compound 1-309 | C | 124 | 0.27 | 120 | 0.30 | Inv. |

Example 14

The emulsions Em-11-Q1 to Em-11-Q15 and the samples 11-201 to 11-215 were prepared in the same manner as in Example 2, using the compounds of Type 1 (general formulae (1) to (3)) of the present invention. The emulsions and samples prepared, and the results of evaluation are shown in Tables 24 and 25.

It is apparent from Table 25 that, also in the green-sensitive silver halide photographic emulsion, the compounds of Type 1 of the present invention have a greater sensitivity-increasing effect, regardless of the small volume used, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

TABLE 24

Addition amount and layer of the inventive and comparative compounds in emulsions 11-Q1 to 11-Q15

| Emulsion No. | Added compound | Addition pattern | Addition amount with respect to silver amount (mol/Ag-mol) |
|---|---|---|---|
| 11-Q1 | none | — | — |
| 11-Q2 | Comparative compound A | C | $10 \times 10^{-6}$ |
| 11-Q3 | Comparative compound B | C | $10 \times 10^{-6}$ |
| 11-Q4 | Exemplified compound 1-301 | C | $7 \times 10^{-6}$ |
| 11-Q5 | Exemplified compound 1-301 | C | $10 \times 10^{-6}$ |
| 11-Q6 | Exemplified compound 1-304 | C | $7 \times 10^{-6}$ |
| 11-Q7 | Exemplified compound 1-304 | C | $10 \times 10^{-6}$ |
| 11-Q8 | Exemplified compound 1-307 | C | $7 \times 10^{-6}$ |
| 11-Q9 | Exemplified compound 1-307 | C | $10 \times 10^{-6}$ |
| 11-Q10 | Exemplified compound 1-308 | C | $7 \times 10^{-6}$ |
| 11-Q11 | Exemplified compound 1-308 | C | $10 \times 10^{-6}$ |
| 11-Q12 | Exemplified compound 1-311 | C | $7 \times 10^{-6}$ |
| 11-Q13 | Exemplified compound 1-311 | C | $10 \times 10^{-6}$ |
| 11-Q14 | Exemplified compound 1-321 | C | $7 \times 10^{-6}$ |
| 11-Q15 | Exemplified compound 1-321 | C | $10 \times 10^{-6}$ |

TABLE 25

Photographic performance of samples 11-201 to 11-215

| Sample | Added compound | Addition pattern | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|
| 11-201 | none | C | 100 (control) | 0.21 | 98 | 0.23 | Comp. |
| 11-202 | Comparative compound A | C | 111 | 0.33 | 104 | 0.40 | Comp. |
| 11-203 | Comparative compound B | C | 114 | 0.35 | 107 | 0.43 | Comp. |
| 11-204 | Exemplified compound 1-301 | C | 116 | 0.26 | 113 | 0.31 | Inv. |
| 11-205 | Exemplified compound 1-301 | C | 122 | 0.29 | 118 | 0.34 | Inv. |
| 11-206 | Exemplified compound 1-304 | C | 114 | 0.25 | 110 | 0.29 | Inv. |
| 11-207 | Exemplified compound 1-304 | C | 118 | 0.28 | 115 | 0.32 | Inv. |
| 11-208 | Exemplified compound 1-307 | C | 119 | 0.27 | 114 | 0.31 | Inv. |
| 11-209 | Exemplified compound 1-307 | C | 124 | 0.30 | 120 | 0.33 | Inv. |
| 11-210 | Exemplified compound 1-308 | C | 118 | 0.25 | 114 | 0.29 | Inv. |
| 11-211 | Exemplified compound 1-308 | C | 123 | 0.31 | 119 | 0.35 | Inv. |
| 11-212 | Exemplified compound 1-311 | C | 117 | 0.25 | 112 | 0.29 | Inv. |
| 11-213 | Exemplified compound 1-311 | C | 122 | 0.30 | 118 | 0.33 | Inv. |
| 11-214 | Exemplified compound 1-321 | C | 119 | 0.24 | 115 | 0.29 | Inv. |
| 11-215 | Exemplified compound 1-321 | C | 123 | 0.28 | 119 | 0.31 | Inv. |

Example 15

The samples 11-301 to 11-320 using the compounds of Type 1 (general formulae (1) to (3)) of the present invention were prepared in the same manner as in Example 3, using the emulsion for a high-speed blue-sensitive layer prepared in Example 14. The samples prepared, and the results of evaluation are shown in Table 26.

It is apparent from Table 26 that, also in the full color silver halide photographic material, the compounds of the present invention have a greater sensitivity-increasing effect, regardless of the small volume used, in any of addition patterns A, B and C, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

TABLE 26

Photographic performance of Samples 11-301 to 11-320

| Sample | Added compound | Addition pattern | Photographic performance with green filter: Relative sensitivity | Photographic performance with green filter: Fog | Photographic performance after thermal treatment: Relative sensitivity | Photographic performance after thermal treatment: Thermal Fog | Remarks |
|---|---|---|---|---|---|---|---|
| 11-301 | none | A | 100 (control) | 0.21 | 98 | 0.23 | Comp. |
| 11-302 | Comparative compound A | A | 112 | 0.30 | 105 | 0.38 | Comp. |
| 11-303 | Exemplified compound 1-301 | A | 117 | 0.25 | 115 | 0.28 | Inv. |
| 11-304 | Exemplified compound 1-302 | A | 121 | 0.26 | 117 | 0.30 | Inv. |
| 11-305 | Exemplified compound 1-307 | A | 127 | 0.28 | 122 | 0.31 | Inv. |

TABLE 26-continued

Photographic performance of Samples 11-301 to 11-320

| Sample | Added compound | Addition pattern | Photographic performance with green filter: Relative sensitivity | Photographic performance with green filter: Fog | Photographic performance after thermal treatment: Relative sensitivity | Photographic performance after thermal treatment: Thermal Fog | Remarks |
|---|---|---|---|---|---|---|---|
| 11-306 | Exemplified compound 1-313 | A | 118 | 0.23 | 115 | 0.27 | Inv. |
| 11-307 | Exemplified compound 1-318 | A | 120 | 0.25 | 116 | 0.28 | Inv. |
| 11-308 | Comparative compound A | B | 111 | 0.28 | 103 | 0.35 | Comp. |
| 11-309 | Exemplified compound 1-301 | B | 119 | 0.26 | 114 | 0.29 | Inv. |
| 11-310 | Exemplified compound 1-302 | B | 118 | 0.25 | 114 | 0.28 | Inv. |
| 11-311 | Exemplified compound 1-307 | B | 122 | 0.28 | 118 | 0.32 | Inv. |
| 11-312 | Exemplified compound 1-313 | B | 120 | 0.24 | 116 | 0.27 | Inv. |
| 11-313 | Exemplified compound 1-318 | B | 124 | 0.29 | 120 | 0.33 | Inv. |
| 11-314 | Comparative compound A | C | 115 | 0.32 | 110 | 0.40 | Comp. |
| 11-315 | Exemplified compound 1-301 | C | 123 | 0.28 | 119 | 0.32 | Inv. |
| 11-316 | Exemplified compound 1-302 | C | 125 | 0.24 | 120 | 0.27 | Inv. |
| 11-317 | Exemplified compound 1-307 | C | 126 | 0.27 | 121 | 0.31 | Inv. |
| 11-318 | Exemplified compound 1-313 | C | 123 | 0.26 | 119 | 0.29 | Inv. |
| 11-319 | Exemplified compound 1-318 | C | 122 | 0.26 | 118 | 0.30 | Inv. |
| 11-320 | Exemplified compound 1-309 | C | 125 | 0.27 | 120 | 0.30 | Inv. |

Example 16

The silver halide emulsions 1-R1 to 1-R10 were prepared by the following method.

(1-R1)

The following changes were made to the emulsion 1-G described in Example 1 of JP-A-2001-228572, thereby preparing the emulsion 1-R1:

(i) the sensitizing dyes were changed to the sensitizing dyes 11 and 23; and (ii) in the chemical sensitization, the compound is used instead of chloroauric acid, and 1,3-dimethyl-1,3-dicarboxymethylthiourea was used instead of sodium thiosulphate.

Sensitizing dye 23

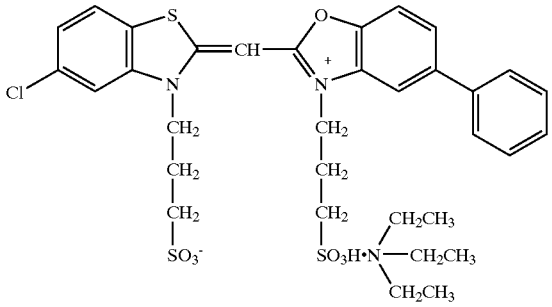

-continued

Compound 15

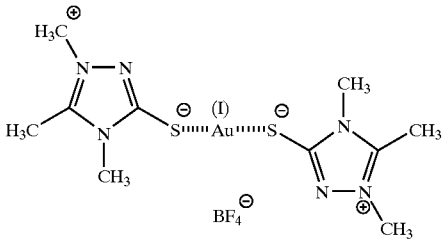

The emulsion 1-R1 contained tabular grains, having an average equivalent-circle diameter of 1.28 μm, an average thickness of 0.088 μm, and an average aspect ratio of 14.5, like the emulsion 1-G described in Example 1 of JP-A-2001-228572. In the emulsion 1-R1, 50% or more of the total projected area of the grains was occupied by grains having an equivalent-circle diameter of 1.0 μm or more, a thickness of 0.10 μm, and 30 or more dislocation lines per grain at a grain fringe portion.

(1-R2 to 1-R10)

The emulsions 1-R2 to 1-R10 were obtained in the same manner as 1-R1, except that after adding the compounds MER-1 and MER-2 and then lowering the temperature of the chemically sensitized emulsion to 40° C., the compounds of Type 1 of the present invention or the comparative compounds were added so as to obtain such a content as in Table 27, in relation to the silver amount of the emulsion.

MER-1

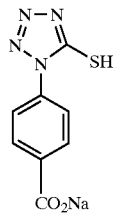

MER-2

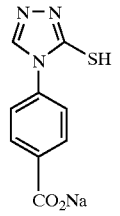

The samples 1-401 to 1-410 were prepared by applying the coating of the emulsions 1-R1 to 1-R10, respectively, in the same manner as in Example 1.

These samples were subjected to a hardening process for 14 hours under the conditions of 40° C. and relative humidity of 70%. After that, the samples were exposed for 1/100 second through a gelatin filter SC-39 manufactured by Fuji Photo Film Co., Ltd., (a long-wavelength light transmission filter having a cut-off wavelength of 390 nm), and a continuous wedge, and subjected to a development process as in Example 1. Then, the density of the samples was measured using a green filter, thereby evaluating the photographic properties. The same process was performed on each sample left for 3 days under the conditions of 50° C. and 80%RH.

The results on the photographic properties are shown in Table 27. The sensitivity is expressed by the relative value of the logarithm value of the reciprocal of the exposure amount necessary to attain a fog density plus 0.2 (the sensitivity of the sample 1-401 was assumed as control, i.e., 100).

TABLE 27

Amount and layer of addition of the inventive and comparative compounds in emulsions 1-R1 to 1-R10, and photographic performance of Samples 1-401 to 1-410

| | | | | Photographic performance with green filter | | Photographic performance after thermal treatment | | |
|---|---|---|---|---|---|---|---|---|
| Sample | Emulsion | Added compound | Addition amount (mol/Ag-mol) | Relative sensitivity | Fog | Relative sensitivity | Thermal fog | Remarks |
| 1-401 | 1-R1 | none | — | 100 (control) | 0.22 | 97 | 0.25 | Comp. |
| 1-402 | 1-R2 | Comparative compound A | $20 \times 10^{-6}$ | 115 | 0.31 | 107 | 0.39 | Comp. |
| 1-403 | 1-R3 | Comparative compound B | $25 \times 10^{-6}$ | 118 | 0.30 | 111 | 0.41 | Comp. |
| 1-404 | 1-R4 | Exemplified compound 1-194 | $10 \times 10^{-6}$ | 120 | 0.26 | 117 | 0.32 | Inv. |
| 1-405 | 1-R5 | Exemplified compound 1-193 | $13 \times 10^{-6}$ | 123 | 0.27 | 118 | 0.32 | Inv. |
| 1-406 | 1-R6 | Exemplified compound 1-13 | $15 \times 10^{-6}$ | 121 | 0.27 | 117 | 0.33 | Inv. |
| 1-407 | 1-R7 | Exemplified compound 1-34 | $13 \times 10^{-6}$ | 123 | 0.25 | 119 | 0.30 | Inv. |
| 1-408 | 1-R8 | Exemplified compound 1-24 | $10 \times 10^{-6}$ | 119 | 0.24 | 116 | 0.29 | Inv. |
| 1-409 | 1-R9 | Exemplified compound 1-28 | $10 \times 10^{-6}$ | 120 | 0.26 | 116 | 0.30 | Inv. |
| 1-410 | 1-R10 | Exemplified compound 1-195 | $13 \times 10^{-6}$ | 122 | 0.25 | 119 | 0.31 | Inv. |

It is apparent from Table 27 that, also in the silver halide photographic emulsion prepared by adding silver halide fine grains produced using the mixer outside the reaction vessel to be grown, the compounds of Type 1 of the present invention have a greater sensitivity-increasing effect, regardless of the small volume used, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

Example 17

The silver halide emulsions 1-S1 to 1-S11 were prepared by the following method.

(1-S1)

The following changes were made to the emulsion b described in Example 1 of JP-A-2001-159799, thereby preparing the emulsion 1-S1:

(i) the sensitizing dyes were changed to the sensitizing dye 11; and (ii) in the chemical sensitization, the compound 15 is used instead of gold chloride acid, and 1,3,3-trimethyl-1-carboxymethylthiourea was used instead of sodium thiosulphate.

The emulsion 1-S1 contained tabular grains, having an average equivalent-circle diameter of 4.1 μm, a variation coefficient of equivalent-circle diameters of 21%, an average thickness of 0.090 μm, and an average aspect ratio of 46, like the emulsion b described in Example 1 of JP-A-2001-159799. In the emulsion 1-S1, 70% or more of the total projected area of the grains was occupied by grains having an equivalent-circle diameter of 4.1 μm or more, and a thickness of 0.090 μm or less.

(1-S2 to 1-S11)

The emulsions 1-S2 to 1-S11 were obtained in the same manner as emulsion S1, except that after completing chemical sensitization and then lowering the temperature of the emulsion to 40° C., the compounds of Type 1 of the present invention or the comparative compounds were added so as to obtain such a content as in Table 28, in relation to the silver amount of the emulsion.

The samples 1-501 to 1-511 were prepared by applying the coating of the emulsions S1 to S1, respectively, in the same manner as in Example 1.

These samples were subjected to a hardening process for 14 hours under the conditions of 40° C. and relative humidity of 70%. After that, the samples were exposed for 1/100 second through a gelatin filter SC-39 manufactured by Fuji Photo Film Co., Ltd., (a long-wavelength light transmission filter having a cut-off wavelength of 390 nm), and a continuous wedge, and subjected to a development process as in Example 1. Then, the density of the samples was measured using a green filter, thereby evaluating the photographic properties. The same process was performed on each sample left for 3 days under the conditions of 50° C. and 80%RH.

The results on the photographic properties are shown in Table 28. The sensitivity is expressed by the relative value of the logarithm value of the reciprocal of the exposure amount necessary to attain a fog density plus 0.2 (the sensitivity of the sample 1-501 was made control, i.e., 100).

TABLE 28

Amount and layer of addition of the inventive and comparative compounds in emulsions 1-S1 to 1-S11, and photographic performance of Samples 1-501 to 1-511

| | | | | Photographic performance with green filter | | Photographic performance after thermal treatment | | |
|---|---|---|---|---|---|---|---|---|
| Sample | Emulsion | Added compound | Addition amount (mol/Ag-mol) | Relative sensitivity | Fog | Relative sensitivity | Thermal fog | Remarks |
| 1-501 | 1-S1 | none | — | 100 (control) | 0.22 | 97 | 0.24 | Comp. |
| 1-502 | 1-S2 | Comparative compound A | $12 \times 10^{-6}$ | 118 | 0.32 | 107 | 0.41 | Comp. |
| 1-503 | 1-S3 | Comparative compound B | $15 \times 10^{-6}$ | 117 | 0.31 | 108 | 0.40 | Comp. |
| 1-504 | 1-S4 | Exemplified compound 1-194 | $5 \times 10^{-6}$ | 122 | 0.27 | 117 | 0.33 | Inv. |
| 1-505 | 1-S5 | Exemplified compound 1-194 | $10 \times 10^{-6}$ | 141 | 0.29 | 135 | 0.35 | Inv. |
| 1-506 | 1-S6 | Exemplified compound 1-193 | $7 \times 10^{-6}$ | 121 | 0.26 | 115 | 0.31 | Inv. |
| 1-507 | 1-S7 | Exemplified compound 1-193 | $12 \times 10^{-6}$ | 143 | 0.29 | 138 | 0.33 | Inv. |
| 1-508 | 1-S8 | Exemplified compound 1-195 | $7 \times 10^{-6}$ | 123 | 0.28 | 118 | 0.32 | Inv. |
| 1-509 | 1-S9 | Exemplified compound 1-195 | $12 \times 10^{-6}$ | 145 | 0.31 | 139 | 0.34 | Inv. |
| 1-510 | 1-S10 | Exemplified compound 1-197 | $5 \times 10^{-6}$ | 120 | 0.27 | 113 | 0.30 | Inv. |
| 1-511 | 1-S11 | Exemplified compound 1-197 | $10 \times 10^{-6}$ | 139 | 0.30 | 130 | 0.35 | Inv. |

It is apparent from Table 28 that, also in the silver halide photographic emulsion prepared by adding silver iodide fine grains produced using the mixer outside the reaction vessel to supply iodide ions, the compounds of Type 1 of the present invention have a greater sensitivity-increasing effect, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

Example 18

The silver halide emulsions 1-T1 to 1-T15 were prepared by the following method.

(T1)

The following change was made to the emulsion obtained by epitaxially depositing the host emulsion e described in Example 1 of JP-A-2001-235821 by epitaxial deposition method (iii) in Example 1 of the same, thereby preparing the emulsion 1-T1:

(i) the sensitizing dyes used in epitaxial deposition was changed to the sensitizing dyes 11 and 23.

The emulsion 1-T1 contained tabular grains, having an average equivalent-circle diameter of 4.2 μm, a variation coefficient of equivalent-circle diameters of 19%, an average thickness of 0.062 μm, and an average aspect ratio of 68, like the host grain of the emulsion e described in Example 1 of JP-A-2001-235821. In the emulsion T1, hexagonal tabular grains having a ratio of the longest to shortest sides of 1.4 or less occupied 90% or more of the total projected area of the grains.

The average silver iodide content of the epitaxially deposited emulsion was 4.5 mol %, and the average silver chloride content was 1.2 mol %.

(1-T2 to 1-T15)

The emulsions 1-T2 to 1-T15 were obtained in the same manner as 1-T1, except that after completing chemical sensitization and then lowering the temperature of the emulsion to 40° C., the compounds of Type 1 of the present invention or the comparative compounds were added so as to obtain such a content as in Table 29, in relation to the silver amount of the emulsion.

The samples 1-601 to 1-615 were prepared by applying the coating of the emulsions 1-T1 to 1-T15, respectively, in the same manner as in Example 1.

These samples were subjected to a hardening process for 14 hours under the conditions of 40° C. and relative humidity of 70%. After that, the samples were exposed for 1/100 second through a gelatin filter SC-39 manufactured by Fuji Photo Film Co., Ltd., (a long-wavelength light transmission filter having a cut-off wavelength of 390 nm), and a continuous wedge, and subjected to a development process as in Example 1. Then, the density of the samples was measured using a green filter, thereby evaluating the photographic properties. The same process was performed on each sample left for 3 days under the conditions of 50° C. and 80%RH.

The results on the photographic properties are shown in Table 29. The sensitivity is expressed by the relative value of the logarithm of the reciprocal of the exposure amount necessary to attain a fog density plus 0.2 (the sensitivity of the sample 1-601 was made control, i.e., 100).

TABLE 29

Amount and layer of addition of the inventive and comparative compounds in emulsions 1-T1 to 1-T15, and photographic performance of Samples 1-601 to 1-615

| | | | | Photographic performance with green filter | | Photographic performance after thermal treatment | | |
|---|---|---|---|---|---|---|---|---|
| Sample | Emulsion | Added compound | Addition amount (mol/Ag-mol) | Relative sensitivity | Fog | Relative sensitivity | Thermal fog | Remarks |
| 1-601 | 1-T1 | none | — | 100 (control) | 0.23 | 96 | 0.26 | Comp. |
| 1-602 | 1-T2 | Comparative compound A | $10 \times 10^{-6}$ | 118 | 0.30 | 109 | 0.39 | Comp. |
| 1-603 | 1-T3 | Comparative compound B | $10 \times 10^{-6}$ | 117 | 0.29 | 109 | 0.37 | Comp. |
| 1-604 | 1-T4 | Exemplified compound 1-194 | $4 \times 10^{-6}$ | 122 | 0.26 | 117 | 0.33 | Inv. |
| 1-605 | 1-T5 | Exemplified compound 1-194 | $7 \times 10^{-6}$ | 143 | 0.29 | 137 | 0.35 | Inv. |
| 1-606 | 1-T6 | Exemplified compound 1-193 | $6 \times 10^{-6}$ | 121 | 0.27 | 116 | 0.31 | Inv. |
| 1-607 | 1-T7 | Exemplified compound 1-193 | $12 \times 10^{-6}$ | 143 | 0.30 | 137 | 0.35 | Inv. |
| 1-608 | 1-T8 | Exemplified compound 1-195 | $5 \times 10^{-6}$ | 123 | 0.27 | 119 | 0.32 | Inv. |
| 1-609 | 1-T9 | Exemplified compound 1-195 | $10 \times 10^{-6}$ | 145 | 0.31 | 139 | 0.39 | Inv. |
| 1-610 | 1-T10 | Exemplified compound 1-197 | $4 \times 10^{-6}$ | 125 | 0.26 | 120 | 0.30 | Inv. |
| 1-611 | 1-T11 | Exemplified compound 1-197 | $7 \times 10^{-6}$ | 149 | 0.31 | 143 | 0.37 | Inv. |
| 1-612 | 1-T12 | Exemplified compound 1-19 | $6 \times 10^{-6}$ | 121 | 0.27 | 117 | 0.29 | Inv. |
| 1-613 | 1-T13 | Exemplified compound 1-19 | $12 \times 10^{-6}$ | 142 | 0.29 | 138 | 0.33 | Inv. |
| 1-614 | 1-T14 | Exemplified compound 1-39 | $6 \times 10^{-6}$ | 120 | 0.28 | 114 | 0.32 | Inv. |
| 1-615 | 1-T15 | Exemplified compound 1-39 | $12 \times 10^{-6}$ | 139 | 0.32 | 133 | 0.36 | Inv. |

It is apparent from Table 29 that, also in the emulsion comprising tabular grains with epitaxial junctions, the compounds of Type 1 of the present invention have a greater sensitivity-increasing effect, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

Example 19

The emulsions 2-R1 to 2-R10 and the samples 2-401 to 2-410 shown in Table 30 using the compounds of Type 2 of the present invention were prepared in the same manner as in Example 16, and evaluated.

TABLE 30

Amount and layer of addition of the inventive and comparative compounds in emulsions 2-R1 to 2-R11, and photographic performance of Samples 2-401 to 1-410

| Sample | Emulsion | Added compound | Addition amount (mol/Ag-mol) | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|---|
| 2-401 | 2-R1 | none | — | 100 (control) | 0.22 | 97 | 0.25 | Comp. |
| 2-402 | 2-R2 | Comparative compound A | $20 \times 10^{-6}$ | 115 | 0.31 | 107 | 0.39 | Comp. |
| 2-403 | 2-R3 | Comparative compound B | $25 \times 10^{-6}$ | 118 | 0.30 | 111 | 0.41 | Comp. |
| 2-404 | 2-R4 | Comparative compound C | $25 \times 10^{-6}$ | 116 | 0.29 | 110 | 0.37 | Comp. |
| 2-405 | 2-R5 | Exemplified compound 2-1 | $18 \times 10^{-6}$ | 122 | 0.27 | 119 | 0.32 | Inv. |
| 2-406 | 2-R6 | Exemplified compound 2-3 | $20 \times 10^{-6}$ | 121 | 0.26 | 118 | 0.30 | Inv. |
| 2-407 | 2-R7 | Exemplified compound 2-15 | $20 \times 10^{-6}$ | 122 | 0.27 | 119 | 0.31 | Inv. |
| 2-408 | 2-R8 | Exemplified compound 2-21 | $20 \times 10^{-6}$ | 122 | 0.25 | 118 | 0.29 | Inv. |
| 2-409 | 2-R9 | Exemplified compound 2-52 | $20 \times 10^{-6}$ | 120 | 0.27 | 117 | 0.31 | Inv. |
| 2-410 | 2-R10 | Exemplified compound 2-63 | $20 \times 10^{-6}$ | 121 | 0.25 | 117 | 0.28 | Inv. |

It is apparent from Table 30 that, also in the silver halide photographic emulsion prepared by adding silver halide fine grains produced using the mixer outside the reaction vessel to be grown, the compounds of Type 2 of the present invention have a greater sensitivity-increasing effect, and the density (fog) at a unexposed area is low, compared with the comparative compounds A, B and C. With respect to the samples left for 3 days under the conditions of 50° C. and 80%RH, the sensitivity decrease of the compounds of the present invention is small after storage, and the level of the fog is reduced, compared with the comparative compounds.

Example 20

The samples 2-501 to 2-515 shown in Table 31 using the compounds of Type 2 of the present invention were prepared in the same manner as in Example 17, except that the emulsions 2-S2 to 2-S15, respectively, were prepared as follows, and evaluated.

(Emulsions 2-S2 to 2-S9)

The emulsions 2-S2 to 2-S9 were obtained in the same manner as the emulsion 1-S1 in Example 17, except that after completing chemical sensitization and then lowering the temperature of the emulsion to 40° C., the compounds of Type 2 of the present invention or the comparative compounds were added so as to obtain such a content as in Table 31, in relation to the silver amount of the emulsion.

(Emulsions 2-S10 to 2-S15)

The emulsions 2-S10 to 2-S15 were obtained in the same manner as the emulsion 2-S1, except that before adding the sensitizing dyes, the compounds of Type 2 of the present invention or the comparative compounds were added so as to obtain such a content as in Table 31, in relation to the silver amount of the emulsion.

TABLE 31

Amount and layer of addition of the inventive and comparative compounds in emulsions 2-S1 to 22-S15, and photographic performance of Samples 2-501 to 2-515

| Sample | Emulsion | Added compound | Addition amount (mol/Ag-mol) | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|---|
| 2-501 | 2-S1 | none | — | 100 (control) | 0.22 | 97 | 0.24 | Comp. |
| 2-502 | 2-S2 | Comparative compound A | $12 \times 10^{-6}$ | 118 | 0.32 | 107 | 0.41 | Comp. |
| 2-503 | 2-S3 | Comparative compound B | $15 \times 10^{-6}$ | 117 | 0.31 | 108 | 0.40 | Comp. |
| 2-504 | 2-S4 | Comparative compound C | $15 \times 10^{-6}$ | 119 | 0.30 | 111 | 0.41 | Comp. |
| 2-505 | 2-S5 | Exemplified compound 2-1 | $10 \times 10^{-6}$ | 121 | 0.26 | 118 | 0.33 | Inv. |

TABLE 31-continued

Amount and layer of addition of the inventive and comparative compounds in emulsions 2-S1 to 22-S15, and photographic performance of Samples 2-501 to 2-515

| Sample | Emulsion | Added compound | Addition amount (mol/Ag-mol) | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|---|
| 2-506 | 2-S6 | Exemplified compound 2-2 | $12 \times 10^{-6}$ | 122 | 0.27 | 118 | 0.34 | Inv. |
| 2-507 | 2-S7 | Exemplified compound 2-7 | $12 \times 10^{-6}$ | 122 | 0.28 | 117 | 0.34 | Inv. |
| 2-508 | 2-S8 | Exemplified compound 2-17 | $10 \times 10^{-6}$ | 120 | 0.27 | 116 | 0.33 | Inv. |
| 2-509 | 2-S9 | Exemplified compound 2-32 | $10 \times 10^{-6}$ | 121 | 0.29 | 118 | 0.35 | Inv. |
| 2-510 | 2-S10 | Comparative compound A | $12 \times 10^{-6}$ | 109 | 0.43 | 105 | 0.48 | Comp. |
| 2-511 | 2-S11 | Comparative compound B | $15 \times 10^{-6}$ | 110 | 0.42 | 107 | 0.46 | Comp. |
| 2-512 | 2-S12 | Comparative compound C | $15 \times 10^{-6}$ | 112 | 0.36 | 109 | 0.41 | Comp. |
| 2-513 | 2-S13 | Exemplified compound 2-1 | $10 \times 10^{-6}$ | 121 | 0.27 | 117 | 0.34 | Inv. |
| 2-514 | 2-S14 | Exemplified compound 2-2 | $12 \times 10^{-6}$ | 120 | 0.27 | 116 | 0.33 | Inv. |
| 2-515 | 2-S15 | Exemplified compound 2-17 | $10 \times 10^{-6}$ | 121 | 0.28 | 118 | 0.35 | Inv. |

It is apparent from Table 31 that, also in the silver halide photographic emulsion prepared by adding silver iodide fine grains produced using the mixer outside the reaction vessel to supply iodide ions, the compounds of Type 2 of the present invention have a greater sensitivity-increasing effect, regardless of the addition position, and the density (fog) at a unexposed area is low, compared with the comparative compounds A, B and C. With respect to the samples left for 3 days under the conditions of 50° C. and 80%RH, the sensitivity decrease of the compounds of the present invention is small after storage, and the level of the fog is reduced, compared with the comparative compounds.

Example 21

The emulsions 2-T1 to 2-T12 shown in Table 32 were prepared in the same manner as in Example 18, except that the compounds of Type 2 of the present invention were used.

The emulsions 2-T1 to 2-T12, instead of the emulsion 1-A1, were used for the 14th layer in Example 3, and the 10th layer to the 16th layer were extracted. Thereby, the model samples 2-601 to 2-612 were prepared.

These samples were subjected to a hardening process for 14 hours under the conditions of 40° C. and relative humidity of 70%. After that, the samples were exposed, and subjected to a development process as in Example 3. Then, the density of the samples was measured using a blue filter, thereby evaluating the photographic properties. The same process was performed on each sample left for 3 days under the conditions of 50° C. and 80%RH, and evaluated. With respect to the samples left for a while, density measurement was performed using a green filter, and storability was evaluated.

The results on the photographic properties are shown in the following Table 32. The sensitivity is expressed by the relative value of the logarithm of the reciprocal of the exposure amount necessary to attain a fog density plus 0.2 (The sensitivity of the sample 2-601 was made control, i.e., 100).

TABLE 32

Amount and layer of addition of the inventive and comparative compounds in emulsions 2-T1 to 2-T12, and photographic performance of Samples 2-601 to 6-612

| Sample | Emulsion | Added compound | Addition amount (mol/Ag-mol) | Photographic performance with blue filter: Relative sensitivity | Photographic performance with blue filter: Fog | Photographic performance with blue filter after thermal treatment: Relative sensitivity | Photographic performance with blue filter after thermal treatment: Thermal fog | Green filter Green-sensitive light fog | Remarks |
|---|---|---|---|---|---|---|---|---|---|
| 2-601 | 2-T1 | none | — | 100 (control) | 0.22 | 97 | 0.26 | 0.55 | Comp. |
| 2-602 | 2-T2 | Comparative compound A | $12 \times 10^{-6}$ | 120 | 0.31 | 105 | 0.33 | 0.60 | Comp. |
| 2-603 | 2-T3 | Comparative compound B | $12 \times 10^{-6}$ | 119 | 0.30 | 106 | 0.35 | 0.51 | Comp. |

TABLE 32-continued

Amount and layer of addition of the inventive and comparative compounds in emulsions 2-T1 to 2-T12, and photographic performance of Samples 2-601 to 6-612

| Sample | Emulsion | Added compound | Addition amount (mol/Ag-mol) | Photographic performance with blue filter: Relative sensitivity | Photographic performance with blue filter: Fog | Photographic performance with blue filter after thermal treatment: Relative sensitivity | Photographic performance with blue filter after thermal treatment: Thermal fog | Green filter Green-sensitive light fog | Remarks |
|---|---|---|---|---|---|---|---|---|---|
| 2-604 | 2-T4 | Comparative compound C | $12 \times 10^{-6}$ | 118 | 0.29 | 110 | 0.32 | 0.31 | Comp. |
| 2-605 | 2-T5 | Exemplified compound 2-1 | $12 \times 10^{-6}$ | 124 | 0.26 | 120 | 0.32 | 0.32 | Inv. |
| 2-606 | 2-T6 | Exemplified compound 2-3 | $12 \times 10^{-6}$ | 123 | 0.25 | 118 | 0.31 | 0.32 | Inv. |
| 2-607 | 2-T7 | Exemplified compound 2-15 | $12 \times 10^{-6}$ | 123 | 0.25 | 119 | 0.30 | 0.31 | Inv. |
| 2-608 | 2-T8 | Exemplified compound 2-18 | $12 \times 10^{-6}$ | 122 | 0.26 | 119 | 0.31 | 0.33 | Inv. |
| 2-609 | 2-T9 | Exemplified compound 2-21 | $12 \times 10^{-6}$ | 120 | 0.26 | 116 | 0.32 | 0.32 | Inv. |
| 2-610 | 2-T10 | Exemplified compound 2-39 | $12 \times 10^{-6}$ | 121 | 0.27 | 117 | 0.33 | 0.31 | Inv. |
| 2-611 | 2-T11 | Exemplified compound 2-52 | $12 \times 10^{-6}$ | 124 | 0.26 | 119 | 0.32 | 0.32 | Inv. |
| 2-612 | 2-T12 | Exemplified compound 2-62 | $12 \times 10^{-6}$ | 122 | 0.26 | 118 | 0.33 | 0.31 | Inv. |

It is apparent from Table 32 that, also in the emulsion comprising tabular grains with epitaxial junctions, the compounds of Type 2 of the present invention have a greater sensitivity-increasing effect, and the density (fog) at a unexposed area is low, compared with the comparative compounds A, B and C. With respect to the samples left for 3 days under the conditions of 50° C. and 80%RH, the sensitivity decrease in the blue-sensitive layer using the compounds of the present invention is small after storage, the level of the fog is reduced, and the influence upon the adjacent green-sensitive layer is small, compared with the comparative compounds.

Example 22

The emulsions 3-R1 to 3-R8 shown in Table 33 were prepared in the same manner as in Example 16, except that the compounds of Type 3 of the present invention were used. The samples 3-401 to 3-408 were then formed and evaluated.

TABLE 33

Amount and layer of addition of the inventive and comparative compounds in emulsions 3-R1 to 3-R11, and photographic performance of Samples 3-401 to 3-408

| Sample | Emulsion | Added compound | Addition amount (mol/Ag-mol) | Photographic performance with green filter: Relative sensitivity | Photographic performance with green filter: Fog | Photographic performance after thermal treatment: Relative sensitivity | Photographic performance after thermal treatment: Thermal fog | Remarks |
|---|---|---|---|---|---|---|---|---|
| 3-401 | 3-R1 | none | — | 100 (control) | 0.22 | 97 | 0.25 | Comp. |
| 3-402 | 3-R2 | Comparative compound A | $20 \times 10^{-6}$ | 115 | 0.31 | 107 | 0.39 | Comp. |
| 3-403 | 3-R3 | Comparative compound B | $25 \times 10^{-6}$ | 118 | 0.30 | 111 | 0.41 | Comp. |
| 3-404 | 3-R4 | Exemplified compound 3-2 | $20 \times 10^{-6}$ | 120 | 0.28 | 116 | 0.33 | Inv. |
| 3-405 | 3-R5 | Exemplified compound 3-64 | $20 \times 10^{-6}$ | 122 | 0.27 | 117 | 0.33 | Inv. |
| 3-406 | 3-R6 | Exemplified compound 3-67 | $18 \times 10^{-6}$ | 123 | 0.28 | 119 | 0.34 | Inv. |
| 3-407 | 3-R7 | Exemplified compound 3-71 | $18 \times 10^{-6}$ | 121 | 0.26 | 116 | 0.31 | Inv. |
| 3-408 | 3-R8 | Exemplified compound 3-88 | $20 \times 10^{-6}$ | 124 | 0.30 | 120 | 0.34 | Inv. |

It is apparent from Table 33 that, also in the silver halide photographic emulsion prepared by adding silver halide fine grains produced using the mixer outside the reaction vessel to be grown, the compounds of Type 3 of the present invention have a greater sensitivity-increasing effect, regardless of the small volume used, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

Example 23

The samples 3-501 to 3-511 shown in Table 34 using the compounds of Type 3 of the present invention were prepared in the same manner as in Example 17, except that the emulsions 3-S2 to 3-S11, respectively, were prepared as follows, and evaluated.

(Emulsions 3-S2 to 3-S7)

The emulsions 3-S2 to 3-S11 were obtained in the same manner as the emulsion 3-S1, except that after completing chemical sensitization and then lowering the temperature of the emulsion to 40° C., the compounds of Type 3 of the present invention or the comparative compounds were added so as to obtain such a content as in Table 34, in relation to the silver amount of the emulsion.

(Emulsions 3-S8 to 3-S11)

The emulsions 3-S8 to 3-S11 were obtained in the same manner as the emulsion S1, except that before adding the sensitizing dyes, the compounds of Type 3 of the present invention or the comparative compounds were added so as to obtain such a content as in Table 34, in relation to the silver amount of the emulsion.

It is apparent from Table 34 that, also in the silver halide photographic emulsion prepared by adding silver iodide fine grains produced using the mixer outside the reaction vessel to supply iodide ions, the compounds of Type 3 of the present invention have a greater sensitivity-increasing effect, regardless of the addition position, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

Example 24

The emulsions 3-T1 to 3-T9 shown in Table 35 were prepared in the same manner as in Example 18, except that the compounds of Type 3 of the present invention were used. The samples 3-601 to 3-609 were then formed and evaluated.

TABLE 34

Amount and layer of addition of the inventive and comparative compounds in emulsions 3-S1 to 3-S11, and photographic performance of Samples 3-501 to 3-511

| | | | | Photographic performance with green filter | | Photographic performance after thermal treatment | | |
|---|---|---|---|---|---|---|---|---|
| Sample | Emulsion | Added compound | Addition amount (mol/Ag-mol) | Relative sensitivity | Fog | Relative sensitivity | Thermal fog | Remarks |
| 3-501 | 3-S1 | none | — | 100 (control) | 0.22 | 97 | 0.24 | Comp. |
| 3-502 | 3-S2 | Comparative compound A | $12 \times 10^{-6}$ | 118 | 0.32 | 107 | 0.41 | Comp. |
| 3-503 | 3-S3 | Comparative compound B | $15 \times 10^{-6}$ | 117 | 0.31 | 108 | 0.40 | Comp. |
| 3-504 | 3-S4 | Exemplified compound 3-1 | $12 \times 10^{-6}$ | 123 | 0.28 | 119 | 0.32 | Inv. |
| 3-505 | 3-S5 | Exemplified compound 3-68 | $12 \times 10^{-6}$ | 124 | 0.27 | 119 | 0.31 | Inv. |
| 3-506 | 3-S6 | Exemplified compound 3-73 | $10 \times 10^{-6}$ | 121 | 0.26 | 117 | 0.31 | Inv. |
| 3-507 | 3-S7 | Exemplified compound 3-106 | $10 \times 10^{-6}$ | 122 | 0.28 | 118 | 0.32 | Inv. |
| 3-508 | 3-S8 | Comparative compound A | $12 \times 10^{-6}$ | 109 | 0.43 | 105 | 0.48 | Comp. |
| 3-509 | 3-S9 | Comparative compound B | $15 \times 10^{-6}$ | 110 | 0.42 | 107 | 0.46 | Comp. |
| 3-510 | 3-S10 | Exemplified compound 3-73 | $12 \times 10^{-6}$ | 120 | 0.27 | 116 | 0.31 | Inv. |
| 3-511 | 3-S11 | Exemplified compound 3-106 | $10 \times 10^{-6}$ | 121 | 0.28 | 117 | 0.32 | Inv. |

TABLE 35

Amount and layer of addition of the inventive and comparative compounds in emulsions 3-T1 to 3-T9, and photographic performance of Samples 3-601 to 3-609

| | | | | Photographic performance with green filter | | Photographic performance after thermal treatment | | |
|---|---|---|---|---|---|---|---|---|
| Sample | Emulsion | Added compound | Addition amount (mol/Ag-mol) | Relative sensitivity | Fog | Relative sensitivity | Thermal fog | Remarks |
| 3-601 | 3-T1 | none | — | 100 (control) | 0.23 | 96 | 0.26 | Comp. |
| 3-602 | 3-T2 | Comparative compound A | $10 \times 10^{-6}$ | 118 | 0.30 | 109 | 0.39 | Comp. |
| 3-603 | 3-T3 | Comparative compound B | $10 \times 10^{-6}$ | 117 | 0.29 | 109 | 0.37 | Comp. |
| 3-604 | 3-T4 | Exemplified compound 3-2 | $8 \times 10^{-6}$ | 124 | 0.28 | 120 | 0.32 | Inv. |
| 3-605 | 3-T5 | Exemplified compound 3-64 | $8 \times 10^{-6}$ | 122 | 0.27 | 117 | 0.31 | Inv. |
| 3-606 | 3-T6 | Exemplified compound 3-75 | $10 \times 10^{-6}$ | 123 | 0.27 | 119 | 0.30 | Inv. |
| 3-607 | 3-T7 | Exemplified compound 3-89 | $10 \times 10^{-6}$ | 120 | 0.26 | 116 | 0.30 | Inv. |
| 3-608 | 3-T8 | Exemplified compound 3-102 | $8 \times 10^{-6}$ | 121 | 0.26 | 118 | 0.30 | Inv. |
| 3-609 | 3-T9 | Exemplified compound 3-112 | $10 \times 10^{-6}$ | 122 | 0.27 | 118 | 0.31 | Inv. |

It is apparent from Table 35 that, also in the emulsion comprising tabular grains with epitaxial junctions, the compounds of Type 3 of the present invention have a greater sensitivity-increasing effect, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

Example 25

The emulsions 11-R1 to 11-R8 shown in Table 36 were prepared in the same manner as in Example 16, except that the compounds of Type 1 (general formulae (1) to (3)) of the present invention were used. The samples 11-401 to 11-408 were then formed and evaluated.

TABLE 36

Amount and layer of addition of the inventive and comparative compounds in emulsions 11-R1 to 11-R8, and photographic performance of Samples 11-401 to 11-408

| | | | | Photographic performance with green filter | | Photographic performance after thermal treatment | | |
|---|---|---|---|---|---|---|---|---|
| Sample | Emulsion | Added compound | Addition amount (mol/Ag-mol) | Relative sensitivity | Fog | Relative sensitivity | Thermal fog | Remarks |
| 11-401 | 11-R1 | none | — | 100 (control) | 0.22 | 97 | 0.25 | Comp. |
| 11-402 | 11-R2 | Comparative compound A | $20 \times 10^{-6}$ | 115 | 0.31 | 107 | 0.39 | Comp. |
| 11-403 | 11-R3 | Comparative compound B | $25 \times 10^{-6}$ | 118 | 0.30 | 111 | 0.41 | Comp. |
| 11-404 | 11-R4 | Exemplified compound 1-302 | $20 \times 10^{-6}$ | 120 | 0.27 | 116 | 0.32 | Inv. |
| 11-405 | 11-R5 | Exemplified compound 1-304 | $20 \times 10^{-6}$ | 122 | 0.28 | 118 | 0.32 | Inv. |
| 11-406 | 11-R6 | Exemplified compound 1-311 | $18 \times 10^{-6}$ | 125 | 0.29 | 120 | 0.34 | Inv. |
| 11-407 | 11-R7 | Exemplified compound 1-318 | $18 \times 10^{-6}$ | 119 | 0.26 | 115 | 0.30 | Inv. |
| 11-408 | 11-R8 | Exemplified compound 1-331 | $20 \times 10^{-6}$ | 126 | 0.29 | 122 | 0.33 | Inv. |

It is apparent from Table 36 that, also in the silver halide photographic emulsion prepared by adding silver halide fine grains produced using the mixer outside the reaction vessel to be grown, the compounds of Type 1 (general formulae (1) to (3)) of the present invention have a greater sensitivity-increasing effect, regardless of the small volume used, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

Example 26

The samples 11-501 to 11-511 shown in Table 37 using the compounds of Type 1 (general formulae (1) to (3)) of the present invention were prepared in the same manner as in Example 17, except that the emulsions 11-S2 to 11-S11, respectively, were prepared as follows, and evaluated.

(Emulsions 11-S2 to 11-S7)

The emulsions 11-S2 to 11-S11 were obtained in the same manner as the emulsion 1-S1, except that after completing chemical sensitization and then lowering the temperature of the emulsion to 40° C., the compounds of Type 1 (general formulae (1) to (3)) of the present invention or the comparative compounds were added so as to obtain such a content as in Table 37, in relation to the silver amount of the emulsion.

(Emulsions 11-S8 to 11-S11)

The emulsions 11-S8 to 11-S11 were obtained in the same manner as the emulsion 11-S1, except that before adding the sensitizing dyes, the compounds of Type 1 (general formulae (1) to (3)) of the present invention or the comparative compounds were added so as to obtain such a content as in Table 37, in relation to the silver amount of the emulsion.

It is apparent from Table 37 that, also in the silver halide photographic emulsion prepared by adding silver iodide fine grains produced using the mixer outside the reaction vessel to supply iodide ions, the compounds of Type 1 (general formulae (1) to (3)) of the present invention have a greater sensitivity-increasing effect, regardless of the addition position, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

Example 27

The emulsions 11-T1 to 11-T9 shown in Table 38 were prepared in the same manner as in Example 18, except that the compounds of Type 1 (general formulae (1) to (3)) of the present invention were used. The samples 11-601 to 11-609 were then formed and evaluated.

TABLE 37

Amount and layer of addition of the inventive and comparative compounds in emulsions 11-S1 to 11-S11, and photographic performance of Samples 11-501 to 11-511

| | | | | Photographic performance with green filter | | Photographic performance after thermal treatment | | |
|---|---|---|---|---|---|---|---|---|
| Sample | Emulsion | Added compound | Addition amount (mol/Ag-mol) | Relative sensitivity | Fog | Relative sensitivity | Thermal fog | Remarks |
| 11-501 | 1-S1 | none | — | 100 (control) | 0.22 | 97 | 0.24 | Comp. |
| 11-502 | 11-S2 | Comparative compound A | $12 \times 10^{-6}$ | 118 | 0.32 | 107 | 0.41 | Comp. |
| 11-503 | 11-S3 | Comparative compound B | $15 \times 10^{-6}$ | 117 | 0.31 | 108 | 0.40 | Comp. |
| 11-504 | 11-S4 | Exemplified compound 1-308 | $12 \times 10^{-6}$ | 124 | 0.28 | 120 | 0.33 | Inv. |
| 11-505 | 11-S5 | Exemplified compound 1-331 | $12 \times 10^{-6}$ | 125 | 0.29 | 120 | 0.35 | Inv. |
| 11-506 | 11-S6 | Exemplified compound 1-309 | $10 \times 10^{-6}$ | 123 | 0.28 | 118 | 0.32 | Inv. |
| 11-507 | 11-S7 | Exemplified compound 1-313 | $10 \times 10^{-6}$ | 120 | 0.26 | 116 | 0.30 | Inv. |
| 11-508 | 11-S8 | Comparative compound A | $12 \times 10^{-6}$ | 109 | 0.43 | 105 | 0.48 | Comp. |
| 11-509 | 11-S9 | Comparative compound B | $12 \times 10^{-6}$ | 110 | 0.42 | 107 | 0.46 | Comp. |
| 11-510 | 11-S10 | Exemplified compound 1-308 | $12 \times 10^{-6}$ | 121 | 0.29 | 116 | 0.33 | Inv. |
| 11-511 | 11-S11 | Exemplified compound 1-331 | $12 \times 10^{-6}$ | 122 | 0.28 | 118 | 0.33 | Inv. |

TABLE 38

Amount and layer of addition of the inventive and comparative compounds in emulsions 11-T1 to 11-T9, and photographic performance of Samples 11-601 to 11-609

| | | | | Photographic performance with green filter | | Photographic performance after thermal treatment | | |
|---|---|---|---|---|---|---|---|---|
| Sample | Emulsion | Added compound | Addition amount (mol/Ag-mol) | Relative sensitivity | Fog | Relative sensitivity | Thermal fog | Remarks |
| 11-601 | 11-T1 | none | — | 100 (control) | 0.23 | 96 | 0.26 | Comp. |
| 11-602 | 11-T2 | Comparative compound A | $10 \times 10^{-6}$ | 118 | 0.30 | 109 | 0.39 | Comp. |
| 11-603 | 11-T3 | Comparative compound B | $10 \times 10^{-6}$ | 117 | 0.29 | 109 | 0.37 | Comp. |
| 11-604 | 11-T4 | Exemplified compound 1-301 | $10 \times 10^{-6}$ | 125 | 0.28 | 120 | 0.33 | Inv. |
| 11-605 | 11-T5 | Exemplified compound 1-308 | $10 \times 10^{-6}$ | 126 | 0.29 | 121 | 0.34 | Inv. |
| 11-606 | 11-T6 | Exemplified compound 1-311 | $10 \times 10^{-6}$ | 124 | 0.27 | 120 | 0.32 | Inv. |
| 11-607 | 11-T7 | Exemplified compound 1-313 | $8 \times 10^{-6}$ | 122 | 0.27 | 117 | 0.30 | Inv. |
| 11-608 | 11-T8 | Exemplified compound 1-318 | $8 \times 10^{-6}$ | 121 | 0.26 | 118 | 0.30 | Inv. |
| 11-609 | 11-T9 | Exemplified compound 1-321 | $8 \times 10^{-6}$ | 121 | 0.25 | 116 | 0.31 | Inv. |

It is apparent from Table 38 that, also in the emulsion comprising tabular grains with epitaxial junctions, the compounds of Type 1 (general formulae (1) to (3)) of the present invention have a greater sensitivity-increasing effect, and the density (fog) at a unexposed area is low, compared with the comparative compounds. With respect to the samples left for 3 days under the conditions of 50° C. and 80%RH, the sensitivity decrease of the compounds of the present invention is small after storage, and the level of the fog is reduced, compared with the comparative compounds.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide emulsion comprising at least one compound selected from the following four types of electron-releasing compounds, namely:

(Type 1) an electron-releasing compound capable of undergoing a one-electron oxidation to thereby form a one-electron oxidation product thereof, the one-electron oxidation product capable of releasing further two or more electrons accompanying a subsequent bond cleavage reaction;

(Type 2) an electron-releasing compound capable of undergoing a one-electron oxidation to thereby form a one-electron oxidation product thereof, the one-electron oxidation product capable of releasing further one electron accompanying a subsequent bond cleavage reaction, and the one-electron oxidation product having, in its molecule, two or more adsorptive groups acting on silver halides;

(Type 3) an electron-releasing compound capable of undergoing a one-electron oxidation to thereby form a one-electron oxidation product thereof, the one-electron oxidation product capable of releasing further one or more electrons after going through a subsequent bond forming process; and (Type 4) an electron-releasing compound capable of undergoing a one-electron oxidation to thereby form a one-electron oxidation product thereof, the one-electron oxidation product capable of releasing further one or more electrons after going through a subsequent intramolecular ring cleavage reaction.

2. The silver halide emulsion according to claim 1, wherein said at least one compound is a compound which undergoes a one-electron oxidation induced by exposure of the silver halide emulsion to light.

3. The silver halide emulsion according to claim 1, wherein said at least one compound is represented by any of the following general formulae (A), (B), (C), (D), (E), (F), (1), (2) and (3):

(A)

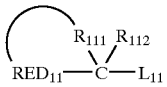

(B)

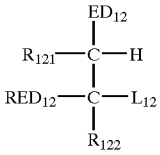

(C)

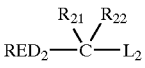

(D)

-continued (E)

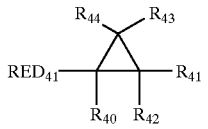

(F)

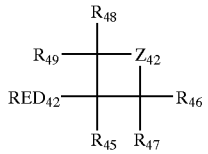

(1)

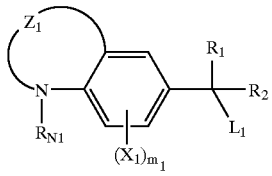

(2)

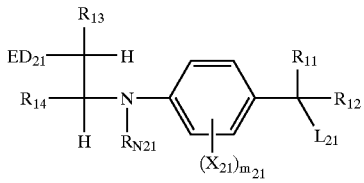

(3)

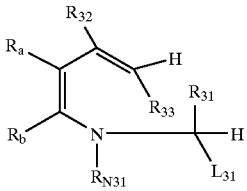

wherein in the general formula (A), $RED_{11}$ represents a one-electron oxidizable reducing group; $L_{11}$, represents a split-off group; $R_{112}$ represents a hydrogen atom or substituent; and $R_{111}$ represents a nonmetallic atomic group capable of forming a cyclic structure corresponding to a tetrahydro form, hexahydro form or octahydro form of a 5-membered or 6-membered aromatic ring (including an aromatic heterocycle) together with carbon atom (C) and $RED_{11}$;

in the general formula (B), $RED_{12}$ and $L_{12}$ have the same meanings as those of $RED_{11}$ and $L_{11}$ of the general formula (A), respectively; each of $R_{121}$ and $R_{122}$ represents a hydrogen atom or substituernt; and $ED_{12}$ represents an electron-donating group; in the general formula (B), $R_{121}$ and $RED_{12}$, or $R_{121}$ and $R_{122}$, or $ED_{12}$ and $RED_{12}$ may be bonded with each other to thereby form a cyclic structure;

in the general formula (C), $RED_2$ has the same meaning as that of $RED_{12}$ of the general formula (B); $L_2$ represents a split-off group; each of $R_{21}$ and $R_{22}$ represents a hydrogen atom or substituent; and $RED_2$ and $R_{21}$ may be bonded with each other to thereby form a cyclic structure; the compound represented by the general formula (C) is a compound having, in its molecule, two or more adsorptive groups acting on silver halides;

in the general formula (D), $RED_3$ has the same meaning as that of $RED_{12}$ of the general formula (B); $Y_3$ represents a reactive group capable of reacting with a one-electron oxidation product formed as a result of a one-electron oxidation of $RED_3$ to thereby form a new bond; and $L_3$ represents a linking group which links between $RED_3$ and $Y_3$;

in the general formulae (E) and (F), each of $RED_{41}$ and $RED_{42}$ has the same meaning as that of $RED_{12}$ of the general formula (B); and each of $R_{40}$ to $R_{44}$ and $R_{45}$ to $R_{49}$ represents a hydrogen atom or substituent. In the general formula (F), $Z_{42}$ represents —$CR_{420}R_{421}$—, —$NR_{423}$— or —O—; herein, each of $R_{420}$ and $R_{421}$ represents a hydrogen atom or substituent; and $R_{423}$ represents a hydrogen atom, alkyl group, aryl group or heterocyclic group;

in the general formula (1), $Z_1$ represents an atomic group capable of forming a 6-membered ring together with the nitrogen atom and the two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group;

in the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent; $m_{21}$ is an integer of 0 to 3; and $L_{21}$ represents a split-off group, wherein any two of $R_{N21}$, $R_{13}$, $R_{14}$, $X_{21}$ and $ED_{21}$ may be bonded with each other to thereby form a cyclic structure; and in the general formula (3), each of $R_{31}$, $R_{32}$, $R_{33}$, $R_{N31}$, $R_a$ and $R_b$ represents a hydrogen atom or substituent; and $L_{31}$ represents a split-off group, provided that, when $R_{N31}$ represents a group other than an aryl group, $R_a$ and $R_b$ are bonded to each other to thereby form an aromatic ring.

4. The silver halide emulsion according to claim 1, wherein said electron-releasing compounds of types 1, 3 and 4 are compounds each having in its molecule at least one adsorptive group acting on silver halides or at least one partial structure of a spectral sensitizing dye.

5. The silver halide emulsion according to claim 1, wherein each of said compounds is a compound having in its molecule two or more mercapto groups as a partial structure thereof.

6. The silver halide emulsion according to claim 1, wherein each of said compounds has a nitrogen-containing heterocyclic group that is substituted with two or more mercapto groups, as the adsorptive group.

7. The silver halide emulsion according claim 3, wherein said split-off group of each of the general formulas (A) to (F) and (1) to (3) is a carboxyl group or salt thereof, or hydrogen atom.

8. The silver halide emulsion according to claim 3, wherein said compound of general formula (D) is represented by any of the following general formulae (D-1) to (D-4):

(D-1)

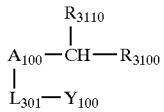

(D-2)

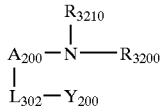

-continued (D-3)

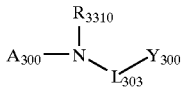

(D-4)

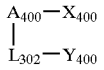

wherein in the general formulae (D-1) to (D-4), each of $A_{100}$, $A_{200}$, $A_{300}$ and $A_{400}$ represents an aryl group or a heterocyclic group, provided that each of $A_{100}$, $A_{200}$ and $A_{400}$ represents a divalent group resulting from removal of one hydrogen atom from an aryl group or a heterocyclic group; each of $L_{301}$, $L_{302}$, $L_{303}$ and $L_{304}$ represents a linking group; each of $Y_{100}$, $Y_{200}$, $Y_{300}$ and $Y_{400}$ represents a reactive group; each of $R_{3100}$, $R_{3110}$, $R_{3200}$, $R_{3210}$ and $R_{3310}$ represents a hydrogen atom or substituent, wherein $R_{3110}$ and $A_{100}$, or $R_{3210}$ and $A_{200}$, or $R_{3310}$ and $A_{300}$ may be bonded with each other to thereby form a cyclic structure; and $X_{400}$ represents a hydroxyl group, mercapto group or alkylthio group.

9. The silver halide emulsion according to claim 1, wherein an oxidation potential with respect to said first electron is 0 V or more and 1.4 V or less.

10. The silver halide emulsion according claim 1, wherein said one-electron oxidation product that is produced after said one-electron oxidation of said compounds of Types 1 to 4 has an oxidation potential of −0.7 V or less.

11. The silver halide emulsion according to claim 1, wherein silver halide grains contained in said silver halide emulsion comprise tabular grains having an aspect ratio of 5 or more.

12. A silver halide emulsion having been chemically sensitized by at least one compound selected from the following four types of electron-releasing compounds:

(Type 1) an electron-releasing compound capable of undergoing a one-electron oxidation to thereby form a one-electron oxidation product thereof, the one-electron oxidation product capable of releasing further two or more electrons accompanying a subsequent bond cleavage reaction;

(Type 2) an electron-releasing compound capable of undergoing a one-electron oxidation to thereby form a one-electron oxidation product thereof, the one-electron oxidation product capable of releasing further one electron accompanying a subsequent bond cleavage reaction, and the one-electron oxidation product having, in its molecule, two or more adsorptive groups acting on silver halides;

(Type 3) an electron-releasing compound capable of undergoing a one-electron oxidation to thereby form a one-electron oxidation product thereof, the one-electron oxidation product capable of releasing further one or more electrons after going through a subsequent bond forming process; and (Type 4) an electron-releasing compound capable of undergoing a one-electron oxidation to thereby form a one-electron oxidation product thereof, the one-electron oxidation product capable of releasing further one or more electrons after going through a subsequent intramolecular ring cleavage reaction.

13. A silver halide photographic lightsensitive material comprising said silver halide emulsion according to claim 1.

14. The silver halide photographic lightsensitive material according to claim 13, wherein said silver halide emulsion is chemically sensitized by at least one compound selected from said electron-releasing compounds of Types 1 to 4.

15. The silver halide photographic lightsensitive material according to claim 13, further comprising at least one reducing compound.

16. The silver halide photographic lightsensitive material according to claim 14, further comprising at least one reducing compound.

* * * * *

UNITED STATES PATENT AND TRADEMARK OFFICE

CERTIFICATE OF CORRECTION

PATENT NO. : 6,689,554 B2
DATED : February 10, 2004
INVENTOR(S) : Kohzaburoh Yamada et al.

It is certified that error appears in the above-identified patent and that said Letters Patent is hereby corrected as shown below:

Title page,
Add Item:
-- [30] Foreign Priority Application Data
Sept. 7, 2001 (JP) 2001-272137 --.

Signed and Sealed this

Eighth Day of June, 2004

JON W. DUDAS
*Acting Director of the United States Patent and Trademark Office*